US009850036B2

(12) United States Patent
Sanfilippo et al.

(10) Patent No.: US 9,850,036 B2
(45) **Date of Patent: *Dec. 26, 2017**

(54) FLEXIBLE PACKAGE AND METHOD OF MAKING THE SAME

(71) Applicant: CLEAR LAM PACKAGING, INC., Elk Grove Village, IL (US)

(72) Inventors: James J. Sanfilippo, Barrington Hills, IL (US); John E. Sanfilippo, Barrington Hills, IL (US); Jeanne M. Skaggs, Arlington Heights, IL (US); Francisco Javier Soria, West Chicago, IL (US); Milorad Radenovic, Chicago, IL (US); Bohdan Wyslotsky, Algonquin, IL (US); Paul Georgelos, Naperville, IL (US); Pat Montefusco, Genoa, IL (US); Roy Speer, Barrington Hills, IL (US); Roman Forowycz, Lake Forest, IL (US)

(73) Assignee: CLEAR LAM PACKAGING, INC., Elk Grove Village, IL (US)

( * ) Notice: Subject to any disclaimer, the term of this patent is extended or adjusted under 35 U.S.C. 154(b) by 563 days.

This patent is subject to a terminal disclaimer.

(21) Appl. No.: 14/064,108

(22) Filed: Oct. 25, 2013

(65) Prior Publication Data

US 2014/0185962 A1 Jul. 3, 2014

Related U.S. Application Data

(60) Provisional application No. 61/860,233, filed on Jul. 30, 2013, provisional application No. 61/801,186,
(Continued)

(51) Int. Cl.
*B65D 33/00* (2006.01)
*B65D 33/16* (2006.01)
(Continued)

(52) U.S. Cl.
CPC ..... *B65D 33/16* (2013.01); *B31B 37/00* (2013.01); *B65B 9/22* (2013.01); *B65B 61/184* (2013.01); *B65D 75/5838* (2013.01)

(58) Field of Classification Search
CPC ..... B65D 33/16; B65D 75/5855
(Continued)

(56) References Cited

U.S. PATENT DOCUMENTS 724,316 A 3/1903 Staples
1,102,750 A 7/1914 Hawkins
(Continued)

FOREIGN PATENT DOCUMENTS

DE 102010019867 9/2011
EP 0879767 A1 11/1998
(Continued)

OTHER PUBLICATIONS

International Search Report and Written Opinion for International Application No. PCT/US2008/082689, dated Mar. 24, 2009.
(Continued)

*Primary Examiner* — Derek Battisti
(74) *Attorney, Agent, or Firm* — Marshall, Gerstein & Borun LLP

(57) ABSTRACT

A flexible, stackable, recloseable container for storing a quantity of products comprising a plurality of walls defined by a first sheet and a second sheet attached to at least a portion of the first sheet. The second sheet extends over at least three of the walls. The opposing container walls each have a sealed portion and one or more tucks, the tucks comprising a portion of the first sheet tucked toward the interior volume. A portion of the second sheet defines a recloseable feature located over an opening for reclosing the container. The second sheet includes a line of reduced strength at or adjacent at least a boundary adjacent the tucks
(Continued)

and disposed between the opposing container walls each having the sealed portion and an adjacent container wall. The second sheet can include a hinge about which the recloseable feature pivots from closed position to open position.

38 Claims, 114 Drawing Sheets

Related U.S. Application Data filed on Mar. 15, 2013, provisional application No. 61/769,168, filed on Feb. 25, 2013, provisional application No. 61/739,535, filed on Dec. 19, 2012, provisional application No. 61/719,340, filed on Oct. 26, 2012.

(51) Int. Cl.

| | |
|---|---|
| ***B31B 37/00*** | (2006.01) |
| ***B65D 75/58*** | (2006.01) |
| ***B65B 61/18*** | (2006.01) |
| ***B65B 9/22*** | (2006.01) |

(58) Field of Classification Search
USPC ..... 383/200, 203, 205, 207, 210, 211
See application file for complete search history.

(56) References Cited

U.S. PATENT DOCUMENTS 1,389,197 A 8/1921 Kusterer
1,395,229 A 10/1921 Inman et al.
1,747,618 A 2/1930 Burns
1,930,285 A 10/1933 Robinson
2,017,176 A 10/1935 Andrews
2,041,227 A 5/1936 Chalmers
2,048,122 A 7/1936 Howard
2,092,858 A 9/1937 Richard
2,106,907 A 2/1938 Brunt et al.
2,113,431 A 4/1938 Milliken
2,153,310 A 4/1939 Newman
2,180,841 A 11/1939 Vogt
2,239,398 A 4/1941 Palmer
2,251,283 A 8/1941 Johnson
2,259,866 A 10/1941 Stokes
2,260,064 A 10/1941 Stokes et al.
2,291,063 A 7/1942 Staude et al.
2,311,857 A 2/1943 Noah
2,328,579 A 9/1943 Pelosi
2,330,015 A 9/1943 Stokes
2,339,156 A 1/1944 Duane
2,352,766 A 7/1944 Bogue
2,365,159 A 12/1944 Walton
2,385,898 A 10/1945 Waters
2,416,332 A 2/1947 Lehman
2,495,807 A 1/1950 Buttery
2,508,962 A 5/1950 Moore
2,524,766 A 10/1950 Carroll
2,619,226 A 11/1952 Adams
2,684,807 A 7/1954 Gerrish
2,695,847 A 11/1954 Fisher
2,719,663 A 10/1955 Meyer-Jagenberg
2,737,338 A 3/1956 Moore
2,749,245 A 6/1956 Peters
2,750,093 A 6/1956 Moore
2,758,775 A 8/1956 Moore
2,787,410 A 4/1957 Moore
2,819,831 A 1/1958 Polarek et al.
2,823,795 A 2/1958 Moore
2,864,710 A 12/1958 Pottle et al.
2,936,940 A 5/1960 Berghgracht
2,970,735 A 2/1961 Jacke
3,006,257 A 10/1961 Orsini
3,054,550 A 9/1962 Comstock
3,091,902 A 6/1963 Grafingholt
3,093,292 A 6/1963 Ahlbor
3,111,223 A 11/1963 Jacobi
3,116,153 A 12/1963 Seiferth et al.
3,125,275 A 3/1964 Ehe
3,127,082 A * 3/1964 Meyer-Jagenberg .. B65D 5/062 229/123.3
3,143,276 A 8/1964 Nichols
3,155,304 A 11/1964 Beerend
3,172,769 A 3/1965 Horan
3,185,379 A 5/1965 Kohlhaas
3,206,094 A 9/1965 Humphrey
3,228,584 A 1/1966 Ashton
3,228,587 A 1/1966 Segebrecht
3,235,168 A 2/1966 Nichols
3,249,286 A 5/1966 Palmer
3,259,303 A 7/1966 Repko
3,259,507 A 7/1966 Smith
3,272,423 A 9/1966 Bjarno
3,275,214 A 9/1966 Carangelo
3,299,611 A 1/1967 Hendrick et al.
3,314,591 A 4/1967 Cheeley
3,318,204 A 5/1967 Crane
3,325,077 A 6/1967 Boegershausen
3,326,097 A 6/1967 Lokey
3,339,721 A 9/1967 Goldstein
3,349,959 A 10/1967 Watkins
3,373,917 A 3/1968 Cox
3,380,646 A 4/1968 Doyen et al.
3,423,007 A 1/1969 Christensson
3,426,499 A 2/1969 Paige
3,434,652 A 3/1969 Shore
3,437,258 A 4/1969 Kugler
3,462,067 A 8/1969 Shore
3,505,779 A 4/1970 Kopp
3,515,270 A 6/1970 Yang et al.
3,521,807 A 7/1970 Weisberg
3,562,392 A 2/1971 Mylius
3,599,387 A 8/1971 James
3,604,491 A 9/1971 Spiess
3,621,637 A 11/1971 Sternau
3,738,567 A 6/1973 Ruda
3,739,977 A 6/1973 Shapiro et al.
3,785,112 A 1/1974 Leasure et al.
3,838,787 A 10/1974 McCloskey
3,917,158 A 11/1975 Dorofachuk et al.
3,935,993 A 2/1976 Doyen et al.
3,940,054 A 2/1976 Goebel et al.
3,968,921 A 7/1976 Jewell
3,980,225 A 9/1976 Kan
4,004,398 A 1/1977 Larsson et al.
4,041,851 A 8/1977 Jentsch
4,069,348 A 1/1978 Bush
4,082,214 A 4/1978 Baker
4,082,216 A 4/1978 Clarke et al.
4,101,051 A * 7/1978 Reil ..... B65D 5/065 229/215
4,129,976 A 12/1978 Grundler et al.
4,185,754 A 1/1980 Julius
4,192,420 A 3/1980 Worrell, Sr. et al.
4,197,949 A 4/1980 Carlsson
4,260,061 A 4/1981 Jacobs
4,291,826 A 9/1981 Swanson
4,308,679 A 1/1982 Ray, III et al.
4,338,766 A 7/1982 Hamilton
D265,777 S 8/1982 Elzea et al.
4,345,133 A 8/1982 Cherney et al.
4,345,393 A 8/1982 Price et al.
D266,049 S 9/1982 Conti
4,353,497 A 10/1982 Bustin
4,361,266 A 11/1982 Killy
4,367,842 A 1/1983 Rausing
4,420,080 A 12/1983 Nakamura
4,441,648 A 4/1984 Portsmouth
4,442,656 A 4/1984 Wylie, Sr.
4,531,668 A 7/1985 Forbes, Jr.
4,552,269 A 11/1985 Chang
4,554,190 A 11/1985 McHenry et al.

(56) References Cited

U.S. PATENT DOCUMENTS 4,576,309 A 3/1986 Tzifkansky et al.
4,589,145 A 5/1986 Van Erden et al.
D286,745 S 11/1986 Forbes, Jr.
4,621,000 A 11/1986 Frick
4,651,874 A 3/1987 Nakamura
4,663,915 A 5/1987 Van Erden et al.
4,674,129 A 6/1987 Janhonen
4,679,693 A 7/1987 Forman
4,679,701 A 7/1987 Ackermann et al.
4,687,104 A 8/1987 Ielmini
4,696,404 A 9/1987 Corella
4,738,365 A 4/1988 Prater
D297,214 S 8/1988 Forbes, Jr.
4,786,192 A 11/1988 Graves et al.
4,790,436 A 12/1988 Nakamura
4,798,295 A 1/1989 Rausing
4,804,137 A 2/1989 Harby
4,808,421 A 2/1989 Mendenhall et al.
4,811,848 A 3/1989 Jud
4,837,849 A 6/1989 Erickson et al.
4,840,270 A 6/1989 Caputo et al.
4,848,575 A 7/1989 Nakamura et al.
4,851,246 A 7/1989 Maxwell et al.
D304,016 S 10/1989 Forbes, Jr.
4,881,360 A 11/1989 Konzal et al.
4,886,373 A 12/1989 Corella
4,909,017 A 3/1990 McMahon et al.
4,954,124 A 9/1990 Erickson et al.
4,986,054 A 1/1991 McMahon
D315,099 S 3/1991 Alizard
4,997,416 A 3/1991 Mitchell et al.
5,031,826 A 7/1991 Seufert
5,036,997 A 8/1991 May et al.
5,044,777 A 9/1991 Watkins et al.
5,046,300 A 9/1991 Custer et al.
5,059,036 A 10/1991 Richison et al.
5,062,527 A 11/1991 Westerman
5,065,887 A 11/1991 Schuh et al.
5,078,509 A 1/1992 Center et al.
5,080,643 A 1/1992 Mitchell et al.
5,092,831 A 3/1992 James et al.
5,127,208 A 7/1992 Custer et al.
5,158,371 A 10/1992 Moravek
5,158,499 A 10/1992 Guckenberger
D332,399 S 1/1993 Neff
5,195,829 A 3/1993 Watkins et al.
5,205,651 A 4/1993 Decottignies et al.
5,215,380 A 6/1993 Custer et al.
5,251,809 A 10/1993 Drummond et al.
5,254,073 A 10/1993 Richison et al.
5,255,497 A 10/1993 Zoromski et al.
5,350,240 A 9/1994 Billman et al.
D351,090 S 10/1994 Narsutis
5,352,466 A 10/1994 Delonis
5,353,946 A 10/1994 Behrend
5,356,069 A 10/1994 Bochet et al.
5,366,104 A 11/1994 Armstrong
D354,436 S 1/1995 Krupa
5,417,035 A 5/1995 English
D364,563 S 11/1995 Miller et al.
5,463,851 A 11/1995 Nagai
5,484,101 A 1/1996 Hedberg
5,498,080 A 3/1996 Dalea et al.
5,505,040 A 4/1996 Janssen et al.
5,505,305 A 4/1996 Scholz et al.
5,542,902 A 8/1996 Richison et al.
5,545,420 A 8/1996 Lipinski et al.
5,556,026 A 9/1996 Blankitny
D374,774 S 10/1996 Cassel
5,561,966 A 10/1996 English
5,577,612 A 11/1996 Chesson et al.
5,611,452 A 3/1997 Bonora et al.
5,613,608 A 3/1997 Tronchetti et al.
5,655,706 A 8/1997 Vandiver
D386,001 S 11/1997 Saffran
5,687,848 A 11/1997 Scholz et al.
5,704,480 A 1/1998 Scholz et al.
5,704,541 A 1/1998 Mogard
D394,606 S 5/1998 Zorn et al.
5,749,512 A 5/1998 Gingras-Taylor
5,770,839 A 6/1998 Ruebush et al.
5,772,332 A 6/1998 Geller
D395,952 S 7/1998 Buczwinski et al.
5,785,179 A 7/1998 Buczwinski et al.
5,788,121 A 8/1998 Sasaki et al.
5,788,378 A 8/1998 Thomas
5,789,049 A 8/1998 Randles
5,791,465 A 8/1998 Niki et al.
D398,526 S 9/1998 Schwarz et al.
D398,844 S 9/1998 Oberloier
5,799,863 A 9/1998 Capy et al.
5,818,016 A 10/1998 Lorence et al.
5,820,017 A 10/1998 Eliovson et al.
5,826,401 A 10/1998 Bois
5,832,701 A 11/1998 Hauers et al.
5,842,790 A 12/1998 Imer
5,857,613 A 1/1999 Drummond et al.
5,858,543 A 1/1999 Futter et al.
5,862,652 A 1/1999 Schoeler
5,882,749 A 3/1999 Jones et al.
5,882,789 A 3/1999 Jones et al.
5,897,050 A 4/1999 Barnes
D409,484 S 5/1999 Tasker
5,908,246 A 6/1999 Arimura et al.
D412,439 S 8/1999 Cormack
5,937,615 A 8/1999 Forman
5,944,425 A 8/1999 Forman
5,972,396 A 10/1999 Jurgovan et al.
5,983,594 A 11/1999 Forman
5,993,593 A 11/1999 Swartz et al.
6,005,234 A 12/1999 Moseley et al.
6,021,624 A 2/2000 Richison et al.
6,023,914 A 2/2000 Richison et al.
6,026,953 A 2/2000 Nakamura et al.
D421,901 S 3/2000 Hill
D421,902 S 3/2000 Hill
6,036,365 A 3/2000 Imer
6,038,839 A 3/2000 Linkiewicz
6,056,141 A 5/2000 Navarini et al.
6,060,096 A 5/2000 Hanson et al.
D427,056 S 6/2000 Irace et al.
6,088,998 A 7/2000 Malin et al.
6,113,271 A 9/2000 Scott et al.
6,120,183 A 9/2000 Buchanan et al.
D431,464 S 10/2000 Collins et al.
6,132,351 A 10/2000 Lotto et al.
6,137,098 A 10/2000 Moseley et al.
6,139,662 A 10/2000 Forman
6,149,304 A 11/2000 Hamilton et al.
D437,686 S 2/2001 Balzar et al.
6,182,887 B1 2/2001 Ljunstrom et al.
6,229,061 B1 5/2001 Dragoo et al.
6,231,237 B1 5/2001 Geller
6,234,676 B1 5/2001 Galomb et al.
6,245,367 B1 6/2001 Galomb
6,250,048 B1 6/2001 Linkiewicz
6,253,993 B1 7/2001 Lloyd et al.
6,254,907 B1 7/2001 Galomb
6,261,215 B1 7/2001 Imer
D446,014 S 8/2001 Adkins
6,273,610 B1 8/2001 Koyama et al.
6,274,181 B1 8/2001 Richison et al.
6,309,105 B1 10/2001 Palumbo
D450,960 S 11/2001 Boyea et al.
6,319,184 B1 11/2001 DeMatteis et al.
D452,374 S 12/2001 Kim
6,325,239 B2 12/2001 Randall et al.
6,350,057 B1 2/2002 Forman
6,354,062 B1 3/2002 Haughton et al.
6,361,212 B1 3/2002 Sprehe et al.
6,412,634 B1 7/2002 Telesca et al.
6,420,006 B1 7/2002 Scott
6,423,356 B2 7/2002 Richison et al.
D461,403 S 8/2002 Chomik et al.

(56) References Cited

U.S. PATENT DOCUMENTS 6,428,867 B1 8/2002 Scott et al.
6,430,899 B1 8/2002 Cicha
6,431,434 B1 8/2002 Haughton et al.
D463,276 S 9/2002 Piscopo et al.
6,446,796 B1 9/2002 Schmidt
D464,884 S 10/2002 Sumpmann et al.
D464,894 S 10/2002 Mittersinker et al.
6,481,183 B1 11/2002 Schmidt
D466,807 S 12/2002 Buck et al.
6,488,556 B2 12/2002 Galomb
6,502,986 B1 1/2003 Bensur et al.
6,510,673 B1 1/2003 Visona' et al.
6,513,308 B1 2/2003 Meeuwesen et al.
D471,804 S 3/2003 Staples
6,533,456 B1 3/2003 Buchman
D473,461 S 4/2003 Joubert
6,568,150 B2 5/2003 Forman
6,589,622 B1 7/2003 Scott
6,615,567 B2 9/2003 Kuhn et al.
6,659,645 B1 12/2003 Schulz
D485,461 S 1/2004 Sams et al.
6,679,034 B2 1/2004 Kohl et al.
6,695,757 B2 2/2004 Edwards et al.
D487,192 S 3/2004 Farnham et al.
6,702,109 B1 3/2004 Tabuchi
6,719,140 B1 4/2004 Rinsler
6,719,678 B1 4/2004 Stern
D489,530 S 5/2004 Lindsay
6,729,112 B2 5/2004 Kuss et al.
6,736,309 B1 5/2004 Westerman et al.
6,746,388 B2 6/2004 Edwards et al.
6,755,927 B2 6/2004 Forman
6,761,279 B1 7/2004 Martin et al.
6,783,277 B2 8/2004 Edwards et al.
6,817,160 B2 11/2004 Schmidt
6,820,391 B2 11/2004 Barmore et al.
D501,134 S 1/2005 Takahashi et al.
6,845,602 B2 1/2005 Drut
D502,095 S 2/2005 Tucker et al.
D503,336 S 3/2005 Tucker et al.
D504,622 S 5/2005 Takahashi et al.
6,886,313 B2 5/2005 Knoerzer et al.
6,913,389 B2 7/2005 Kannankeril et al.
6,918,532 B2 7/2005 Sierra-Gomez et al.
6,935,086 B2 8/2005 Brenkus et al.
6,953,069 B2 10/2005 Galomb
D513,870 S 1/2006 Rosine et al.
6,986,920 B2 1/2006 Forman et al.
D514,439 S 2/2006 Snedden et al.
7,051,877 B2 5/2006 Lin
7,059,466 B2 6/2006 Lees et al.
7,077,259 B2 7/2006 Breidenbach
7,080,726 B2 7/2006 Breidenbach et al.
D528,010 S 9/2006 Yashima et al.
7,108,441 B2 9/2006 Altonen et al.
7,128,200 B2 10/2006 Lees et al.
D531,894 S 11/2006 Ramirez et al.
7,153,026 B2 12/2006 Galomb
7,156,556 B2 1/2007 Takahashi et al.
D536,608 S 2/2007 Arkins
RE39,505 E 3/2007 Thomas et al.
7,205,016 B2 4/2007 Garwood
7,207,717 B2 4/2007 Steele
7,213,710 B2 5/2007 Cotert
D544,762 S 6/2007 Zimmerman
D545,186 S 6/2007 Liebe et al.
D548,080 S 8/2007 Brown et al.
D551,508 S 9/2007 Friedland et al.
D552,468 S 10/2007 Seum et al.
7,299,608 B2 11/2007 Kohl et al.
7,350,688 B2 4/2008 Sierra-Gomez et al.
D569,719 S 5/2008 Ross
7,371,008 B2 5/2008 Bonenfant
D571,146 S 6/2008 Sanfilippo et al.
D571,197 S 6/2008 Sanfilippo et al.
7,475,781 B2 1/2009 Kobayashi et al.
D591,555 S 5/2009 Sanfilippo et al.
D593,369 S 6/2009 Green et al.
D608,193 S 1/2010 Sanfilippo et al.
7,665,629 B2 2/2010 Julius et al.
7,665,895 B2 2/2010 Takita et al.
7,717,620 B2 5/2010 Hebert et al.
7,744,517 B2 6/2010 Bonenfant
7,780,006 B2 8/2010 Clark, Jr. et al.
D629,296 S 12/2010 De Muynck
D637,577 S 5/2011 Han et al.
7,993,256 B2 8/2011 Takita et al.
8,006,833 B2 8/2011 Clark, Jr. et al.
8,038,349 B2 10/2011 Andersson et al.
D648,302 S 11/2011 Park et al.
8,066,137 B2 11/2011 Sanfilippo et al.
8,074,803 B2 * 12/2011 Motsch ..... B65D 75/5833 206/440
8,114,451 B2 2/2012 Sierra-Gomez et al.
8,132,395 B2 3/2012 Gehring et al.
8,182,891 B2 5/2012 Scott et al.
8,231,024 B2 7/2012 Sanfilippo et al.
8,245,865 B2 8/2012 Damaghi et al.
8,276,353 B2 10/2012 Reaves et al.
D671,000 S 11/2012 O'Neill et al.
8,308,363 B2 11/2012 Vogt et al.
D676,014 S 2/2013 Chung
D682,244 S 5/2013 Park et al.
D686,181 S 7/2013 Jeong
D689,767 S 9/2013 Clark et al.
8,523,441 B2 9/2013 Goglio et al.
D696,107 S 12/2013 Kimple et al.
8,602,242 B2 12/2013 Sanfilippo et al.
8,602,244 B2 12/2013 Sanfilippo et al.
8,746,483 B2 6/2014 Sierra-Gomez et al.
8,951,591 B2 2/2015 Vogt et al.
2001/0005979 A1 7/2001 Kuss et al.
2001/0010253 A1 8/2001 Forman
2002/0009575 A1 1/2002 DeMatteis
2002/0090879 A1 7/2002 Galomb
2002/0094922 A1 7/2002 Edwards et al.
2002/0118896 A1 8/2002 Forman
2002/0144998 A1 10/2002 Lees et al.
2002/0147088 A1 10/2002 Edwards
2003/0001002 A1 1/2003 Haughton et al.
2003/0041564 A1 3/2003 Schmidt
2003/0054929 A1 3/2003 Post et al.
2003/0059130 A1 3/2003 Yoneyama et al.
2003/0063820 A1 4/2003 Buchman
2003/0085265 A1 5/2003 Haim
2003/0100424 A1 5/2003 Barmore et al.
2003/0111523 A1 6/2003 Haugan
2003/0113042 A1 6/2003 Yeager
2003/0152679 A1 8/2003 Garwood
2003/0165602 A1 9/2003 Garwood
2003/0170357 A1 9/2003 Garwood
2003/0170359 A1 9/2003 Garwood
2003/0175392 A1 9/2003 Garwood
2003/0185937 A1 10/2003 Garwood
2003/0185948 A1 10/2003 Garwood
2003/0230504 A1 12/2003 Hamming
2004/0025476 A1 2/2004 Oliverio et al.
2004/0031244 A1 2/2004 Steele
2004/0040261 A1 3/2004 Troyer et al.
2004/0058103 A1 3/2004 Anderson et al.
2004/0081729 A1 4/2004 Garwood
2004/0089578 A1 5/2004 Lin
2004/0099570 A1 5/2004 Cargile
2004/0105600 A1 6/2004 Floyd
2004/0114838 A1 6/2004 McGregor
2004/0120611 A1 6/2004 Kannankeril et al.
2004/0141664 A1 7/2004 Olsen et al.
2004/0146602 A1 7/2004 Garwood et al.
2004/0185154 A1 9/2004 Garwood
2004/0185155 A1 9/2004 Garwood
2004/0185156 A1 9/2004 Garwood
2004/0188457 A1 9/2004 Galomb
2004/0226625 A1 11/2004 Galomb
2004/0226849 A1 11/2004 Brenkus et al.

(56) References Cited

U.S. PATENT DOCUMENTS

| | | | | |
|---|---|---|---|---|
| 2004/0232029 | A1 | 11/2004 | Cotert | |
| 2004/0251163 | A1 | 12/2004 | Conde et al. | |
| 2004/0262322 | A1 | 12/2004 | Middleton et al. | |
| 2005/0011906 | A1 | 1/2005 | Buck et al. | |
| 2005/0031233 | A1 | 2/2005 | Varanese et al. | |
| 2005/0053315 | A1 | 3/2005 | Aasen | |
| 2005/0069227 | A1 | 3/2005 | Steele | |
| 2005/0069230 | A1 | 3/2005 | Takahashi et al. | |
| 2005/0084186 | A1 | 4/2005 | Caris | |
| 2005/0139645 | A1 | 6/2005 | Shean et al. | |
| 2005/0150785 | A1 | 7/2005 | Julius et al. | |
| 2005/0189367 | A1 | 9/2005 | Chasid et al. | |
| 2005/0208188 | A1 | 9/2005 | Garwood | |
| 2005/0238766 | A1 | 10/2005 | Henderson et al. | |
| 2005/0265636 | A1 | 12/2005 | Michalsky | |
| 2005/0276525 | A1 | 12/2005 | Hebert et al. | |
| 2005/0284776 | A1 | 12/2005 | Kobayashi et al. | |
| 2006/0006049 | A1 | 1/2006 | Breidenbach et al. | |
| 2006/0016865 | A1 | 1/2006 | Berglin et al. | |
| 2006/0076352 | A1 | 4/2006 | Peterson et al. | |
| 2006/0080944 | A1 | 4/2006 | Annehed et al. | |
| 2006/0113212 | A1 | 6/2006 | Steele | |
| 2006/0126970 | A1* | 6/2006 | Perell | B65D 75/5855 383/61.1 |
| 2006/0169691 | A1 | 8/2006 | Rothschild et al. | |
| 2006/0210202 | A1 | 9/2006 | Plourde | |
| 2006/0283750 | A1 | 12/2006 | Villars et al. | |
| 2006/0285777 | A1 | 12/2006 | Howell et al. | |
| 2007/0080078 | A1 | 4/2007 | Hansen et al. | |
| 2007/0082096 | A1 | 4/2007 | Dougherty et al. | |
| 2007/0084142 | A1 | 4/2007 | Matthews | |
| 2007/0151887 | A1 | 7/2007 | Clark et al. | |
| 2008/0053860 | A1 | 3/2008 | McDonald | |
| 2008/0247686 | A1 | 10/2008 | Phee et al. | |
| 2009/0039078 | A1 | 2/2009 | Sanfilippo et al. | |
| 2009/0120828 | A1 | 5/2009 | Sanfilippo et al. | |
| 2009/0232425 | A1 | 9/2009 | Tai et al. | |
| 2009/0273179 | A1 | 11/2009 | Scott et al. | |
| 2010/0002963 | A1 | 1/2010 | Holbert et al. | |
| 2010/0040311 | A1* | 2/2010 | Plate | B65D 75/58 383/203 |
| 2010/0092112 | A1 | 4/2010 | Goglio et al. | |
| 2010/0113240 | A1 | 5/2010 | Takita et al. | |
| 2010/0140129 | A1 | 6/2010 | Sanfilippo et al. | |
| 2010/0154264 | A1 | 6/2010 | Scott et al. | |
| 2010/0278454 | A1* | 11/2010 | Huffer | B65D 75/5838 383/5 |
| 2011/0058755 | A1 | 3/2011 | Guibert | |
| 2011/0297690 | A1 | 12/2011 | Teys et al. | |
| 2012/0008884 | A1 | 1/2012 | Murray | |
| 2012/0125937 | A1 | 5/2012 | Ahlstrom et al. | |
| 2012/0128835 | A1 | 5/2012 | Lyzenga et al. | |
| 2012/0177307 | A1 | 7/2012 | Duan et al. | |
| 2012/0275727 | A1 | 11/2012 | Chang | |
| 2012/0321229 | A1 | 12/2012 | Surdziel et al. | |
| 2013/0004626 | A1 | 1/2013 | Renders et al. | |
| 2013/0011527 | A1 | 1/2013 | Renders et al. | |
| 2013/0114918 | A1* | 5/2013 | Lyzenga | B65B 9/067 383/203 |
| 2013/0266244 | A1* | 10/2013 | Doll | B65D 75/5805 383/209 |
| 2014/0083897 | A1 | 3/2014 | Sanfilippo et al. | |
| 2014/0102936 | A1 | 4/2014 | Sanfilippo et al. | |
| 2014/0109522 | A1 | 4/2014 | Sanfilippo et al. | |
| 2014/0196406 | A1 | 7/2014 | Sanfilippo et al. | |
| 2014/0301674 | A1 | 10/2014 | Sanfilippo et al. | |
| 2014/0307985 | A1 | 10/2014 | Sanfilippo et al. | |
| 2014/0328552 | A1 | 11/2014 | Sanfilippo et al. | |
| 2015/0001234 | A1 | 1/2015 | Sanfilippo et al. | |

FOREIGN PATENT DOCUMENTS

| | | | |
|---|---|---|---|
| EP | 1106508 | A1 | 6/2001 |
| EP | 1508531 | A1 | 2/2005 |
| EP | 1637472 | A1 | 3/2006 |
| EP | 1749756 | | 2/2007 |
| EP | 2347971 | | 7/2011 |
| FR | 2766794 | A1 | 2/1999 |
| FR | 2772009 | | 6/1999 |
| GB | 2399331 | A | 9/2004 |
| IT | 1274100 | B | 7/1997 |
| JP | 01167084 | | 6/1989 |
| JP | 01226579 | | 9/1989 |
| JP | 01267182 | | 10/1989 |
| JP | 09142551 | | 6/1997 |
| JP | 10-203560 | | 8/1998 |
| JP | 2005320032 | A | 11/2005 |
| WO | WO-86/06344 | A1 | 11/1986 |
| WO | WO-94/11270 | A1 | 5/1994 |
| WO | WO-00/12407 | | 3/2000 |
| WO | WO-02/085726 | A1 | 10/2002 |
| WO | WO-2004/024588 | A1 | 3/2004 |
| WO | WO-2004/110885 | | 12/2004 |
| WO | WO-2004110885 | A1 | 12/2004 |
| WO | WO-2006/091821 | A2 | 8/2006 |
| WO | WO-2007/058689 | A1 | 5/2007 |
| WO | WO-2009/061959 | A1 | 5/2009 |

OTHER PUBLICATIONS

International Search Report and Written Opinion for International Application No. PCT/US08/072554, dated Feb. 23, 2009.

International Search Report and Written Opinion for International Application No. PCT/US2009/063591, dated Jun. 18, 2010.

Extended European Search Report, European application No. EP 09825498.0, dated Nov. 22, 2012.

International Search Report and Written Opinion for International Application No. PCT/US2015/022859, mailed Oct. 12, 2015.

Brody et al., *Encyclopedia of Packaging Technology*, 2nd ed., New York, NY: John Wiley & Sons (1993).

Photographs of flexible container packaging, "Minibrick Pack", from Sonoco (Hartsville, South Carolina, USA) (became aware of in Dec. 2007).

SBS Special Top Design Machine, product sheet from Rovema Packaging Machines L.P. (Lawrenceville, Georgia, USA) (1 pg.) (2005).

International Search Report and Written Opinion from corresponding International Application No. PCT/US2013/066985, mailing date Jan. 29, 2014.

Search Report and Second Office Action (English translation), Chinese patent application No. 201380068596.2, May 4, 2017.

* cited by examiner

310

312

10
38d
38b
20
36b
12
38a
340
339
38
38c
36c
36

Three Ply Laminations

| | | | |
|---|---|---|---|
| Example 1<br>150 ga. Coex EVOH PE<br>ink<br>adhesive<br>75 ga. Cast Nylon<br>adhesive<br>150 ga. Coex EVOH PE | Example 2<br>80 ga. Cast PP<br>ink<br>adhesive<br>75 ga. Cast Nylon<br>adhesive<br>225 ga. Coex EVOH PE | Example 3<br>120 ga. Cast Coex EVOH PP<br>ink<br>adhesive<br>75 ga. Cast Nylon<br>adhesive<br>200 ga. Coex EVOH PE | Example 4<br>120 ga. Cast Coex EVOH PP<br>ink<br>adhesive<br>75 ga. Coex EVOH Nylon<br>adhesive<br>200 ga. Coex EVOH PE |
| Example 5<br>150 ga. Coex EVOH PE<br>ink<br>adhesive<br>75 ga. PET-F<br>adhesive<br>150 ga. Coex EVOH PE | Example 6<br>80 ga. Cast PP<br>ink<br>adhesive<br>75 ga. PET-F<br>adhesive<br>225 ga. Coex EVOH PE | Example 7 ##<br>80 ga. Cast PP<br>ink<br>adhesive<br>75 ga. Metallized PET<br>adhesive<br>225 ga. Coex EVOH PE | Example 8<br>150 ga. Coex Nylon PE<br>ink<br>adhesive<br>75 ga. PET-F<br>adhesive<br>150 ga. Coex EVOH PE |
| Example 9 ##<br>150 ga. Coex EVOH PE<br>ink<br>adhesive<br>75 ga. Metallized BOPP<br>adhesive<br>150 ga. Coex EVOH PE | Example 10 ##<br>150 ga. Coex EVOH PE<br>ink<br>adhesive<br>75 ga. Metallized CPP<br>adhesive<br>150 ga. Coex EVOH PE | Example 11 ##<br>175 ga. Coex Nylon PE<br>ink<br>adhesive<br>285 ga. Al Foil<br>adhesive<br>175 ga. Coex EVOH PE | Example 12 ##<br>175 ga. Coex Nylon PE<br>ink<br>adhesive<br>285 ga. Al Foil<br>adhesive<br>175 ga. PE |
| Example 13<br>150 ga. Coex EVOH PE<br>ink<br>adhesive<br>120 ga. PLA<br>adhesive<br>150 ga. Coex EVOH PE | Example 14<br>80 ga. Cast PP<br>ink<br>adhesive<br>120 ga. PLA<br>adhesive<br>150 ga. Coex EVOH PE | Example 15<br>125 ga. Coex Nylon PE<br>ink<br>adhesive<br>120 ga. PLA<br>adhesive<br>150 ga. Coex EVOH PE | Example 16<br>150 ga. Coex EVOH PE<br>ink<br>adhesive<br>120 ga. PLA<br>adhesive<br>150 ga. Coex EVOH PE |
| Example 17<br>150 ga. Coex EVOH PE<br>ink<br>adhesive<br>75 ga. Cast Nylon<br>adhesive<br>150 ga. Coex EVOH PE - Breakaway 1 | Example 18<br>150 ga. Coex EVOH PE<br>ink<br>adhesive<br>75 ga. Cast Nylon<br>adhesive<br>150 ga. Coex EVOH PE - Breakaway 2 | Example 19<br>80 ga. Cast PP<br>ink<br>adhesive<br>75 ga. Cast Nylon<br>adhesive<br>150 ga. Coex EVOH PE - Breakaway 1 | Example 20<br>80 ga. Cast PP<br>ink<br>adhesive<br>75 ga. Cast Nylon<br>adhesive<br>150 ga. Coex EVOH PE - Breakaway 2 |
| Example 21<br>150 ga. Coex EVOH PE<br>ink<br>adhesive<br>75 ga. PET-F<br>adhesive<br>150 ga. Coex EVOH PE - Breakaway 1 | Example 22<br>150 ga. Coex EVOH PE<br>ink<br>adhesive<br>75 ga. PET-F<br>adhesive<br>150 ga. Coex EVOH PE - Breakaway 2 | Example 23<br>80 ga. Cast PP<br>ink<br>adhesive<br>75 ga. PET-F<br>adhesive<br>150 ga. Coex EVOH PE - Breakaway 1 | Example 24<br>80 ga. Cast PP<br>ink<br>adhesive<br>75 ga. PET-F<br>adhesive<br>150 ga. Coex EVOH PE - Breakaway 2 |
| Example 25<br>150 ga. Coex EVOH Nylon PE<br>ink<br>adhesive<br>75 ga. PET-F<br>adhesive<br>150 ga. Coex EVOH PE - Breakaway 1 | Example 26<br>150 ga. Coex EVOH Nylon PE<br>ink<br>adhesive<br>75 ga. PET-F<br>adhesive<br>150 ga. Coex EVOH PE - Breakaway 2 | Example 27 ##<br>48 ga. PET<br>ink<br>adhesive<br>75 ga. PET-F<br>adhesive<br>150 ga. Coex EVOH PE | Example 28 ##<br>48 ga. PET w/ PVDC<br>ink<br>adhesive<br>75 ga. PET-F<br>adhesive<br>150 ga. Coex EVOH PE |
| Example 29<br>120 ga. BOPP w/SiOx, AlOx or PVOH barrier coating<br>ink<br>adhesive<br>75 ga. PET-F<br>adhesive<br>150 ga. Coex EVOH PE - Breakaway 1 | | | |

| | | | |
|---|---|---|---|
| ## | = | Not Formable | |
| Coex EVOH PE | = | PE/TIE/EVOH/TIE/PE | BLOWN OR CAST |
| Coex EVOH PP | = | PP/TIE/EVOH/TIE/PP | BLOWN OR CAST |
| Coex EVOH Nylon PE | = | PE/Tie/Nylon/Evoh/Nylon/Tie/PE | BLOWN OR CAST |
| PET-F | = | FORMABLE PET | CAST |

Figure 77

| | | | | |
|---|---|---|---|---|
| Coex Nylon PE | = | PE/TIE/NYLON/TIE/PE | BLOWN OR CAST | |
| Coex Nylon PE | = | EVA/NYL/NYL/NYL/EVA | BLOWN OR CAST | |
| X-Breakaway 1 | = | PE/TIE/EVOH/TIE*/PE | BLOWN | Interply Bond Strength (150 to 500 grams/in) |
| X-Breakaway 2 | = | PE/TIE/EVOH/TIE**/PE | BLOWN | Interply Bond Strength (500 to 900 grams/in) |
| TIE* | = | 70% TO 40% PX3236 TIE RESIN + 30% TO 60% PB8640 POLYBUTENE RESIN | | |
| TIE ** | = | 70% TO 40% PX3236 TIE RESIN + 30% TO 60% SPS-35C PEELABLE RESIN | | |
| SiOx, AlOx, PVOH | = | Silicon dioxide or Aluminum dioxide or poly vinyl alcohol barrier coatings | | |

Figure 77 (cont.)

Two Ply Laminations

| Example 1 | Example 2 | Example 3 |
|---|---|---|
| 150 ga. Coex EVOH Nylon PE | 150 ga. Coex Nylon PE | 120 ga. Cast PP |
| ink | ink | ink |
| adhesive | adhesive | adhesive |
| 300 ga. Coex EVOH PE | 300 ga. Coex EVOH PE | 275 ga. Coex EVOH PE |

| Example 4 | Example 5 | Example 6 |
|---|---|---|
| 150 ga. Coex Nylon PE | 150 ga. Coex Nylon PE | 120 ga. Cast Coex EVOH PP |
| ink | ink | ink |
| adhesive | adhesive | adhesive |
| 300 ga. Coex EVOH PE - Breakaway 1 | 300 ga. Coex EVOH PE - Breakaway 2 | 275 ga. Coex EVOH PE |

| Example 7 | Example 8 | Example 9 |
|---|---|---|
| 150 ga. Coex EVOH Nylon PE | 150 ga. Coex EVOH Nylon PE | 150 ga. Coex Nylon PE |
| ink | ink | ink |
| adhesive | adhesive | adhesive |
| 300 ga. Coex EVOH PE - Breakaway 1 | 300 ga. Coex EVOH PE - Breakaway 2 | 300 ga. Coex EVOH PE - Breakaway 2 |

| Example 10 ## | Example 11 | Example 12 |
|---|---|---|
| ink | 120 ga. Cast PP | 120 ga. Cast PP |
| 70 ga. Metallized Sealable BOPP | ink | ink |
| adhesive | adhesive | adhesive |
| 275 ga. Coex EVOH PE | 120 ga. Cast PP | 250 ga. PE |

| Example 13 ## | Example 14 | Example 15 |
|---|---|---|
| ink | 200 ga. PE | 150 ga. Coex PP Nylon EVOH PE |
| 70 ga. Metallized Sealable BOPP | ink | ink |
| adhesive | adhesive | adhesive |
| 275 ga. Metallized PE | 200 ga. PE | 300 ga. Coex EVOH PE |

| | | | | |
|---|---|---|---|---|
| ## | = | Not Formable | | |
| Coex EVOH PE | = | PE/TIE/EVOH/TIE/PE | BLOWN OR CAST | |
| Coex EVOH PP | = | PP/TIE/EVOH/TIE/PP | BLOWN OR CAST | |
| Coex EVOH Nylon PE | = | PE/Tie/Nylon/Evoh/Nylon/Tie/PE | BLOWN OR CAST | |
| Coex PP Nylon EVOH PE | | PP/Tie/NYLON/EVOH/NYLON/Tie/PE | BLOWN OR CAST | |
| Coex Nylon PE | = | PE/TIE/NYLON/TIE/PE | BLOWN OR CAST | |
| X-Breakaway 1 | = | PE/TIE/EVOH/TIE*/PE | BLOWN | Interply Bond Strength (150 to 500 grams/in) |
| X-Breakaway 2 | = | PE/TIE/EVOH/TIE**/PE | BLOWN | Interply Bond Strength (500 to 900 grams/in) |
| TIE* | = | 70% TO 40% PX3236 TIE RESIN + 30% TO 60% PB8640 POLYBUTENE RESIN | | |
| TIE ** | = | 70% TO 40% PX3236 TIE RESIN + 30% TO 60% SPS-35C PEELABLE RESIN | | |

Figure 77 (cont.)

FLEXIBLE PACKAGE AND METHOD OF MAKING THE SAME

CROSS REFERENCE TO RELATED APPLICATIONS

The benefit under 35 U.S.C. §119(e) of U.S. Provisional Patent Application Nos. 61/719,340 filed Oct. 26, 2012, 61/739,535 filed Dec. 19, 2012, 61/769,168 filed Feb. 25, 2013, 61/801,186 filed Mar. 15, 2013, and 61/860,233 filed Jul. 30, 2013 is hereby claimed and the disclosures of are each incorporated herein by reference in their entireties.

FIELD OF THE DISCLOSURE

This disclosure relates generally to packaging, and, more particularly, to a re-closable lid that is secured to a container, and to methods of making the packaging, and flexible materials for forming the same.

BACKGROUND

Re-closable or re-sealable packaging assemblies are commonly used to store food items, liquids, powders, baby wipes, chemicals, detergent, dry goods, pharmaceuticals, nutraceuticals and other packaged products, for example. Typically, the re-closable packaging assemblies include a container portion and a flap portion that covers an opening in the container. An end of the flap portion is secured to the container adjacent to the opening such that a user can pivot or fold the flap portion about the end to expose the opening, thereby allowing the user to access a product contained in an interior volume defined by the walls of the container. The underside of the flap and/or surface of the container covered by the flap in a closed position may have an adhesive coating such that when the flap is in the closed position, the flap releasably adheres to and sealingly engages the container. However, dust, moisture, or other debris, such as powder stored in the container, may adhere to the adhesive coating, and the adhesive coating may subsequently lose the ability, or the strength of the resealability will be substantially reduced, to sealingly engage the container.

A solution to the problem of contamination of the adhesive coating involves securing an injection-molded plastic lid assembly on the container such that the lid assembly is disposed around the opening. To access the interior volume of the container, a lid member is upwardly pivoted about a living hinge of the lid assembly to an open position in which the opening is exposed. To close the lid assembly, the lid member is downwardly pivoted about the living hinge to sealingly engage a base of the lid assembly. While the injection-molded plastic lid assembly is typically not affected by debris, moisture, or dust that gathers on or near the sealing area, the plastic lid assembly may be relatively expensive to produce and may add weight to the re-closable packaging assembly. In addition, attachment of the lid assembly to the container involves a relatively complicated production step that adds time and cost to production.

Accordingly, there exists a need to provide a re-closable packaging assembly that is simple and inexpensive to manufacture, that minimizes production time, and that provides reliable sealing when exposed to contamination.

SUMMARY

A re-closable packaging assembly includes a container (also referred to herein as a "package") formed at least partially by a first sheet, and the container has a plurality of walls that cooperate to define an interior volume. The container has an opening through a least one of the plurality of walls. The re-closable packaging assembly also includes a closure assembly secured to the container adjacent to the opening. The closure assembly at least partially comprises a second sheet and a portion of the first sheet. The closure assembly includes a lid member and a hinge portion. The lid member is pivotable about the hinge portion between a first position in which the lid member releasably engages a first portion of the container surrounding the opening and a second position in which the lid member is pivoted away from the opening about the hinge portion, thereby allowing for a user to access the interior volume through the opening. A first engagement feature may be disposed on the container adjacent to the opening. A second engagement feature may be disposed on the lid member of the closure assembly. The first engagement feature engages the second engagement feature to removably secure the lid member to the container when the lid member is in the first position. The first engagement feature may be integrally formed with the container. The first engagement feature may be formed as a ridge and the second engagement feature may be formed as a channel adapted to receive the ridge, for example.

A method of manufacturing a re-closable packaging assembly comprising a container defining an interior volume is provided, and the method includes providing a first sheet and providing a second sheet secured to a first portion of the first sheet. The method further includes forming a lid member of a closure assembly from a portion of the second sheet such that at least a portion of the lid member is secured to the first portion of the first sheet. A hinge portion of the closure assembly is formed from the second sheet, and the hinge portion is disposed adjacent to the lid member. The lid member is pivotable about the hinge portion between a first position in which the lid member releasably engages a first portion of the container surrounding an opening formed in the first sheet and a second position in which the lid member is pivoted away from a portion of the opening.

BRIEF DESCRIPTION OF THE DRAWINGS

FIG. 77 is a chart illustrating exemplary two-ply and three-ply film laminate configurations suitable for use in various embodiments of the disclosure;

DETAILED DESCRIPTION

Re-Closable Packaging Assembly

Figure 1:
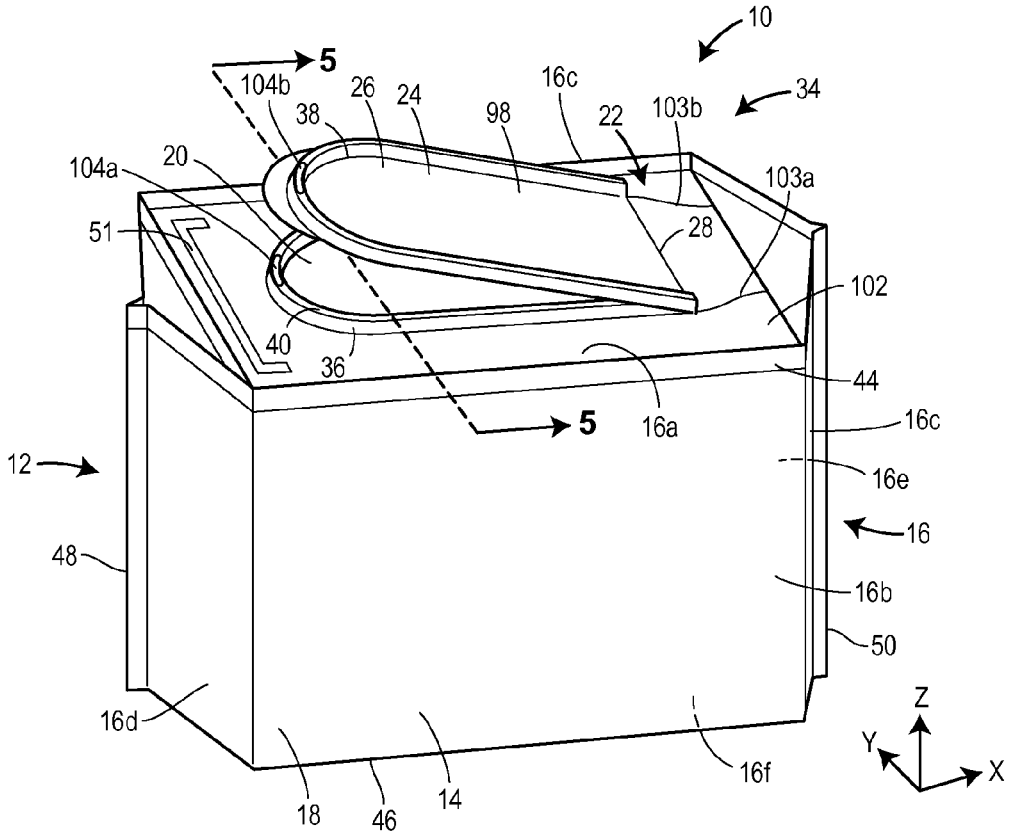
FIG. 1 is an isometric view of an embodiment of a re-closable packaging assembly with a lid member in an open, second position.

As illustrated in FIG. 1, a re-closable packaging assembly 10 includes a container 12 formed at least partially by a first sheet 14 (also called a first film), and the container 12 has a plurality of walls 16 that cooperate to define an interior volume 18. The container 12 has an opening 20 through a least one of the plurality of walls 16. The re-closable packaging assembly 10 also includes a closure assembly 22 secured to the container 12 adjacent to the opening 20 (or an area in which the opening 20 is defined). The closure assembly 22 at least partially comprises a second sheet 24 (also called a second film) and optionally a portion of the first sheet 14 (see FIG. 3). For example, a portion of the first sheet 14 can detach from the first sheet 14 and remain adhered to the second sheet to form an aperture in the first sheet. In other embodiments, a portion of the first sheet 14 can be detached from the remaining portion of the first sheet and discarded rather than adhered to the second sheet 24 to form the aperture. The terms container and package are used herein interchangeably.

Figure 2:
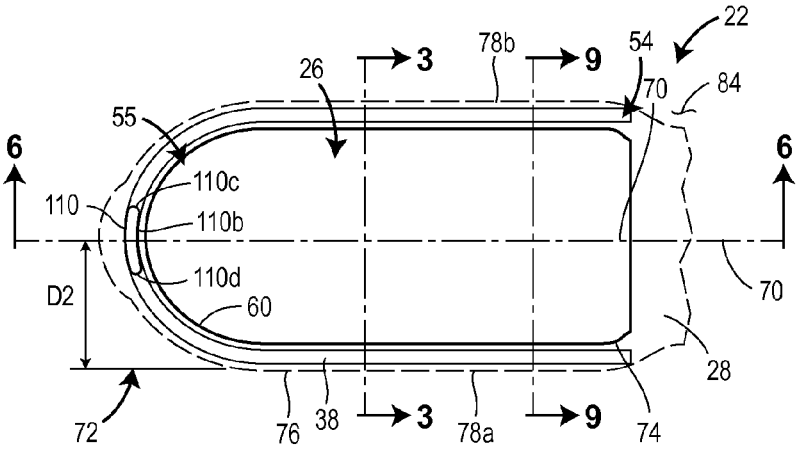
FIG. 2 is a top view of the lid member of the embodiment of the re-closable packaging assembly of FIG. 1.
Figure 3:
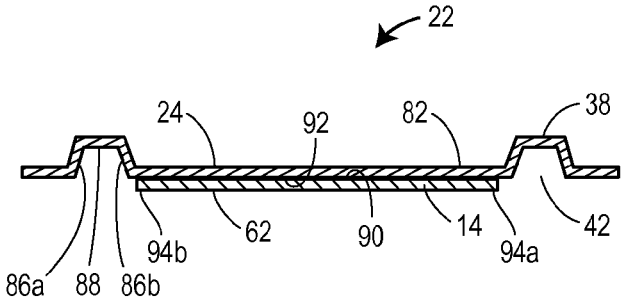
FIG. 3 is a sectional view of the lid member taken along line 3-3 of FIG. 2.

In one embodiment, the closure assembly 22 includes a lid member 26 and a hinge portion 28. The lid member 26 is pivotable about the hinge portion 28 between a first position 30 (illustrated in FIG. 4) in which the lid member 26 releasably engages a first portion 32 of the container 12 surrounding the opening 20 and a second position 34 (illustrated in FIGS. 1 and 28) in which the lid member 26 is pivoted away from the opening 20 about the hinge portion 28, thereby allowing for a user to access the interior volume 18 through the opening 20. As illustrated in FIGS. 1 and 5, a first engagement feature 36 may be disposed on the container 12 adjacent to the opening 20. As illustrated in FIGS. 1, 2, and 3, a second engagement feature 38 may disposed on the lid member 26 of the closure assembly 22. The first engagement feature 36 engages the second engagement feature 38 to removably secure the lid member 26 to the container 12 when the lid member 26 is in the first position 30. The first engagement feature 36 may be integrally formed with the container 12.

As illustrated in FIGS. 1, 3, and 5, the first engagement feature 36 may be formed as a ridge 40 and the second engagement feature 38 may be formed as a channel 42 adapted to receive the ridge 40, for example.

So configured, in a single manufacturing step, the lid member 26, the first engagement feature 36, and the second engagement feature 38 may be formed in the film of the container 12, thereby eliminating the need to attach a separately-fabricated lid assembly that is secured to a container. Because the features are formed in a single process step, and because the separately-fabricated lid assembly is not necessary, one having ordinary skill in the art would recognize that manufacturing time and cost are reduced. Moreover, one having ordinary skill in the art would recognize such features allows for reliable resealing of the lid member 26 to the container 12 by a mechanical closure, which is not degraded by the presence of surface contaminants in the sealing area.

Turning to the container 12 of the re-closable packaging assembly 10 in more detail, the container 12 includes the plurality of walls 16 that cooperate to define the interior volume 18, as illustrated in FIG. 1. The plurality of walls 16 may cooperate to form any suitable shape or combination of shapes. For example, the plurality of walls 16 may include a top wall 16*a*, a first side wall 16*b*, a second side wall 16*c*, a third side wall 16*d*, a fourth side wall 16*e*, and a bottom wall 16*f*. The top wall 16*a* may be planar or substantially planar and may extend in a horizontal direction (i.e., parallel to the X-Y plane of the reference coordinate system provided in FIG. 1) or a substantially horizontal direction. The bottom wall 16*f* may be planar or substantially planar and may extend in a horizontal direction or a substantially horizontal direction, and the bottom wall 16*f* may be vertically (i.e., in a direction parallel to or along the Z-axis of the reference coordinate system provided in FIG. 1) offset from the top wall 16*a*. The first side wall 16*b* may vertically extend between the top wall 16*a* and the bottom wall 16*f*, and the first side wall 16*b* may be parallel or substantially parallel to the X-Z plane of the reference coordinate system provided in FIG. 1. A first portion of the first side wall 16*b* may extend vertically beyond the top wall 16*a* to form a portion of a top ridge wall 44 that extends along and around the perimeter of the top wall 16*a*. A second portion of the first side wall 16*b* may extend vertically beyond the bottom wall 16*f* to form a portion of a bottom ridge wall 46 that extends along and around the perimeter of the bottom wall 16*f*.

Still referring to FIG. 1, the second side wall 16*c* may vertically extend between the top wall 16*a* and the bottom wall 16*f*, and the first side wall 16*b* may be offset from the second side wall 16*c* along the Y-axis of the reference coordinate system provided in FIG. 1. A first portion of the second side wall 16*c* may extend vertically beyond the top wall 16*a* to form a portion of the top ridge wall 44. A second portion of the second side wall 16*c* may extend vertically beyond the bottom wall 16*f* to form a portion of the bottom ridge wall 46. The third side wall 16*d* may vertically extend between the top wall 16*a* and the bottom wall 16*f*, and the third side wall 16*d* may be parallel or substantially parallel to the Y-Z plane of the reference coordinate system provided in FIG. 1. A first portion of the third side wall 16*d* may extend vertically beyond the top wall 16*a* to form a portion of the top ridge wall 44. A second portion of the third side wall 16*d* may extend vertically beyond the bottom wall 16*f* to form a portion of the bottom ridge wall 46. A first sealed edge 48 may vertically extend from the top ridge wall 44 to the bottom ridge wall 46. The third side wall 16*d* may not be directly attached to the top wall 16*a*, and a portion of the first sheet 14 making up the top wall 16*a* may be inserted through a gap between the third side wall 16*d* and the top wall 16*a* such that the portion of the first sheet 14 is disposed against a portion of an internal surface of the third side wall 16*d* (i.e., tucking the portion of the top wall 16*a* into the gap). Similarly, the third side wall 16*d* may not be directly attached to the bottom wall 16*b*, and a portion of the first sheet 14 making up the bottom wall 16*b* may be inserted through a gap between the third side wall 16*d* and the bottom wall 16*b* such that the portion of the first sheet 14 is disposed against a portion of the internal surface of the third side wall 16*d* (i.e., tucking the portion of the bottom wall 16*b* into the gap).

Referring again to FIG. 1, the fourth side wall 16*e* may vertically extend between the top wall 16*a* and the bottom wall 16*f*, and the fourth side wall 16*e* may be parallel or substantially parallel to the Y-Z plane of the reference coordinate system provided in FIG. 1. A first portion of the fourth side wall 16*e* may extend vertically beyond the top wall 16*a* to form a portion of the top ridge wall 44. A second portion of the fourth side wall 16*e* may extend vertically beyond the bottom wall 16*f* to form a portion of the bottom ridge wall 46. A second sealed edge 50 may vertically extend from the top ridge wall 44 to the bottom ridge wall 46. The fourth side wall 16*e* may not be directly attached to the top wall 16*a*, and a portion of the first sheet 14 making up the top wall 16*a* may be inserted through a gap between the fourth side wall 16*e* and the top wall 16*a* such that the portion of the first sheet 14 is disposed against a portion of an internal surface of the fourth side wall 16*e* (i.e., tucking the portion of the top wall 16*a* into the gap). Similarly, the fourth side wall 16*e* may not be directly attached to the bottom wall 16*b*, and a portion of the first sheet 14 making up the bottom wall 16*b* may be inserted through a gap between the fourth side wall 16*e* and the bottom wall 16*b* such that the portion of the first sheet 14 is disposed against a portion of the internal surface of the fourth side wall 16*e* (i.e., tucking the portion of the bottom wall 16*b* into the gap).

The plurality of walls 16 of the container 12 may cooperate to form any suitable shape or combination of shapes that form a sealed or partially sealed enclosure. In other contemplated embodiments, for example, the plurality of walls 16 may form a substantially elongated tubular shape. The container 12 may include any container known in the art, such as quad-sealed packaging, Horizontal Flow Wrap Packages (such as those manufactured by Ilapak, Hayssen-Sandiacre, Bosch, or Doboy), Vertical—Form—Fill Seal "Pillow" style bags (such as those manufactured by Hayssen, Ilapak, Bosch, or Triangle), Horizontal—Form-Fill—Seal packages included a formed bottom and a liding material (such as those manufactured by Multivac or Tiromat), Stand-Up Pouches (such as those manufactured by KHS-Bartelt or Laudenberg), and tray sealing equipment such as such as those manufactured by Pack-Line, Osgood or Modern.

An exemplary quad seal package and methods of folding a quad seal package which can be used as the container for the packages of the disclosure is described in U.S. Patent Application Publication No. 2012/0312868, the disclosure of which is incorporated herein by reference in its entirety. Such quad seal packages can include corner seals that extend and surround one or more panels of the package. For example, the package can include a top wall in which the opening is disposed and an oppositely disposed bottom wall. Corners seals can extend from and surround one or both of the top and bottom walls. In alternative embodiments, the corner seals can extend from one or more of the side walls.

Figure 26:
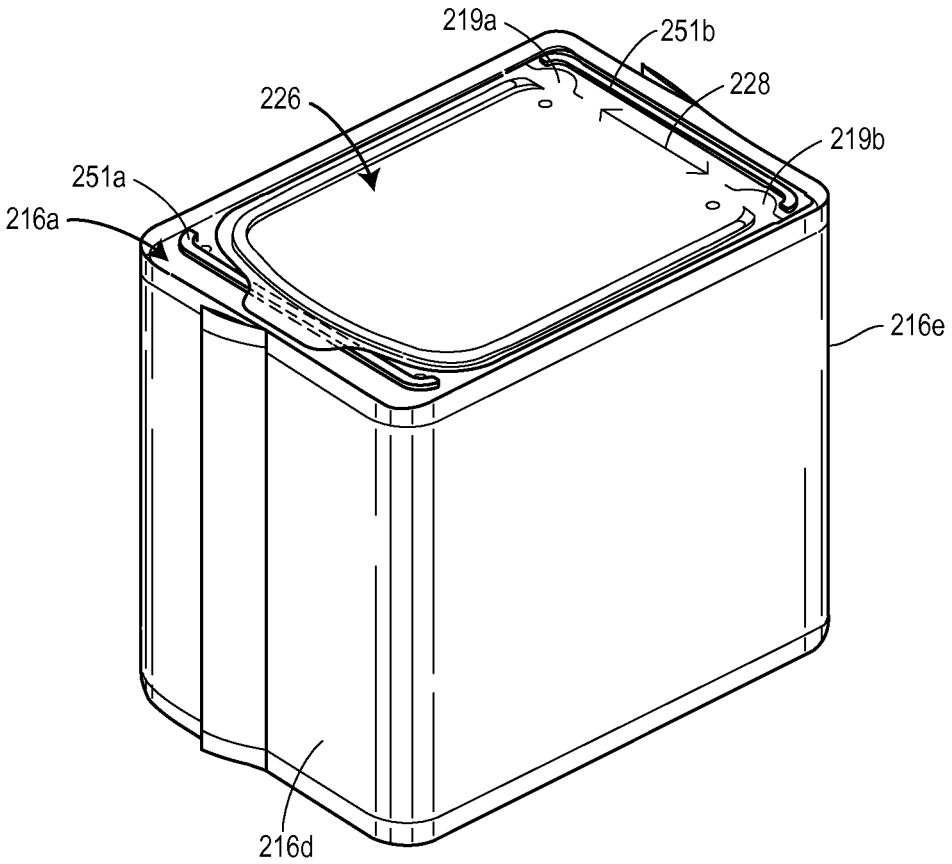
FIG. 26 is a perspective view of a container in accordance with an embodiment of the disclosure.

As illustrated in FIG. 1, one or more ribs 51 may be formed along one or more surfaces of the container 12. For example, a rib 51 may extend along the top wall 16*a* of the container 12 adjacent to and aligned with the third side wall 16*d* of the container. In some embodiments, as illustrated in FIG. 26, for example, a first rib 251*a* may extend along the top wall 216*a* of the container adjacent to and aligned with the third side wall 216*d* and a second rib 251*b* may extend along the top wall 216*a* of the container adjacent to and aligned with the fourth side wall 216*e*. The one or more ribs 51 may be formed as an elongated protrusion that upwardly extends from the top wall 16*a* of the container 12, and the protrusion may provide stiffness to a desired area of the container 12. In addition, one or more ribs 51 may extend along all or part of one or more of the side walls 16*b-d* of the container 12 and upwardly from the wall of the container as described above with respect to the top wall. In various embodiments, the one or more ribs 51 can be formed in the wall containing the closure assembly 22 as well as on one or more of the walls adjacent to the panel having the closure assembly. The one or more ribs 51 may be formed in a thermoforming operation that will be described in more detail below.

The plurality of walls 16 of the container 12 may be formed from a single sheet of material, (e.g., the first sheet 14), and the material may be flexible. However, the container 12 may be made of any suitable number of sheets of material. The first sheet 14 can include any suitable number of laminate layers needed to achieve the desired composition and/or film properties. The first sheet 14 may have a composition and structure that are appropriate for the product to be stored within the container 12. The first sheet 14 may be formed from materials such as polypropylene (PP), ethylene vinyl alcohol (EVOH), polyethylene (PE), ethylene vinyl acetate (EVA) co-polymers, foil (such as aluminum foil), paper, polyester (PET), polyamide or nylon (PA), and laminates and composites thereof. In other embodiments, the first sheet 14 may be formed from metalized polypropylene or metalized polyethylene terephthalate (PET), or combinations of such materials. Still further, the first sheet 14 may include or be infused with a degradable or biodegradable component that may allow the container to degrade in a relatively short amount of time after the useful life of the container 12, such as after the container 12 is disposed in a landfill or other disposal facility. If necessary or desired based on the implementation, the first sheet 14 may include an outer ply of heat sealable polypropylene or other material suitable for heat sealing so that the seals joining portions of the film as the container 12 is fabricated may be sealed and/or attached to the outer surface of the container 12 to form and shape the container 12.

Figure 7:
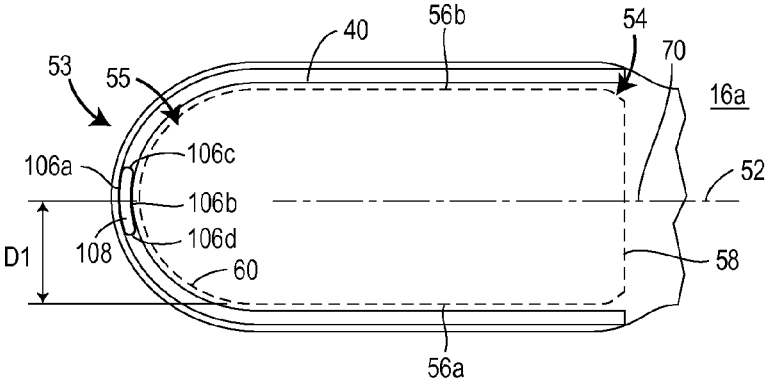
FIG. 7 is a top view of a top wall of the container of the embodiment of the re-closable packaging assembly of FIG. 1.

As illustrated in FIG. 1, the container 12 includes the opening 20 through at least one of the plurality of walls 16. The opening 20 may be disposed through any suitable wall or walls of the plurality of walls 16. For example, the opening 20 may be disposed through the top wall 16*a* (i.e., an access panel or opening panel), as illustrated in FIG. 1. As used herein, the term opening panel is used to describe any panel in which the opening is formed or defined. The opening 20 may have any suitable shape or combination of shapes to allow a user to access the interior volume 18 through the opening 20. For example, as illustrated in FIGS. 1 and 7, the opening 20 may have an elongated shape that extends along a horizontal opening axis 52 that is parallel to the X-axis of the reference coordinate system of FIG. 1. The opening axis 52 may extend from a first end 53 of the opening 20 to a second end 54 that is opposite the first end 53, and the opening axis 52 may at least partially extend along or adjacent to a top surface of the first sheet 14 comprising the top wall 16*a*. The opening axis 52 may be equidistant from the first side wall 16*b* and the second side wall 16*c* when viewed along the Z-axis of the reference coordinate system of FIG. 1. The perimeter of the opening 20 may be defined by an opening edge 55 that may include one or more segments. For example, the opening edge 55 may include a first side edge 56*a* and a second side edge 56*b*, and each of the first side edge 56*a* and the second side edge 56*b* may be parallel to and equidistantly offset from the opening axis 52. Each of the first side edge 56*a* and the second side edge 56*b* may be disposed a first distance D1 from the opening axis 52. The opening edge 55 may also include an end edge 58 that may extend between a first end of the first side edge 56*a* and a first end of the second side edge 56*b* at the second end 54 of the opening 20. A curved front edge 60 may extend from a second end of the first side edge 56*a* and a second end of the second side edge 56*b* towards the first end 53 of the opening 20. The front edge 60 may be symmetrically formed about the opening axis 60 and a distance between the front edge 60 and the opening axis 24 may increase from the first end 53 of the opening 20 to the second end of the first and second side edges 56*a*, 56*b*. The front edge 60 may have the shape of a portion of a circle, a portion of an oval, or a portion of a parabola, a square, or a rectangle, for example. The front edge 60 may also have a point or chevron (not shown) to create a starting point. The edge surface of the opening edge 55 may be smooth, wavy, scalloped, or have any other suitable texture or shape. The opening 20 can have a symmetrical or an asymmetric shape.

The opening 20 may be formed in a cutting operation. For example, in one embodiment a cutting operation can include forming cuts for the first and second side edges 56*a*, 56*b* and the front edge 60 from the first sheet 14, while all or a portion of the end edge 58 may remain integrally secured to the first sheet 14 to form a portion of the hinge portion 28. In such an operation, an underportion 62 of the first sheet 14 is formed that is disposed inward of the first and second side edges 56*a*, 56*b* and inward of the front edge 60 (when formed during the cutting operation) and that may be pivotably coupled to the container 12 about the portion of the first sheet 14 at or adjacent to the end edge 58. In alternative embodiments, the opening 20 may be formed in a cutting operation that cuts along the entire opening edge 55. The cutting operation may cut substantially along the entire opening edge 55, and gaps or bridges may be provided along the opening edge 55 as desired.

In alternative embodiments, an opening 20 can be defined in the container 12 (such as on the top wall 16*a* of the container) by forming or defining the underportion 62 in a portion of the top wall 16*a* such that when the underportion 62 is at least partially removed from the remaining portion of the top wall 16*a* the opening 20 is defined. That is, the underportion 62 may not be secured to the lid member 26. This can allow the re-closable packaging assembly 10 to remain sealed, for example, hermetically sealed, until the first use by the users. Such an embodiment can advantageously be utilized to provide a tamper evident packaging assembly 10 in which the user would readily be able to determine if the package 10 was previously opened by observing whether the underportion 62 had been at least partially detached from the container 12. Any other known tamper evident mechanisms can be provided on the container 12 as is known in the art. The underportion 62 may be configured to completely or partially detach from the remaining portion of the container 12. For example, the underportion 62 may be configured to partially detach from the container 12 such that it remains at least partially attached to the container 12. In other embodiments, the underportion 62 can completely detach from the access panel 14.

Referring to FIG. 3, the underportion 62 of the first sheet 14 may be at least partially secured to the second sheet 24 of the lid member 26. More specifically, all or a portion of a first surface 90 of the underportion 62 may be secured to all or a portion of a second surface 92 of the second sheet 24 of lid member 26. Preferably, the entire first surface 90 of the underportion 62 may be secured to a portion of the second surface 92 of the lid member 26. The underportion 62 may be secured to the second sheet 24 of the lid member 26 in any manner known in the art, such as by the use of an adhesive, heat sealing, ultra-sonic sealing, etc. Suitable adhesives may be pressure sensitive acrylics, two-part dry bond, single component polyurethanes, and thermally activated, for example. Because the underportion 62 may be formed in the cutting operation that forms the opening 20, the underportion 62 may have dimensions that are equal or substantially equal to corresponding dimensions of the opening 20. Specifically, the underportion 62 may have first and second side edges 94*a*, 94*b* that dimensionally correspond to the first and second side edges 56*a*, 56*b* of the opening 20 and a front edge 96 that dimensionally corresponds to the front edge 60, as illustrated in FIGS. 2, 3, 6, and FIG. 8. In the first position 30, a longitudinal axis of the underportion 62 may be collinear with the opening axis 52, and the underportion 62 may be symmetrically formed about the longitudinal axis.

The underportion 62 may be defined in any suitable way. For example, the underportion 62 (and, by extension) the opening 20) may be defined by a path of reduced strength that allows the underportion 62 to be at least partially detached along the path of reduced strength when a force is applied to pull the underportion 62 away from the remaining portion of the container 12. The path of reduced strength defining the underportion 62 in the container 12 may be provided by any suitable method, including, for example, by laser scoring, mechanical scoring or a similar process for forming perforations in the first sheet 14 without puncturing the sheet, but allowing puncturing if necessary or desired based on the requirements for the re-closable packaging assembly 10 and/or the stored product. Alternatively, blade scoring with approximately 60%-100% penetration, for example, may be used to form a score line defining the underportion 62 instead of individual perforations. In such embodiments, it can be possible to retain a hermetic seal in the container until the first opening of the container as there is not full penetration through the first sheet 14 until the underportion 62 is separated from the first sheet 14. In other embodiments, full penetration through the first sheet 14 may be performed by blade scoring to facilitate detachment of the underportion 62. For example, a continuous blade score with full penetration through the first sheet 14 may be performed with intermittent interruptions or bridges in the score line being provided to hold the underportion 62 in place until the underportion 62 is detached by the user. The distance between the bridges may range from 200 micron to 2.0", and the length of the bridges may fall within the range of 50 microns 2500 microns depending on the implementation.

Other suitable methods of forming a score or perforation to define the opening edge include laser scoring/cutting, laser perforation or micro perforation methods, for example, using dies or knifes.

As illustrated in FIG. 1, the first engagement feature 36 may be disposed on the container 12 adjacent to the opening 20, and the first engagement feature may be integrally formed on or with the container 12. The first engagement feature 36 may be adapted to engage the second engagement feature 38 disposed on the lid member 26 of the closure assembly 22 such that the first engagement feature 36 engages the second engagement feature 38 to removably secure the lid member 26 to the container 12 when the lid member 26 is in the first position 30 illustrated in FIG. 4. The first engagement feature 36 may be any element or combination of elements that engage a corresponding second engagement feature 38 to allow the lid member to releasably engage the container 12. For example, the first engagement feature 36 may be a ridge 40 that may vertically extend upward from the top wall 16*a* and that may be integrally formed on or with the top wall 16*a*. The ridge 40 may extend along a ridge axis 64 that has a general U-shape (when viewed along the Z-axis of the reference coordinate system of FIG. 1) and that extends around the opening 20, and the open end of the U-shaped ridge axis 64 may be at or adjacent to the second end 54 of the opening 20. The ridge axis 64 may be outwardly offset a uniform distance from the first side edge 56*a*, the second side edge 56*b*, and the front edge 60.

As illustrated in FIGS. 1 and 5, the ridge 40 may be formed in the first sheet 14 and may have any suitable cross-sectional shape or combination of shapes (when viewed along the ridge axis 64). For example, the ridge 40 may include a pair of inwardly-tapering sides 66*a*, 66*b* and a top wall 68. The cross-sectional shape of the ridge 40 may be uniform or substantially uniform along the ridge axis 64. However, the ends of the ridge 40 that make up the legs of the U-shape that are adjacent to the second end 54 of the opening 20 may gradually downwardly taper such that the top wall 68 is flush or substantially flush with a top surface of the first sheet 14 (i.e., a top surface of the top wall 16*a*). Instead of a gradual taper, the ends of the ridge 40 may be chamfered or may be rounded. Alternatively, the ends of the ridge 40 may not taper, and the cross-sectional shape of the ridge 40 may be uniform or substantially uniform along the entire ridge axis 64.

As previously explained, the ridge 40 may be adapted to engage a corresponding channel 42 (see FIG. 3) formed in the lid member 26 of the closure assembly 22 when the lid member 26 is in the first position 30 illustrated in FIG. 4, and the channel 42 will be described in more detail below.

Instead of a single ridge 40, the first engagement feature 36 may include two or more ridge segments (not shown) that are not continuous over the length of the ridge axis. That is, gaps may separate the two or more ridge segments, and each of the ridge segments may be adapted to engage a corresponding channel segment or a portion of a channel 42 formed in the lid member 26 of the closure assembly 22 when the lid member 26 is in the first position 30.

As illustrated in FIG. 1, the re-closable packaging assembly 10 also includes the closure assembly 22 secured to the container 12 adjacent to the opening 20 or adjacent to an area in which the opening is defined (as when the underportion 62 acts as a removable seal to cover the opening 20). The closure assembly 22 includes the lid member 26 and the hinge portion 28, and the lid member 26 is pivotable about the hinge portion 28 between the first position 30 and the second position 34. At least a portion of the closure assembly 22 may include the second sheet 24 and a portion of the first sheet 14. More specifically, the lid member 26 may partially include the second sheet 24, and the second sheet may be sized and dimensioned to cover the opening 20 when the lid member 26 is in the first position 30. The second sheet 24 may be any suitable material, such as any of the previously-described materials that may comprise the first sheet 14. Specifically, the second sheet 24 may be PP, PET, or PLA, or any other suitable material. The second sheet 24 may have a uniform thickness, or the thickness may vary. In this first position 30, the lid member 26 may have an elongated shape that extends along a longitudinal lid axis 70 from a first end 72 to a second end 74 that is adjacent to the hinge portion 28, as illustrated in FIGS. 2 and 4. The lid axis 70 may at least partially extend along or adjacent to a bottom surface of the second sheet 24 (and a top surface of the first sheet 14) such that the lid axis 70 is collinear (or substantially collinear) with the opening axis 52 when the lid member 26 is in the first position 30. In alternative embodiments, the lid member 26 of the closure assembly 22 may include only the second sheet 24, and the underportion 62 may remain secured to the container 12 to cover the opening 20 and to act as a seal as previously described.

Figure 8:
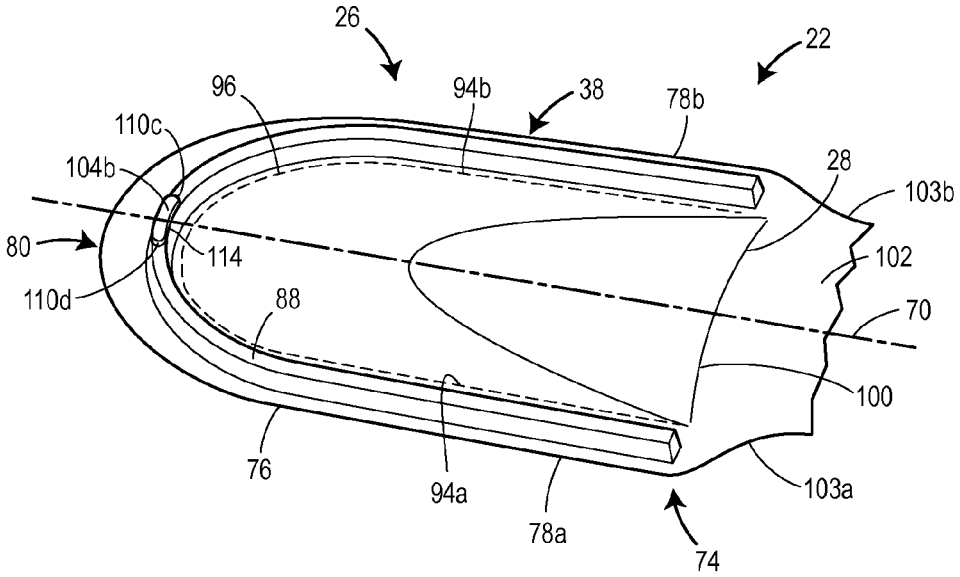
FIG. 8 is an isometric view of a portion of the lid member of the embodiment of the re-closable packaging assembly of FIG. 1.

As illustrated in FIGS. 2 and 8, the lid member 26 may include a lid edge 76 that defines the outer edge (or an outer perimeter edge) of the lid member 26, and the lid edge 76 may include one or more segments. For example, the lid edge 76 may include a first side edge 78*a* and a second side edge 78*b*, and each of the first side edge 78*a* and the second side edge 78*b* may be parallel to and equidistantly offset from the lid axis 70. Each of the first side edge 78*a* and the second side edge 78*b* may be disposed a second distance D2 from the lid axis 70, and the second distance D2 may be greater than the first distance D1 that separates each of the first side edge 56*a* and the second side edge 56*b* from the opening axis 52. A first end of the first side edge 78*a* and a first end of the second side edge 78*b* may be disposed adjacent to the hinge portion 28 at the second end 54 of the opening 20.

The lid edge 76 may also include a curved front edge 80 that extends from a second end of the first side edge 78*a* and a second end of the second side edge 56*b* towards the first end 53 of the opening 20. The front edge 80 may be symmetrically formed about the lid axis 60 and a distance between the front edge 80 and the lid axis 70 may increase from the first end 72 of the lid member 26 to the second end of the first and second side edges 78*a*, 78*b*. The front edge 80 may have the same or substantially the same general shape as the front edge 60 of the opening 20. That is, the front edge 80 may have the shape of a portion of a circle, a portion of an oval, or a portion of a parabola, a square, or a rectangle, for example. The front edge 80 may be outwardly offset from the front edge 60 of the opening, and the distance of offset may be uniform. For example, the offset distance may be the difference between the second distance D2 of the lid member 26 and the first difference D1 of the opening 20. The front edge 80 may include a pull tab 117 (illustrated in FIGS. 20A and 20B) that projects away from the second engagement feature 38 to facilitate the opening and closing of the lid member 26 by a user.

Figure 4:
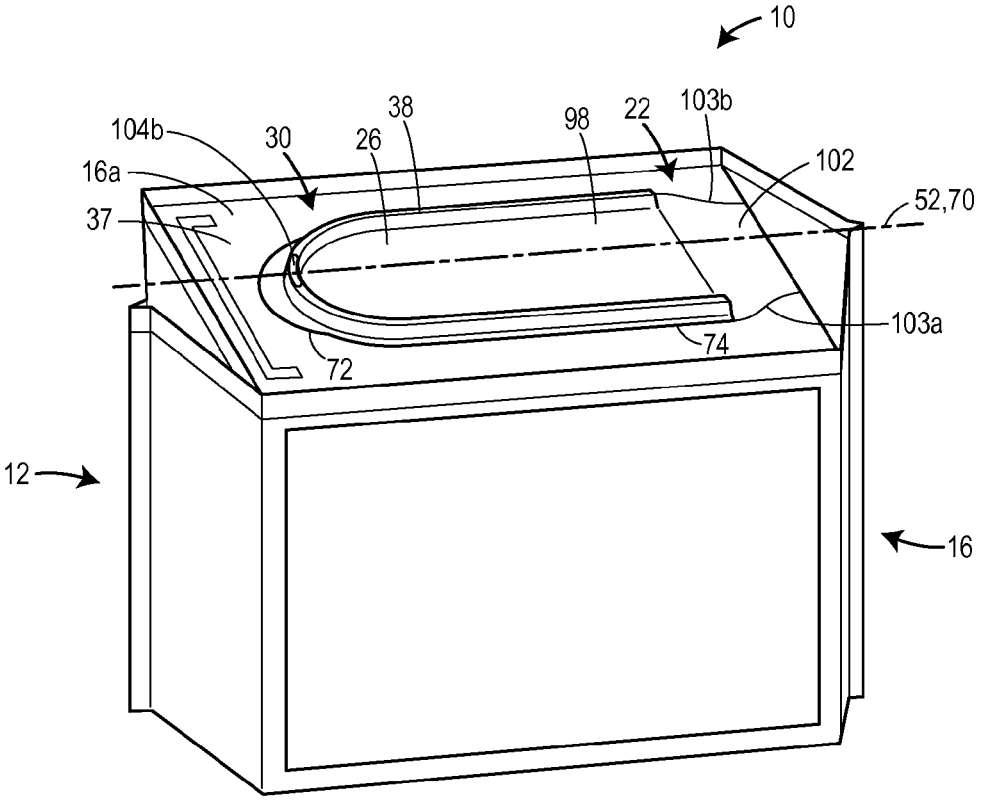
FIG. 4 is an isometric view of the embodiment of the re-closable packaging assembly of FIG. 1 with the lid member in a closed, first position.
Figure 5:
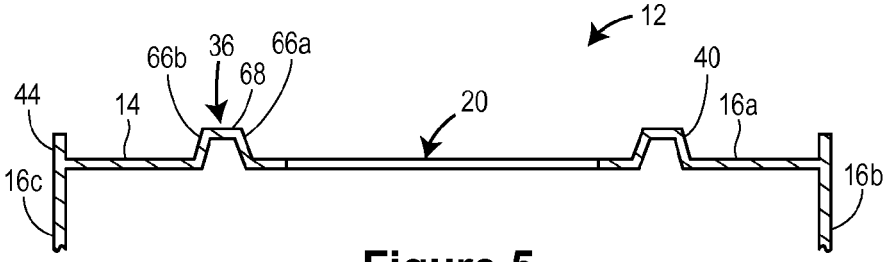
FIG. 5 is a sectional view of the top wall of a container taken along line 5-5 of FIG. 4.

As illustrated in FIGS. 2, 3, 4, and 8, the lid member 26 of the closure assembly 22 includes the second engagement feature 38 adapted to engage the first engagement feature 36 disposed on the container 12 to removably secure the lid member 26 to the container 12 when the lid member 26 is in the first position 30 illustrated in FIG. 4, and the second engagement feature 38 may be integrally formed on or with the lid member 26. The second engagement feature 38 may be any element or combination of elements that engage a corresponding first engagement feature 36 to allow the lid member to sealingly engage the container 12. For example, the second engagement feature 38 may be a channel 42 adapted to receive the ridge 40 formed on the top wall 16*a* of the container 12. As illustrated in FIG. 3, the channel 42 may vertically extend upward (or substantially vertically upward) from a first surface 82 of the second sheet 24, and, as shown in FIG. 2, the channel may extend along a channel axis 84. The channel axis 84 may have a general U-shape, and the open end of the U-shaped channel axis 84 may be at or adjacent to the second end 74 of the lid member 26. Referring to FIGS. 54A, and 59A-65F, in various embodiments, the channel can be continuous, surrounding the entire perimeter of the opening. As described in detail below, in such embodiments, the lid member can be completely removable from the container, or can be hinged to the container, for example, at a second end of the lid member. The channel axis 84 may be inwardly offset a uniform distance from the first side edge 78*a*, the second side edge 78*b*, and the front edge 80 of the lid member 26. The channel axis 84 may overlap or substantially overlap (i.e., have the same shape, dimension, and relative position) the ridge axis 64 when viewed along the Z-axis of the reference coordinate system of FIG. 1 when the lid member 26 is in the first position 30. The channel 42 may have a uniform or substantially uniform cross-sectional shape along the channel axis 84. Alternatively, the channel 42 may have a non-uniform cross-sectional shape.

Referring to FIG. 3, the channel 42 may be formed in the first sheet 14 and may have any suitable cross-sectional shape or combination of shapes (when viewed along the channel axis 84). For example, the channel 42 may include a pair of inwardly-tapering surfaces 86*a*, 86*b* and a bottom surface 88, and the surfaces 86*a*, 86*b*, 88 are adapted to contact or be adjacent to a corresponding surface of the ridge 40 (i.e., the inwardly-tapering sides 66*a*, 66*b* and a top wall 68, respectively), when the lid member 26 is in the first position 30. The cross-sectional shape of the channel 42 may be uniform or substantially uniform along the channel axis 84, and may correspond to the cross-sectional shape of the ridge 40 along the ridge axis 64. The ends of the channel 42 that make up the legs of the U-shape that are adjacent to the second end 74 of the lid member 26 may gradually taper to receive the corresponding tapered ends of the ridge 40.

Instead of a single channel 42, the second engagement feature 38 may include two or more channel segments (not shown) that are not continuous over the length of the channel axis 84. Each of these channel segments may correspond to a previously-described ridge segments formed on the top wall 16*a* of the container 12 such that each of the ridge segments may be adapted to engage a corresponding channel segment or a portion of a channel 42 formed in the lid member 26 of the closure assembly 22 when the lid member 26 is in the first position 30.

In an alternative embodiment, the first engagement feature 36 may be a channel 42 that may vertically extend downward from the top wall 16*a* of the container 12, and the second engagement feature 38 may be ridge 40 that may vertically extend downward from the lid member 26 of the closure assembly 22. In the first position 30, the ridge 40 may be received into the channel 42 to allow the lid member to sealingly engage the container 12.

Referring to FIGS. 59A-65F, the lid member can include one or more additional closure features 500, including undercuts, button or snap in features, or other interacting locking features. For example, as shown in FIGS. 59A to 59E, the lid member can include a single closure feature 500 disposed at a first end 502 of the lid 26, and arranged in approximately the center the closure feature can include a downwardly projecting portion formed in the second sheet. The downwardly projecting portion formed in the second sheet can interact, for example, reside in, a correspondingly shaped and sized recess formed in the first sheet, when the lid is in the closed position. FIG. 61 shows that a lid can include a closure feature 500 that is defined by an upwardly projecting portion formed in the first sheet and a receiving recess formed in the second sheet, with the receiving recess being arranged such the upwardly projecting portion resides in the receiving recess when the lid is in the closed position.

Figure 60A:
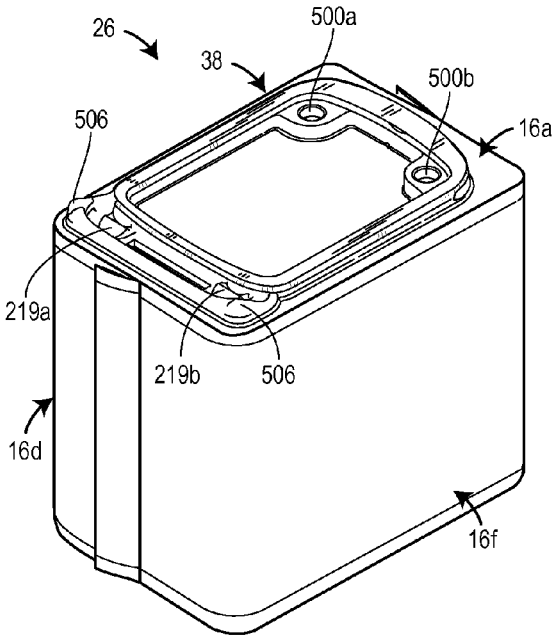
FIGS. 60A to 60C are a packaging assembly in accordance with an embodiment of the disclosure.
Figure 60B:
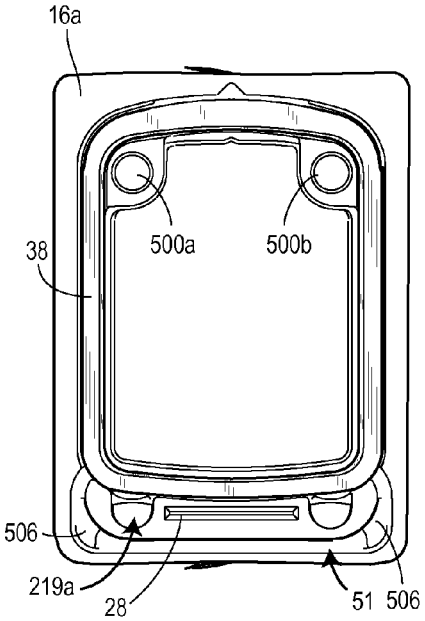
Figure 60C:
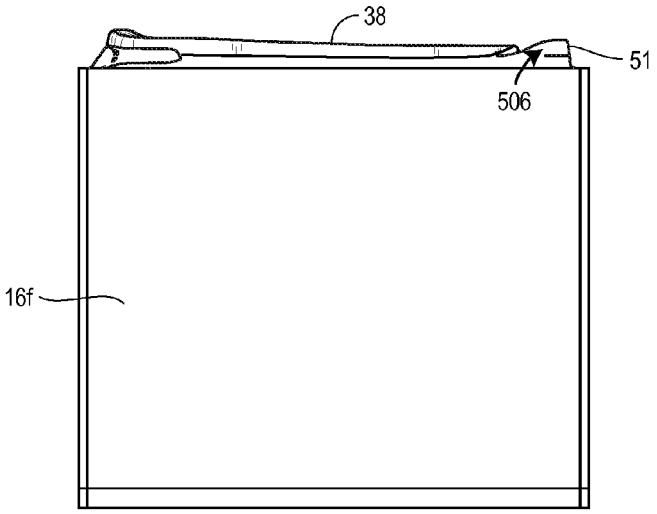
Figure 60H:
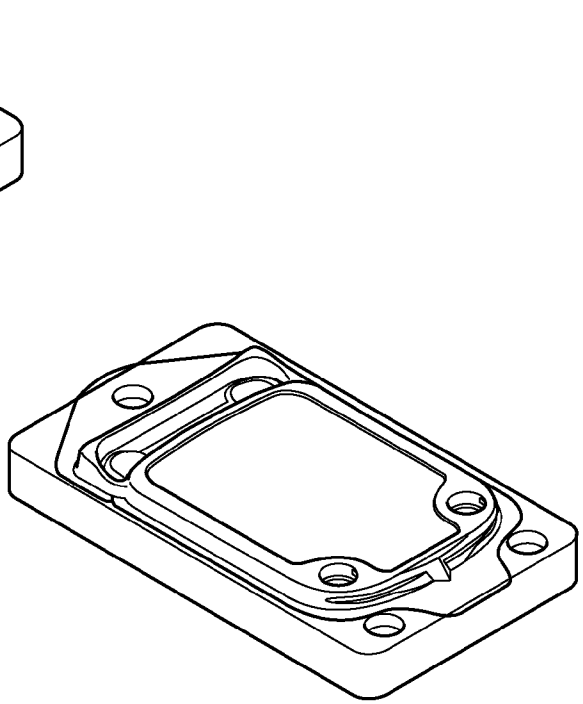
FIGS. 60D to 60H are an example forming die for an embodiment of the re-closable packaging assembly.
Figure 60F:
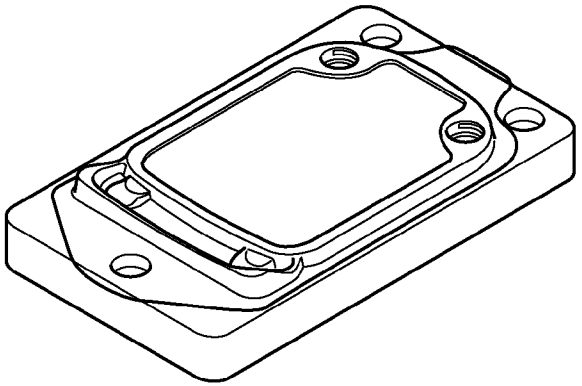
Figure 60G:
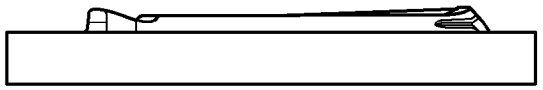
Figure 60D:
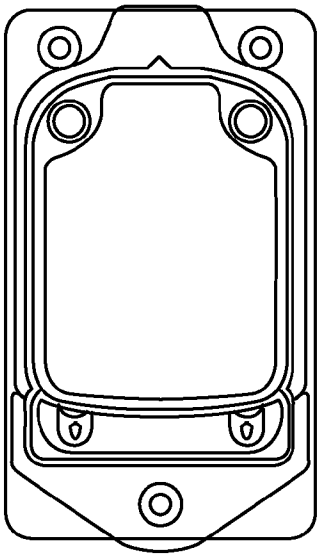
Figure 60E:
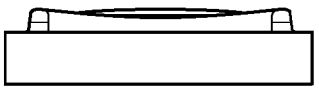
Figure 61A:
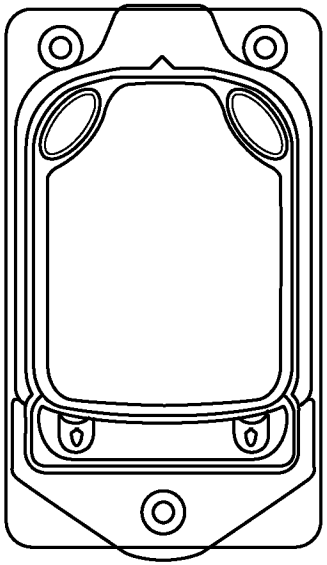
FIGS. 61A to 61E are an example forming die for an embodiment of the re-closable packaging assembly.
Figure 61B:
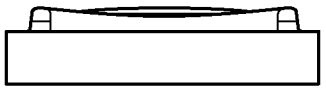
Figure 61C:
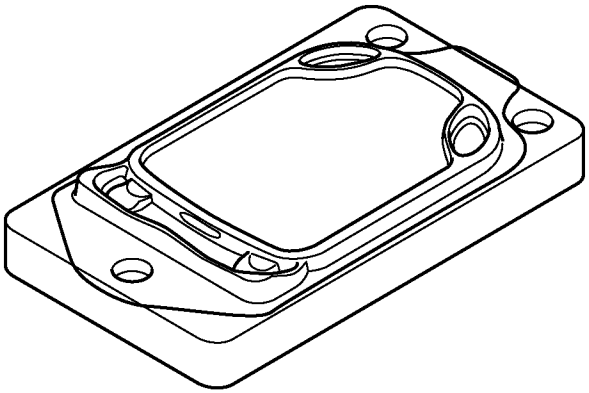
Figure 61D:
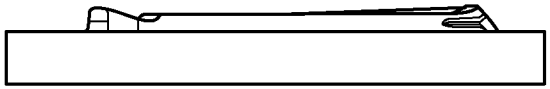
Figure 61E:
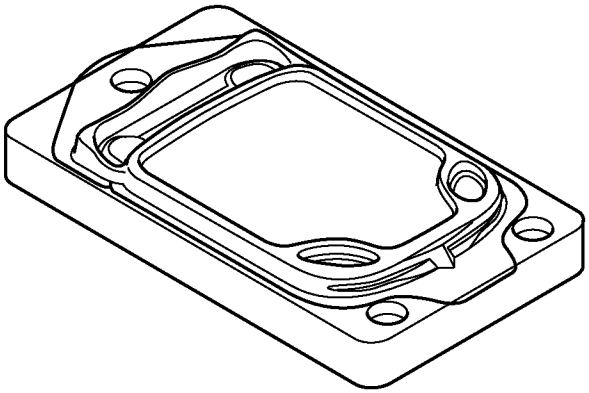
Figure 62A:
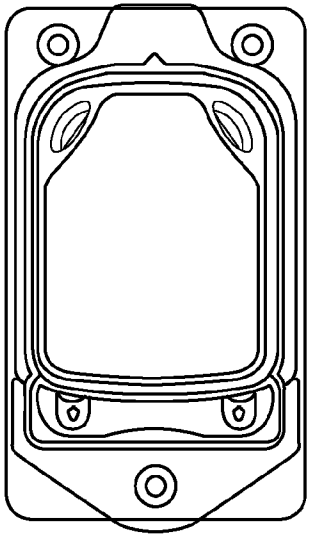
FIGS. 62A to 62E are an example forming die for an embodiment of the re-closable packaging assembly.
Figure 62B:
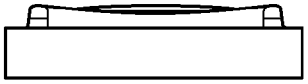
Figure 62C:
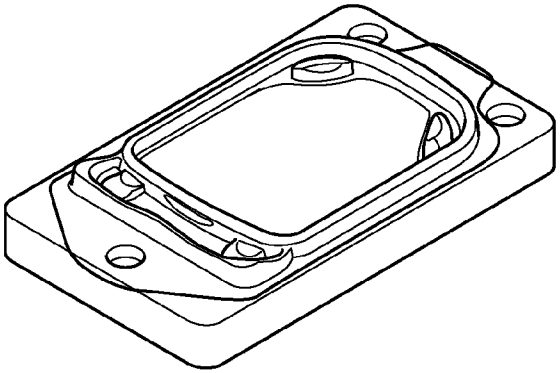
Figure 62D:
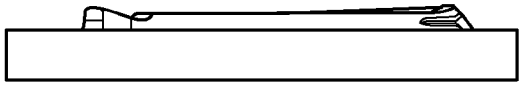
Figure 62E:
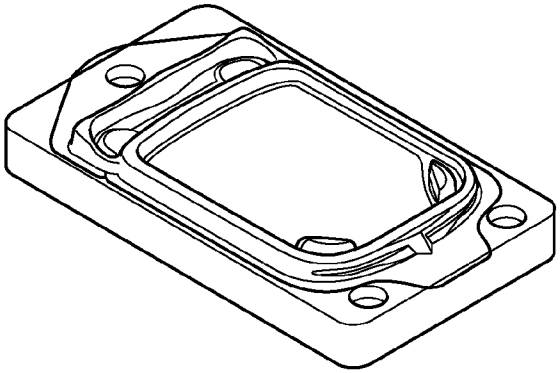
Figure 63A:
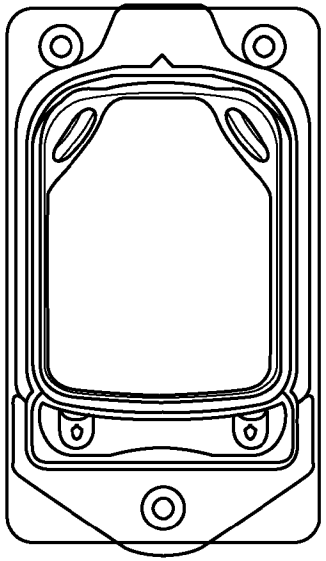
FIGS. 63A to 63E are an example forming die for an embodiment of the re-closable packaging assembly.
Figure 63B:
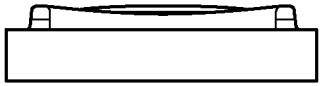
Figure 63C:
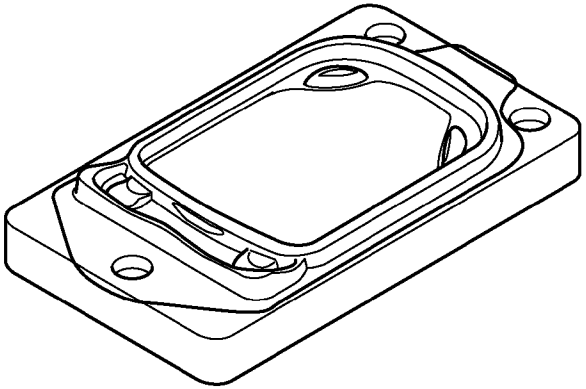
Figure 63D:
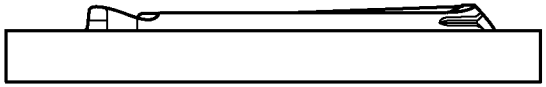
Figure 63E:
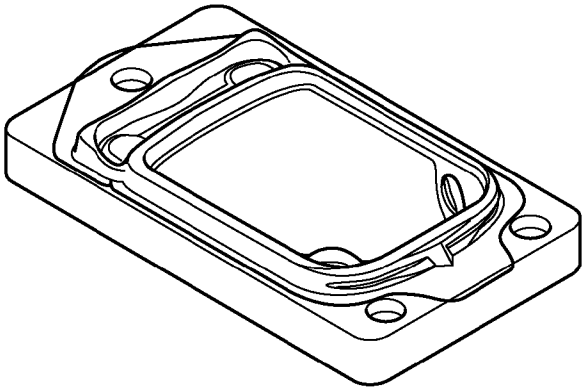
Figure 64A:
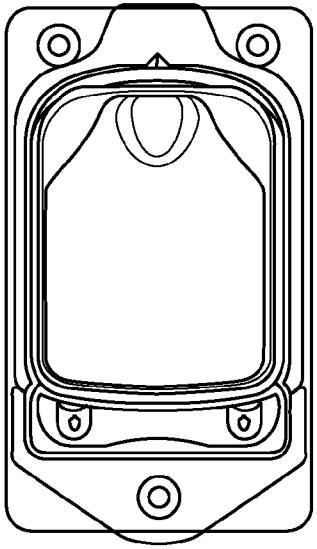
FIGS. 64A to 64E are an example forming die for an embodiment of the re-closable packaging assembly.
Figure 64B:
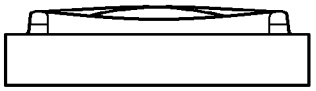
Figure 64C:
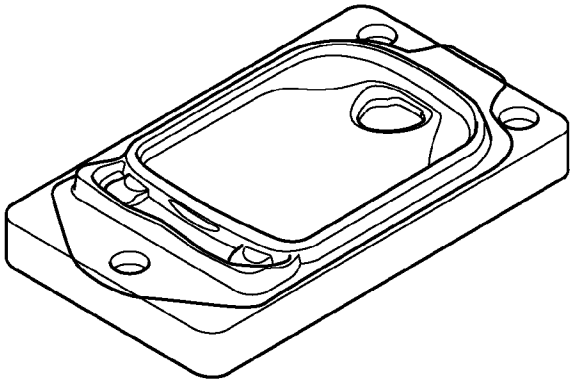
Figure 64D:
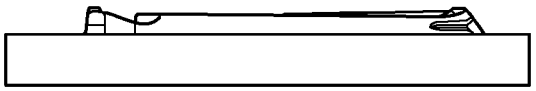
Figure 64E:
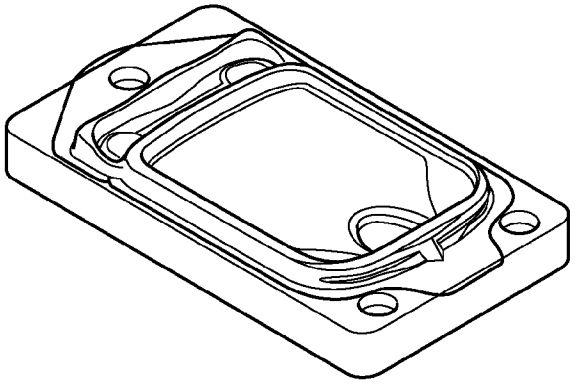
Figure 65E:
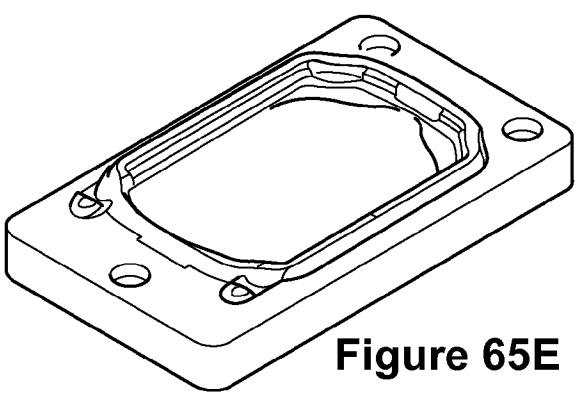
FIGS. 65A to 65E are views of an example forming die for an embodiment of a re-closable packaging assembly.
Figure 65F:
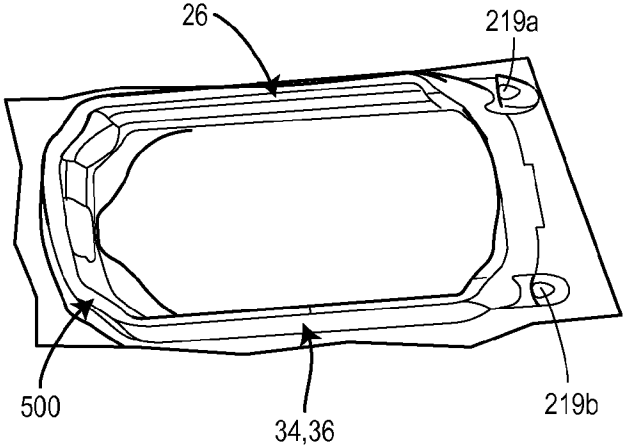
FIG. 65F is a top view of a lid member of a re-closable packaging assembly in accordance with an embodiment of the disclosure.
Figure 65D:
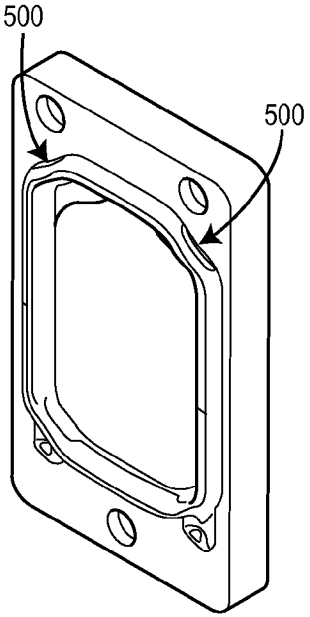
Figure 65A:
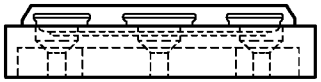
Figure 65C:
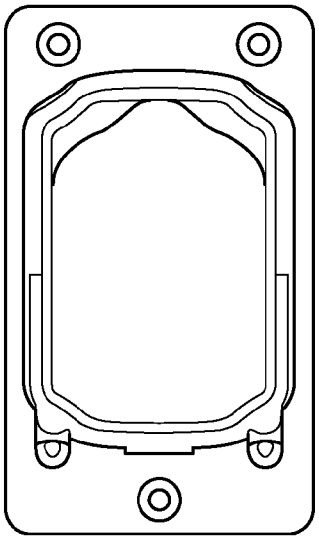
Figure 65B:
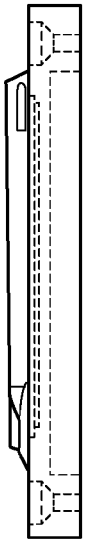

The lid member can include any number of closure features. For example, FIGS. 60A to 60C illustrates an embodiment having two closure features 500*a*, 500*b* disposed in the corners of the lid near the first end of the lid. The closure feature(s) 500 can be disposed in any suitable location of the lid to aid in securing the lid 26 in the closed position. For example, the closure feature 500 can be provided in a center region of the lid 26 (as illustrated for example in FIG. 70), or near an edge of the lid 26 (as illustrated for example in FIGS. 60 and 71). The closure feature 500 can have any suitable shape. For example, FIGS. 59A to 60C illustrate embodiments in which the closure feature has a circular shape. FIGS. 61A to 61E illustrates an embodiment in which the closure feature has an oblong shape. For example the closure feature can have any shape, including circular, elliptical, square, rectangular, triangular, or any other polygonal shape. FIGS. 64A to 64E illustrates an embodiment in which the closure feature 500 has a tear-drop shape that projects downwardly from the second sheet 416 towards the opening. The closure feature 500 can have increasing depth as it approaches the first end of the lid member 26, for example, as illustrated in FIGS. 64A to 64E.

Figure 6:
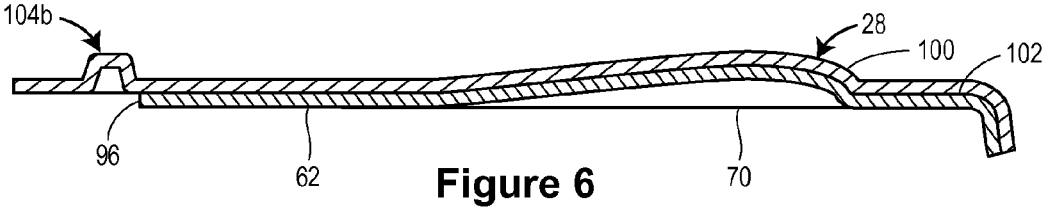
FIG. 6 is a sectional view of the lid member taken along line 6-6 of FIG. 2.

As illustrated in FIGS. 1, 6, and 8, the lid member 26 of the closure assembly 22 may include a convex portion 98 to provide structural support to the lid member 26. The convex portion 98 may extend from the second end 74 of the lid member 26 towards the first end 72, and a back edge 100 of the convex portion 98 adjacent to the second end 74 may comprise a portion of the hinge portion 28. More specifically, the lid member 26 may pivot about the back edge 100 of the convex portion to displace from the first position 30 to the second position 34. The back edge 100 may have the shape of a portion of an arc when viewed along the Z-axis, and the shape of the back edge 100 coupled with the shape of the convex portion 98 cooperate to maintain the lid member 26 in a rigidly erect position when in the second position 34. For example, the lid axis 70 may form an angle between 45 degrees and 125 degrees with the opening axis 52 when the lid member 26 is in the second position 34. Instead of an arc, the back edge 100 may include a plurality of arc segments or linear segments that form a zigzag pattern.

Figure 9:
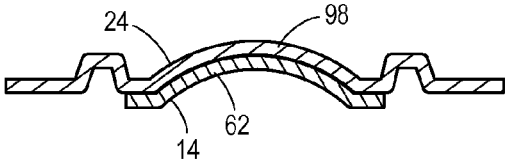
FIG. 9 is a sectional view of the lid member taken along line 9-9 of FIG. 2.

Referring again to FIGS. 1, 6, and 8, the convex portion 98 may have a parabolic shape or a substantially parabolic shape when viewed along the Z-axis of the reference coordinate system of FIG. 1. The convex portion 98 may be symmetrically formed along the lid axis 70, and the distance between a top surface of the first sheet 14 comprising the convex portion 98 and the lid axis 70 may gradually decrease as the convex portion 98 extends from the second end 74 of the lid member 26 towards the first end 72, as illustrated in FIG. 6. For example, the distance between a top surface of the first sheet 14 comprising the convex portion 98 and the lid axis 70 may gradually decrease as the convex portion 98 extends from the lid axis 70 towards the each of the first and second side edge 78*a*, 78*b*, as illustrated in FIG. 9. In addition, when view in cross-section along the lid axis 70; the convex portion 98 may have a curved or substantially curved shape. In alternative embodiments, the convex portion 98 may be have a generally triangle shape when viewed along the Z-axis of the reference coordinate system of FIG. 1, as provided in the illustrations of the thermoforming molds of FIGS. 17A to 17J.

Referring now to FIG. 1, the closure assembly 22 may include a support portion 102 that extends from the second end 74 of the lid member 26 towards the fourth side wall 16*e* of the container 12, and a portion of the support portion 102 adjacent to the second end 74 of the lid member 26 may comprise a portion of the hinge portion 28. The support portion 102 may be formed from the second sheet 24, and the all or a portion of the second sheet 24 of the support portion 102 may be secured to a portion of the first sheet 14 (e.g., the top wall 16*a* of the container 12) adjacent to the fourth side wall 16*e* of the container 12. The support portion 102 may structurally secure the lid member 26 to the container 12 and allow the lid member 26 to pivot about the hinge portion 28. A portion of the support portion 102 (either or both of the first sheet 14 and the second sheet 24) may extend from the hinge portion 28 through the gap between the fourth side wall 16*e* and the top wall 16*a* such that the portion of the first sheet 14 is disposed against a portion of the internal surface of the fourth side wall 16*e*. The support portion 102 may be partially defined by a pair of lateral edges 103*a*, 103*b* that may extend parallel to or substantially parallel to the first and second side edges 78*a*, 78*b* when the lid member 26 is in the first position 30. However, the distance between each of the pair of lateral edges 103*a*, 103*b* and the lid axis 70 may be less than the distance between the first and second side edges 78*a*, 78*b* and the lid axis 70.

Figure 10:
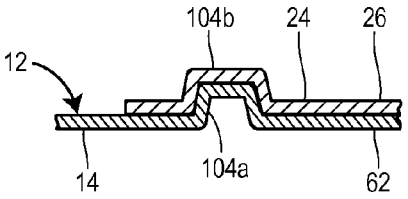
FIG. 10 is a partial sectional view of the first securement feature and the second securement feature of the embodiment of the re-closable packaging assembly of FIG. 1.
Figure 11A:
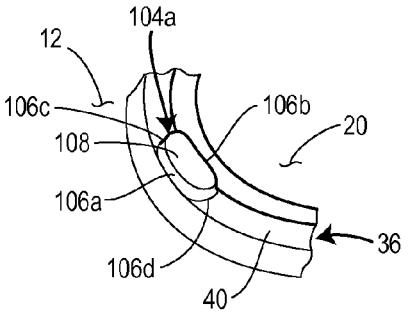
FIG. 11A is a partial isometric view of the first securement feature of the embodiment of the re-closable packaging assembly of FIG. 1.

As illustrated in FIGS. 1, 4, 6 and 7, the re-closable packaging assembly 10 may also include a first securement feature 104*a* and a second securement feature 104*b*. The first securement feature 104*a* may be a protrusion formed on the container 12, and the second securement feature 104*b* may be a cavity formed on the lid member 26 that is adapted to receive the first securement feature 104*a*, as illustrated in FIG. 10. More specifically, the first securement feature 104*a* may be an elongated protrusion formed along a portion of the ridge axis 64, and the protrusion may have a plurality of side walls 106*a*-*d* that extend vertically beyond the top wall 68 of the ridge 40, as shown in FIG. 11A. The first side wall 106*a* and oppositely-disposed second side wall 106*b* may be curved to correspond to the contour of the ridge axis 64, and the third 106*c* and fourth side walls 106*d* may each extend between the first 106*a* and second side wall 106*b*. The third 106*c* and fourth side walls 106*d* may have any suitable cross-sectional shape, such as curved, linear, a chevron, a triangle, or partially curved. A top surface 108 may be parallel or substantially parallel to and vertically offset from the top wall 68 of the ridge 40. All or part of any or all of the plurality of side walls 106*a-d* may be formed as an undercut. That is, the one or more side walls 106*a-d* or a portion of the one or more side walls 106*a-d* may form an acute angle with the top surface of the top wall 16*a* (i.e., the first sheet 14) of the container 12. Such an undercut will allow the lid member 26 to "positively" secure to the container 12. The undercut may also be formed on or into the first ridge 40.

Figure 11B:
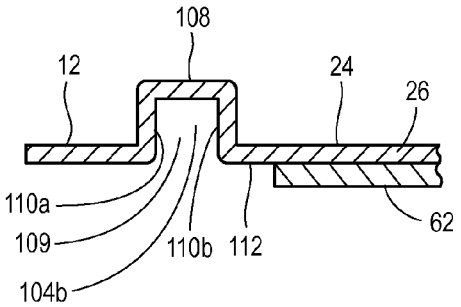
FIG. 11B is a partial sectional view of the second securement feature of the embodiment of the re-closable packaging assembly of FIG. 1.

As previously explained, the second securement feature 104*b* may be a cavity formed on the lid member 26. More specifically, the second securement feature 104*b* may be an elongated cavity 109 formed on an underside of a protrusion formed along a portion of the channel axis 84, and the cavity 109 may be adapted to receive the first securement feature 104*a*. As illustrated in FIGS. 2 and 11B, the cavity 109 may have a plurality of side surfaces 110*a-d* that each extend vertically upwards from a bottom surface 112 of the second sheet 24 of the lid member 26. A first side surface 110*a* and an oppositely-disposed second side surface 110*b* may be curved or contoured to correspond to the curved shape of the first side wall 106*a* and the second side wall 106*b*, respectively of the first securement feature 104*a*. Similarly, a third side surface 110*c* and a fourth side surface 110*d* may be shaped to correspond to the shape of the third 106*c* and fourth side walls 106*d* of the first securement feature 104*a*.

Referring to FIGS. 2, 8, and 11B, a top surface 114 may be parallel or substantially parallel to and vertically offset from the bottom surface 88 of the channel 42, and a vertical distance between the top surface 114 and the bottom surface 112 of the second sheet 24 of the lid member 26 may be greater than a vertical distance between the bottom surface 88 of the channel 42 and the bottom surface 112 of the second sheet 24. The first securement feature 104*a* may be dimensioned and sized such that the first securement feature 104*a* may be engaged (e.g., be received into) the second securement feature 104*b* to allow the lid member 26 to sealingly engage the container 12. All or part of any or all of the plurality of side surfaces 110*a-d* may be formed as an undercut. That is, the one or more side surfaces 110*a-d* or a portion of the one or more side surfaces 110*a-d* may form an acute angle with the bottom surface 112 of the second sheet 24 of the lid member 26. The undercut of the first securement feature 104*a* may engage a corresponding undercut on the second securement feature 104*b* to releasably lock or secure the lid member 26 to the container 12. Instead of an acute angle, a portion of the one or more side surfaces 110*a-d* may include a detent that starts 0.050" from the top surface 108, proceeds down and inward at a 45° angle for about 0.070", and transitions downward for 0.050", then down and outward at 35°. These dimensions are for illustrative purposes only, other dimensions may be suitable. One having ordinary skill in the art would recognize that a corresponding similar detent or protrusion may be formed on or in the first securement feature 104*a*.

In alternative embodiments, the first securement feature 104*a* may be a cavity formed in a channel 42 that may vertically extend downward from the top wall 16*a* of the container 12, and the second securement feature 104*b* may be a protrusion that may extend downwardly from the lid member 26 of the closure assembly 22. In the first position 30, the protrusion may be received into the cavity to allow the lid member to sealingly engage the container 12.

Figure 20A:
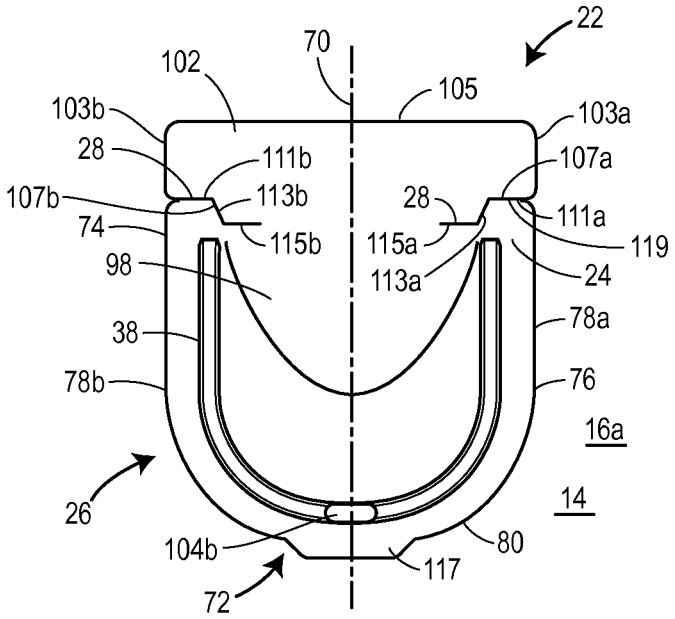
FIG. 20A is a top view of a closure assembly of a container of an embodiment of a re-closable packaging assembly.
Figure 20B:
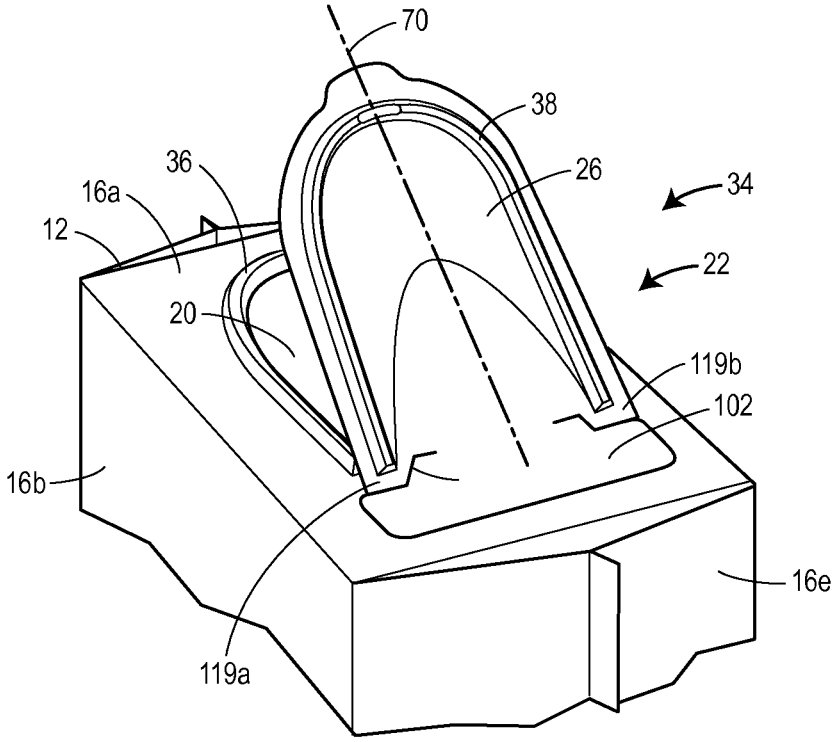
FIG. 20B is an isometric view of the closure assembly of the re-closable packaging assembly of FIG. 20A in a second position.
Figure 21:
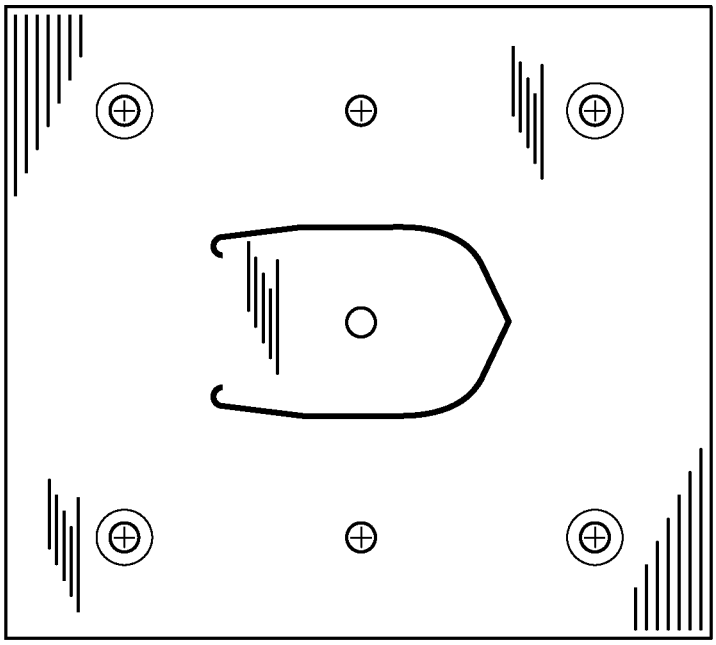
FIG. 21 is an example forming die for an embodiment of the re-closable packaging assembly.
Figure 22:
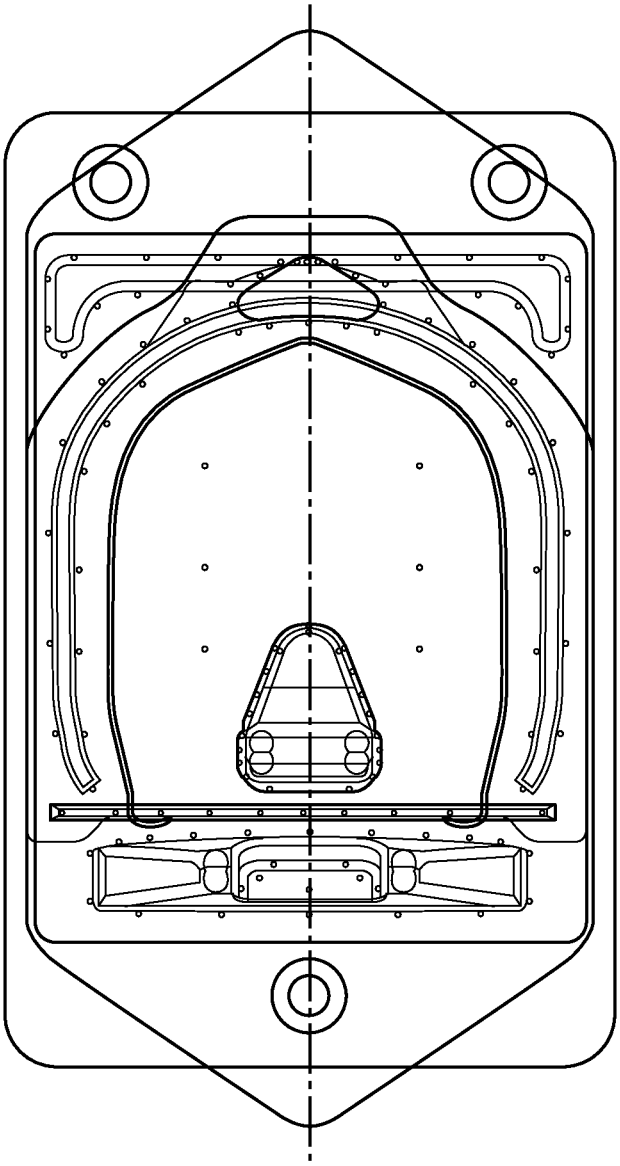
FIG. 22 is an example forming die for an embodiment of the re-closable packaging assembly.
Figure 23:
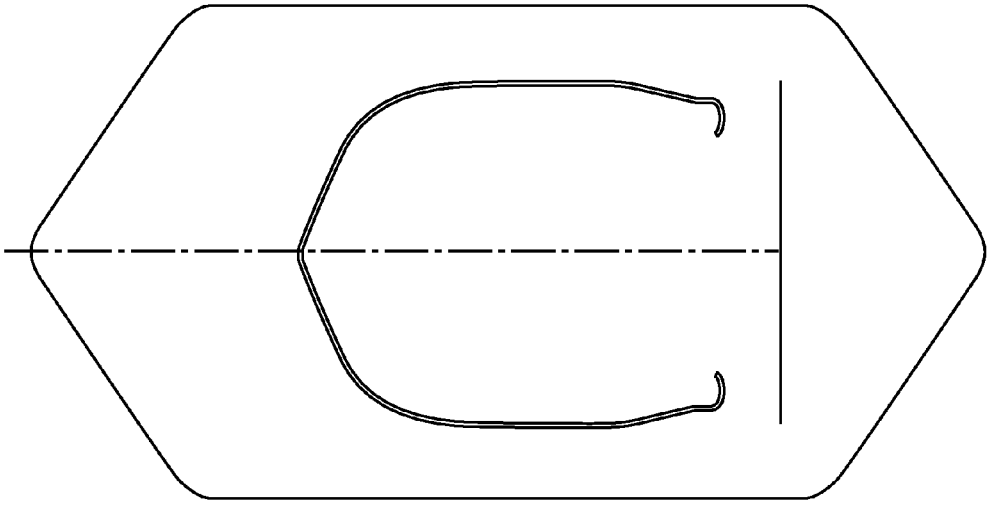
FIG. 23 is an example forming die for an embodiment of the re-closable packaging assembly.
Figure 24:
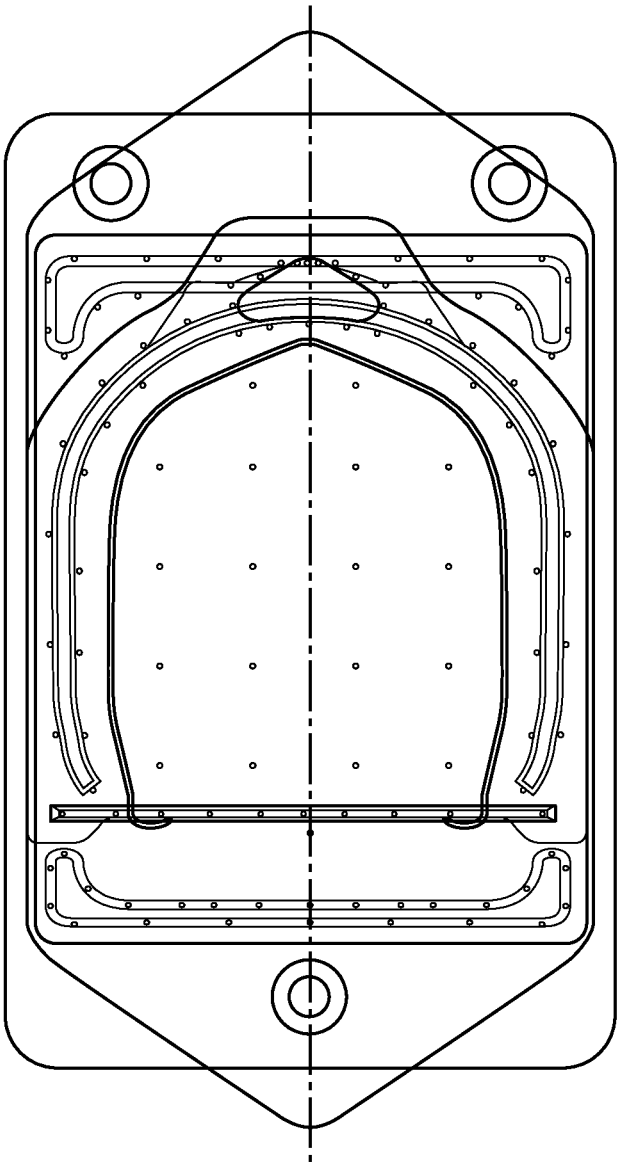
FIG. 24 is an example forming die for an embodiment of the re-closable packaging assembly.
Figure 25:
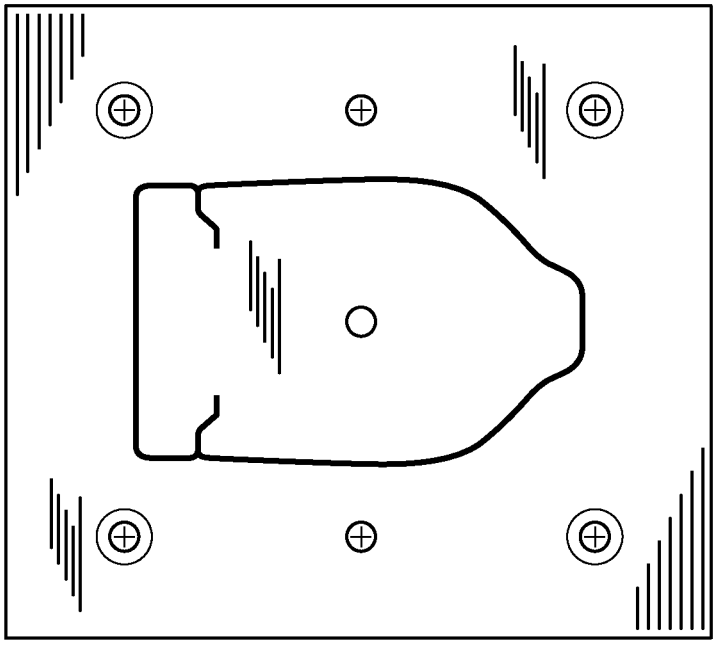
FIG. 25 is an example forming die for an embodiment of the re-closable packaging assembly.

An alternative closure assembly 22 is illustrated in FIGS. 20A and 20B. In this embodiment, the support portion 102 may be at least partially disposed on or secured to the top wall 16*a* of the container 12. When viewed parallel to the Z-axis of the reference coordinate system of FIG. 1, the support portion 102 may be defined by a pair of parallel lateral edges 103*a*, 103*b*, and a rear edge 105 extends between the lateral edges 103*a*, 103*b* such that the support portion 102 is disposed on the top wall 16*a*. Alternatively, a portion of the support portion 102 may be inserted through a gap between the top wall 16*a* and the fourth side wall 16*e*. The hinge portion 28 may include a pair of oppositely-disposed cuts 107*a*, 107*b* that may inwardly extend from each of the pair of parallel lateral edges 103*a*, 103*b* (and inward from the first and second side edges 78*a*, 78*b* of the lid member 26 adjacent to the second end 74 of the lid member 26). The cuts 107*a*, 107*b* may be symmetrical about the lid axis 70. Each of the cuts 107*a*, 107*b* may include a first segment 111*a*, 111*b* normal to the corresponding lateral edge 103*a*, 103*b*. A second segment 113*a*, 113*b* may obliquely extend from an end of the first segment 111*a*, 111*b* towards the first end 72 of the lid member 26. A third segment 115*a*, 115*b* may inwardly extend from a corresponding end of the second segment 113*a*, 113*b* parallel to the first segment 111*a*, 111*b*. A terminal end of the third segment 115*a*, 115*b* may be disposed a suitable distance from the lid axis 70 such that the lid member 26 may pivot from a first position 30 to the second position 34 about a portion of the closure member extending between a terminal end of each of the cuts 107*a*, 107*b* (i.e., a terminal end of each of the third segments 115*a*, 115*b*). Specifically, the lid member 26 may pivot from a first position 30 to the second position 34 about a crease or fold (that may be scored, perforated, or formed as a feature on the closure member 22) that extends between the terminal ends of each of the third segment 115*a*, 115*b*.

When the lid member 26 is pivoted into a second position 34 illustrated in FIG. 20B, a first lid projection 119*a* and a second lid projection 119*b* may snap, deform, or move to a position in which an edge formed by one of more of the segments 111*a*, 111*b*, 113*a*, 113*b*, 115*a*, 115*b* engages the support portion 102 to support the lid member 26 in the second position 34. Alternatively, the first lid projection 119*a* and the second lid projection 119*b* may remain stationary relative to the remainder of the lid member 25 when engaging the support portion 102 to support the lid member 26 in the second position 34. As the lid member 26 is pivoted from the first position 30 to the second position 34, the lid member 26 may deform (e.g., take on a cambered shape) to provide longitudinal rigidity to the lid member 26. The second position 34 may be a position that is intermediate between a first position (e.g., a closed position) and a fully open position (a third position) in which the lid member 26 or a portion of the lid member may be adjacent to a top portion of the fourth side wall 16*e*. In the second position, the lid axis 70 may form an angle with the top wall 16*a* of the container 12 (or with the position of the lid axis 70 when the lid member is in the first position 30) that is between 30° and 120°.

The hinge portion 28 including the cuts 107*a*, 107*b* may be used in embodiments in which the lid member 26 includes an underportion 62, and the cuts 107*a*, 107*b* may extend through each of the first sheet 14 (the underportion 62) and the second sheet 24. Alternatively, the cuts 107*a*,

107*b* may extend only through the second sheet 24 and not the underportion 62. The hinge portion 28 including the cuts 107*a*, 107*b* may also be used in embodiments in which the lid member 26 is formed of only the second sheet 24 (i.e., when the lid member 26 does not have an underportion 62). The cuts 107*a*, 107*b* may extend through the second sheet 24 (and, optionally, the underportion 62), partially through the second sheet 24 (and, optionally, the underportion 62), or a combination thereof. The cuts 107*a*, 107*b* may be continuous or may comprise cut segments and gaps between the segments. The cuts 107*a*, 107*b* may be perforated or scored (or any combination thereof).

The above-described hinge portion 28 that includes the cuts 107*a*, 107*b* can also be suitable for use in a package not including a lid member 26. For example, packages can generally include a re-sealable or re-closable label disposed on the first sheet 14, covering the opening 20. The hinge portion 28 as described above can be formed, as described above, in the re-sealable label to allow the re-sealable label to pivot about the hinge portion 22 and reside in a position that is intermediate from a closed position and a fully open position (i.e., the second position).

Figure 18:
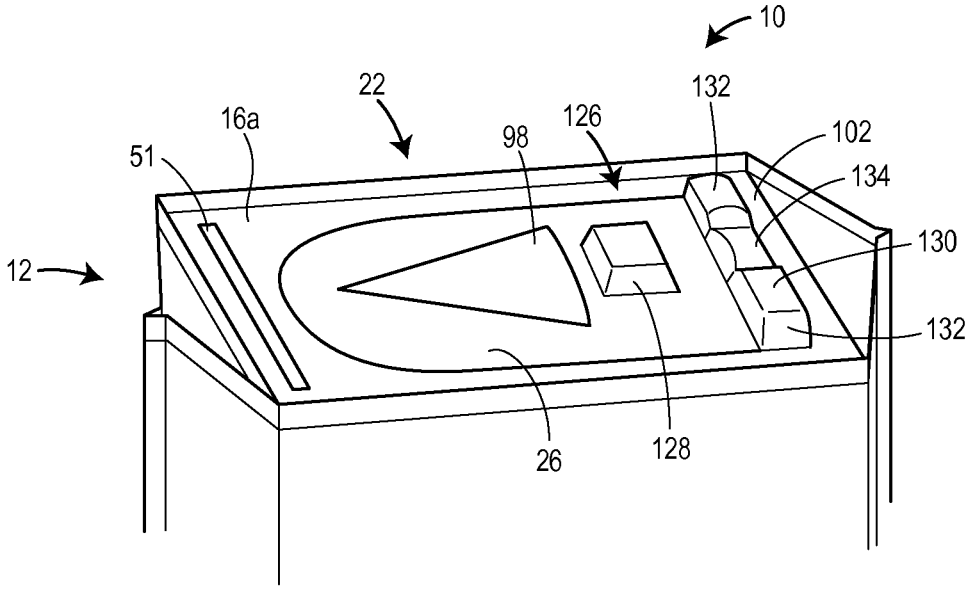
FIG. 18 is a partial isometric view a package having engagement features in accordance with an embodiment of the disclosure.
Figure 14A:
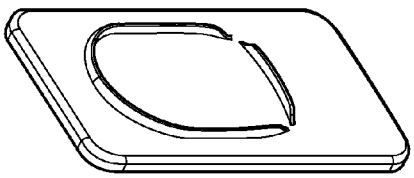
FIGS. 14A to 14H are various views of a mold used to form the first and second engagement features and the hinge portion on the container and the lid member.
Figure 14B:
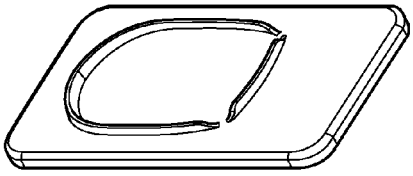
Figure 14C:
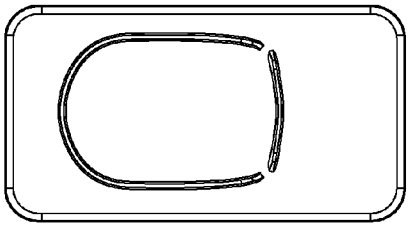
Figure 14D:
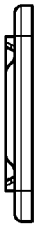
Figure 14E:
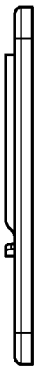
Figure 14G:
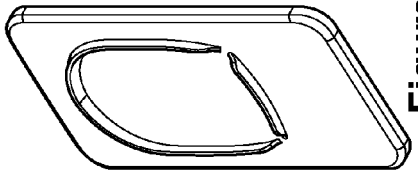
Figure 14H:
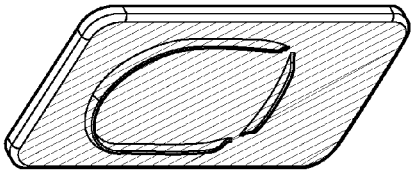
Figure 14F:
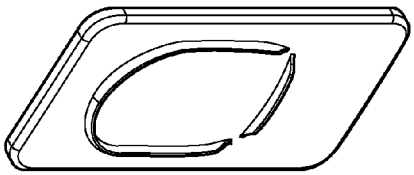
Figure 15A:
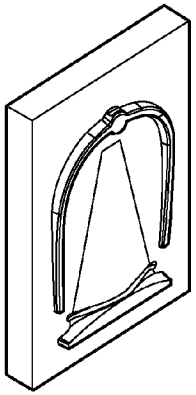
FIGS. 15A to 15H are various views of a mold used to form the first and second engagement features and the hinge portion on the container and the lid member.
Figure 15B:
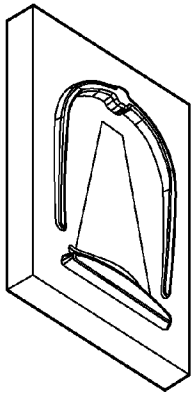
Figure 15C:
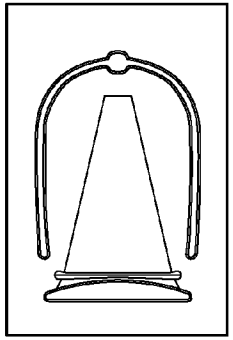
Figure 15D:
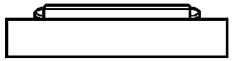
Figure 15E:
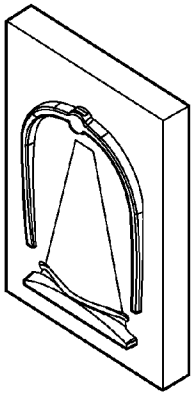
Figure 15F:
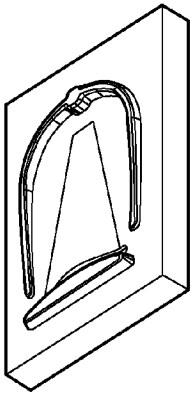
Figure 15G:
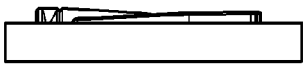
Figure 15H:
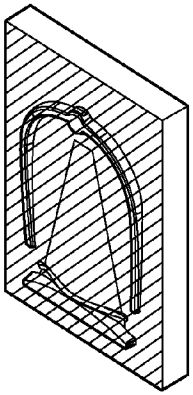
Figure 16A:
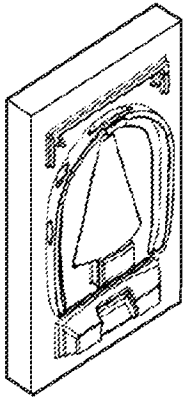
FIGS. 16A to 16I are various views of a mold used to form the first and second engagement features and the hinge portion on the container and the lid member.
Figure 16C:
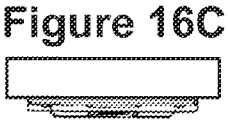
Figure 16B:
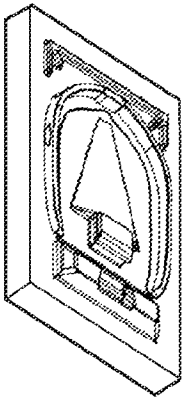
Figure 16D:
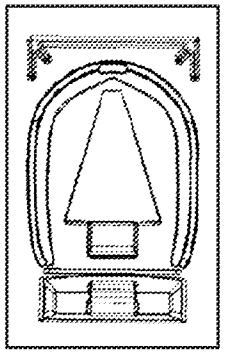
Figure 16E:
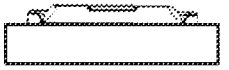
Figure 16H:
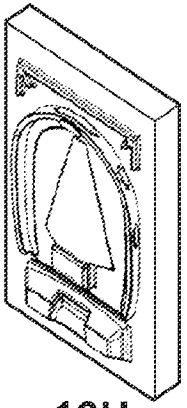
Figure 16F:
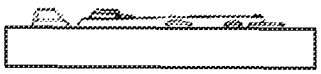
Figure 16G:
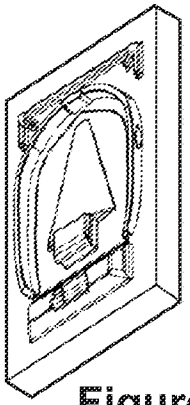
Figure 16I:
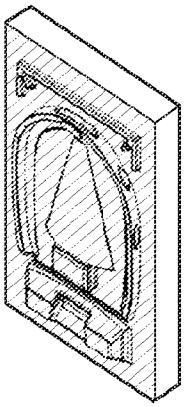
Figure 17I:
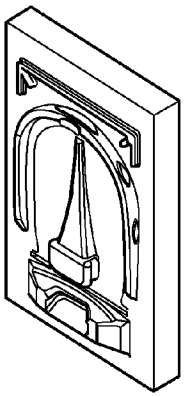
FIGS. 17A to 17I are various views of a mold used to form the first and second engagement features and the hinge portion on the container and the lid member.
Figure 17F:
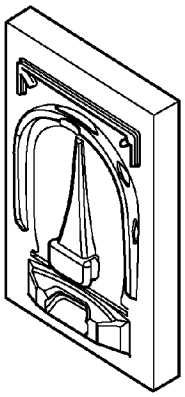
Figure 17G:
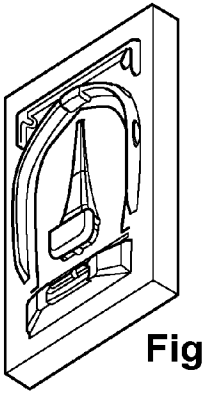
Figure 17H:
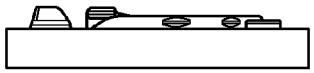
Figure 17C:
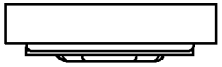
Figure 17D:
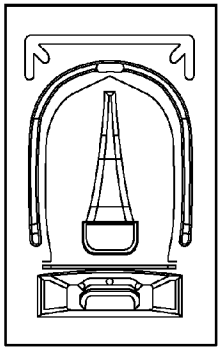
Figure 17E:
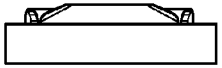
Figure 17A:
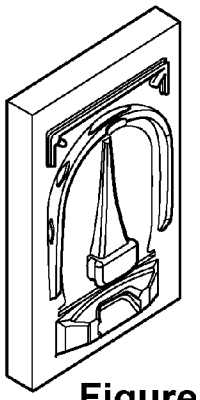
Figure 17B:
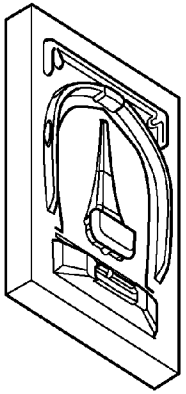
Figure 19A:
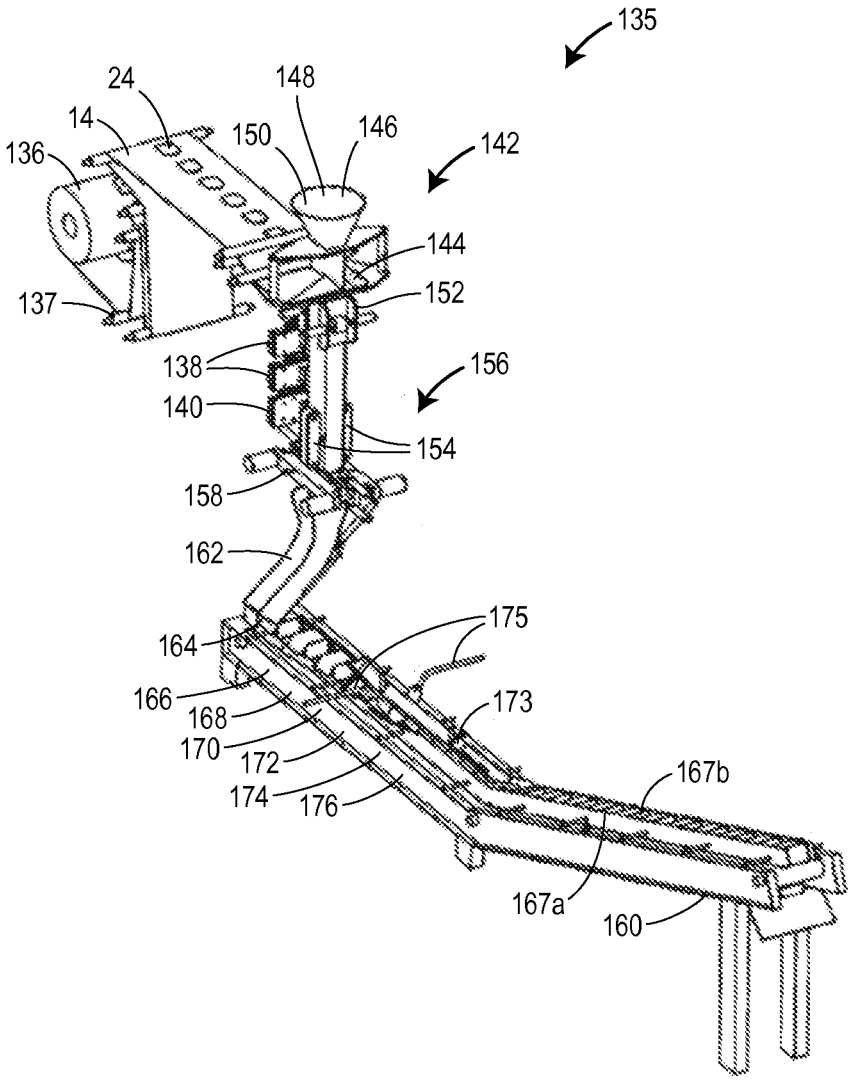
FIG. 19A is a first isometric view of an embodiment of a packaging machine used to manufacture an embodiment of a re-closable packaging assembly 10.
Figure 19B:
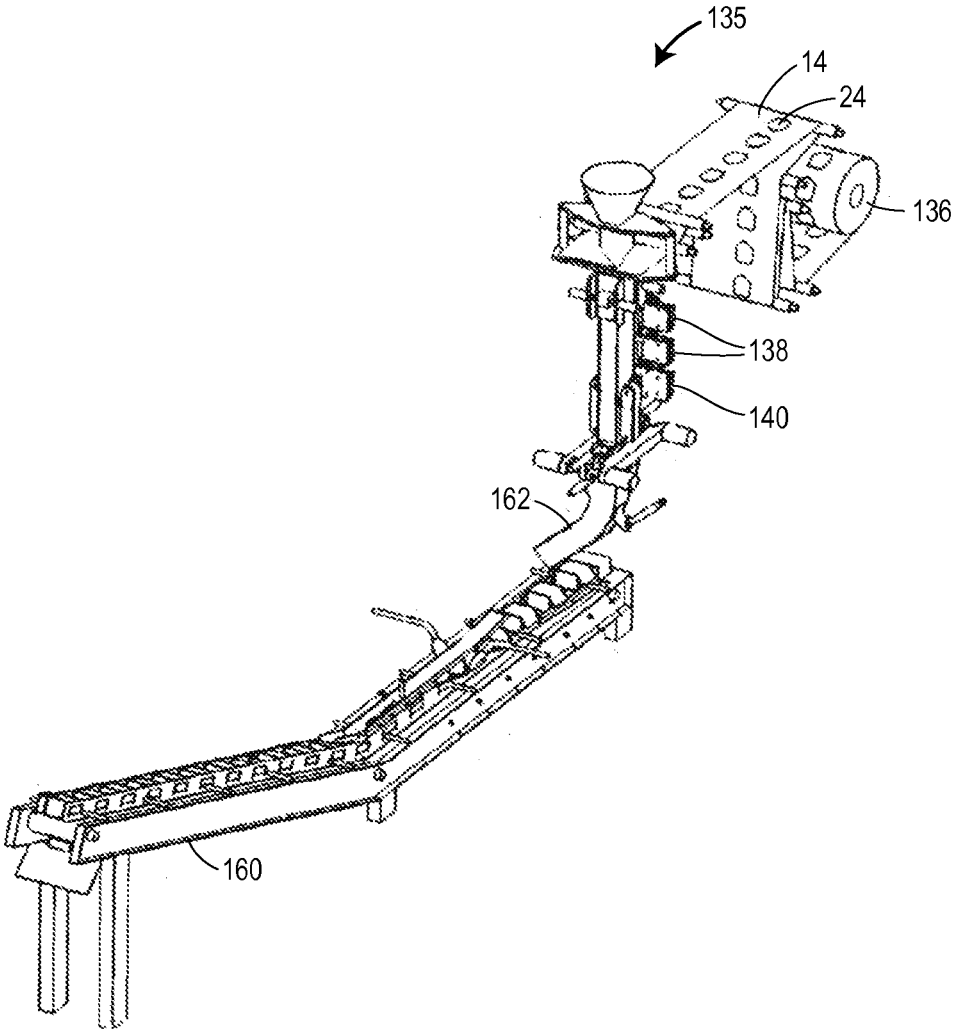
FIG. 19B is a second isometric view of the embodiment of the packaging machine illustrated in FIG. 19A.
Figure 19C:
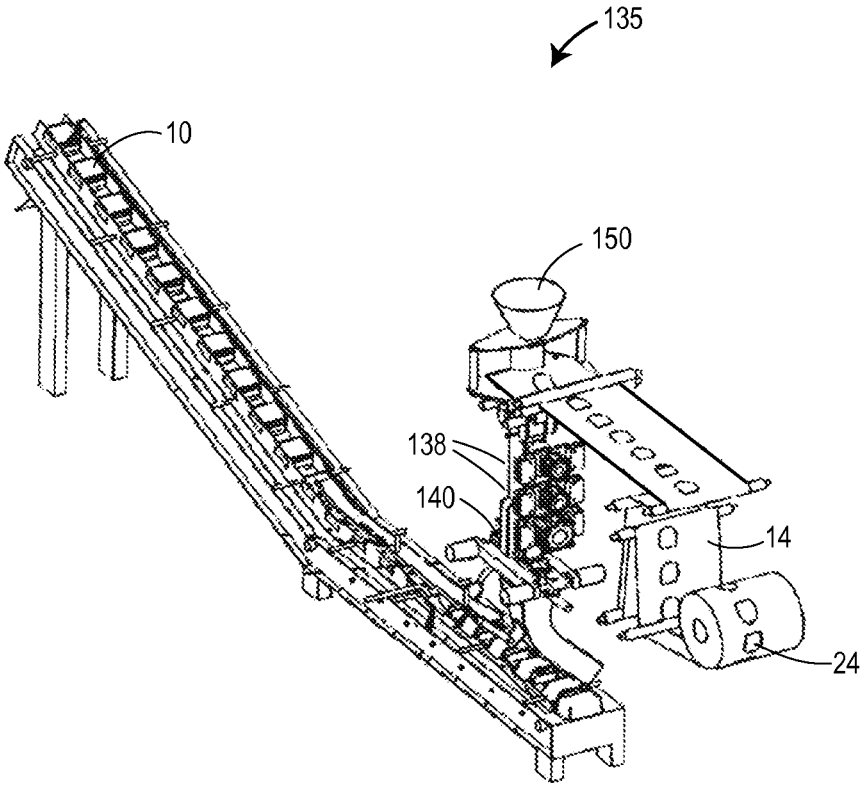
FIG. 19C is a third isometric view of the embodiment of the packaging machine illustrated in FIG. 19A.
Figure 19D:
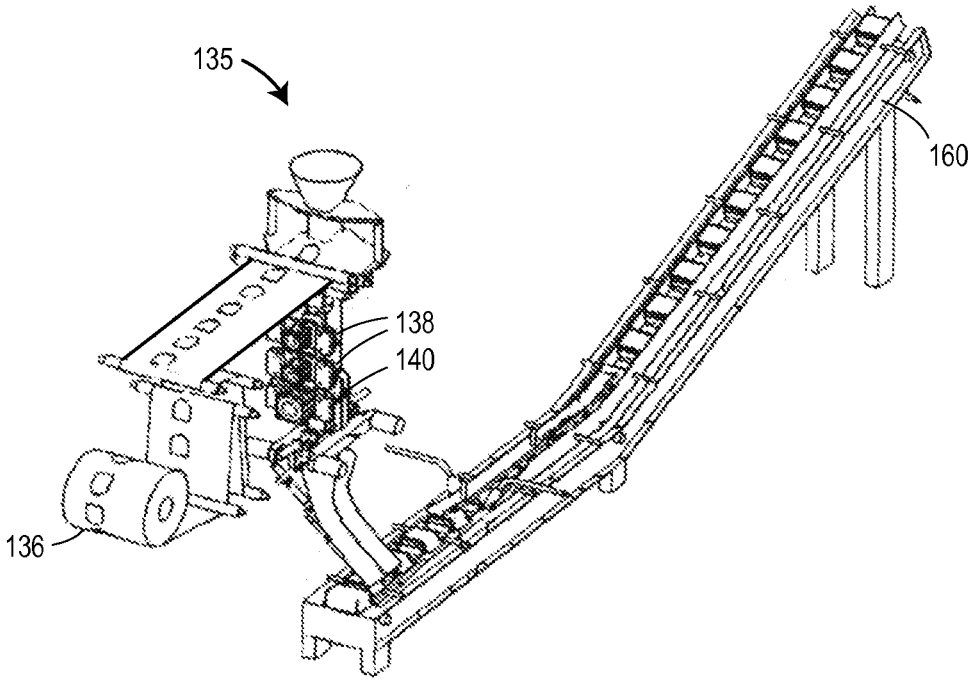
FIG. 19D is a fourth isometric view of the embodiment of the packaging machine illustrated in FIG. 19A.
Figure 19E:
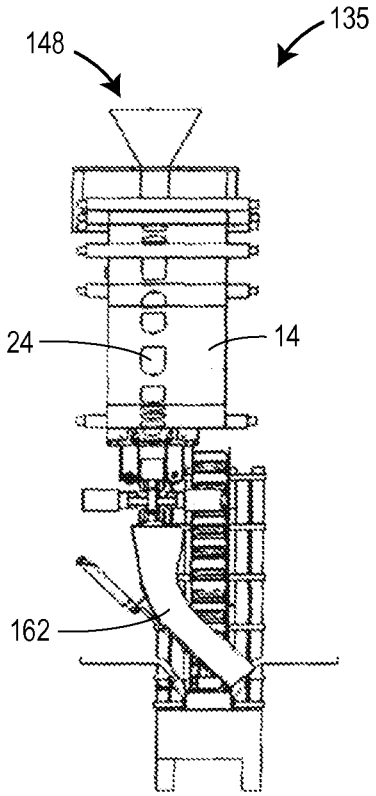
FIG. 19E is a front view of the embodiment of the packaging machine illustrated in FIG. 19A.
Figure 19F:
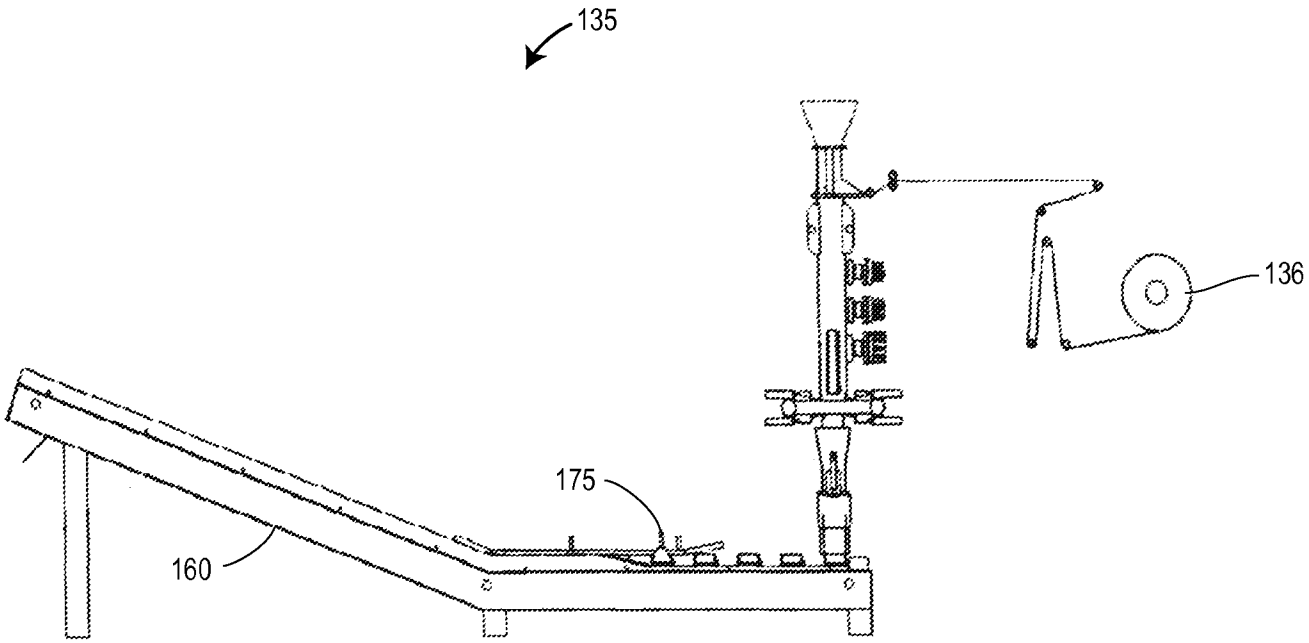
FIG. 19F is a side view of the embodiment of the packaging machine illustrated in FIG. 19A.

As illustrated in FIG. 18, the closure assembly 22 may include a locking mechanism 126 that includes a locking feature 128 that is received into a receiving feature 130 when the lid member 26 is in a fully open position. The locking feature 128 may be a protrusion that upwardly extends from the lid member 26, and the protrusion may have a rectangular, square, round, or any other suitable cross-sectional shape or combination of cross-sectional shapes. The receiving feature 130 may be formed in the support portion 102 (or in the container 12 itself) on an opposite side of the hinge portion 28, and the receiving feature 130 may include a pair of receiver protrusions 132 that are separated to form a receiving slot 134 therebetween. Each of the pair of receiver protrusions 132 may have a rectangular, square, round, or any other suitable cross-sectional shape or combination of cross-sectional shapes. The width of the receiving slot 134 is approximately equal to or slightly less than a corresponding width of the locking feature 128 such that the locking feature 128 (and, consequently, the entire lid member 26) is retained in the receiving slot 134 when the lid member 26 is pivoted about the hinge portion 28 such that the lid member 26 is in a fully open position. An undercut may be formed in the pair of receiver protrusions 132 and/or in the locking feature 128 to positively lock the locking feature 128 within the receiving slot 134. The locking mechanism 126 may be formed in a thermoforming operation using one of the molds illustrated in FIGS. 16A to 17J, for example.

Features For Retaining the Lid or Resealable Flap in an Open Position

Figure 27:
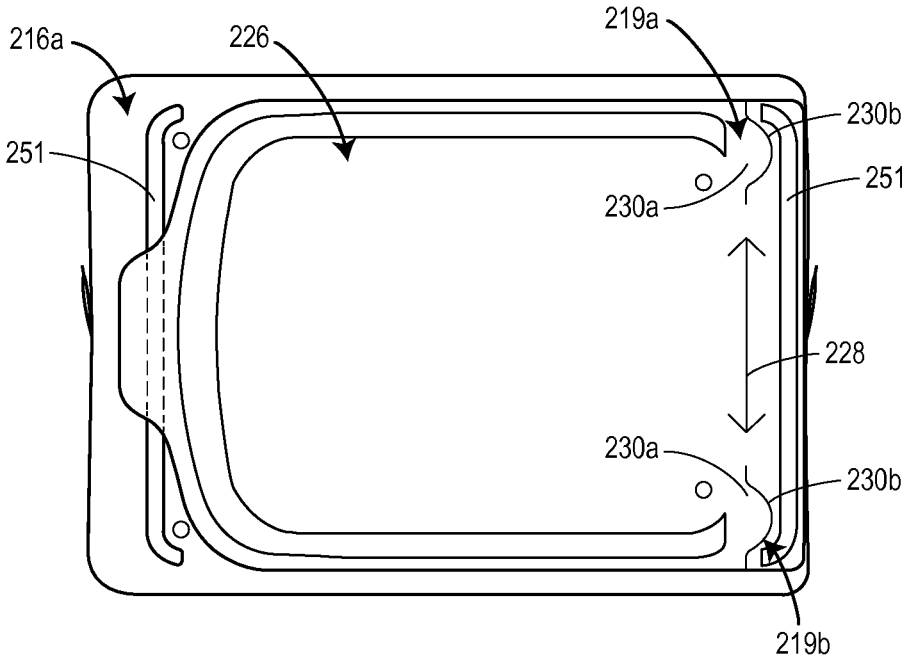
FIG. 27 is a top view of the container of FIG. 26, illustrating the closure assembly of a container in accordance with an embodiment of the disclosed packaging assembly
Figure 28:
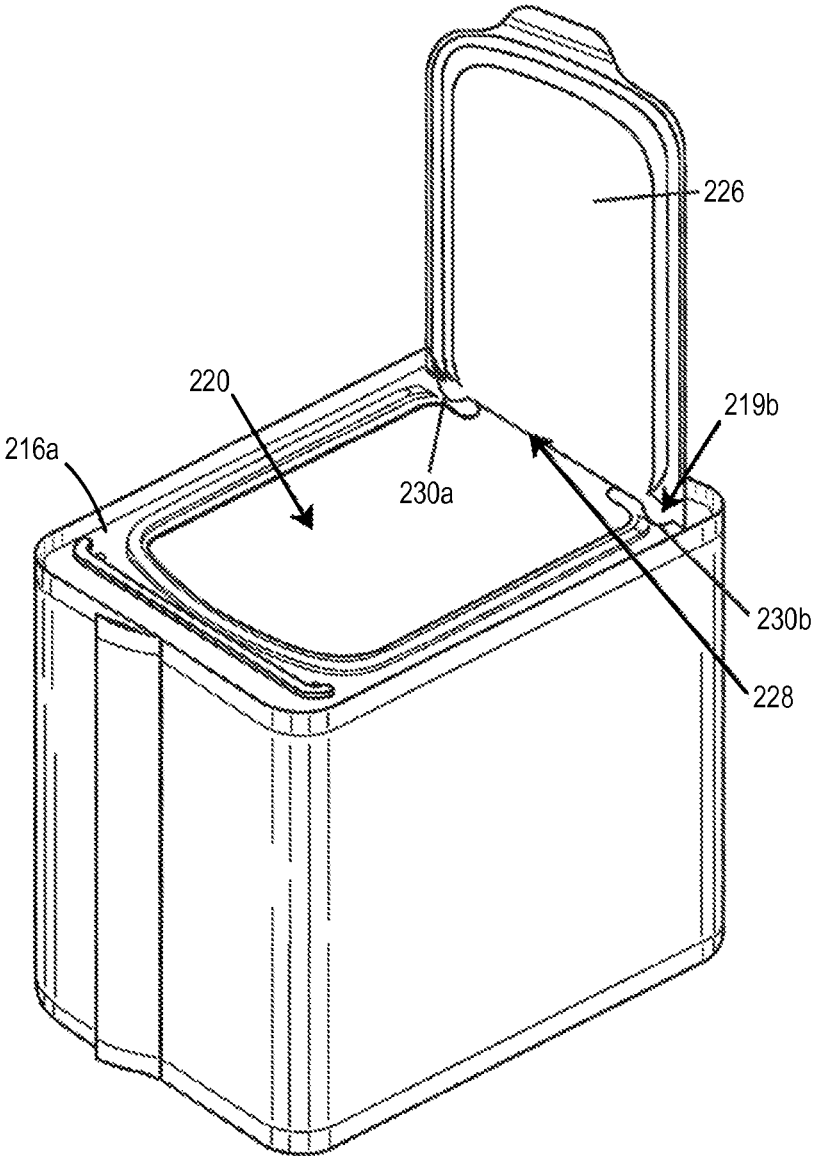
FIG. 28 is a perspective view of a package assembly of FIG. 26, illustrating the lid in the open position.

In various embodiments, the closure assembly or resealable flap can include features disposed on the lid member that retain the lid member in an open position (second position), which can facilitate access to the package. Referring to FIG. 26, the lid member 226 can include first and second projections 219*a*, 219*b* that pivot upon opening of the lid member 226 from a first (closed) position to the second (open) position. While description below is provided with respect to the lid including two projections, it should be understood that the lid can include any suitable number of projections, including a single projection or greater than two projections. The projection or projections facilitate retaining the lid member 226 in the second position. The first and second projections 219*a*, 219*b* can be disposed in the region of the hinge portion 228 of the lid member 226 and are positioned so that the axis of the hinge lies between the projections and the distal end of the lid 226. Referring to FIG. 27, the first and second projections 219*a*, 219*b* each have a first end 230*a* and a second end 230*b*. The projections are formed by cuts in the lid member such that the first end 230*a* of the projections 219*a*, 219*b* remain attached to the lid member 226 and the second end 230*b* and periphery of the projections 219*a*, 219*b* can detach from a portion of the second sheet 224 and pivot from a first position to a second position when the lid member 226 is moved from the first position to the second position. In the first position, the lid projections 219*a*, 219*b* can be generally disposed parallel to the top wall 216*a* of the package. Referring to FIG. 28, in the second position the lid projections 219*a*, 219*b* can be positioned generally perpendicular to the top wall 216*a* of the package 212, with the second end 230*b* of each lid projection 219*a*, 219*b* being in contact with the top wall 216*a*, thereby retaining the lid member 226 in the second position. For example, the friction between the projections 219*a*, 219*b* and the top wall 216*a* can resist the lid from closing by gravity force. The friction interference between the projections 219*a*, 219*b* can be a function of how far the top wall 216*a* is deflected by the projections 219*a*, 219*b* during movement from the first to second position. The amount of friction is sufficient to retain the lid 226 in the second position, but can be overcome without damage to the projections 219*a*, 219*b* to return the lid and the projections to the first (closed position).

Figure 29:
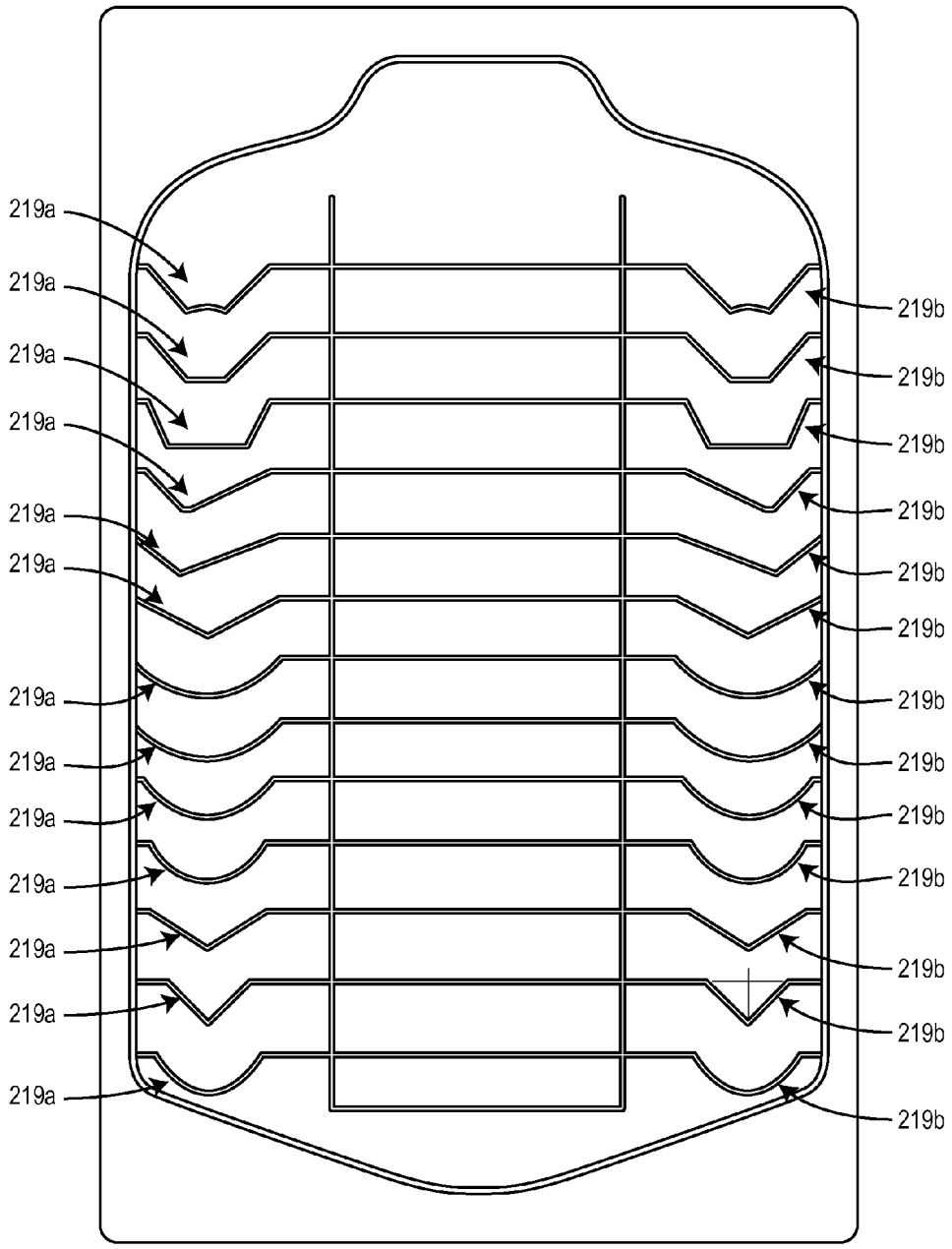
FIG. 29 is a schematic illustrating embodiments of first and second projections of a closure assembly in accordance with embodiments of the disclosure.

The first and second projections 219*a*, 219*b* can have any suitable shape, such as for example, semi-circular, triangular, semi-hexagonal, and "W-shaped". FIG. 29 is a schematic illustration of the region of hinge portions 228 of lid members 226 having differently shaped and sized projections 219*a*, 219*b*. In various embodiments, the first and second projections 219*a*, 219*b* have the same shape and the same size. In some embodiments, the first and second projections 219*a*, 219*b* can have different shapes and/or different sizes.

The first and second projections 219*a*, 219*b* have a length between the first and second ends such that upon pivoting of the lid, the first and second projections 219*a*, 219*b* move from the first position to the second position, the first and second projections 219*a*, 219*b* can contact the top wall 216*a* at least at their respective second edges 230*b*. The length of the projections 219*a*, 219*b* can be adjusted to tailor the amount of force acting on and resultant deflection of the top wall 216*a* by the projections 219*a*, 219*b*. In various embodiments, the first and second projections 219*a*, 219*b* have a length such that the projections 219*a*, 219*b* do not excessively bend or deform during movement from the first and second positions and can retain sufficient stiffness to retain the lid member 226 in the second (open) position.

Referring to FIG. 30, the first and second projections 219*a*, 219*b* can have any suitable width or diameter. In various embodiments, the width of the projections 219*a*, 219*b* are selected such that the cuts in the lid member 226 for forming the projections 219*a*, 219*b* do not overlap with cuts in the first sheet and the underportion (if provided) for forming the opening in the package. By arranging the various cuts in such a fashion, the package can be provided such that there is no opening in the package that is not covered by the lid member.

The top wall of the container can include one or more features disposed below the first and second projections to aid in movement of the projections. The features can be formed, for example, when forming, such as by thermoforming, the engagement and/or any other closure features, on the lid. For example, the top wall can include one or more ridges upon which the first and second projections can slide and ultimately reside against to aid in maintaining the lid member in the open position.

Referring to FIGS. 59-64, 70 and 71, the lid member can include additional features to aid in retaining the lid in an open position and/or to add additional rigidity to the lid member. For example, the lid can include a rib projecting upward from the top wall of the container. The lid can include corner portions 506 having a thickness greater than a center portion disposed between the corner portions. The varying thickness of the rib 51 and the location of the rib 51 relative to the channel 42 can be arranged such that a back region of the channel resides in the center portion when the lid member 26 is in the open position. The lid member 26 can further include cut portions adjacent the back region of the channel that are adapted to reside on the raised corners of the rib when the lid member is in the open position.

Referring to FIG. 65, in various embodiments, the lid member can be free of such additional features, which can beneficially maximize the opening of the package. FIGS. 65A-E illustrate a mold for forming the lid 26 and FIG. 65F illustrates a lid formed using the mold of FIGS. 65A-E. As illustrated in FIG. 65, the hinge 28 about which the lid 26 pivots can be disposed closely adjacent an end, for example the second end, of the lid member 26. The first and second engagement features 34,36 can be channels and a corresponding ridge defining the perimeter of the opening. The lid 26 can further include projections 219 (described above) to aid in retaining the lid 26 in an opening position.

The lid 26 can also include one or more closure features 500 to help retain the lid in the closed position. Any of the closure feature as discussed above can be used. FIG. 65 illustrates an embodiment in which undercuts are positioned in the corners of the lid to aid in closure.

Referring to FIGS. 67A to 67E, illustrates an embodiment of the lid channel having a hexagonal shape, with corner regions 508 of the lid 26 being substantially flat or having a subtle curvature. The corners can be angled for example from about 30 degrees to about 60 degrees, about 30 degrees to about 45 degrees, about 30 degrees to about 35 degrees. Other suitable values for the angle of the corner include, for example, about 30, 31, 32, 33, 34, 35, 36, 37, 38, 39, 40, 41, 42, 43, 44, 45, 46, 47, 48, 49, 50, 51, 52, 53, 54, 55, 56, 57, 58, 59, and 60 degrees. Locking mechanisms 510, provided as undercuts in the corner regions, can be provided to aid in retaining the lid in the closed position.

Figure 70:
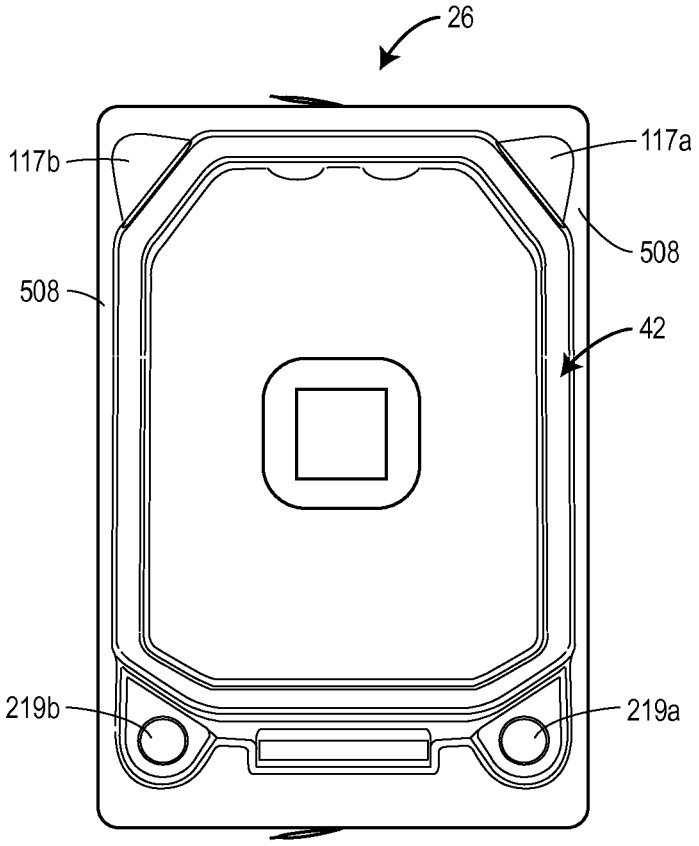
FIG. 70 is a schematic illustration of a forming die for forming an embodiment of the reclosable packaging assembly.
Figure 71A:
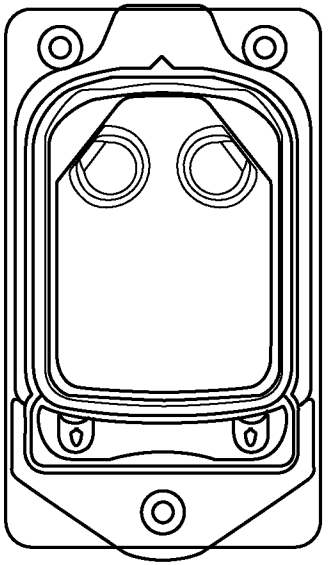
FIGS. 71A to 71E are schematic illustrations of a forming die for forming an embodiment of the reclosable packaging assembly.
Figure 71B:
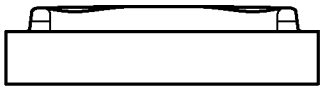
Figure 71C:
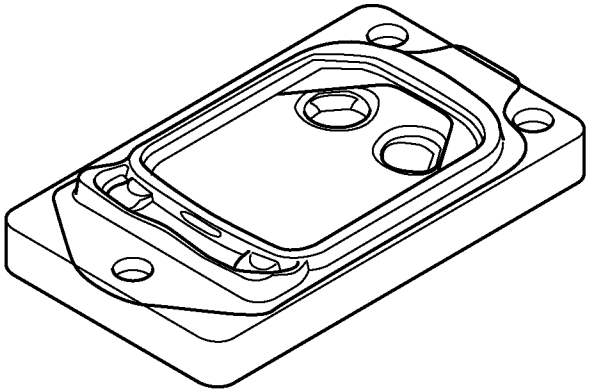
Figure 71D:
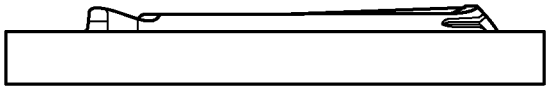
Figure 71E:
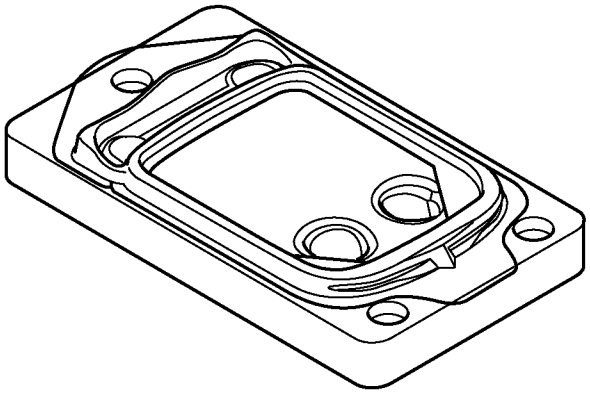

In various embodiments, the lid can be provided with a pull tab disposed in the corner region 508 of the lid 26, as opposed to a center portion of the lid 26. It should be understood herein that lids in accordance with the disclosure can include one or more pull tabs 117 disposed in any location of the lid 26. Without intending to be bound by theory, it is believe that providing a pull tab 117 in a corner region 508 of the lid 26 can facilitate opening of the lid 26, by reducing the amount of mechanical closure force of the lid 26 that must be overcome to open the package as compared to a pull tab 117 disposed in center region of the lid 117. It has been observed that by providing a pull tab 117 in the corner 508 the mechanical force to open the container can be reduced from approximately 1000 grams of mechanical force for a center pull tab to 150 grams mechanical strength. The embodiment of FIG. 70 illustrates an embodiment having two pull tabs 117*a*, 117*b* disposed at opposite corners 508 of the front of the lid 26. Any suitable number of pull tabs, including zero or a single, pull tab can be provided on packages in accordance with embodiments of the disclosure.

Referring to FIGS. 68A to 68E, the lid 26 can have a center portion 512 with a curvature extending downwardly (concave) into the interior of the package. The concave center portion 512 can provide the package, and particularly, the lid 26 with increased resistance from opening due to internal pressure in the container. For example, during shipping the packages may experience different pressure environments, even been subject to significant vacuum pressure. The concave portion of the lid can provide some tolerance of the lid for such pressure changes that may be experienced during, for example, shipping.

Figure 69B:
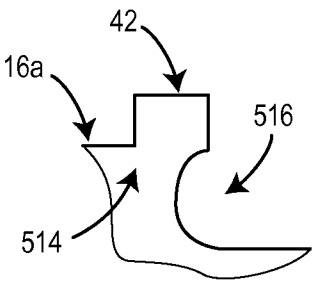
FIG. 69B is a cross-sectional illustration of a closure assembly in accordance with an embodiment of the disclosure, illustrating an recessed groove on an inner wall of the channel for improved sealing when the lid is in the closed positions.
Figure 69A:
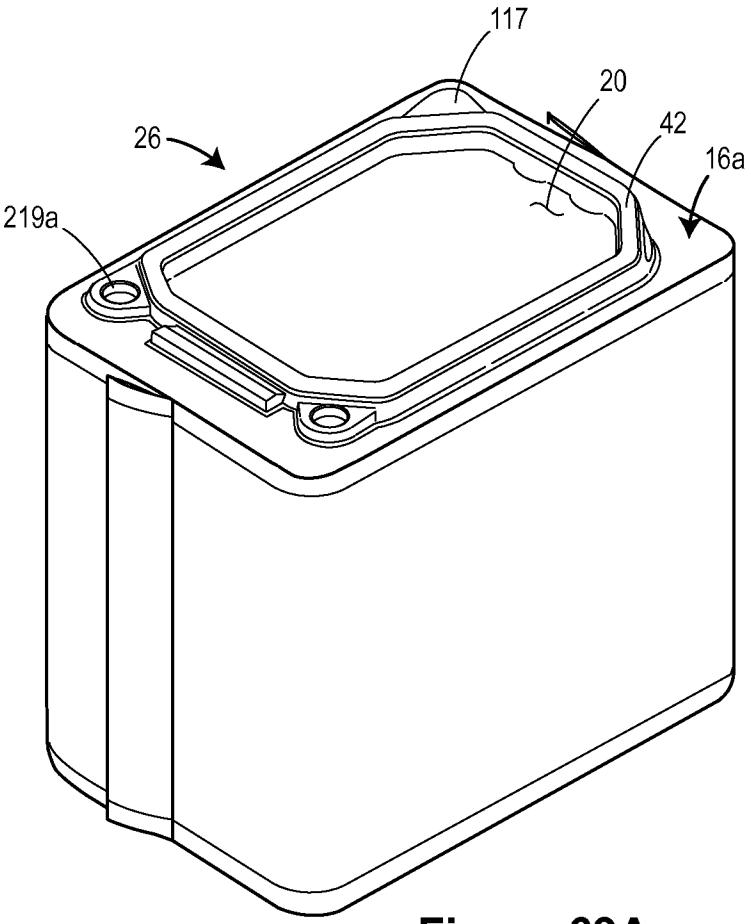
FIG. 69A is a schematic illustration of a reclosable package assembly in accordance with an embodiment of the disclosure.

Additionally, referring to FIGS. 68 and 69A and 69B, by providing the lid with a downward concave portion 512, a portion of the lid can be disposed below the top surface of the opening panel region and can interact with the side wall 512 of the channel below the top surface of the opening panel region. The side wall 514 of the channel can be provided with a recesses grove 516 disposed around all or a portion of the opening into which a corresponding projection on the edge of the lid can reside when the lid is in the closed position. This can enhance the sealability of the lid and the resistance of the lid to accidental opening when dropped or otherwise during handling, shipping, or storage.

Referring again to FIG. 27, a hinge portion 228 of the lid 226 is disposed between the first and second projections 219*a*, 219*b*. In one embodiment, the hinge portion 228 is disposed in line with the first end of the projections 230*a*. The hinge portion 228 can be provided by a cut in the lid. The cut defining the hinge portion extends between but does not overlap with the cuts defining the first and second projections. The cut can have a length such that the cut for the hinge portion also does not overlap with cuts in the first sheet 214 and the underportion 262 (if provided) for defining the opening 220 of the package 212.

The above described first and second projections 219*a*, 219*b* and associated hinge portion 228 can be incorporated into embodiments of the package 212 including either the formed lid or the unformed lid in which a portion of the second sheet 224 removably attaches to the first sheet 214 to cover the opening 220 of the package 212.

Figure 13:
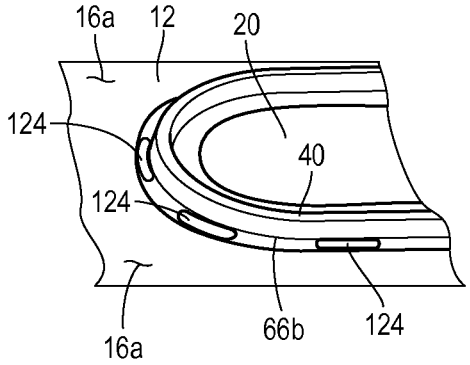
FIG. 13 is a partial isometric view of the first engagement feature of an embodiment of the re-closable packaging assembly.

One or more additional features may be disposed on the ridge 40 of the first engagement feature 36 to further secure the lid member 26 to the container 12. For example, as illustrated in FIG. 13, one or more oblong protrusions 124 may outwardly project from the exterior tapering side 66*b* of the ridge 40, and each protrusion 124 may be adapted to engage a corresponding surface of the channel 42 of the lid member 26 to secure the lid member 26 to the container 12 in the first position 30. Alternatively, or in addition, one or more protrusions 124 or undercuts may be disposed on a surface of the channel 42 of the lid member 26 to engage a corresponding surface or undercut of the ridge 40 to secure the lid member 26 to the container 12 in the first position 30.

To further assist in the coupling of the lid member 26 to the container 12 in the first position 30, a releasable surface adhesive may be applied to all or a portion of the lid member 26 that contacts (and sealingly engages) the top wall 16*a* of the container 12 when the lid member 26 is in the first position 30. Alternatively, or in addition to the adhesive described above, a releasable surface adhesive may be applied to all or a portion of the top wall 16*a* of the container 12 that contacts the lid member 26 when the lid member 26 is in the first position 30. For example, a releasable surface adhesive. The surface adhesive may be any suitable adhesive that provides for adhesion between the lid member 26 and the container 12 over the course of a suitable number of openings and closings by the user. Suitable adhesives may be pressure sensitive acrylics, for example.

Figure 12:
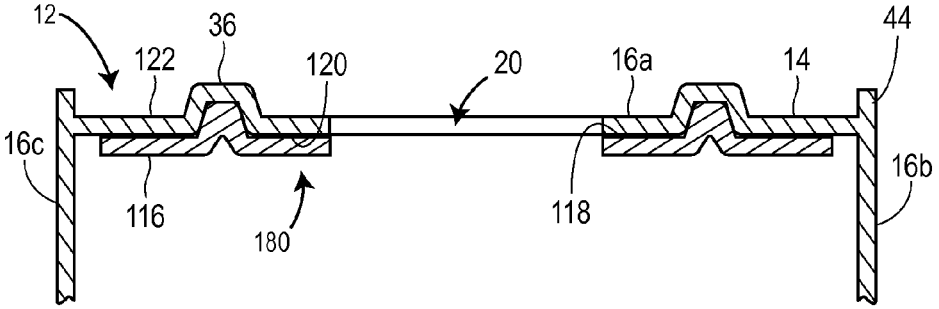
FIG. 12 is a sectional view of the top wall of the a container along line 7-7 of FIG. 5 that includes a third sheet secured to a first sheet.
Figure 32:
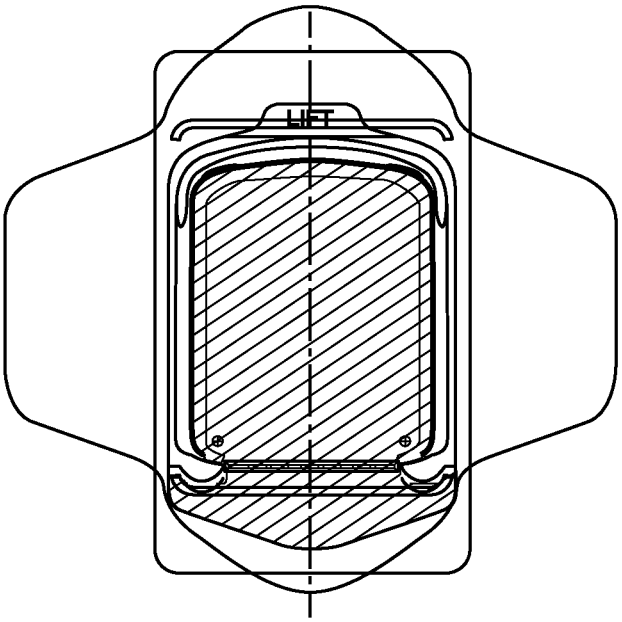
FIG. 32 is a schematic illustrating embodiments of first and second projections of a closure assembly and extensions of the second sheet into two sidewalls in accordance with embodiments of the disclosure.
Figure 33A:
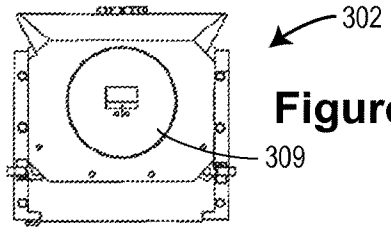
FIGS. 33A to 33D include various views of an embodiment of a forming tube assembly of a packaging machine used to manufacture an embodiment of a re-closable packaging assembly 10.
Figure 33B:
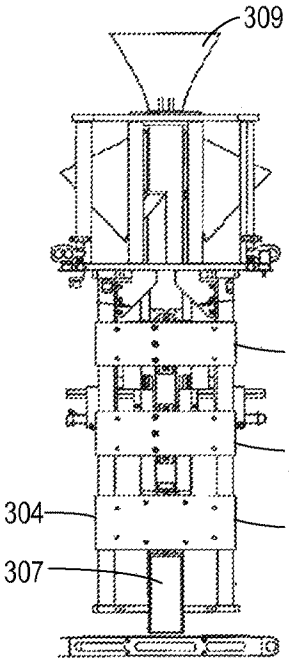
Figure 33C:
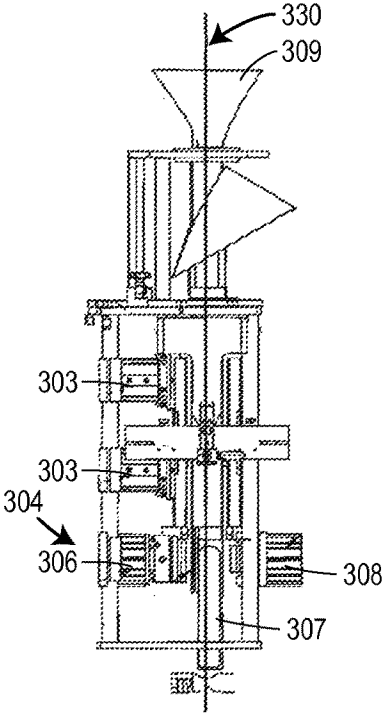
Figure 33D:
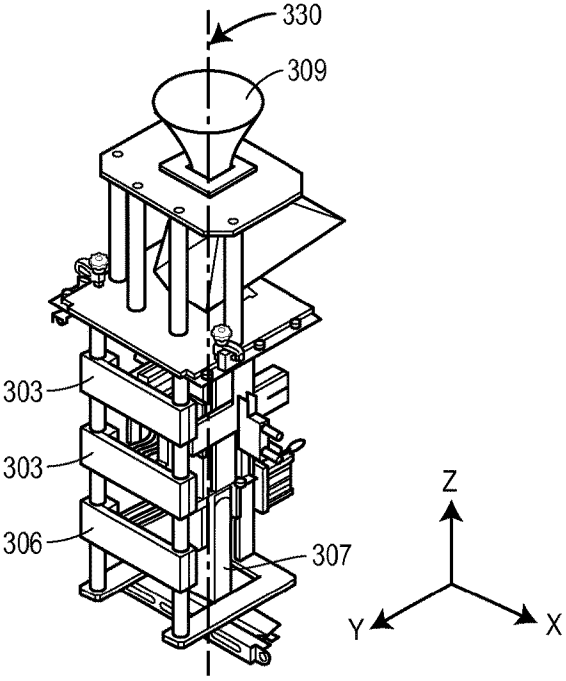
Figure 34D:
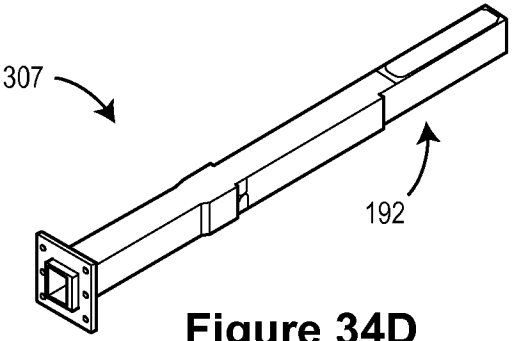
FIGS. 34A-34E include various views of an embodiment of a forming tube of an embodiment of a forming tube assembly.
Figure 34E:
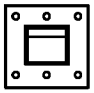
Figure 34A:
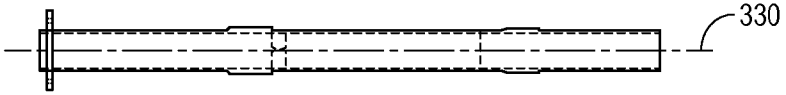
Figure 34B:
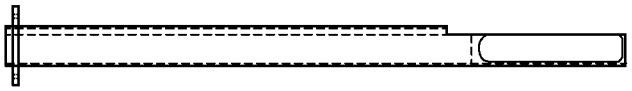
Figure 34C:
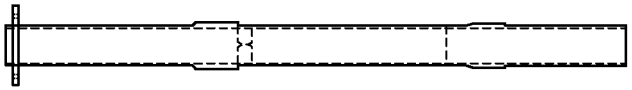
Figure 35:
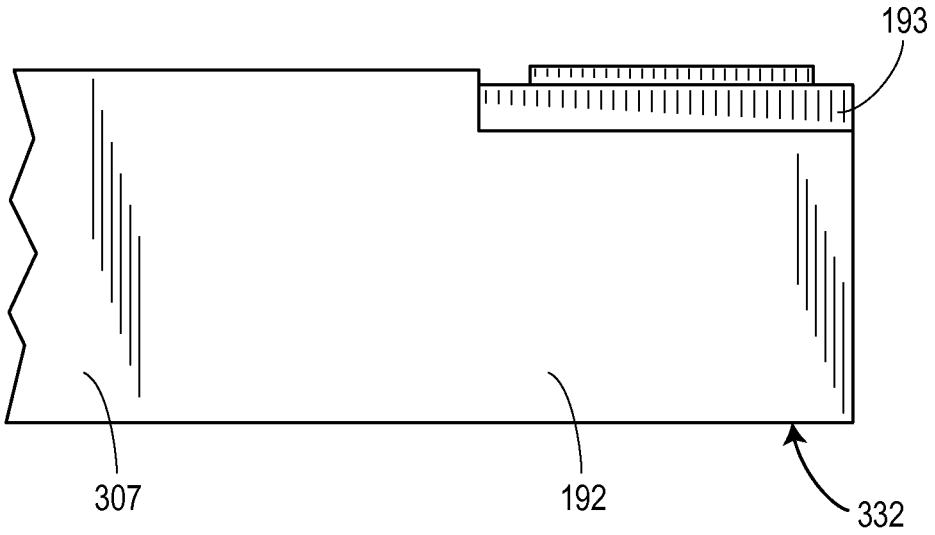
FIG. 35 is a partial side view of an embodiment of a forming tube of an embodiment of a forming tube assembly.

As illustrated in FIG. 12, a stabilizing portion 180, such as a third sheet 116 (or a third film), may be secured (or integrally formed with) the first sheet 14 comprising the container 12 to increase the gauge of the container 12 in the region of the stabilizing portion 180 to provide added stiffness to the container 12 in a desired area. The stabilizing portion 180 may advantageously be provided only at a portion of the top wall 16*a* of the container 12 without affecting the gauge of other portions of the container 12. This can be advantageous when forming various re-closable packaging assembly 10 configurations in which sealing of edges and/or folding of portions of the first sheet 14 may be made more difficult if a film having an overall large gauge was used. Referring to FIG. 32, in some embodiments, the third sheet can have one or more portions that extend outwardly from a main body such that upon forming of the package the main body remains in the region of the top wall and the one or more outwardly extended portions are disposed on one or more sidewalls. The stabilizing portion 180 may be secured to (or integrally formed with) the first sheet 14 in any manner known in the art. Specifically, all or a portion of a top surface 118 (i.e., a first side or first surface) of the third sheet 116 may be secured to all or a portion of a bottom surface 120 (i.e., a second side or second surface) of the first sheet 14 that comprises all or a portion of the top wall 16*a*, with a top surface 122 (i.e., a first side or first surface) of the first sheet 14 may be an exterior surface of the top wall 16*a*. For example, the third sheet 116 may be secured to the bottom surface 120 of the first sheet 14 such that the opening 20 in the first sheet 14 is entirely surrounded by the third sheet 116. The third sheet 116 may extend to the opening edge 55, or may be outwardly offset from the opening edge 55. The third sheet 116 may also extend to any one or more of the first, second, third, and fourth side walls 16*b*-16*e*, or the third sheet 116 may be inwardly offset from any or all of the first, second, third, and fourth side walls 16*b*-16*e*. The distance of the inward offset may vary or may be uniform from each side wall 16*b*-16*e*. To secure the third sheet 116 to the first sheet 14, an adhesive may be applied to all or a portion of the top surface of the third sheet 116. In addition, or alternatively, an adhesive may be applied to all or a portion of the bottom surface 120 of the first sheet 14. As an alternative to adhesive, the third sheet 116 may be integrally formed with, heat sealed to, or ultra-sonically welded to the first sheet 14. The thickness of the third sheet 116 may be uniform or may vary, and may have any thickness that provides a desired stiffness to the top wall 16*a* of the container 12 to allow for suitable sealing engagement of the lid member 26 and the container 12 in the first position 30.

The stabilizing portion 180 may also include a coating, such as an ink or an adhesive, applied selectively to the bottom surface 120 of the first sheet 14. The stabilizing portion 180 may also include an additional material layer disposed on the bottom surface 120 of the first sheet 14. For example, the material may have a foam structure. In one embodiment, a coating of a polymeric material may be applied to at least a portion of the bottom surface 120 of the first sheet 14 and reacted to form a foam structure and thereby form the stabilizing portion 180. In various embodiments, the stabilizing portion 180 may be provided when forming the first sheet 14. For example, the first sheet 14 may be extruded to have an increased gauge portion in the region of the first sheet 14 that is adapted to be adjacent to the opening 20. For example, the first sheet 14 may be provided with an additional laminated layer in the region of the first sheet 14 that is adapted to be adjacent to the opening 20, as compared to the number of layers in other regions of the first sheet 14, thereby increasing the gauge of the first sheet 14 in the region of the opening 20.

The one or more ribs 51 (see FIG. 18) or any other protrusion or combination of protrusions formed on or along the top wall 16*a* of the container 12, including the second engagement feature 38, may allow for the vertical stacking of re-closable packaging assembles 10. More specifically, the vertically-projecting feature/features may engage a portion of the wall downwardly projecting from the bottom wall 16*f* of the container, and such engagement limits or prevents relative horizontal movement between stacked assemblies 10.

As illustrated in FIGS. 55A, 55B, and 56A to 56D, the re-closable packaging assembly 10 may include a closure assembly 339 that may include a lid member 340 similar (or identical) to the hinged embodiment of the previously-disclosed lid member 26 with the exception that the lid member 340 is completely removable from the container 12. That is, the lid member 340 is movable between a first position (FIG. 55A) in which the lid member 340 releasably engages a first portion of the container 12 surrounding the opening 20 and a second position (FIG. 55B) in which the lid member is not in contact with the container 12, thereby allowing for a user to access the interior volume through the opening. The opening 20 may have any suitable shape or combination of shapes, such as a rectangular, oval, oblong, round, and/or polygonal shape.

Referring to FIGS. 54A to 54N, 55A, 55B, and 56A to 56D, the lid member 340 may have any suitable shape or combination of shapes, such as square, oval, oblong, and/or polygonal, for example. More specifically, the lid member 340 may be rectangular. The lid member 340 may be defined by a first lateral edge 341 and a second lateral edge 432 parallel or substantially parallel to the first lateral edge 341. Alternatively, the first lateral edge 341 and the second lateral edge 432 may each have any suitable orientation. A first end edge 343 may extend between a first end of the first lateral edge 341 and a first end of the second lateral edge 432. A second end edge 344 may extend between a second end of the first lateral edge 341 and a second end of the second lateral edge 432. The first end edge 343 may be parallel or substantially parallel to the second end edge 344, but the first end edge 343 and the second end edge 344 may have any suitable orientation. Each of the edges 341-344 may be linear or may be curved, partially, curved, contoured, partially contoured, scalloped, and/or partially scalloped, for example.

Figure 55A:
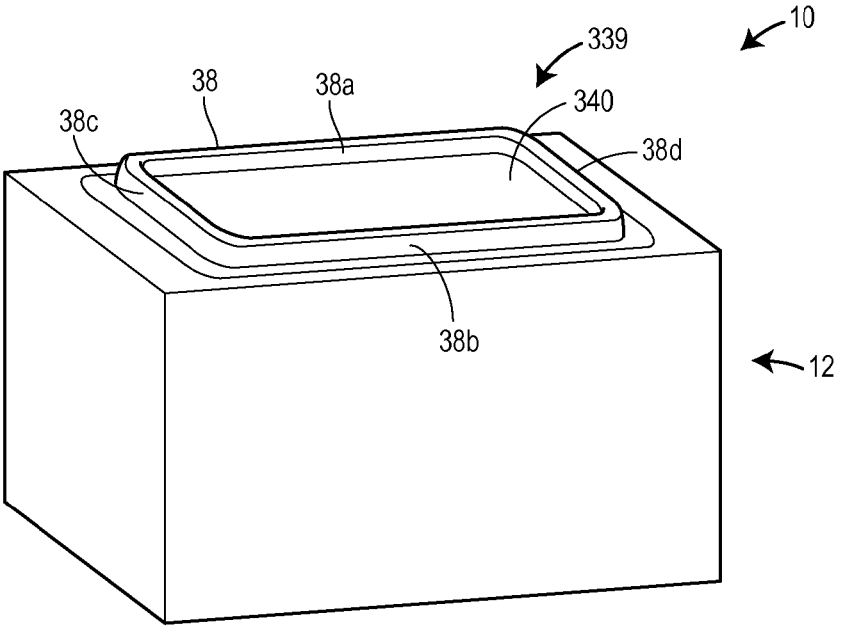
FIGS. 55A to 55B are various views of a container and a removable lid member.
Figure 55B:
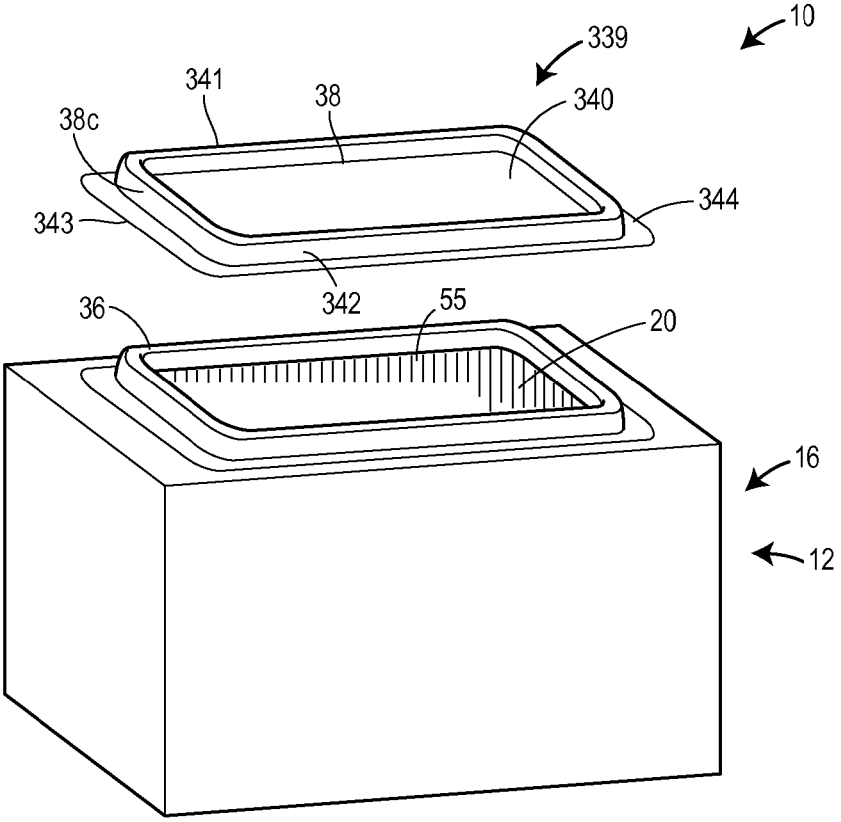
Figures 56A, 56B, 56C, 56D:
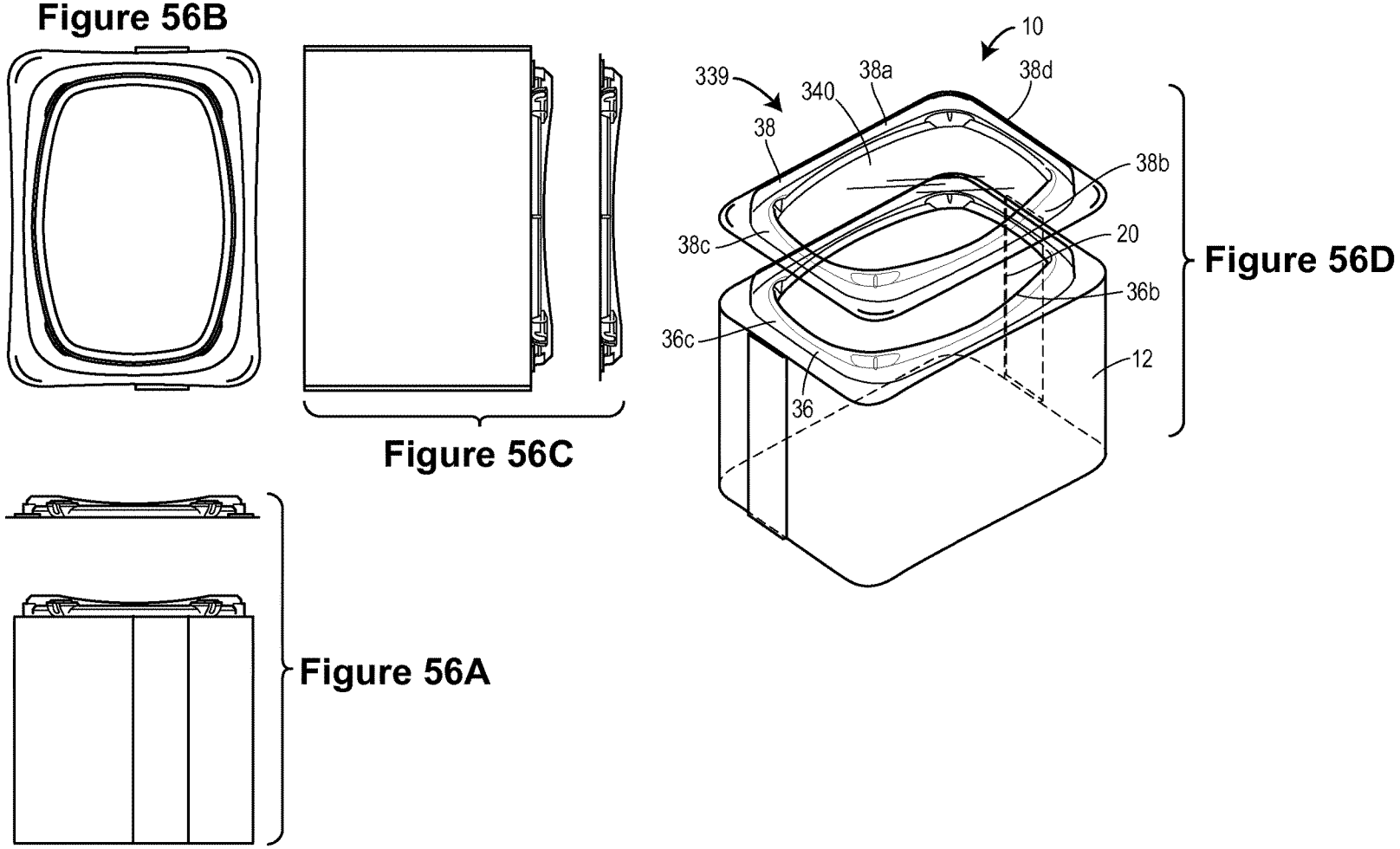
FIGS. 56A to 56D are various views of a container and a removable lid member.
Figure 57:
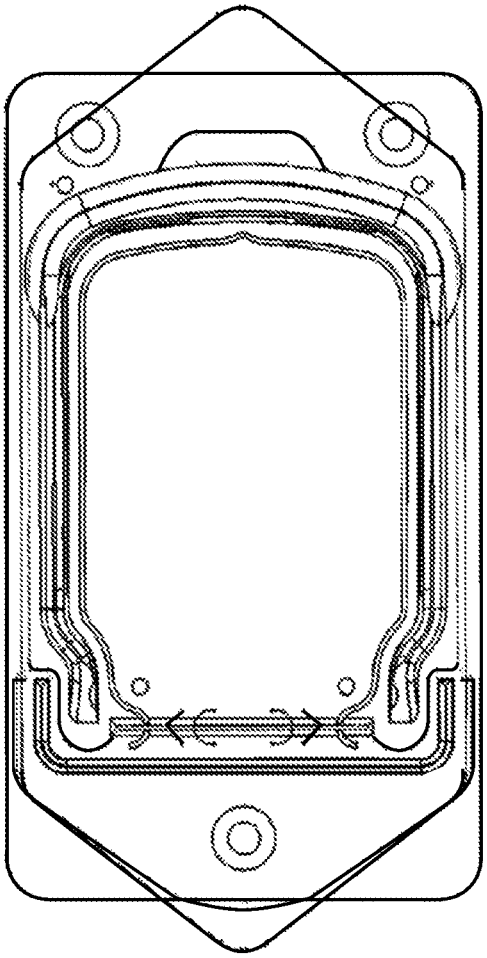
FIG. 57 is an example forming die for an embodiment of the re-closable packaging assembly.
Figure 58:
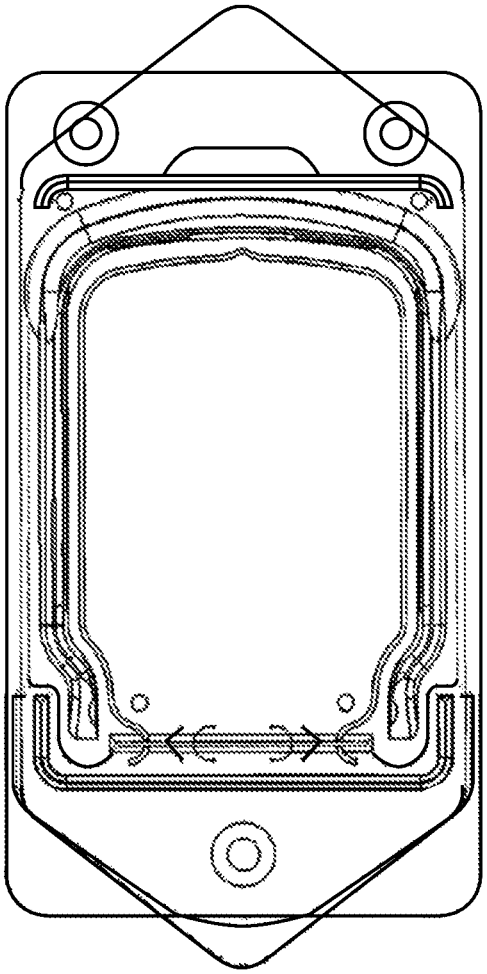
FIG. 58 is an example forming die for an embodiment of the re-closable packaging assembly.
Figure 59E:
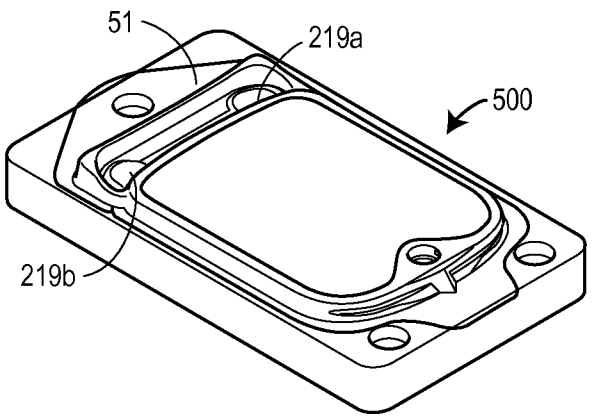
FIGS. 59A to 59E are an example forming die for an embodiment of the re-closable packaging assembly.
Figure 59C:
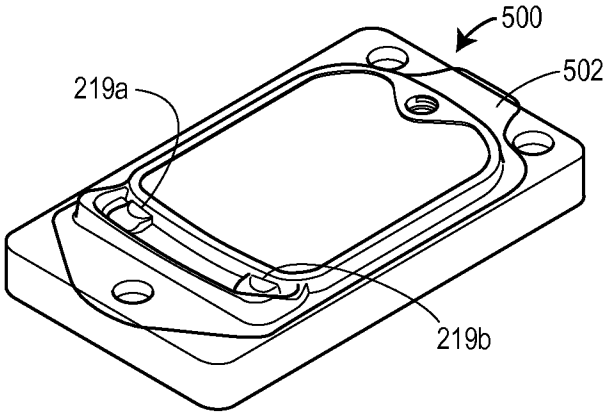
Figure 59D:
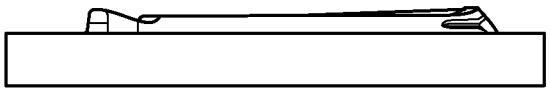
Figure 59A:
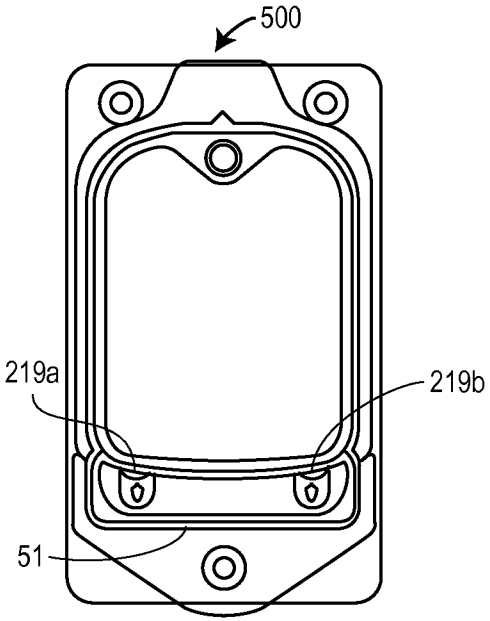
Figure 59B:
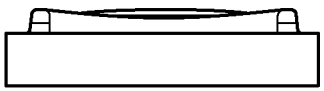

The lid member 340 of the closure assembly 339 may include the second engagement feature 38 adapted to engage the first engagement feature 36 disposed on the container 12 to removably secure the lid member 26 to the container 12 when the lid member 339 is in the first position 30 illustrated in FIG. 55A, and the second engagement feature 38 may be integrally formed on or with the lid member 340. The second engagement feature 38 may be any element or combination of elements that engage a corresponding first engagement feature 36 to allow the lid member 340 to sealingly engage the container 12. For example, the second engagement feature 38 may be a channel 42 adapted to receive the ridge 40 formed on the top wall 16*a* of the container 12, as previously described. As an additional example, the first engagement feature 36 may be a channel 42 that may vertically extend downward from the top wall 16*a* of the container 12, and the second engagement feature 38 may be ridge 40 that may vertically extend downward from the lid member 340 of the closure assembly 339. In the first position, the ridge 40 may be received into the channel 42 to allow the lid member 340 to sealingly engage the container 12.

The second engagement feature 38 may include a first portion 38*a*, a second portion 38*b*, a third portion 38*c*, and a fourth portion 38*d*, and the first portion 38*a*, the second portion 38*b*, the third portion 38*c*, and the fourth portion 38*d* may be in alignment with a first portion 36*a*, a second portion 36*b*, a third portion 36*c*, and a fourth portion 36*d* of the first engagement feature 36, respectively, when the lid member 339 is in the first position 30 illustrated in FIG. 55A. Each of the first portion 38*a*, the second portion 38*b*, the third portion 38*c*, and the fourth portion 38*d* may be inwardly (and, optionally, equidistant) from the first lateral edge 341, the second lateral edge 342, the first end edge 343, and the second end edge 344, respectively. Each of the first portion 38*a* and second portion 38*b* may be elongated and may have a longitudinal axis parallel to the first lateral edge 341. Alternatively, each of the first portion 38*a* and second portion 38*b* may be elongated and may have a longitudinal axis that is curved or bowed (or inwardly curved or bowed) relative to the first lateral edge 341. Each of the third portion 38*c* and fourth portion 38*d* may be elongated and may have a longitudinal axis parallel to the first end edge 343. Alternatively, each of the third portion 38*c* and fourth portion 38*d* may be elongated and may have a longitudinal axis that is curved or bowed (or inwardly curved or bowed) relative to the to the first end edge 343. Each of the corresponding first portion 36*a*, second portion 36*b*, third portion 36*c*, and fourth portion 36*d* of the first engagement feature 36 may be similarly formed on the container 12. Each of the first portion 38*a*, the second portion 38*b*, the third portion 38*c*, and the fourth portion 38*d* of the second engagement feature 38 may form a continuous, single, uninterrupted feature that completely surrounds the opening 20. Alternatively, one or more gaps or interruptions may be disposed in or between the first portion 38*a*, the second portion 38*b*, the third portion 38*c*, and the fourth portion 38*d* of the second engagement feature 38.

Figure 54D:
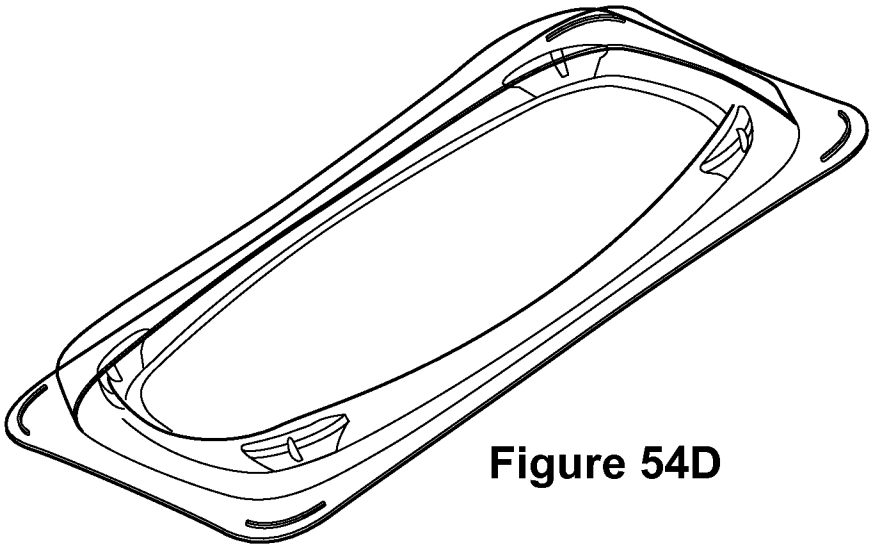
FIGS. 54A to 54N are various views of removable lid member.
Figure 54C:
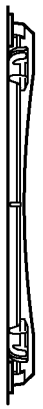
Figure 54B:
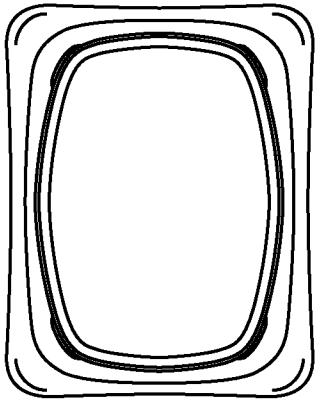
Figure 54A:
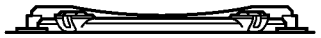
Figure 54H:
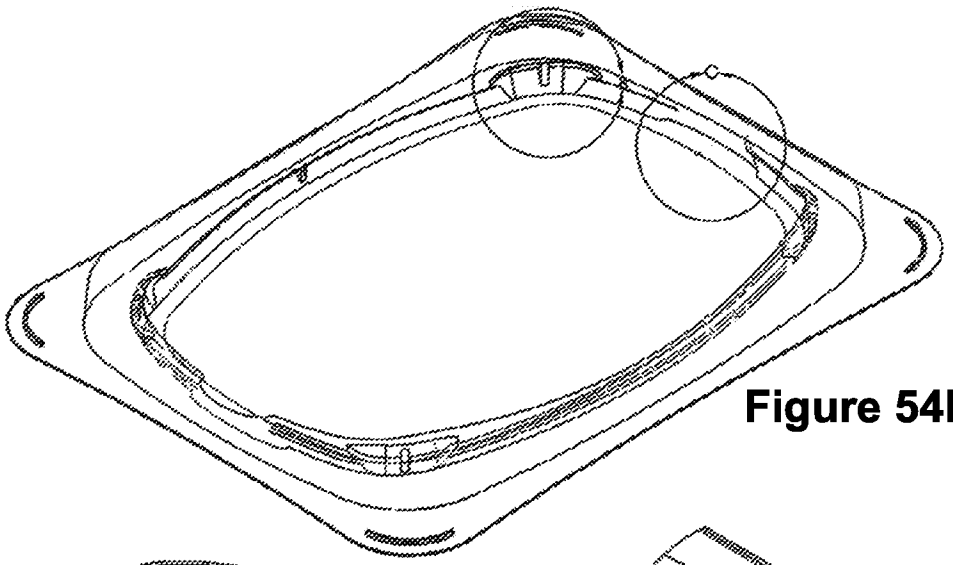
Figure 54J:
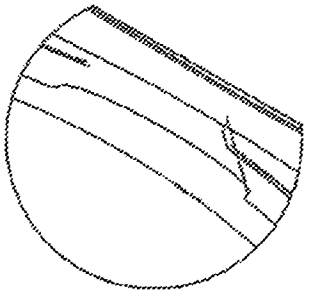
Figure 54I:
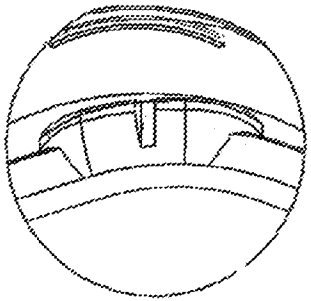
Figure 54G:
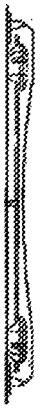
Figure 54F:
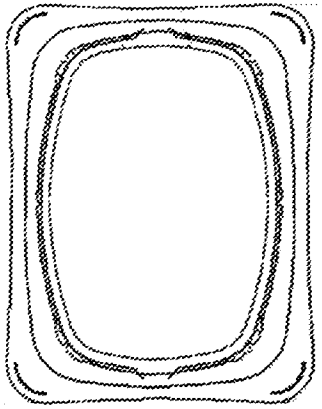
Figure 54E:
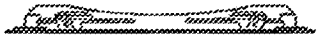
Figure 54K:
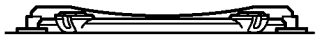
Figure 54L:
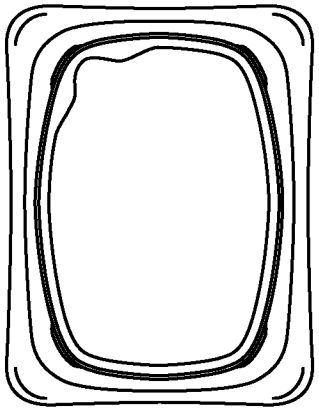
Figure 54M:
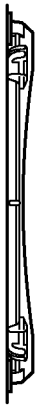
Figure 54N:
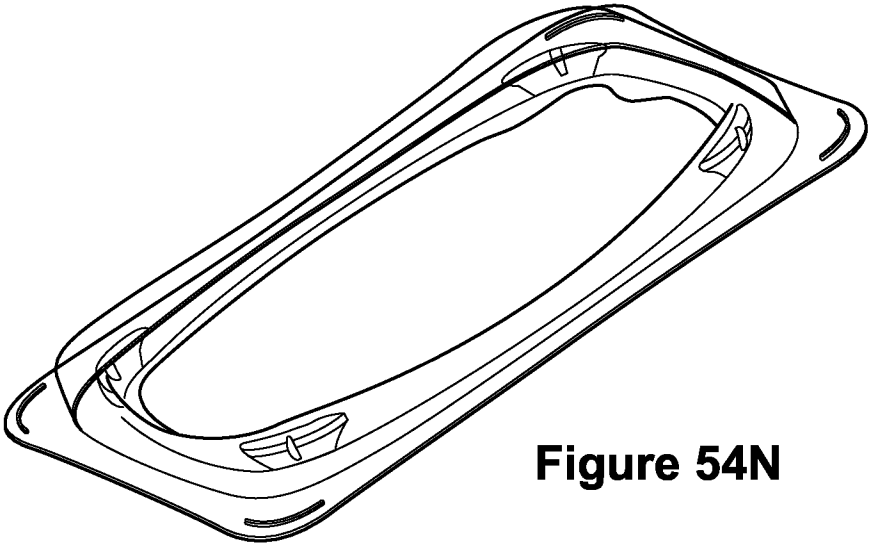

The re-closable packaging assembly 10 may also include a pour spout feature 345, as illustrated in FIGS. 54L to 54N. The pour spout feature 345 may include any feature or combination of features that allows for easier pouring out or dispensing of materials stored in the interior volume of the container 12. For example, the pour spout feature 345 may be a contoured edge 346 partially defining the opening 20 formed on the container 12 or partially defining an edge of a removable cut-out through the lid member 340. In addition, the pour spout feature 345 may comprise or partially comprise a vertical projection in contact with or adjacent to the opening 20, and the vertical projection may be a upwardly-extending ridge or lip that extends from the top wall 16*a* of the container. The vertical projection may be a thermoformed feature that may be formed when the features of the closure assembly 22 are formed. Alternatively, the vertical projection may be formed prior to or after the forming of the features of the closure assembly 22.

Resealable Flexible Container

In various embodiments, the package can be provided with a resealable opening as opposed to a closure assembly. Any of the features described above, including for example, the projections 219*a*, 291*b*, a hinge, pull tabs, etc., can be utilized in the packages in accordance with embodiments of the disclosure a having resealable opening.

Figure 72:
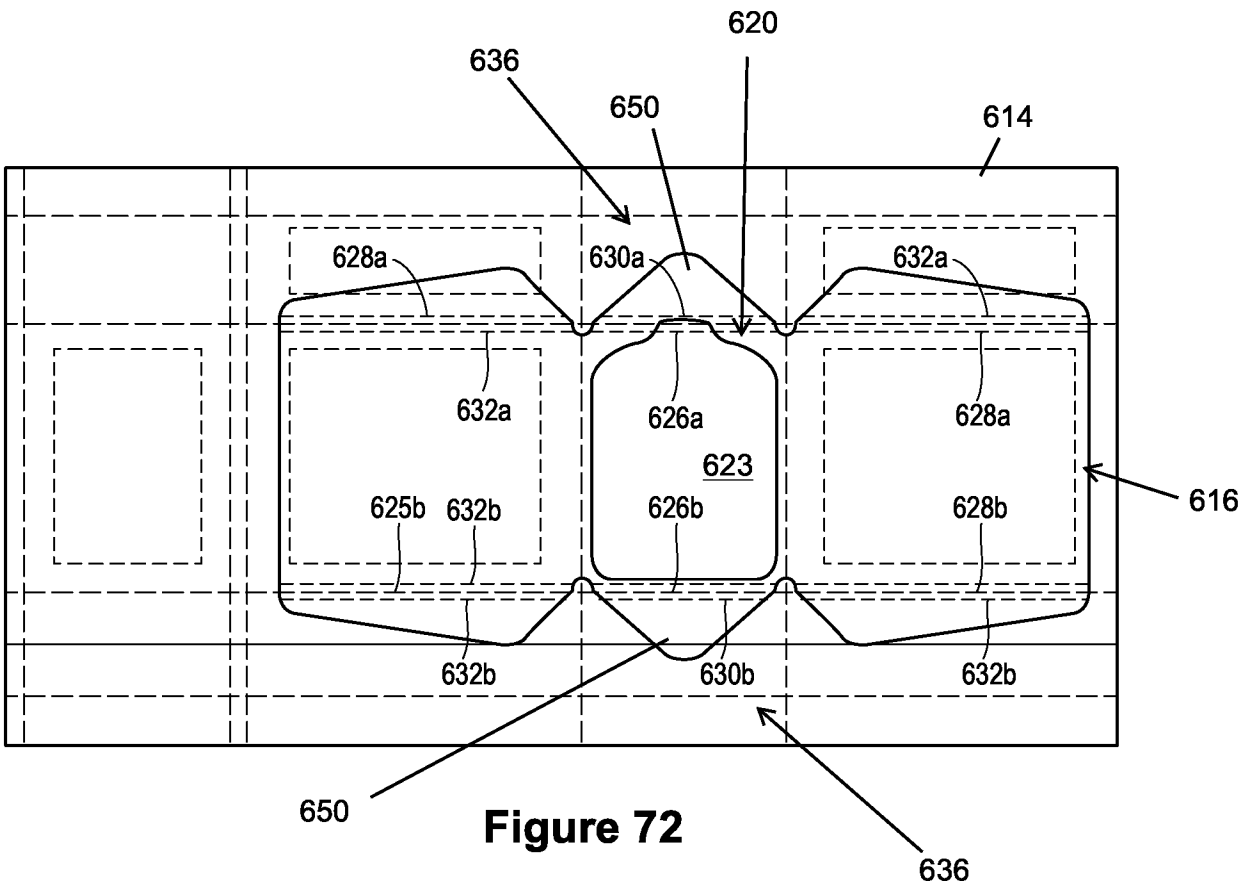
FIG. 72 illustrates a film layout for forming a package in accordance with an embodiment of the disclosure.
Figure 73A:
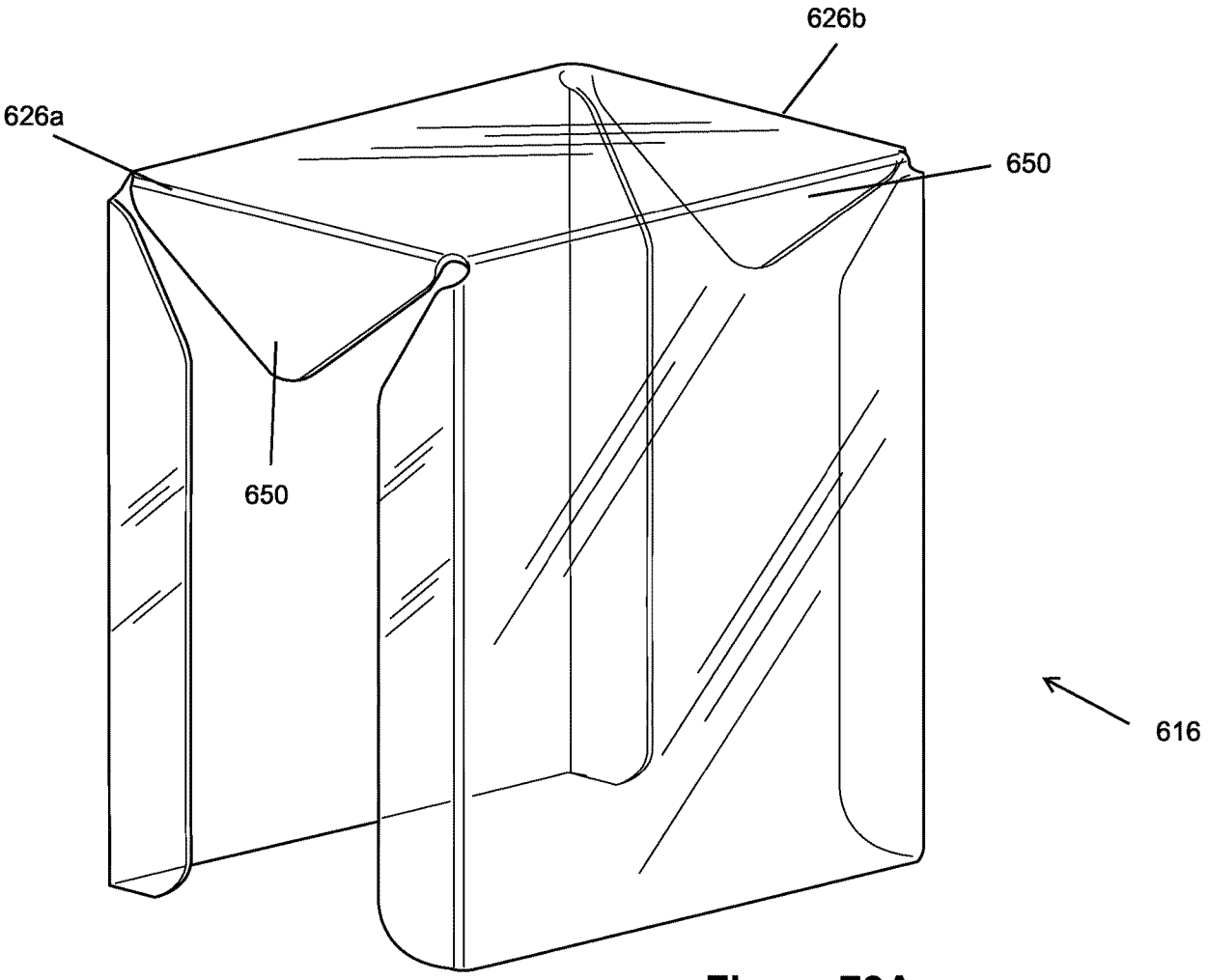
FIG. 73A illustrates an embodiment of a second sheet illustrated in a configuration as provided in a package in accordance with an embodiment of the disclosure.
Figure 73B:
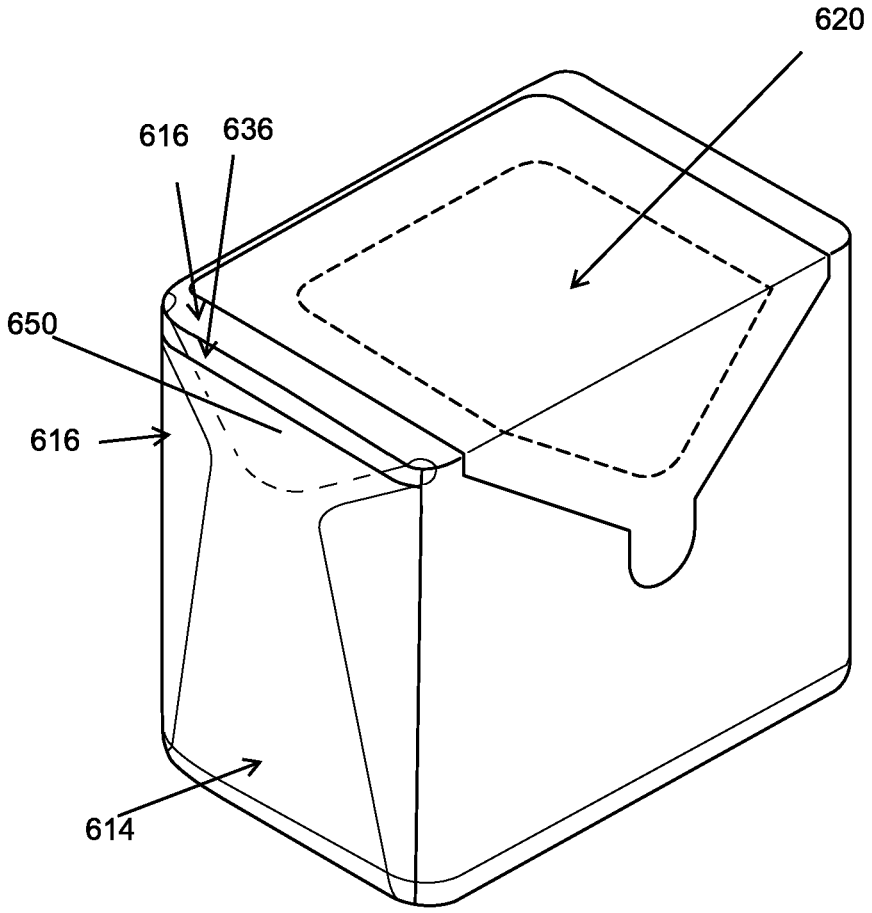
FIG. 73B illustrates an embodiment of a package having a second sheet in accordance with an embodiment of the disclosure.

Referring to FIGS. 72 and 73, in an embodiment, the package can be provided with only the first sheet 614 and the second sheet 616 disposed on the first sheet 614, such that the second sheet 616 defines at least a portion of the outer surface of the package in at least one panel of the package. The second sheet 616 can be disposed in the opening panel region 620 of the package and can extend over at least three walls, each of the three walls being adjacent to one of the other walls in which the second sheet is disposed. The second sheet 616 can be disposed over all or just a portion of any of the at least three walls. An opening 20 can be defined in the first sheet 614 and a resealable flap 623 can be defined in the second sheet 616 in the opening panel region 620 to cover the opening. The resealable flap 623 is movable between a closed position in which the flap 623 is resealable attached to the first sheet and covers the opening, and an open position in which the flap 623 is disposed away from the opening and the opening is accessible. The opening panel region 620 can be any one of the walls defining the package, including, for example, the top wall, as illustrated in FIG. 72, the front or back wall, or both the top wall and one or both of the front or back wall. In some embodiments, as illustrated in FIG. 73*b*, the opening 20 can extend from the opening panel region 620 to one or more side walls or panels 624 of the package. FIG. 73*b* illustrates an embodiment in which the opening panel 20 extends across the opening panel region 620 and to a side panel 624, with the pull tab 617 being located on the side panel 624. The opening 20 in this embodiment is provided in both the opening panel region 620 and the side panel 624 and the resealable flap 623 provided by the second sheet 616 is dimensioned to extend over the opening 20 in both the opening panel region 620 and the side panel region 624. The second sheet 616 can be scored, cut, or otherwise perforated so as to provide the resealable flap portion 623 that is adapted to resealable seal to the first sheet 614 in the opening panel region 620 to resealable close the package.

The second sheet 616 is attached to the first sheet 614 in the regions of the first sheet that it contacts. In various embodiments, the second sheet can be attached to the portion of the film defining the opening, and the portion of the first sheet can separate from the first sheet and remain attached to the second sheet during first opening of the package. Alternatively, the first sheet can have a portion removed defining the opening, and the second sheet can be disposed over the opening (in which the first sheet portion has been removed). The second sheet can be attached to the first sheet using any known adhesives. For example, portions of the second sheet can be permanently attached to the first sheet, with only the portion of the second sheet defining the resealable flap being resealable attached to the first sheet. In other embodiments, the second sheet can be attached to the first sheet entirely with resealable adhesive. Any known methods of attaching film sheets can be used.

Referring to FIG. 72, the opening panel region 620 can have first and second boundaries 626*a*, 626*b* that are configured to define first and second edges of the opening panel of the package. The second sheet 618 can overlap with one or both of the first and second boundaries 626*a*, 626*b* and extend past the boundary and be secured to the first sheet on opposed sides of the boundary along one or more walls of the package. For example, the second sheet 614 can extend down substantially an entire length and width of opposed walls 624*c*, 624*d* of the package. In alternative embodiments, the second sheet 616 can be provided so as to extend partially down one or more walls 624 of the container. The second sheet can also be provided to extend along one or more lateral edges of the package, which can enhance the strength and rigidity of the package. In an embodiment, the second sheet is provided along each of the four boundaries defining the opening panel 620 as well as along the four lateral edges of the package. When combined with lines of reduced strength of the second sheet (described below) such an arrangement can allow the film to essentially self-assembly into a box in a pop-up box type arrangement. Lines of reduced strength can include perforations and/or score lines.

Without intending to be bound by theory, it is believed that the one or more lines of reduced strength in the second sheet 616 in various regions of the second sheet at the boundaries of the panels and walls, corresponding to edges and corners of the package, reduce the bending strength of the second sheet such that the second sheet will force the first sheet into a folded orientation in which the edges and corners (corresponding to the location perforation) preferentially form and are maintained in the folded orientation, with minimal application of a folding force. That is, the edges of the opening panel and the lateral edges of the package may preferential form from the flat sheet material based on the incorporation of the perforated second sheet material along these regions. This can advantageously provided a package having well-defined edges, as well as improved crush resistance when a load is applied against one of the walls and particularly in the opening panel region.

Figure 90:
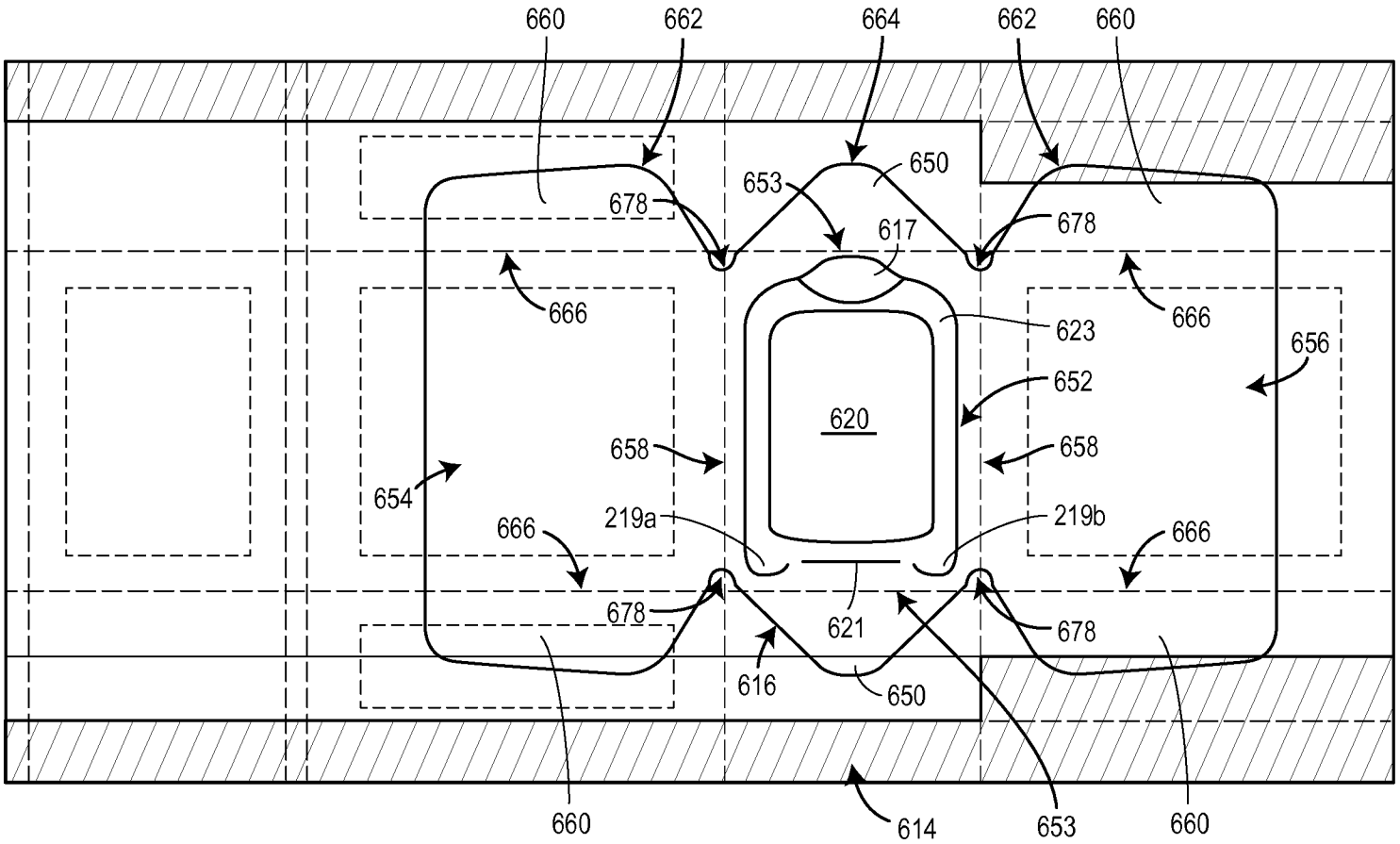
FIG. 90 is a schematic illustration of a film layout for a container in accordance with an embodiment of the disclosure.
Figure 91:
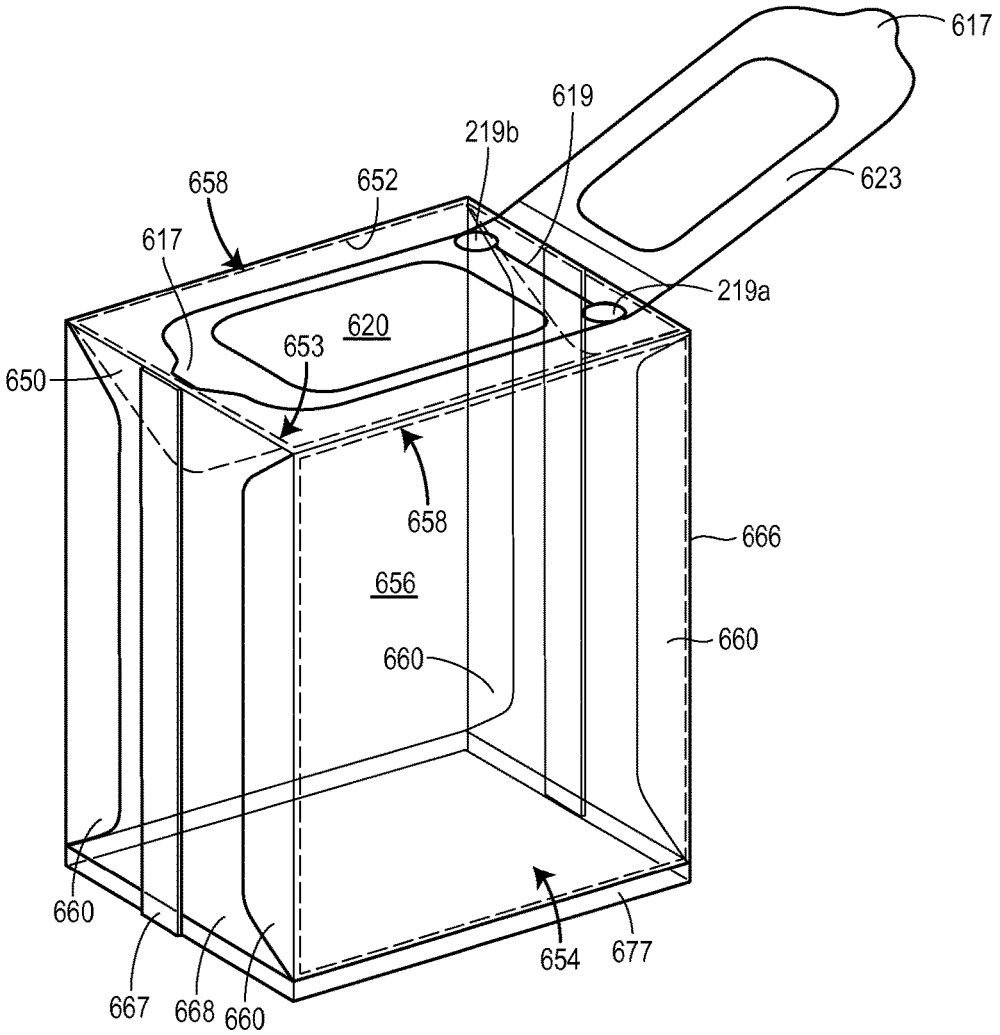
FIG. 91 is a schematic illustration of a flexible container in accordance with an embodiment of the disclosure showing the resealable flap on the top panel and in an open position.
Figure 92:
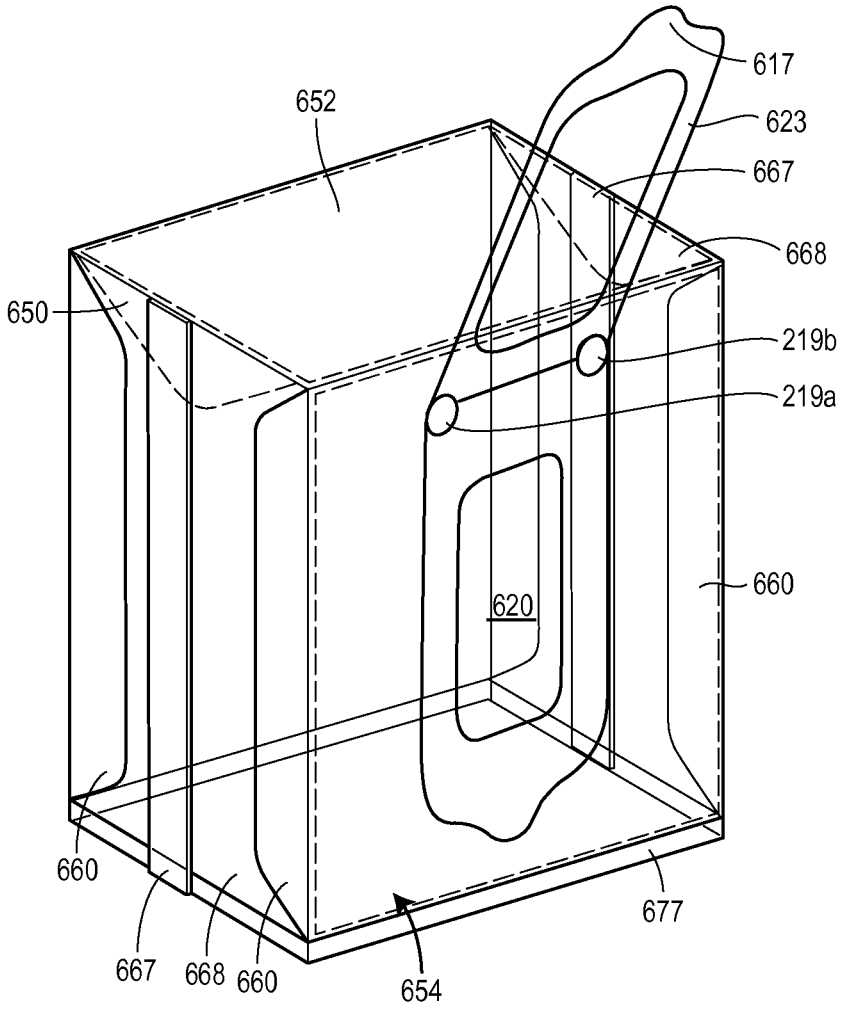
FIG. 92 is a schematic illustration of a flexible container in accordance with an embodiment of the disclosure showing a resealable flap on a front panel and in an open position.

Referring to FIG. 90, in various embodiments, the second sheet 616 can extend over a top panel and into a tucks formed in the side wall of the package. FIG. 91 illustrates a package defined by the film layout illustrated in FIG. 90. FIG. 92 illustrates an embodiment of the package in which the opening and the resealable flap are provided on the front panel. In the embodiments of FIGS. 91 and 92, the second sheet is illustrated as extending over the entirety of the top wall, front wall, and back walls. It should be understood that the second sheet could be disposed over only portions of any of the respective walls. For ease of reference, reference numbers in FIGS. 91 and 92 generally refer to portions of the second sheet as described below. The packages include opposed side walls 668 and each side wall includes a seal 667 (illustrated in FIG. 93, for example) disposed along the side wall.

The tucks are formed by tucking portions of the first sheet inwardly toward the interior volume of the container such that the tuck portions of the first sheet are disposed beneath the seal. The second sheet can include a tuck portion 650 that extends into the tucks. As shown in FIG. 90, the tuck portion 650 can extend from an adjoining portion of the second sheet that extends over an adjacent wall. In the embodiment shown in FIG. 90, the tuck portion extends from a top wall portion of the second sheet and the top wall portion includes the resealable flap 623 defined therein. It is contemplated, however, that the opening 620 and corresponding resealable flap can be disposed in a different wall of the package, for example, the front or back wall, or can be disposed along multiple walls of the package. The tuck portion 650 extends from the top wall portion 652, with the boundary between the tuck portion and the top wall portion being the edge between a side wall of the container and the top wall of the container. The second sheet includes one or more lines of reduced strength at or adjacent to the boundaries between the tuck portion and the top wall portion of the second sheet. FIG. 90 illustrates a single line of reduced strength 653 at each of the boundaries between the top wall portion 652 and the tuck portions 650.

FIG. 72 similarly illustrates an embodiment in which the container includes at least one tuck and the second sheet includes at least one tucking portion 650 that is adjacent to a boundary of the opening panel region and/or a boundary 626*a*, 626*b* of at least one wall region 624*c*. The tuck folding region 636 is configured to be tucked inward to define an edge of wall or panel of the package. The flexible film can include a portion of the second sheet (for example, detached from other portions of the second sheet) secured to the first sheet in the tuck folding region 636. As described above, the tucking portion 650 of the second sheet 616 can include a line of reduced strength 630*a*, 630*b* in the region of the boundary 626*a*, 626*b* to facilitate folding the flexible film into the tuck fold. The tucking portion 650 of the second sheet 616 can provide improved rigidity to the edge of the package at the tuck fold, which in turn can provide improved rigidity to the panel or wall of the package adjacent to the tuck fold. In some embodiments, the second sheet 616 can be provided as a single continuous sheet extending across the opening panel region and the tuck folding regions. For example, the flexible material can be folded into the package such that tuck fold regions are provided at the boundaries of the opening panel region. For example the line of reduced strength 630*a*, 630*b* adjacent the tuck portion can include perforations and/or score lines. As used herein, score lines refer to one or more continuous or non-continuous lines (linear or nonlinear) that penetrate through a defined portion of the thickness, express herein as a percentage of penetration through the thickness. In the tuck region, the perforations can include about 50% to about 100% cut openings or score lines having about 50% to 100% penetration through the thickness of the second sheet to facilitate folding of the tuck portion and provide a well defined edge. As used herein, "percent cut opening" refers to the percentage of the perforated line that is cuts. Perforations include cuts and bridges between adjacent cuts, a percent cut opening of 50%, for example, refers to a perforation having cuts and bridges of equal length, such that 50% of the length of the perforation is cuts and 50% of the length of the perforation is bridges. An 80% cut opening, for example refers to perforations having cuts that are longer in length than the bridges, such that 80% of the overall length the perforation is cuts and 20% of the overall length of the perforation is bridges. Other suitable percent cut openings of perforations or percent penetration of score lines for the lines of reduced strength 630*a*, 630*b* adjacent the tucks include about 50% to about 99%, about 60% to about 95%, about 55% to about 80%, about 70% to about 99%, about 75% to about 90%. The percent cut opening can be for example about 50, 52, 54, 56, 58, 60, 62, 64, 68, 70, 72, 74, 76, 78, 80, 82, 84, 86, 88, 90, 91, 92, 93, 94, 95, 96, 97, 98, 99, and 100%. The percent of perforation or reduction in thickness of the line of reduced having perforations and/or score lines can depend on the thickness of the second sheet. For second sheets 616 having a high thickness, for example, above 10 mils, a high degree of reduction in strength at the line of reduced strength may be needed to allow for preferential folding of the first and second sheets into the tucks.

As noted above, the line(s) of reduced strengths facilitates folding the first and second sheets during the tucking operation and advantageously provides a well defined edge to the top wall at the tucked portion. Without inclusion of a line of reduced strength, forming the tucks can be difficult if not impossible depending on the overall thickness of the first and second sheets. Further, while with relatively thin materials, such folding can be accomplished, there are often defects, such as dents, in the folded regions because the flexible material resists folding. It has been advantageously determined that inclusion of the line of reduced strength in the second sheet at the boundary between the tuck portion and the top wall portion induces the first sheet to preferentially form an edge along the line of reduced strength to form a well defined edge. As described in detail below, it has been unexpectedly found that selective placement of the lines of reduced strength at various boundaries of the package, including the boundary adjacent the tuck portion, as described above, can allow the first sheet to preferentially fold into the desired package configuration, including for forming a contoured package without the need for changing the packaging forming equipment. This is advantageous as it avoids the needs for costly modification package forming equipment, such as seal bars, and down times associated with adjusting the package forming equipment for each configuration of the flexible package.

Referring to FIG. 72, in any of the embodiments in which the second sheet 616 overlaps a boundary or edge of the container, the second sheet can 616 can further include a line of reduced strength 630*a*, 630*b* or perforation in the portion of the second sheet 416 that overlaps with the boundary or edge. The line of reduced strength 630*a*, 630*b* can be defined by one or more paths or lines of reduced strength, for example, two paths of reduced strength disposed on opposed sides of the boundary or edge. As described above, extension of the second sheet to overlap with one or more boundaries and even extend past the boundary can beneficially strengthen a corner or edge of the package when formed. The line of reduced strength facilitate bending of the secured first and second sheets in the region of the edge and can aid in the defining a sharp or curved edge of the package that has improved rigidity. This can also aid in defining the shape of the packaging, and in some embodiments can aid the film to preferentially form into the defined package assembly shape during processing.

As illustrated in FIGS. 72 and 73, the extension of the second sheet to overlap with the boundary of a region can be provided in any one of the regions of the film including the opening panel region and one or more wall regions. FIGS. 72 and 73 illustrate an embodiment in which the second sheet is secured to the first sheet in the opening panel region and two adjacent wall regions. In this embodiment, the second sheet overlaps and extends beyond the boundaries 626*a*, 626*b*, 628*a*, 628*b*, of the opening panel region and the wall regions. In the embodiment illustrated in FIGS. 72 and 73, the second sheet further extends around the edges of the container, partially extending into the side walls of the package. The second sheet is configured so as not to extend into and interfere with the leading and trailing seals.

The second sheet can overlap substantially along the entire length of the boundaries and/or edges. Alternatively, the sheet can overlap with only a portion of the boundaries/edges in one or more of the regions. Additionally, the second sheet may overlap with both the opposed boundaries 626*a* and 626*b* and 628*a* and 628*b* of the region. If desired, however, the second sheet can overlap with only one boundary.

Referring to FIG. 90, as noted above the second sheet can also include lines of reduced strength at or adjacent to other boundaries between portions of the second sheet, corresponding to edges of the container. For example, FIG. 90 illustrates an embodiment in which the second sheet includes first and second face portions 654, 656 that extend across at least a portion of front and back walls of the container. The first and second face portions 654, 656 extend from the top wall portion 652. The respective boundary between the first and second face portions 654, 656 and the top wall portion 652 can also include one or more lines of reduced strength 658 in the second sheet at or adjacent to the boundary. The lines of reduced strength 658 can aid in providing well defined side edges at the top wall and similarly other walls of the package. However, the lines of reduced strength 658 reduce the rigidity of the second sheet in the region of the edge of the boundary, which can reduce the overall rigidity of the package, when for example, the package is gripped by a user at the top wall or about which the lines of reduced strength are provided. Reduction of the rigidity is a concern with flexible packaging as the package can tend to collapse or dent during handling or gripping by a user if not sufficiently rigid, which can render the package difficult to use. It has been advantageously determined that lines of reduced strength 658 can be provided in the second label at the side edges of the top wall or other side edge gripped by the user by controlling the degree of reduction of strength in the line of reduced strength. For example, in the gripping region, for example lines of reduced strength 658 illustrated in FIG. 90, can include perforations having about 1 to about 50% cut openings or score lines having about 1% to 50% penetration through the thickness of the second sheet to facilitate folding of the tuck portion and provide a well defined edge. Other suitable cut opening percentages and/or penetration percentages include about 5% to about 50%, about 10% to about 45%, about 15% to about 40%, about 20% to about 30%, about 20% to about 50%, and about 10% to about 50%. The cut opening percentages and/or can be, for example, about 1, 2, 3, 4, 5, 6, 7, 9, 10, 12, 14, 16, 18, 20, 22, 24, 26, 28, 30, 32, 34, 36, 38, 40, 42, 44, 46, 48, and 50%. The percent cut openings and/or the penetrations percentages will vary depending on the thickness of the second sheet. For example, if the second sheet is thick, for example, having a thickness greater than 10 mils, then high percentages of cut opening or scoring can be used to facilitate folding of the relatively thick sheet, which by virtue of its thickness will maintain sufficient rigidity to resist denting or collapsing when the package is gripped. Thinner second sheets, for example, second sheets having a thickness of less than about 10 mils may require low percentages of cut opening or scoring to maintain sufficient strength of the package in the gripping region.

In accordance with embodiments of the disclosure, first lines of reduced strength 653 disposed at the boundary between tuck portions 650 and an adjacent wall portion (for example, a top wall portion 650) can have a percent cut opening or percent penetration of the score lines that is greater than the percent cut opening or percent penetration of the score lines of a second line of reduced strength disposed in a gripping region, for example lines of reduced strength 658 disposed between the top wall portion 650 and the front and back wall portions 654, 656. By selectively perforating or scoring as described above, a package can be provided in which the first sheet defining the walls of the package preferentially folds into the package configuration, while maintaining sufficient strengths in various regions of the package that may be gripped by a user during handling.

Referring still to FIG. 90, the second sheet can include sidewall portions 660 that extend to respective side walls of the container and extend from the first and second face portions 654, 656 of the second sheet. The side wall portions 660 can be dimensioned so as not to extend into a region of the first sheet that is sealed to form the seals disposed in the side walls. In some embodiments, one or more of the side wall portions 660 can extend up to the seal, but not into the seal. In such embodiments, the seal can be folded over and sealed to one of the side wall portions. One or more of the side wall portions can alternatively terminate at an edge that is spaced away from the seal, such that the seal can be sealed to a portion the first sheet defining the side wall. In yet other embodiments, one or both of the seals can remain extending outward from the side wall. In such, embodiments, one or both of the seals can include, for example, an aperture defined in a portion of the seal, such that the seal can act as a handle, and a user can grip through the aperture.

The second sheet can be configured such that the terminal points of the side wall portions 662 and the tucking portion 664 lie along the same line. Such configuration of the second sheet can facilitate application of the second sheet to the first sheet and ensuring registration of the second sheet and the first sheet is maintained during the package folding process.

The second sheet can include one or more lines of reduced strength 666 disposed at or adjacent to the boundary between the side wall portions and the adjacent face portions, which corresponds to edges of the container between the front and/or back wall and one of the side walls. The line of reduced strength can include perforations having any suitable percent of cut openings and/or score lines having any suitable percent penetration. For example, if one or more of the liens of reduced strength is provided in a gripping region of the container, it may be advantages to have a lower percent of cut openings or percent penetration as described above.

In one embodiment, the line of reduced strength 666 at or adjacent to the boundary between the side wall portions and the face portions includes perforations having a cut percent opening and/or score lines having a penetration percentage that is equal to those of the line of reduced strength 658 between the top wall portion and the face portions. In another embodiment, the line of reduced strength 666 at or adjacent to the boundary between the side wall portions and the face portions includes perforations having a cut percent opening and/or score lines having a penetration percentage that is equal to those of the line of reduced strength 653 at or adjacent the boundary of the tuck portion. In yet another embodiment, the line of reduced strength 666 at or adjacent to the boundary between the side wall portions and the face portions includes perforations having a cut percent opening and/or score lines having a penetration percentage that is greater than those of the line of reduced strength 658 between the top wall portion and the face portions, but less than those of the line of reduced strength 653 at or adjacent the boundary of the tuck portion.

As with the lines of reduced strength described above, the percent of cuts and/or penetration can vary depending on the thickness of the material.

It has been advantageously found that by selectively perforating or scoring the second sheet in a controlled manner, a package can be provided in which the first sheet defining the plurality of walls of the package can be induced by the second sheet and controlled perforations to preferentially fold into the package configuration. Further controlled perforation or scoring as described above in the various regions of the second sheet can allow for such preferential folding while maintain rigidity and even improving rigidity of the container for improved durability, stability, and usability.

As discussed above it has unexpectedly been found that controlled application of non-linear lines of reduced strength in select regions of the second sheet can contour the shape of the package, without the need for specialized package forming equipment to impart the contour shape.

Figure 93:
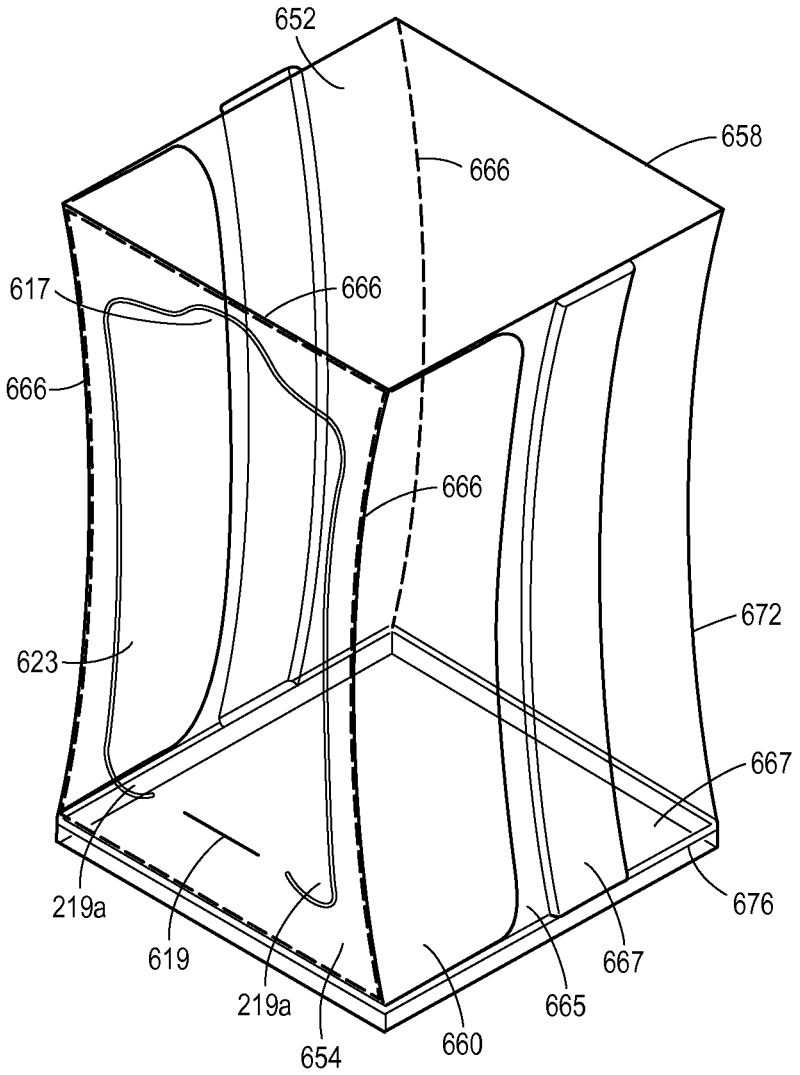
FIG. 93 is a schematic illustration of a contoured package in accordance with an embodiment of the disclosure.
Figure 94:
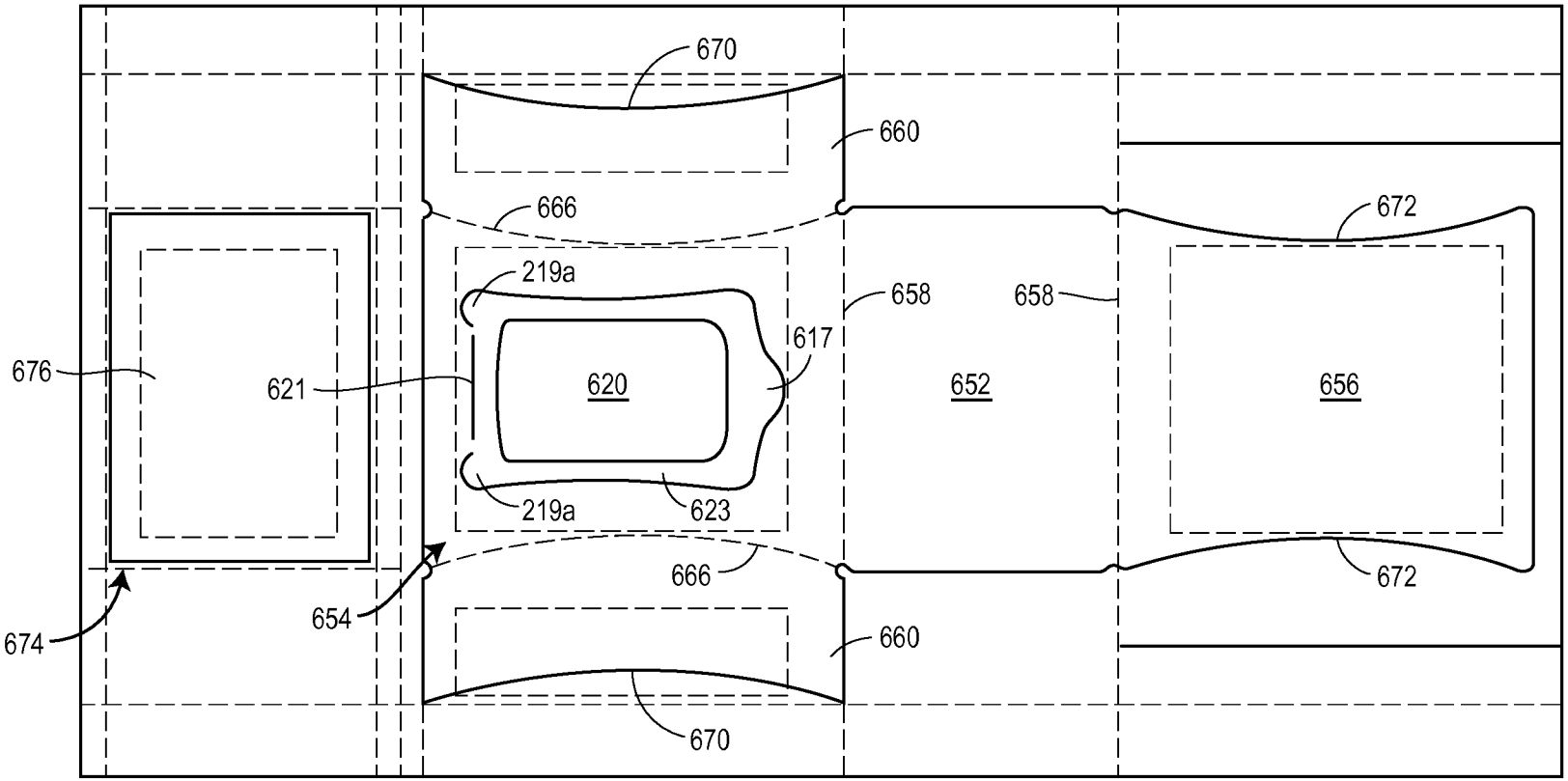
FIG. 94 is a schematic illustration of a film layout for the contoured package of FIG. 93.

FIG. 93 illustrates one embodiment of a contoured package. FIG. 94 illustrates the film layer of the first and second sheets corresponding to the contoured package of FIG. 93. As illustrated in FIGS. 93 and 94, the line of reduced strength formed in the second sheet between the boundary between the side wall portions and face portions are curved. The curvature of the line of reduced strength 666 in these regions will induce the first sheet to preferentially form package edges having a substantially similar curvature. The curvature of the side walls 668 can also be controlled using the second sheet. For example, as illustrated in FIG. 93, the side walls 667 curve inward. Such curvature can be achieved, for example, by forming the side wall portions 660 of the second sheet to have a terminal edge 670 that has a curvature corresponding to the curvature of the line of reduced strength. 666. In the embodiment of FIGS. 93 and 94, the second sheet is provided with two opposed side portions 660, extending from adjacent ends of the first face portion 654 (disposed in the front panel). Each side portion 660 terminates in a curved edge 670. The curvature of the curved edge 670 can be similar or the same as, for example, the curvature of the lines of reduced strength 666. The second face portion 656, which is disposed on the back wall includes opposed terminal edges 672 that have a curvature that is the same as the curvature of the lines of reduced strength 666 and correspond in location of the lines of reduced strength 666. Alternatively, the second face portion 656 can include side portions extending therefrom, as with the first face portion, and lines of reduced strength having a curvature can be provided in the second sheet at the boundary between the second face portion and the side portions, as with the first face portion. The embodiment of FIGS. 93 and 94 also do not include a tuck portion. However, such portions can optionally be included in this or any of the described embodiments.

FIG. 94 also illustrates an embodiment in which the bottom panel 674 includes an optional reinforcing sheet 676. The reinforcing sheet 676 can be similar to the second sheet and can be optionally attached or detached (as shown in the figure) from the second sheet. The reinforcing sheet can be disposed on either the exterior of the first sheet or the interior of the first sheet. The reinforcing sheet can be optionally dimensions to reside only in the bottom wall region. Additionally, a third sheet can be provided on the interior or exterior of the first sheet, as described above, to further provide reinforcing. The third sheet, when provided in a region corresponding to the second sheet can be similarly perforated or scored for preferential folding of the first sheet.

Figure 95:
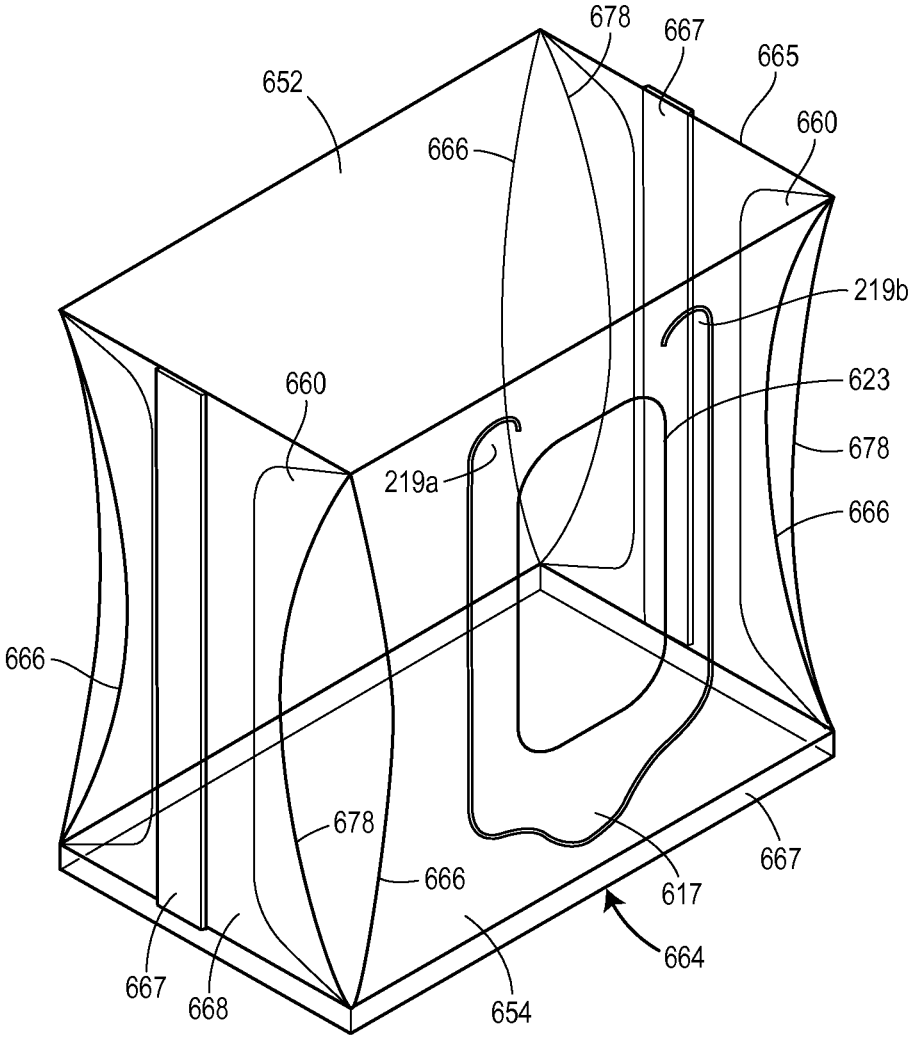
FIG. 95 is a schematic illustration of a contoured package in accordance with another embodiment of the disclosure.
Figure 96:
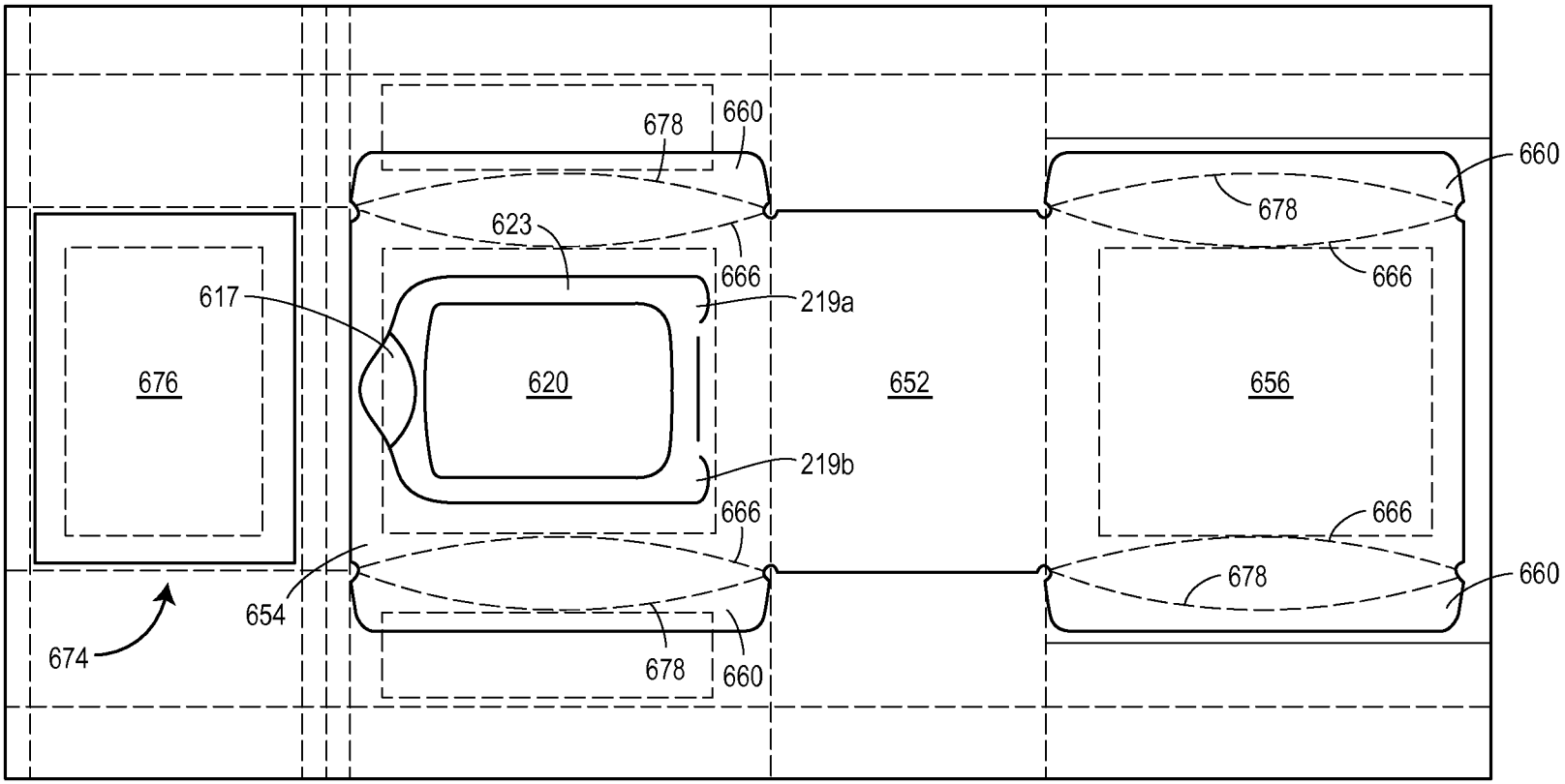
FIG. 96 is a schematic illustration of a film layout for the contoured package of FIG. 95.

FIGS. 95 and 96 (package and film layout, respectively) illustrate another embodiment of a contoured package. In the embodiment of FIGS. 95 and 96, lines of reduced strength 666, 678 are provided as mirror images about the boundary between the side wall portions and the face portions, with one line of reduced strength extending into the face portion and one line of reduced strength extending into the side wall portion. As illustrated in FIG. 95, the mirror image lines of reduced strength provide a contour package having side walls shapes that are distinct from that illustrated in FIG. 93, thus illustrating the ability of the controlled and selective perforation of scoring of the section sheet in controlling the contour of the package. In the embodiment of FIG. 95, the side walls include two angled portions and a flat portion raised above the angled portions, the flap portion having the seal.

Figure 97:
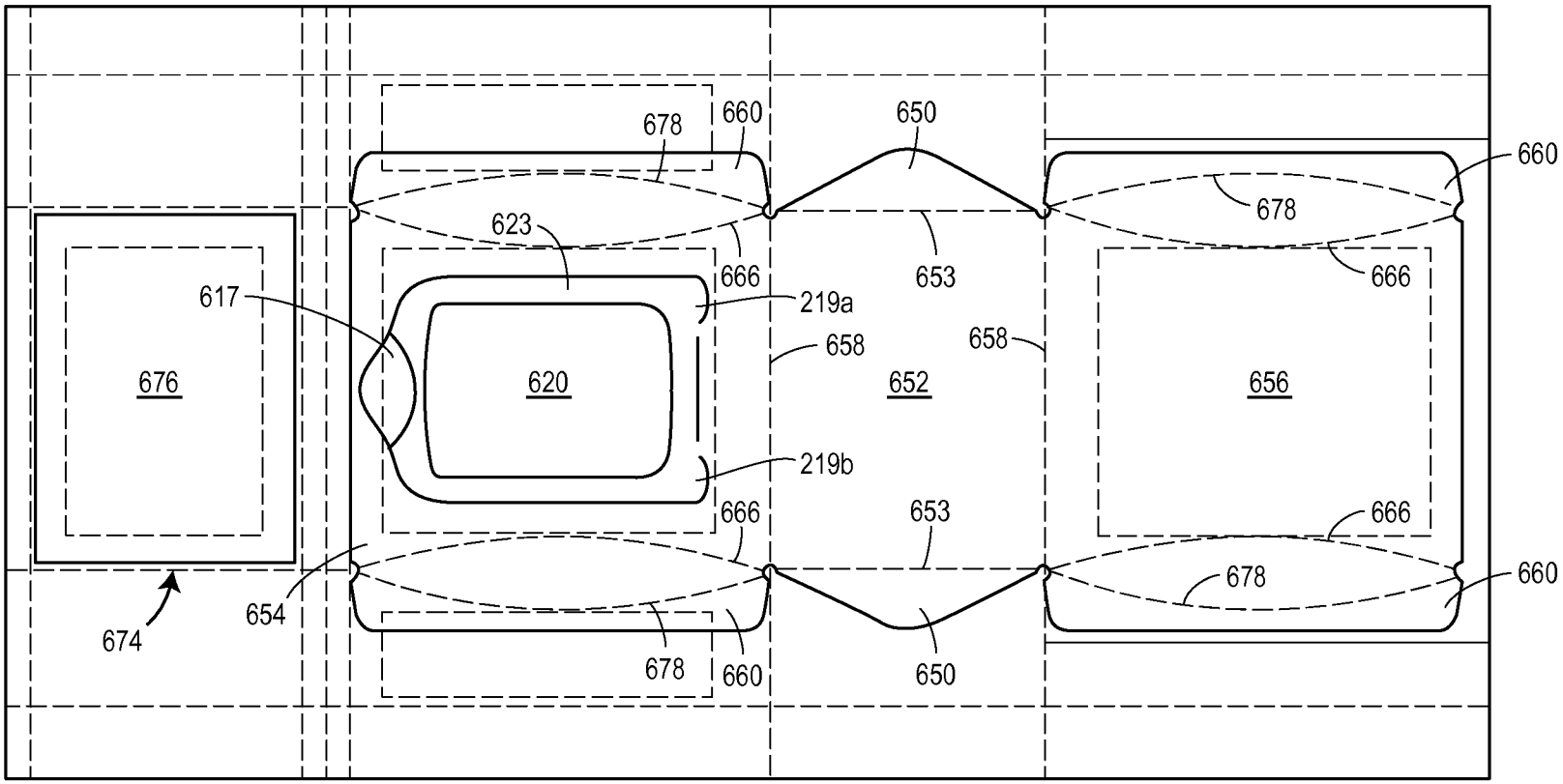
FIG. 97 is a schematic illustration of a film layout for a contoured package in accordance with an embodiment of the disclosure.
Figure 98:
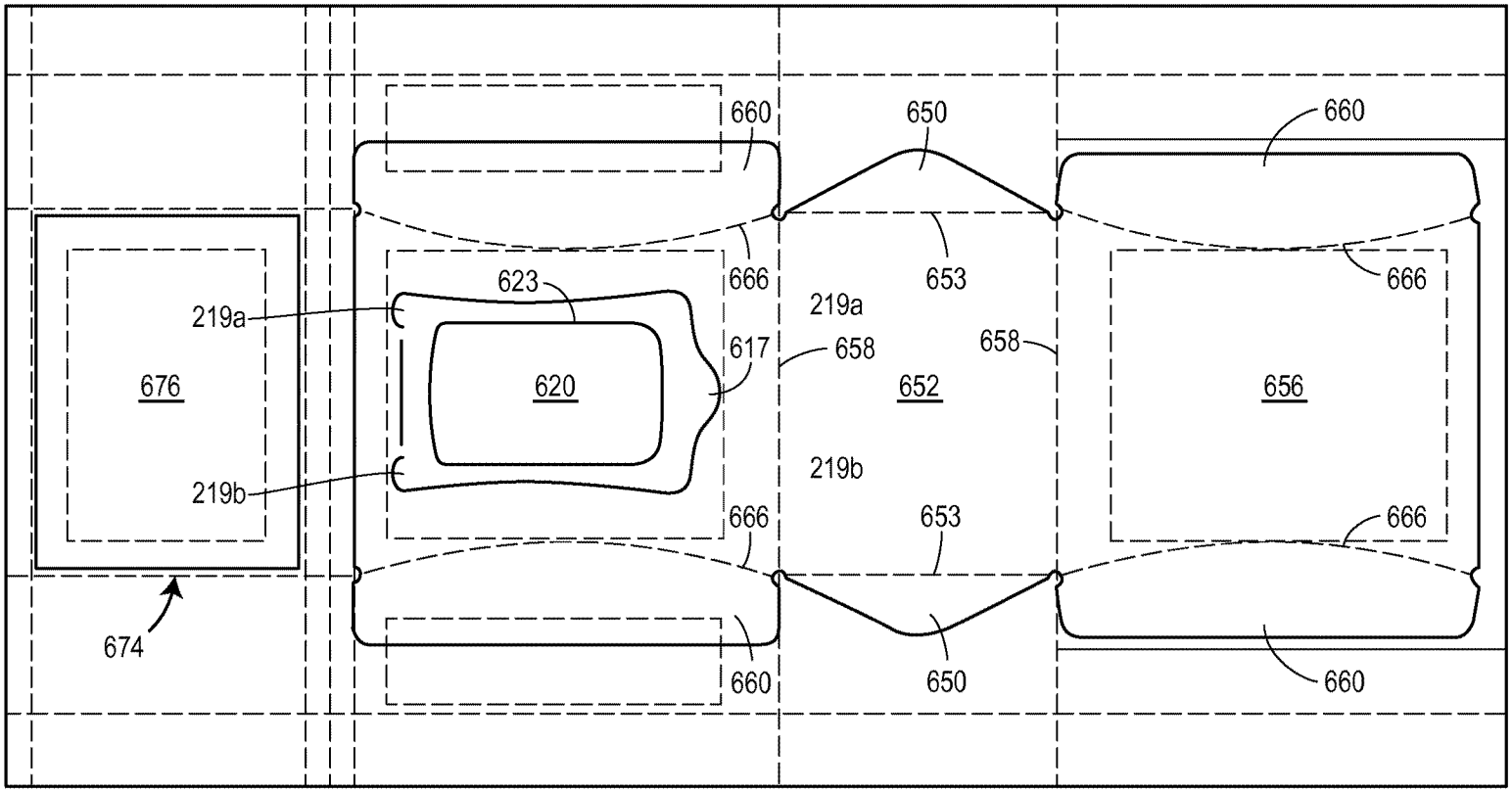
FIG. 98 is a schematic illustration of a film layout for a contoured package in accordance with another embodiment of the disclosure.

FIGS. 97 and 98 illustrate other configurations of film layouts for achieving preferential folding of a first sheet into a contoured package configuration.

Other configurations and contours are contemplated and can be achieved by modification of the curvature of the line of reduced strength at the boundary between the side wall portions and the face portions, the shape of the terminal edge of the side wall portion, and/or secondary lines of reduced strength including in the side wall portion. Additionally, one or more of the regions described as having lines of reduced strength could also alternatively be mechanically creased prior to folding the first sheet into the package configuration.

The features described above, including the percent cuts or penetration of the various lines of reduced strength that can be included in the second sheet are applicable to the contoured packages, as well.

Any of the above package configurations can include a pull tab 617. The pull tab can extend up to or past an adjacent edge of the container for easy gripping. In some embodiments, it may be advantageous to space the pull tab a distance away from an edge of the container, for example at least about 0.03 inches to about 0.1 inches, about 0.05 inches to about 0.8 inches, about 0.4 to about 0.6, and about 0.02 to about 0.9 inches from the edge of the container. Other spacings include, for example, about 0.03, 0.04, 0.05, 0.06, 0.07, 0.08, 0.09, and 0.1 inches. Such spacing can be advantageous if the pull tab extends adjacent to a line of reduced strength in the second sheet. Such spacing can assist in maintaining strength at the edge having the line of reduced strength. Extension of the pull tab up to or past the line of reduced strength, however, is also contemplated.

In any of the foregoing embodiments, the second sheet can include apertures or be otherwise dimensioned such that the second sheet does not extend over one or more corners of the package. For example, FIG. 90 illustrate a film layout in which corner reliefs 678 are provided at each of the four corners of the top panel. Corner reliefs 678 can be provided at any number of the corners of the package. The corner relief 678 are arranged such that the second sheet 616 is disposed around and not over the one or more corners. While corners can be formed with the second sheet 616 being disposed in the corner regions, such corners may be sharp and displeasing to the user when gripping the container.

In one embodiment, the opening is disposed on the front or back wall and arranged such that the pull tab extending from the resealable flap extends toward a bottom panel of the package. The bottom panel can optionally include a corner seal 677, for example, as illustrated FIG. 95. In such embodiments, extension of the pull tab toward the corner seal 676 can allow a user to grip the corner seal 676 and the pull tab 617 when opening the package to provide better gripping of the package when opening the package.

Flexible Materials For Forming Flexible Containers

A flexible material 400 for forming a flexible package 400 includes an opening panel region 420 that is configured to define a panel of the package having an opening for accessing the internal volume of the package (also referred to herein as an opening panel). For ease of reference, the FIGS. 30*a-c*, and 50-51 illustrate formed features 422 in the opening panel region 420 that correspond to the closure assembly. It should be understood that the formed feature need not be included in the flexible material 400 and can be formed during forming of the package, as described herein. The flexible material 400 can further include one or more wall regions 424 that are configured to define one or more walls of the flexible package, including, for example one or more side wall and/or a bottom wall.

The flexible material can be provided as a web of material capable of forming a plurality of packages, which can be rolled into a flexible material roll. The flexible material can include a plurality of opening panel regions and optionally a plurality wall regions discretely spaced along a longitudinal direction of the flexible material, wherein the plurality of opening panel regions and the plurality of wall regions comprise the first sheet. That is, the first sheet can be a common sheet material extending between each of the plurality of regions configured to be folded or formed into the plurality of packages. The flexible material can further include a plurality of second sheets and/or third sheets in the opening panel regions and wall regions as described below.

The flexible material includes a first sheet 414, which as disclosed above is configured to be formed into the opening panel and provide an opening and/or can be configured to be formed into more walls of the first sheet 414. The opening panel region 420 and one or more wall regions 424 comprise the first sheet 414. The flexible material 400 can further include a second sheet 416 that is secured to the first sheet 414 in the opening panel region 420. In various embodiments, the second sheet or at least a portion thereof is thermoformable.

As used herein the term "secured" refers joining of one layer or sheet to another layer or sheet and can include intermediate layers or adhesives. Layers or sheets can be joined using any known methods including adhesive, heat sealing, ultrasonic sealing, welding, crimping, and combinations thereof. It should be understood herein that unless otherwise specified, sheets or layers can be secured in whole or in part to another sheet or layer. Layers or sheets can be permanently secured or releasable secured. As used herein, the term "permanently secured" refers to a connection between two adjacent layers or sheets that requires at least partial destruction of the one or both of the layers or sheets to separate the layers or sheets at the connection. As used herein, the term "releasable secured" refers to a connection between two adjacent layers or sheets such that the layers or sheets can be separated substantially without destruction. In some embodiments, two sheets can be resealably secured, meaning that the sheets layers can be separated and then re-secured without application of a further adhesive or seal.

Figure 50:
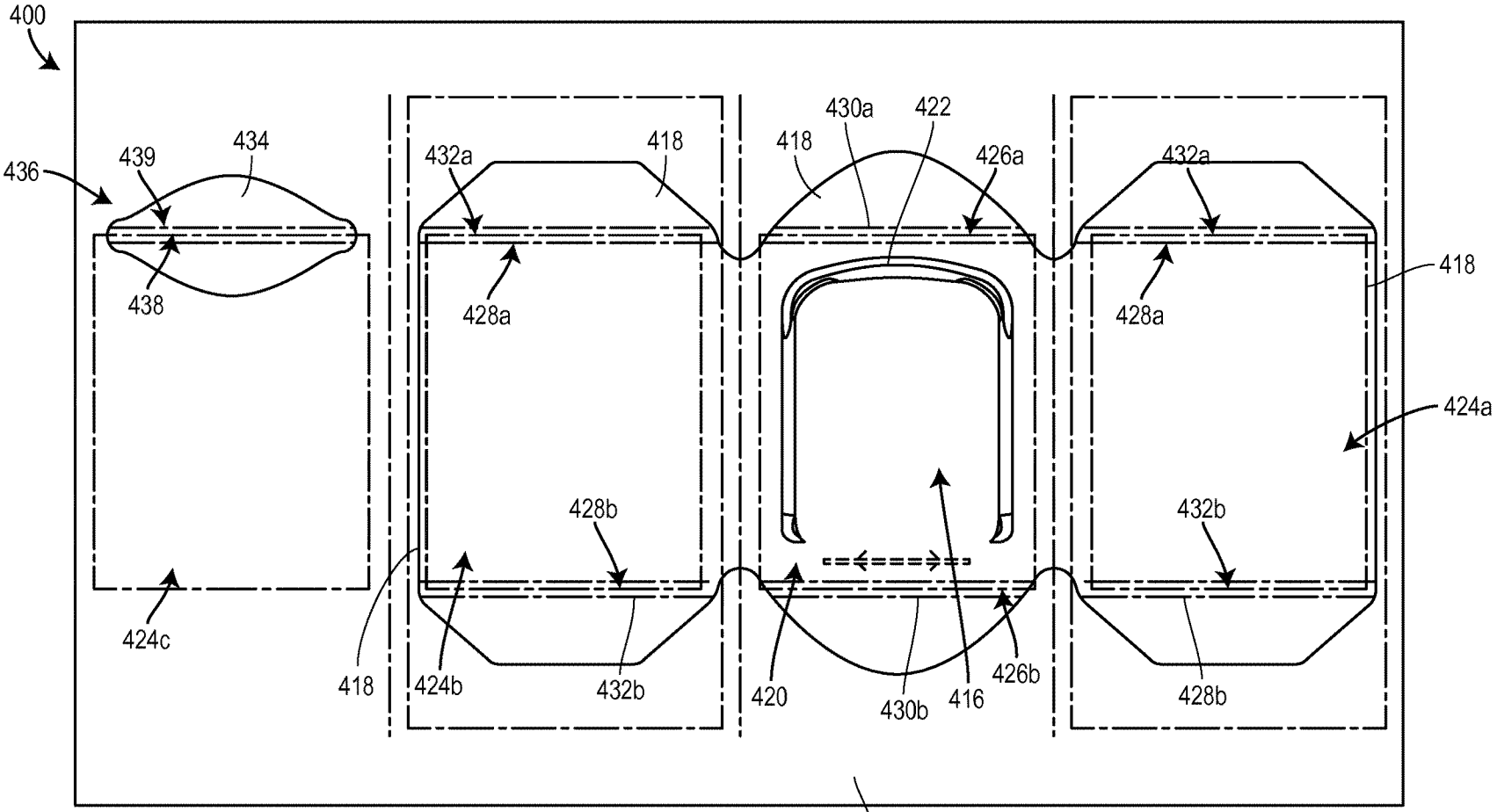
FIG. 50 is a schematic illustration of a flexible material in accordance with an embodiment of the disclosure.
Figure 51:
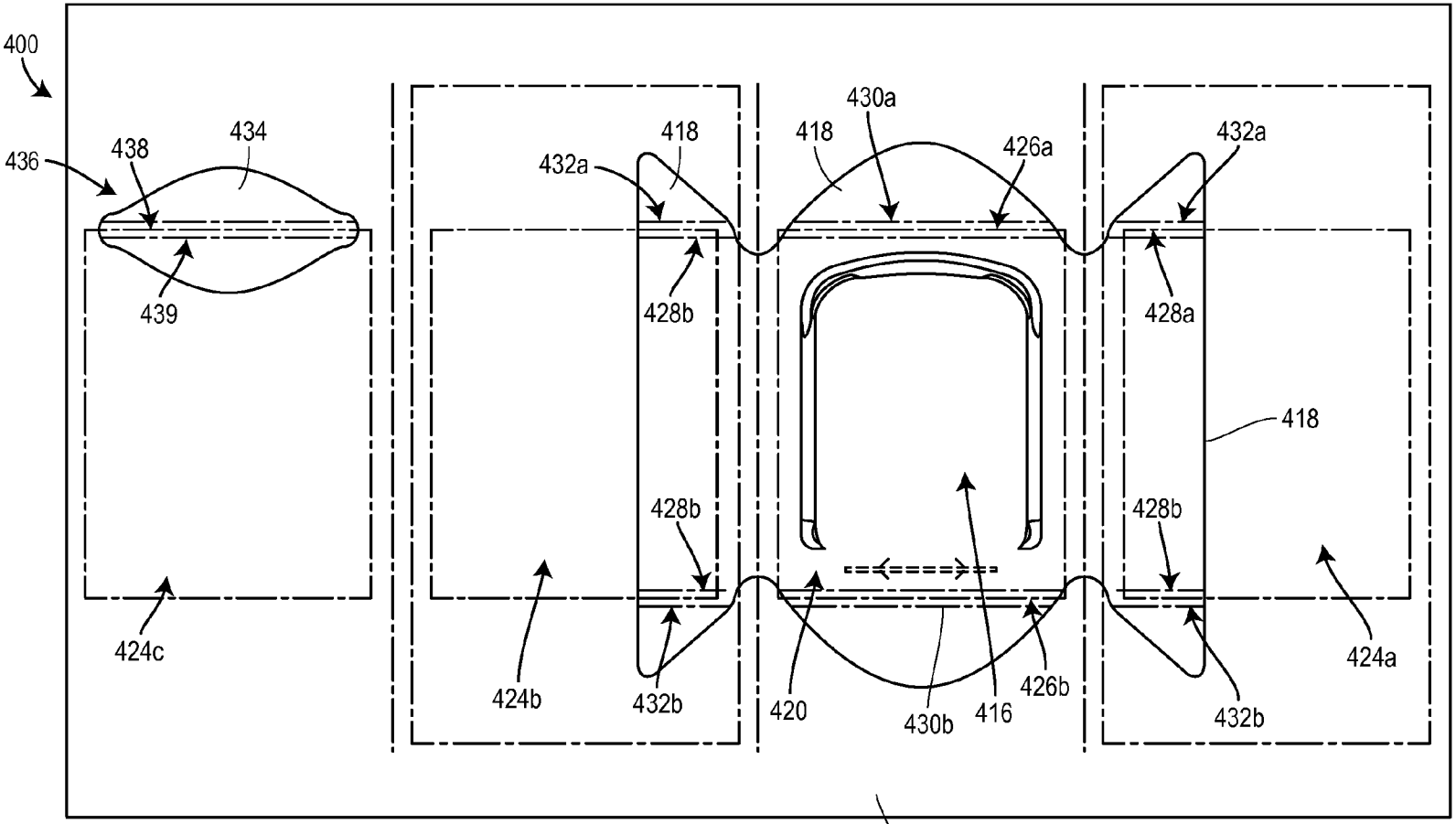
FIG. 51 is a schematic illustration of a flexible material in accordance with an embodiment of the disclosure.

The flexible material can further include a third sheet 418 secured to the first sheet 414 at least in the opening panel region 420. In one embodiment, the third sheet 418 is secured to the first sheet 414 and the second sheet 416 is secured to the third sheet 418. In another embodiment, the first sheet 414 is disposed between the second and third sheets 416, 418. As described in detail below, the third sheet 418 can additionally or alternatively be secured to the first sheet 414 in the one or more wall regions 424 of the flexible sheet 400. The third sheet 418 can partially or completely overlap with first sheet in the opening panel region 420 and/or the one or more wall regions. For example, FIG. 50 illustrates an embodiment wherein the third sheet 418 completely overlaps with the first sheet in the opening panel region 420 and two adjacent wall regions 424*a*, 424*b*. FIG. 51 illustrates an embodiment wherein the third sheet 418 only partially overlaps with the first sheet 414 in two adjacent wall regions 424*a*, 424*b*.

Figure 30A:
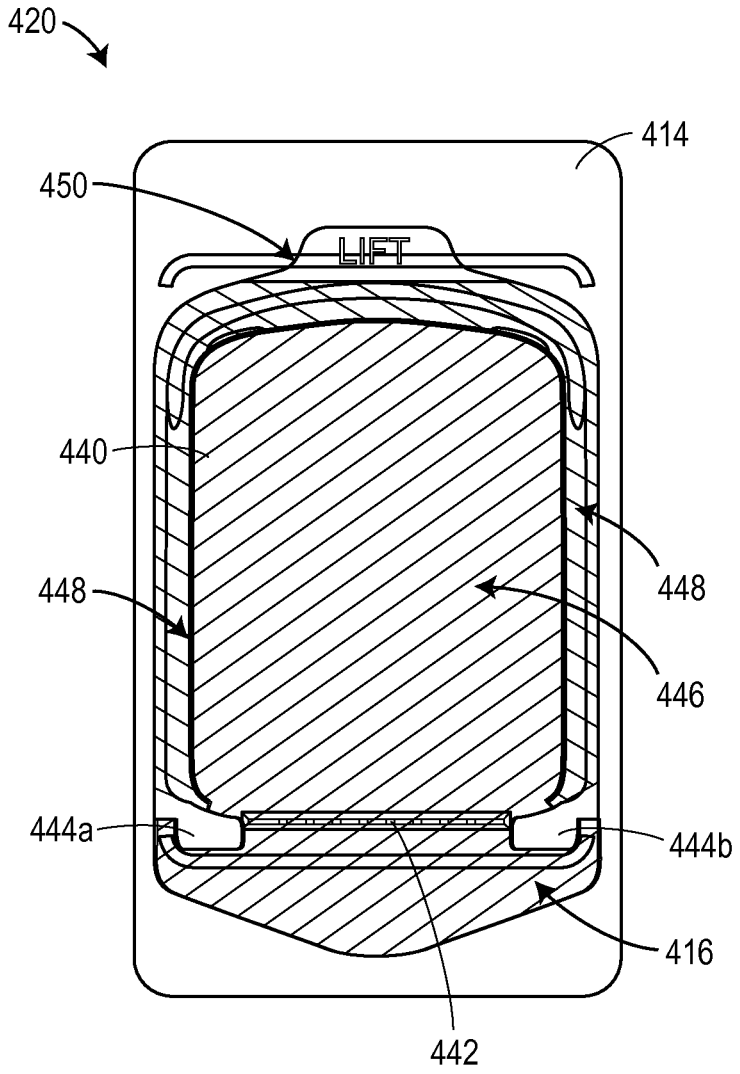
FIGS. 30*a*-30*c* are schematic illustrations of an opening panel region of a flexible material in accordance with embodiments of the disclosure, illustrating the zones of the opening panel region.
Figure 30B:
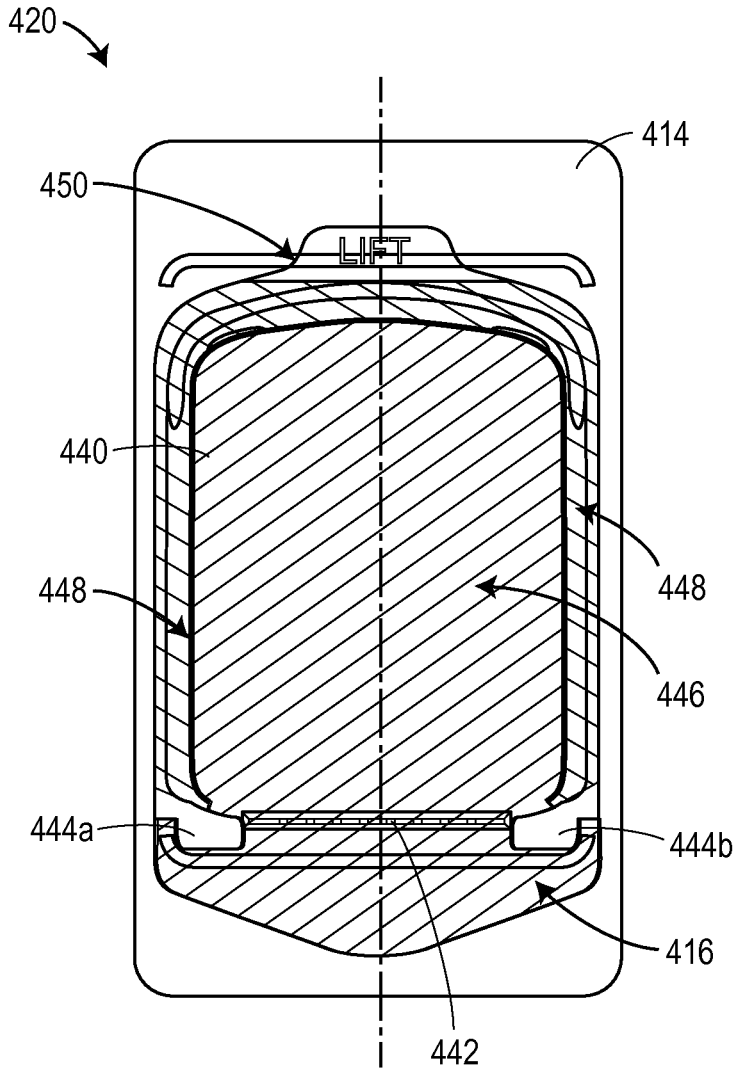

Referring to FIG. 30*b*, which illustrates an opening panel region of the flexible material, the flexible material can include a line or path of reduced strength 440 in the first sheet 414 of the opening panel region 420 that is configured to define the opening of the package. In embodiments in which the flexible material 400 further includes a third sheet 418, a line or path of reduced strength can be provided in the third sheet to define the opening through the first and third sheets 414, 418. As used herein, the terms "line of reduced strength" and "path of reduced strength" are used interchangeable and can be straight, curved, or have any suitable shape. A line or path of reduced strength can be formed in a flexible material or sheet using any known method including, for example, laser scoring, mechanical scoring or a similar process for forming perforations. Perforations can either puncture the sheet or be provided without puncturing the sheet if desired.

The flexible material can further include a line or path of reduced strength 442 or a continuous cut defining in the second sheet 416 in the opening panel region 420 that is configured to define a hinge 442 about which a lid 26 of a closure assembly 22 of the package can pivot. Additional cuts or lines or paths of reduced strength 444*a*, 444*b* can be provided in the second sheet 416, if desired, to define first and second projections 219*a*, 219*b* of the closure assembly as described in detail below. The cuts or paths or lines of reduced strength for the hinge (442) and the projections 219*a*, 219*b* can be provided in the second sheet such that they do not overlap with each other or with a line or path of reduced strength 440 defining the opening of the package. This can help to ensure that the package remains hermetically sealed prior to first use.

In various embodiments, as illustrated in FIGS. 50 and 51, the third sheet 418 can be a single sheet that extends across one or more regions of the flexible material, for example, the opening panel region 420 and one or more wall regions 424. In other embodiments, the third sheet 418 can be provided as separated sheets overlapping with the first sheet 414 in one or more regions of the flexible material. The third sheet can be between boundaries 426*a*, 426*b*, 428*a*, 428*b*, of a region as illustrated in FIGS. 50, 51. Alternatively, the third sheet 418 can extend only partially in a face of a region and/or can be provided as separated sheets that overlap with the boundaries but are not contiguous. FIG. 50 illustrates a third sheet portion 434 that extends only partially in the face of the region. As described in detail below, the third sheet portion 434 can in some embodiments be selectively placed at a boundary in a tuck folding region of the flexible material. In such embodiments, the third sheet portion 434 is also referred to herein as a fourth sheet 434. It should be understood herein that in such embodiments the fourth sheet can be same or a different material as the third sheet.

Referring to FIGS. 50 and 51, in some embodiments, the flexible material can include first 414, second 416, and third 418 sheets in the opening panel region 420. The opening panel region 420 can have first and second boundaries 426*a*, 426*b* that are configured to define first and second edges of the opening panel of the package. The third sheet 418 can overlap with one or both of the first and second boundaries 426*a*, 426*b* and optionally extend past the boundary and be secured to the first sheet 414 on opposed sides of the boundary. The third sheet 418 can further include a line of reduced strength 430*a*, 430*b* in the portion of the third sheet 418 that overlaps with the boundary 426*a*, 426*b*. As shown in FIG. 50, the line of reduced strength 430*a*, 430*b* can be defined by one or more paths or lines of reduced strength, for example, two paths of reduced strength disposed on opposed sides of the boundary. Extension of the third sheet 418 to overlap with one or more boundaries and even extend past the boundary can beneficially strengthen a corner or edge of the package when formed. The line of reduced strength facilitates bending of the secured first and second sheets 414, 416 in the region of the corner or the edge and can aid in the defining a sharp or curved edge of the package that has improved rigidity. As described in detail below, this can also aid in defining the shape of the packaging, and in some embodiments can aid the film to preferentially form into the defined package assembly shape during processing. As illustrated in FIG. 50, the extension of the third sheet 418 to overlap with the boundary of a region can be provided in any one of the regions of the film including the opening panel region and one or more wall regions. FIG. 50 illustrates an embodiment in which the third sheet 418 is secured to the first sheet 414 in the opening panel region 420 and two adjacent wall regions 424*a*, 424*b*. In this embodiment, the third sheet overlaps and extends beyond the boundaries 426*a*, 426*b*, 428*a*, 428*b*, of the opening panel region and the wall regions. In the embodiment of FIG. 50, the third sheet 418 overlaps substantially along the entire length of the boundaries. As illustrated in FIG. 51, the third sheet 418 can overlap with only a portion of the boundaries in one or more of the regions. Additionally, the third sheet may overlap with both the opposed boundaries 426*a* and 426*b* and 428*a* and 428*b* of the region. If desired, however, the third sheet can overlap with only one boundary.

In some embodiments, for example, for flexible materials for quad-seal packages as described in U.S. Patent Application Publication No. 2012/0312868, the flexible film can include at least one tucking region 436 that is adjacent to a boundary of the opening panel region and/or a boundary 438 of at least one wall region 424*c* (as illustrated in FIG. 50). The tuck folding region is configured to be tucked inward to define an edge of wall or panel of the package. The flexible film can include a fourth sheet 434 secured to the first sheet in the tuck folding region 436. As described above with the third sheet, the fourth sheet can include a line of reduced strength 439 in the region of the boundary 438 to facilitate folding the flexible film into the tuck fold. The fourth sheet 434 can provide improved rigidity to the edge of the package at the tuck fold, which in turn can provide improved rigidity to the panel or wall of the package adjacent to the tuck fold. In some embodiments, as noted above, the third sheet 418 can function as the fourth sheet 434 and be disposed in the tuck folding region. For example, the flexible material can be folded into the package such that tuck fold regions are provided at the boundaries of the opening panel region. Extension of the third sheet 418 past the boundary as illustrated in FIG. 50 can result in the third sheet 418 extending into and supporting the tuck fold, as described with respect to the fourth sheet 434.

Figure 31:
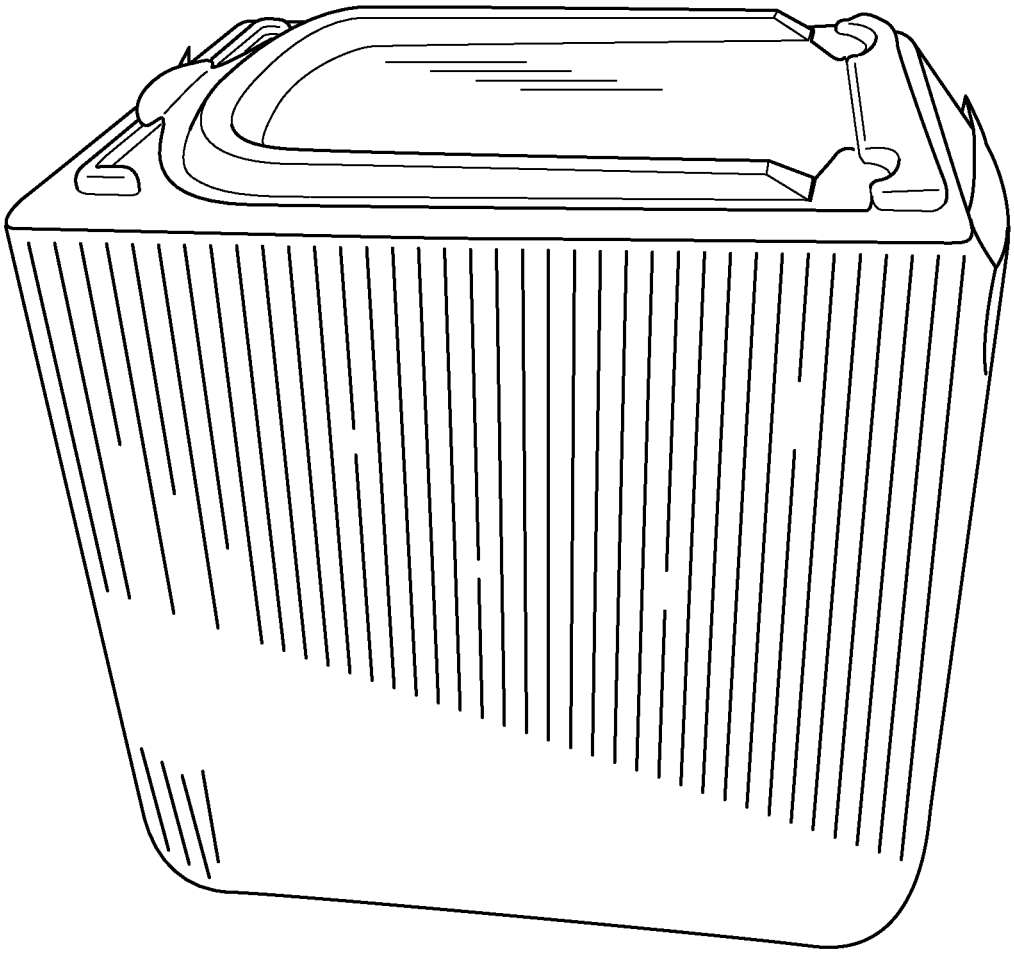
FIG. 31 is a perspective view of a container in accordance with an embodiment of the disclosure, the containing having a portion of film that is transparent or translucent to provide a window through which the product disposed in the container can be viewed.
Figure 47:
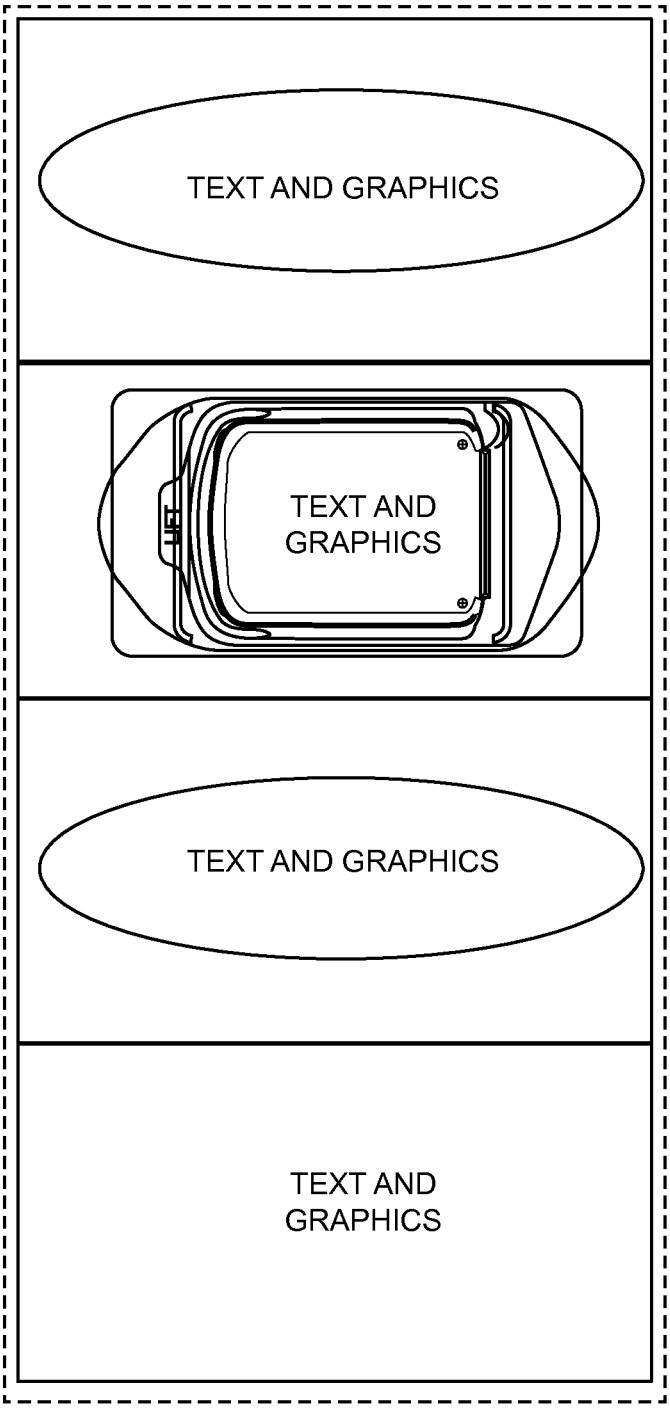
FIG. 47 is a first example of a graphical layout for the patterning and/or coloring on the film.
Figure 48:
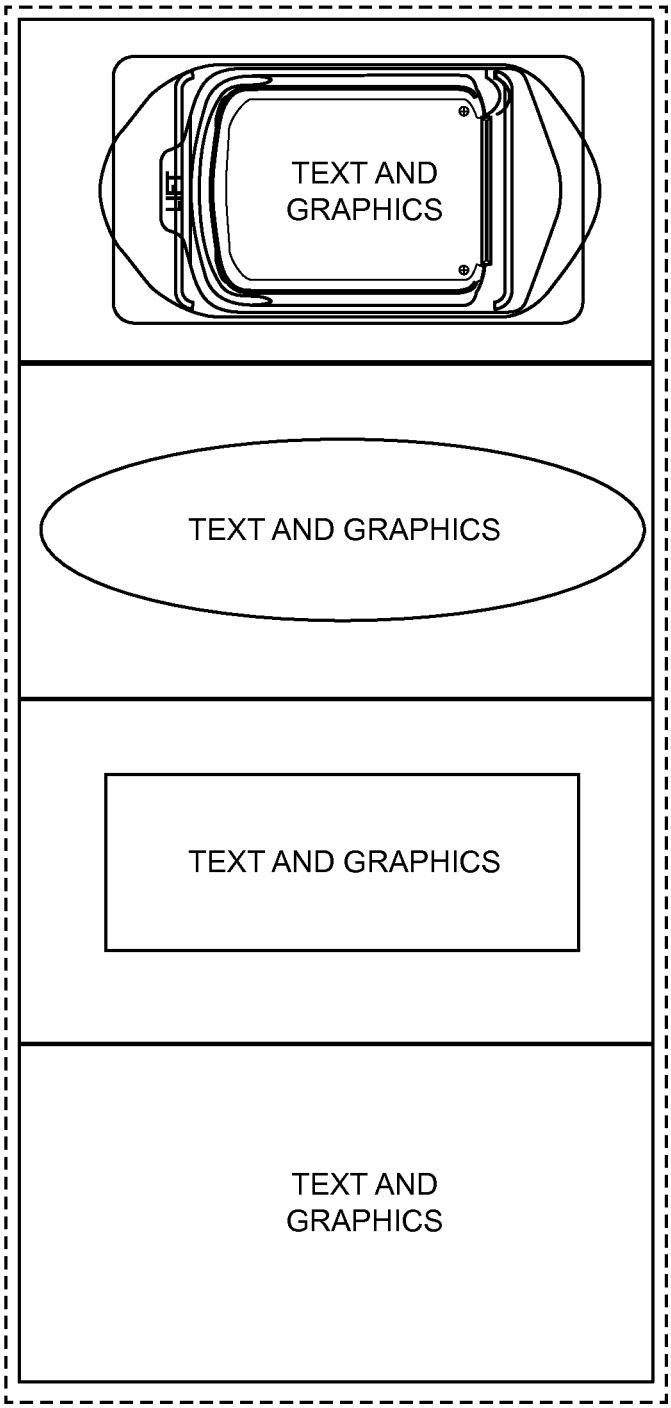
FIG. 48 is a second example of a graphical layout for the patterning and/or coloring on the film.

The film can include any suitable printing and/or graphics. For example, all or portions of the film can be colored. Referring to FIG. 31, in one embodiment, the film can be colored such that a portion of the film remains transparent or translucent to provide a window for viewing the product contained therein. The graphical layout for the patterning and/or coloring on the film can be adapted based on the package configuration and graphics to be displayed on the package. In embodiments in which a closure assembly is formed into the lid, the graphical layout illustrated in FIG. 47 can be used when the lid-forming process is performed on the side of the forming tube. In other embodiments in which a closure assembly is formed into the lid, the graphical layout illustrated in FIG. 48 can be used when the lid-forming process is performed on the front of the forming tube. The lid forming process can be performed on any one side of the forming tube. For example, in an embodiment multi sides of the forming tube can be used in the lid forming process to provide alternative formation of the lids on the forming die to increase the per package rate of the forming process.

The First Sheet

The first sheet 414 may have any suitable thickness, and the thickness may be a uniform thickness or may vary. In various embodiments, the first sheet 414 has a nominal thickness of about 1 mils to about 10 mils, about 3 mils to about 9 mils, about 4 mils to about 8 mils, about 5 mils to about 7 mils, about 2 mils to about 6 mils. Other suitable nominal thicknesses include, for example, about 1, 2, 3, 4, 5, 5.1, 5.2, 5.3, 5.4, 5.5, 5.6, 5.7, 5.8, 5.9, 6, 7, 8, 9, and 10 mils. As used herein, the term "nominal thickness" refers to the thickness of a film or sheet material, not including ink or adhesive layers.

Exemplary materials suitable for use as the first sheet 414 include, but are not limited to, a laminate of 150 ga cast polypropylene, 120 ga polylactic acid, and 2.875 mil coex including ethylene vinyl alcohol (EVOH) (12321.302W), a laminate of 150 ga cast polypropylene, 76 ga formable polyethylene terephthalate (PET), and 3.5 mil high clarity polyethylene, a laminate of 140 ga biaxially oriented polypropylene, 92 ga PET, and 3.5 mil high clarity polyethylene. The laminate layers can be adhered together using any suitable adhesives. The thicknesses referred to in this paragraph are nominal thicknesses of the laminate layers. As desired inks to color or apply graphics to the film can be applied between the laminate layers or can be applied to an exposed surface of the film.

The material can be selected based on the product to be incorporated therein. For example, for salty snack foods, the material of the package film generally provides one or more of a moisture barrier to keep the food crisp, an oxygen barrier to reduce rancidity of the oils that are often used as ingredients or cooking aids for the product, and a light barrier to reduce the presence of light in the package, which for some products can cause or increase rancidity of the product. FIG. 69 illustrates a number of exemplary embodiments of two-ply and three-ply films suitable for use with various embodiments of the disclosure.

The first sheet can be polypropylene, which can provide good moisture barrier properties. The polypropylene can be metalized to improve the moisture barrier properties as well as provide oxygen barrier properties and reduce light transmission. Other exemplary materials include, for example, polyesters, such as PET, and nylons, such as polyamides.

As described above the first sheet can be a composite or laminate structure. For example, in some embodiments, the material of the first sheet can include a polyethylene as a tie or adhesion layer between two layers of polypropylene. Such layering can improve the ability of the film to resist tearing or tear propagation. Sealants can also be used in the film. Sealants can be provided as coextrusions (i.e., as distinct layers within a film), blends (mixtures of polymers in a single layer), and combinations thereof. Suitable sealants include linear low density polyethylene, ultra low density polyethylene, high density polyethylene, metallocene, plastomer, hexene, butene polyethylenes and combinations thereof. Other sealants include EVA copolymers, SURLYN® (Ionomers), and ethylene methacrylic acid (EMA), and ethylene acrylic acid (EAA).

Additional coatings or structure can be added to base material or laminate of the first sheet to enhance desired properties. For example, PVDC (SARAN®) can be coated on first sheet material to enhance the oxygen barrier properties. Acrylic coating can be applied to the first sheet material to provide the desired surface energies and characteristics for enhancing the efficiency of processing the film on a packaging machine.

The Second Sheet

The second sheet may be formed from materials such as polypropylene (PP), ethyl vinyl alcohol, polylactic acid (PLA), polyethylene terephthalate (PET), polyethylene (PE), EVA co-polymers, foil (such as aluminum foil), paper, polyester (PET), nylon or poly amide (PA), and laminates and composites thereof.

In various embodiments, the second sheet can be a resealable label. For example, the resealable label can be as described in U.S. Pat. Nos. 6,113,271, 6,918,532, 7,344,744, 7,681,732, and 8,182,891, the disclosures of which are incorporated herein by reference. For example, the resealable label 20 can be formed by delaminating a web of pressure sensitive film, for example, bi-axially oriented polypropylene (BOPP) film, having a resealable pressure sensitive adhesive, from a release liner. Other suitable materials for the resealable label include, for example, EarthFirst® polylactic acid (PLA), BOPP (for example clear or white), polystyrene (PS), and polyethylene terephthalate (PET). Any other known resealable label materials can also be used. The resealable label can also include any known pressure sensitive adhesive, including but not limited to, emulsion acrylic and solvent acrylic. Suitable labels are commercially available as well, such as the Avery Dennison R5195 and R5423 labels, and Flexcon V-312, V-314, and V-233 labels.

The second sheet can have any suitable thickness. For example, the second sheet can have a nominal thickness in a range of about 1 mils to about 30 mils, about 1 mil to about 15 mil, about 2 mil to about 10 mils, about 3 mils to about 7 mils, about 4 mils to about 10 mils, about 7 mils to about 12 mils, about 10 mils to about 30 mils, about 1 mil to about 10 mil, about 11 mils to about 25 mils, or about 1 mil to about 8 mils. Other suitable nominal thicknesses include, for example, about 1, 2, 3, 4, 5, 6, 7, 8, 8, 9, 10, 11, 12, 13, 14, 15, 16, 17, 18, 19, 20, 21, 22, 23, 24, 25, 26, 27, 28, 29, and 30 mils. In one embodiment, the second sheet is formed of 10 mil (nominally thick) PET. In some embodiments, the second sheet can be adhered to the first sheet such that at least a portion of the second sheet is adhesively resealable to the first sheet. For example, a portion of the second sheet can be attached to the second sheet using a resealable adhesive. In an embodiment, a portion of the second sheet is permanently adhered to the first sheet such that the second sheet cannot be completely removed from the first sheet. As used herein the term "permanently adhered" refers to bond between the sheets cannot be broken without at least partial destruction of at least one of the sheets.

In other embodiments, the second sheet is not resealably adhered to the first sheet, but with at least a portion of the second sheet being removable from the first sheet. For example, the second sheet can be adhered to the first sheet such that the second sheet has a peel strength in a range of 500 to 1200 grams/inch when peeled from cast polypropylene film. The cast polypropylene film can have, for example, a surface energy in a range of about 30 dynes/cm to about 50 dynes/cm, about 32 dynes/cm to about 44 dynes/cm, about 32 dynes/cm to about 36 dynes/cm, about 45 dynes/cm to about 50 dynes/cm, about 30 dynes/cm to about 45 dynes/cm, and about 40 dynes/cm to about 50 dynes/cm. Other suitable surface energies include about 30, 31, 32, 33, 34, 35, 36, 37, 38, 39, 40, 41, 42, 43, 44, 45, 46, 47, 48, 49, or 50 dynes/cm. The second sheet is selected and adhered to the first sheet such that there is no residual stickiness once the package is opened and at least a portion of the second sheet is pulled away from the first sheet. In some embodiments, portions of the adhesive used to adhere the second sheet to the first sheet can be deadened, for example by using a varnish or lacquer, in regions in which it is undesirable to include an adhesive. For example, regions of the adhesive can be deadened to facilitate opening of the package and reduce the strength required to open a package. In some embodiments, the second sheet is adhered to the first sheet using an adhesive and upon peeling of the second sheet from the first sheet, there is no adhesive transfer to the first sheet.

In some embodiments, for example, embodiments in which a moist or wet product is to be stored in the package, a moisture-resistant adhesive can be used to adhere the first and second sheets. For example, the moisture-resistant adhesive can be a non-whitening adhesive. As used herein the term "non-whitening adhesive" refers to adhesives that are not aesthetically changed when contacted with water or moisture. As described in detail below, the package can further include a third sheet attached to the first sheet in the region of the opening. The third sheet can add stability to the region about the opening by increasing the gauge of the package in that region. In one embodiment, the third sheet is applied to the first sheet on a surface opposite to the surface to which the second sheet is applied. In another embodiment, the third sheet is applied to a surface of the first sheet and the second sheet is applied to a surface of the third sheet.

The Third Sheet

The third sheet may be formed from materials such as polypropylene (PP), ethylene vinyl alcohol, polylactic acid (PLA), polyethylene terephthalate (PET), polyethylene (PE), EVA co-polymers, foil (such as aluminum foil), paper, polyester (PET), nylon (poly amide), and laminates and composites thereof.

The third sheet can have any suitable thickness. For example, the third sheet can have a thickness in a range of about 1 mil to about 15 mil, about 2 mil to about 10 mils, about 3 mils to about 7 mils, about 4 mils to about 10 mils, or about 7 mils to about 12 mils. Other suitable thicknesses include, for example, about 1, 2, 3, 4, 5, 6, 7, 8, 9, 10, 11, 12, 13, 14, and 15 mils. In one embodiment, the third sheet is formed of 10 mil PET. In another embodiment, the third sheet is formed of a laminate of PLA and EVOH and has a thickness of 7 mil.

The third sheet can be attached to the first sheet using any known permanent adhesion methods, such as for example, heat sealing and application of permanent adhesives.

Depending on the end use of the product, the film, including the first, second and optional third sheets and any adhesives or inks used therein can be formed with FDA compliant materials.

Zoned Attachment

In various embodiments, the second sheet can be adhered to the first sheet (or in some embodiments a third sheet disposed on the portion of the first that defines the exterior portion of the package) using zoned adhesion. For example, the overprint varnish (deadening agent) can be printed upon a heat sealable layer, for example, a cast polypropylene, at 0% to 100% screening levels, for example, in 10% increments. For example, either 10% or 20% or 30% etc of the surface up until we screen off (or cover) 100% of the surface with the deadening agent. A lidding film can be sealed to the various samples. Peel strength can be measured. The samples can be sealed at 300'F, 1.0 second dwell to various OPV coverage areas for purposes of measuring peel strength. Some exemplary coverages and peels strength are illustrated below.

| Overprint Varnish Coverage (%) | Peel strength (gms) | Description |
|---|---|---|
| 0 | 1350 | sealed - frangible - peeled |
| 10 | 1560 | sealed - frangible - peeled |
| 20 | 1660 | sealed - frangible - peeled |
| 30 | 1510 | sealed - frangible - peeled |
| 40 | 1710 | sealed - frangible - peeled |

-continued

| Overprint Varnish Coverage (%) | Peel strength (gms) | Description |
|---|---|---|
| 50 | 1380 | Half - (sealed - frangible - peel) and half peeled |
| 60 | 1130 | not sealed - peeled |
| 70 | 800 | not sealed - peeled |
| 80 | 310 | not sealed - peeled |
| 90 | 180 | not sealed - peeled |
| 100 | 80 | not sealed - peeled |

60% coverage of a deadening agent can provide a significant decrease in the bond strength. Varying the percentage and zoning of the percent coverage of a deadening agent can allow for variations in peel strengths from greater than 100 gms to as low as 80 gms.

The adhesion between the first and second sheet can be defined by a suitable number of zones, with each zone having a different level of adhesion. For example, in one embodiment, the second sheet can be adhered to the first sheet using two adhesion zones. A first zone can be defined by the region that is disposed interior the edge of the opening—that is the region in which the portion of the first sheet separates and is designed to remain adhered to the second sheet upon opening of the package. The second zone can be defined by the region disposed outside of the edge of the opening and to which the second sheet reseals to the first sheet and/or where the closure assembly provides a mechanical closure between formed structures in the first and second sheets to reclose the package. In various embodiments, the first zone can have a greater adhesion than the second zone to facilitate opening of the package. In some embodiments, such as embodiments having a mechanical closure, the second zone can be a region of substantially no chemical adhesion between the first and second sheet, relying instead on the mechanical closure. For example, the second zone can be coated with a deadening agent or varnish to reduce or eliminate any adhesive properties of an adhesive which is applied to adhere the second sheet to the first sheet in the first zone. This can eliminate the need to selectively apply adhesive and can facilitate the manufacturing process. Zoned adhesion can be done with heal sealing techniques, selective application of deadening agents, and/or the selective application of adhesives. An exemplary deadening agent is Sun Chemical Opt-T-Flex overprint varnish.

In the embodiments illustrated in FIG. 30, the adhesion can be provided in three adhesive zones. For example, the first and second sheets are adhered in a zone that defines a portion of the second sheet that is configured to remain adhered to a portion of the first sheet upon opening of the package. A zone can be defined in an overlapping portion provided in a region of the opening, inside the edge of the opening, in which the second sheet is adhered to a portion of the first sheet surrounding the aperture to provide a hermetic seal despite perforations that are provided in the first sheet to define the aperture. The overlapping portion is dimensioned such that a sufficient seal is provided between the first and second sheets to retain a hermetic seal despite perforations in the first sheet used to define the aperture and the second sheet is capable of detaching from the first sheet in the overlapping portion upon opening of the package for the first time when a portion of the first sheet is detached at the perforations or other edge feature defining the opening.

This zone can have an adhesion property such that it is less than the adhesion between the first and second sheet in the first zone, to facilitate opening of the package while maintaining a hermetic seal. Another zone can be defined in a region disposed outside of the edge of the opening. For example, this zone can be defined where the thermoformed features are formed into the first and second sheet to define a closure assembly. This zone can have substantially no adhesion between the first and second sheet to further facilitate opening of the package.

The second sheet can be adhered to the first sheet using an adhesive. A process of zoning the adhesive can include applying a deadening agent to the first sheet in region in which adhesion between the first and second sheet is not desired. An adhesive can then be applied to the entire second sheet and adhered to the first sheet. The deadening agent will eliminate the adhesive properties of the adhesive in the regions in which it is applied, thereby zoning the adherence without need to apply the adhesive in a zoned manner. This can simplify the adhesive application process.

The selective application of the deadening agent or varnish can be accomplished, for example, during the printing process for printing graphics onto the package. This can advantageously provide a rapid process for defining a deadened or reduced adhesive zone with high throughput printing machines.

In some embodiments, the selective application of an adhesive or different types of adhesive can be accomplished using a printing machine, such as for printing graphics on a film package.

In various embodiments, the flexible material can include the first second sheet secured to the first sheet in zones of the opening panel region. As described above, the third sheet can be interposed between the first and second sheets in some embodiments. It is contemplated that the zones and relative peel strengths described below with respect to securing the first sheet to the second sheet in the opening panel region apply to the peel strengths associated with instead securing the second sheet to the third sheet. The peel strength between the first and second sheets 414, 416 in the opening panel region 420 can be defined by a suitable number of zones. Some of the zones can have different peel strengths. As used herein, the term "peel strength" refers to the strength of the adherence of bond between two sheets or layers. In embodiments in which a sheet or layer is permanently secured to another sheet or layer, the peel strength between the layers or sheets is infinite, that is greater than the structural strength of the laminate, as separation of the sheets or layers results in destruction of one or both of the sheets or layers. In embodiments in which two sheets or layers are disposed on each other, but not secured together, there is no peel strength, which is described herein as a peel strength of 0 gms/in.

Figure 30C:
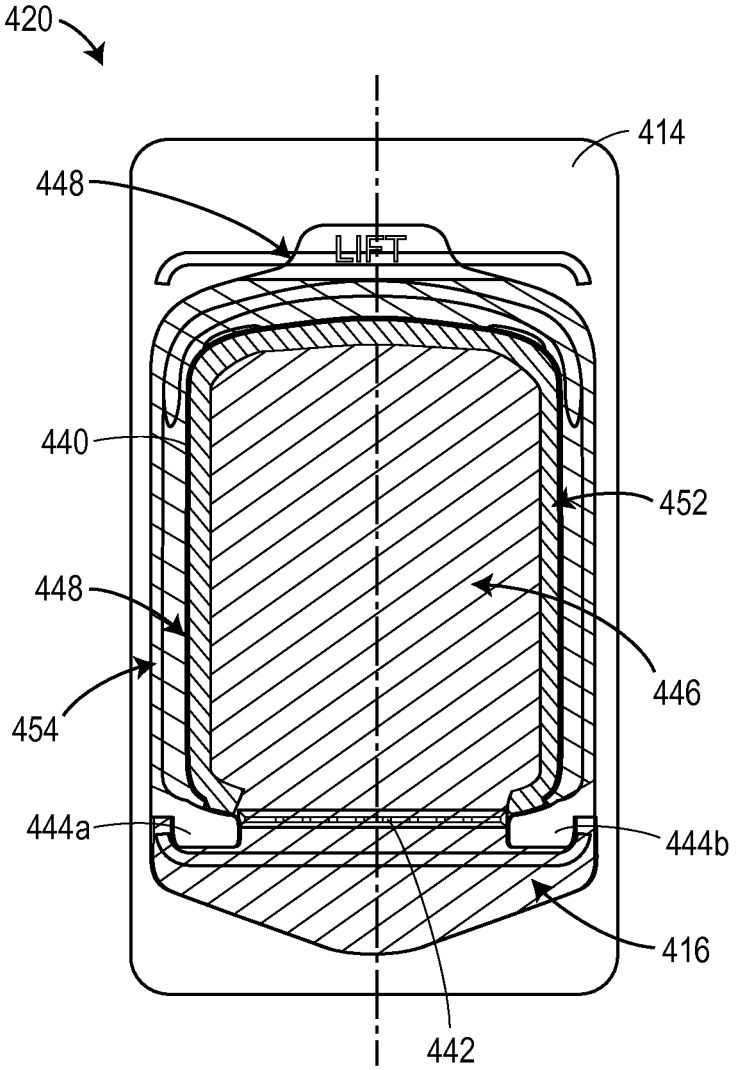
Figure 30D:
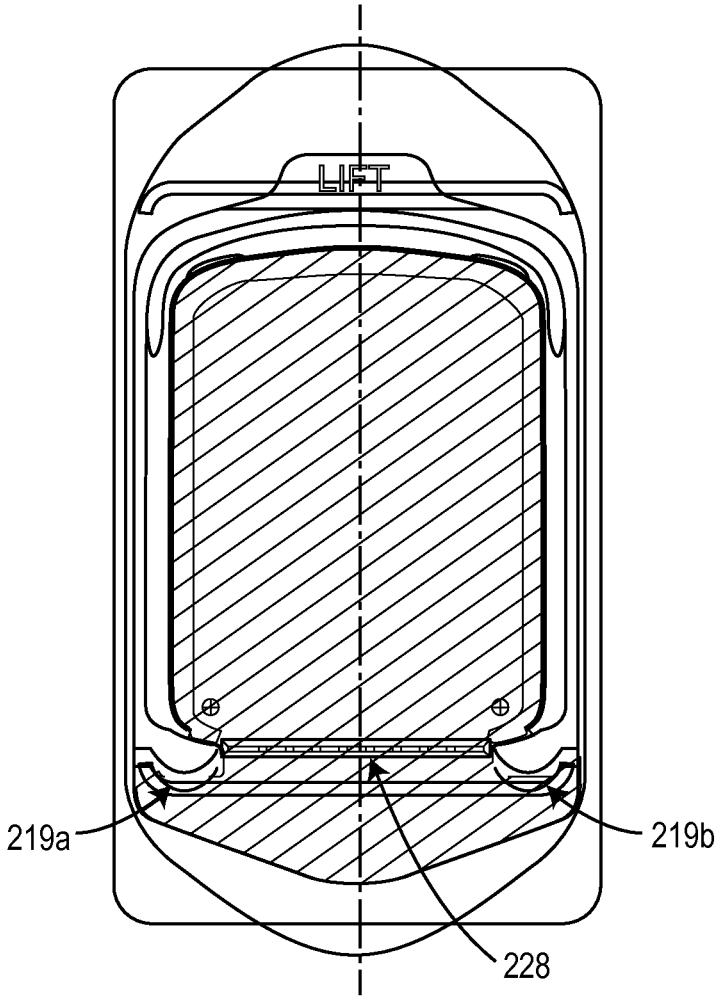
FIG. 30*d* is a schematic illustration of an opening panel region in accordance with embodiments of the disclosure, illustrating the cuts made in the various layers for forming the closure assembly.

Referring to FIG. 30*a*, for example, in one embodiment, the opening panel can include first and second zones 446, 448. The first zone is adjacent to the second zone and in some embodiments directly adjacent to each other with no intervening zone (as illustrated in FIG. 30*a*). A first portion of the first sheet is secured to a first portion of the second sheet in the first zone, and a second portion of the first sheet is secured to a second portion of the second sheet in the second zone. The peel strength between the first and second sheets in the first zone is greater than the peel strength between the first and second sheets in the second zone. For example, the peel strength in the second zone can be about 10% to about 60% of the peel strength of the first zone. A portion of the second zone can be configured to thermoformed to include the closure assembly features or other formed features as described herein. FIGS. 30*a*-30*c* illustrate formed features in a portion of the second sheet to illustrate regions of the second sheet that can be configured to be thermoformed. It should be understood that such formed features need not be included in the flexible material prior to package forming and can be formed while configuring/forming the flexible material into the package as described herein.

The first zone 446 can include at least the portion of the opening panel region configured to define the opening of the package. Referring to FIGS. 30*a*-*c*, the opening panel region 420 includes an opening boundary, which can optionally be defined by the line of reduced strength 440. The opening boundary is an outer boundary of the opening of the package. In various embodiments, the first zone 446 corresponds to a portion of the opening panel region in which the first sheet 414 is configured to remain attached to the second sheet 416. For example, when opening a package formed of the flexible material 400, a portion of the first sheet can detach from a remaining portion of the first sheet 414 at the opening boundary and remain secured to the second sheet 418 upon opening of the package. Additionally, as illustrated in FIG. 30*a*, in some embodiments, the first zone 446 can also include a lid rear region of the opening panel that is configured such that a lid of the closure assembly of a packaged remains secured in the lid rear region.

As illustrated in FIG. 30*a*, the first zone 446 can include portions of the opening panel region disposed on opposed sides of the opening boundary. Referring to FIG. 30*b*, the first zone 446 can be disposed only inward of the opening boundary. The first zone can have a peel strength of at least 500 gms/in. For example, the peel strength in the first zone can be about 500 gms/in to about 2000 gms/in, about 600 gms/in to about 1500 gms/in, about 1000 gms/in to about 2000 gms/in. Other suitable peel strengths include about 500, 600, 700, 800, 900, 1000, 1100, 1200, 1300, 1400, 1500, 1600, 1700, 1800, 1900, and 2000 gms/in. In some embodiments, the first sheet is permanently secured to the second sheet in the first zone.

Referring to FIGS. 30*a*-*c*, the second zone 448 can be directly adjacent to the first zone. The second zone 448 generally includes a portion of the opening panel region configured to be thermoformed. For example, the second zone can include a thermoformed portion of the opening panel region configured to have the second engagement feature or channel thermoformed therein. The second zone can have a peel strength of about 0 gms/in to about 200 gms/in, about 5 gms/in to about 175 gms/in, about 10 gms/in to about 150 gms/in, about 25 gms/in to about 125 gms/in, about 50 gms/in to about 100 gms/in about 75 gms/in to about 150 gms/in, or about 0 gms/in to about 2 gms/in. Other suitable peel strengths include, for example, 0, about 5, 10, 15, 20, 25, 30, 35, 40, 45, 50, 60, 70, 80, 90, 100, 125, 150, 175, or 200 gms/in.

Referring to FIG. 30*a*, for example, the first zone 446 can extend up to a portion of the second sheet 416 that is configured to be thermoformed (referred to herein as the "thermoformed portion"). As illustrated in FIG. 30*a*, for example, the first zone 446 extends up to the thermoformed portion of the opening panel region (illustrated in FIG. 30*a* by inclusion of the formed channel). The second zone 418 contains the thermoformed portion and a portion of the opening panel region having the first sheet secured to the second sheet outward of the thermoformed portion.

Referring again to FIG. 30*b*, in some embodiments the second zone 448 can be disposed inward the thermoformed portion up to the opening boundary.

Referring to FIG. 30*c*, in some embodiments, the opening panel region can include a third zone 452 disposed between the first and second zones 446, 448. For example, as illustrated in FIG. 30*c*, the first zone 446 can be bounded in part by the opening boundary, the third zone 452 can be disposed between the opening boundary and the second zone 448. The third zone 452 can have a peel strength that is less than the peel strength in the first zone 446. Optionally the third zone 452 can have a peel strength that is substantially equal to the peel strength in the second zone.

The third zone can have a peel strength of about 0 gms/in to about 200 gms/in, about 5 gms/in to about 175 gms/in, about 10 gms/in to about 150 gms/in, about 25 gms/in to about 125 gms/in, about 50 gms/in to about 100 gms/in about 75 gms/in to about 150 gms/in, or about 0 gms/in to about 2 gms/in. Other suitable peel strengths include, for example, 0, about 5, 10, 15, 20, 25, 30, 35, 40, 45, 50, 60, 70, 80, 90, 100, 125, 150, 175, or 200 gms/in.

In various embodiments, the second zone 448 can be disposed only in the thermoformed portion (i.e., the region in which the second engagement feature is to be formed. A fourth zone can optionally be provided outward of the second zone 448 thermoformed region. The fourth zone 454 can have a peel strength that is less than or greater than the peel strength of the second zone 458, but is less than the peel strength of the first zone 446.

FIGS. 30*a-c* further illustrates an embodiment in which the opening panel region includes a pull tab region. The pull tab region can define a pull tab zone 450. The pull tab zone can have a peel strength of 0 gms/in to about 30 gms/in, about 0 gms/in to about 5 gms/in, about 1 gms/into about 10 gms/in, about 3 gms/in to about 7 gms/in, about 10 gms/into about 30 gms/in, about 15 gms/in to about 20 gms/in, and about 5 gms/in to about 25 gms/in. Other suitable values include, for example, about 0, 1, 2, 3, 4, 5, 6, 7, 8, 9, 10, 11, 12, 13, 14, 15, 16, 17, 18, 19, 20, 21, 22, 23, 24, 25, 26, 27, 28, 29, and 30 gms/in. In some embodiments, the second zone can include the pull tab zone, in other embodiments, the second zone can have a peel strength different that the pull tab zone 450.

In various embodiments in which the flexible material is configured to form a package having first and second projections 219*a*, 219*b* in the closure assembly 22, the portion of the opening panel region in which the first and second projections (illustrated in FIGS. 30*a*-30*c* as defined by lines of reduced strength 444*a*, 444*b*) are defined, can define a projections zone. The peel strength of the projection zone 443*a*, 443*b* can about 0 gms/in to about 30 gms/in. Have reduced peel strength in the projection zone 443*a*, 443*b* can aid in allowing the projections 219*a*, 219*b* to freely move along the first sheet when pivoting between first and second positions as described below.

In some embodiments, such as embodiments having a mechanical closure, the second zone 448 can be a region of substantially no chemical adhesion between the first and second sheet 414, 416, relying instead on the mechanical closure. For example, the second zone 448 can be coated with a deadening agent or varnish to reduce or eliminate any adhesive properties of an adhesive which is applied to secure the second sheet 416 to the first sheet 414 in the first zone 446. This can eliminate the need to selectively apply adhesive and can facilitate the manufacturing process. Zoned adhesion can be done with heal sealing techniques, selective application of deadening agents, and/or the selective application of adhesives.

A process of zoning the adhesive in the opening panel region can include applying adhesive to one or both of the first and second sheets. The process can then include applying a deadening agent to the first or second sheet in the opening panel region in a zone in which reduced peel strength is desired. For example, a deadening agent can be applied in the second zone and optional third zone at a coverage percentage of about 50% to about 100% to achieve the desired peel strength in the second zone. By way of further example, the deadening agent can be applied at a coating percentage of 100% in the pull tab zone to achieve no peel strength between the pull tab on the second sheet and the first sheet in the pull tab zone. The deadening agent reduces the peel strength where applied with the amount of reduction corresponding to the coating percentage of the deadening agent. Use of a deadening agent to achieve the desired peel strengths in the various zones can simplify the flexible material making process by avoiding the need to zone adhesive. Deadening agents can be printed, for example, in similar fashion to printing inks and graphics on a sheet material, allowing for precise control over the location and coating percentage of the deadening agent. In alternative embodiments, an adhesive or sealing process can be applied/pre-formed in a zoned fashion. For example, heat seals can be formed in the first zone to achieve the desire peel strength, while adhesives can be used in the second and optional third or fourth zones to achieve the desired reduced peel strengths. In some embodiments, different adhesive chemistries resulting in different adhesion strengths can be selectively applied to the regions to achieve the desired peel strengths.

The selective application of the deadening agent or varnish can be accomplished, for example, during the printing process for printing graphics onto the package. This can advantageously provide a rapid process for defining a deadened or reduced adhesive zone with high throughput printing machines.

In some embodiments, the selective application of an adhesive or different types of adhesive can be accomplished using a printing machine, such as for printing graphics on a film package.

Any of the second, third, fourth, pull tab and/or projection zones can have the first and second sheets secured using a sealing layer. In one embodiment, the sealing layer can be comprised of materials that contain both compatible and incompatible polymers as the surface of the second sheet that is adapted to contact the first sheet. The second sheet can be adhered to the sealing layer using known processes, such as, for example, heat sealing. When the package is opened, the two adjoined surfaces peel apart in the area that was subjected to the sealing process because of the controlled incompatible polymer chosen. In a second embodiment, the sealing layer of the first sheet can be identical to the sealing layer on the second sheet. The second sheet can be adhered to the sealing layer using heat which melts and bonds the two surfaces. In this embodiment, one of the two sealing surfaces is designed to have just a thin layer of the polymer and just adjacent to it (away from the sealing interface) has a layer which is designed to break away. This breakage allows the transfer of one polymeric surface to the other surface and thru such transfer, opens the package. In various embodiments, the flexible material including the first sheet, the second sheet, and optionally the third sheet, can be thermoformed to form a closure assembly having a lid formed in the flexible material. In such embodiments, the flexible material must be adapted for thermoforming and have a desired heat transfer through the flexible material structure (i.e., the second sheet, first sheet, and optional third sheet). In some embodiments of the forming process, the flexible material can be heated from one side, for example, the side of the flexible material that is disposed on the exterior of the package. When heating from one side, the flexible material can have a structure such that the higher melting point materials are disposed closer to the heat source than lower melting point materials. Thermal conductivity of the polymers can be controlled and tailored based on desired packaging machine line speeds.

Other parameters of the flexible material that can be selected or tailored to provide the desired line speed, thermoforming, and/or sealing properties include elastic modulus E. The elastic modulus is a measure of a materials resistance to deformation or its stiffness.

The mechanical properties of polymers, such as those which can be included in the flexible materials of the disclosure, are dependent on temperature. For example, the flexible materials of the disclosure can have 1% secant modulus of greater than about 60,000 psi in the stackable direction, as measured using ASTM D882 at 23° C.

Method and Apparatus for Manufacturing A Flexible Container

Turning to the assembly of the re-closable packaging assembly 10, the container 12 may be formed or assembled in any manner known in the art. For example, the container 12 may be formed as described in U.S. Pat. No. 8,231,024, which is herein incorporated by reference in its entirety. For example, the first sheet 14 may be provided as a roll of material, and the second sheet 24 may be secured to desired portions of the first sheet 14 along the roll. The opening 20 may also be pre-cut on the first sheet 14. In some embodiment in which a lid is formed into the film, the second sheet may be pre-cut to the dimensions of the lid edge 76 such that no additional cutting operations may be required on the second sheet 24 subsequent to attachment to the first sheet 14. In embodiments in which the lid is formed into the flexible material, one or more forming stations may be provided at a desired location along the assembly line to form desired features of the container 12 and/or the closure assembly 22. While embodiments of the method and apparatus for forming the package may include and illustrate one or more forming stations for forming a closure assembly, it is contemplated that the methods and apparatuses disclosed herein, without the forming station(s), can be used in forming a resealable package that does not include a formed closure assembly.

The first forming station may include thermoforming the desired features of the container 12 and/or the closure assembly 22. Thermoforming is a manufacturing process where a plastic sheet, such as the first sheet 14 and/or the second sheet 24, is heated to a pliable forming temperature and formed to a specific shape in a mold. The sheet, or "film" when referring to thinner gauges and certain material types, is heated in an oven to a high-enough temperature that it can be stretched into or onto a mold and cooled to a finished shape. Instead of thermoforming, one skilled in the art would recognize that other manufacturing operations may be used to form the first engagement feature 36 and the first securement feature 104*a* (or any other features described herein).

In a typical thermoforming process, a plastic sheet (such as the first sheet 14) is fed from a roll into a set of indexing chains that transport the plastic sheet through an oven for heating to forming temperature. The heated sheet then indexes into a form station where a mold (such as the molds illustrated in FIGS. 15A to 17J) and pressure-box close on the sheet, with vacuum then applied to remove trapped air and to pull the material into or onto the mold along with pressurized air to form the plastic to the detailed shape of the mold. After a short form cycle, a burst of reverse air pressure is actuated from the vacuum side of the mold as the form tooling opens, commonly referred to as air-eject, to break the vacuum and assist the formed parts off of, or out of, the mold. A stripper plate may also be utilized on the mold as it opens for ejection of more detailed parts or those with negative-draft, undercut areas. As previously explained, one or more forming stations may be provided at any suitable location along the assembly line. For example, a system for making the packages of the disclosure can include a forming tube, about which the film is folded for making the package. Along the forming tube, one or more heating stations (see heating stations 138 in FIGS. 19A to 19F, for example) and forming stations for making the thermoformed features can be included. Referring to FIGS. 33A to 33D, in one embodiment, the machine can be provided with two preheating stations 303 that heat the film to a suitable temperature for thermoforming and a forming station 306 that includes a die to which the preheated film is conformed to form the desired features, such as the closure assembly. The heating and/or forming stations can be disposed such that the thermoforming process occurs while the film is folded about the forming tube process to form the package structure. In one embodiment, the film is provided into the machine from a film roll and is folded about the forming tube by passing the film over a collar. While on the forming tube, a portion of the film is preheated for thermoforming. The film then passes over a die having the desired structures for thermoforming and compressed to conform the film to the structures of the die. The film can then proceed to stations for forming the seals of the package.

The forming tube can be adapted such that for a portion of the forming station, for example, the die can be integrally incorporated onto the forming tube or may be directly secured to the forming tube. As illustrated in FIGS. 34A to 34E and 35, the forming tube 307 can have a first portion having a first diameter and a second portion 192 downstream the first portion having a second diameter less than the first diameter. The forming tube 307 may also have a square or rectangular cross-sectional shape, and the perimeter of the second portion 192 may be less than the perimeter of the first portion. A die 193 (such as or similar to the die illustrated in FIGS. 40A to 40F, for example) for thermoforming can be attached to or integrally formed into the forming tube 191 at the second portion 192. The first and second diameters (or perimeters) are selected such that when the film passes from the first portion of the forming tube to the second portion of the forming tube with a die installed thereon, the film remains in substantially the same plane. In some embodiments, the forming tube can also be used as the fill tube for filling the product into the container. In such embodiments, the interior of the forming tube can include a restriction portion that reduces the diameter on the inside of the forming tube to the size of the second diameter such that product flow through an interior portion of the forming tube having a consistent diameter.

For example, a first forming station may form the first engagement feature 36 (e.g., the ridge 40) and, optionally, the first securement feature 104*a*. The first forming station may also form any or all of the second engagement portion 38, the convex portion 98, the second securement feature

104*b*, the hinge portion 28 of the closure assembly 22, the one or more ribs 51, and/or the locking mechanism 126, for example. Other desired features may also be formed at the first forming station. The first engagement feature 36, the first securement feature 104*a*, the second engagement portion 38, the convex portion 98, the second securement feature 104*b*, the hinge portion 28 of the closure assembly 22, the one or more ribs 51, and/or the locking mechanism 126 may all be formed at the first forming station using a single mold (such as the molds illustrated in FIGS. 15A to 17J) in a single process step. Alternatively, the first engagement feature 36 and the first securement feature 104*a* may be formed at the first forming station using a single mold in a single manufacturing operation, and the second engagement portion 38, the convex portion 98, the second securement feature 104*b*, and the hinge portion 28, or example, may be formed at a second forming station that is remote from the first forming station. If the opening 20 (and/or cuts 107*a*, 107*b* of the hinge portion 28 of the embodiment of FIGS. 20A and 20B) is not pre-cut, the opening 20 or cuts 107*a*, 107*b* may be cut by a die at the first forming station at the same time as the first engagement feature 36, the first securement feature 104*a*, the second engagement portion 38, the convex portion 98, the second securement feature 104*b*, the hinge portion 28 of the closure assembly 22, the one or more ribs 51, and/or the locking mechanism 126 are formed. Alternatively, the opening 20 or cuts 107*a*, 107*b* may be cut by a cutting die prior to, during, or after the forming operation at the first forming station. A cutting operation for the cutting of the opening 20 or cuts 107*a*, 107*b* would include inserting a blade of a cutting die (that corresponds to the shape of the opening 20 or cuts 107*a*, 107*b*) through the first sheet 14 up to (but not through) the second sheet 24.

In various embodiments, the forming die and/or forming structure can include structures to retain the film so that it is able to controllably stretch during the forming process. This can aid in reducing or preventing tearing or pulling of the film when the film is compressed against the forming die to form the closure assembly structures into the film.

In an embodiment, the opening can be formed or defined in the package at the time of forming the closure assembly. For example, the die used for forming the closure assembly into the film can include a cutting die incorporated within the forming die. For example, the cutting die can be including on a back side of the forming die and arranged such that upon sufficient compression of the forming die the cutting die will pass through an opening provided in the face of the forming die to contact a film disposed on the face of the cutting die. In another embodiment, the forming die can include two cutting dies, with a first cutting die disposed on the back side of the forming die for cutting the first and third sheets, and a second cutting die disposed on the front side of the forming die for cutting the second sheet. The cutting dies can be, for example, forged steel knives. FIGS. 75A to 75K illustrate an exemplary forming die having forged knives disposed within the forming die. For example, in an exemplary forming operation, a heated film can be disposed on the face of a forming die and compressed at a first compression pressure to conform the heated film to the structure defined in the forming die and cool the film to retain the formed shaped, then the film can be compressed onto the die at a second compression pressure greater than the first compression pressure to engage the cutting die disposed on a back side of the forming die such that the cutting die contacts the film to define the opening. For example, in another exemplary forming operation, a heated film can be disposed on the face of a forming die and compressed at a first compression pressure to conform the heated film to the structure defined in the forming die and cool the film to retain the formed shaped, then the film can be compressed onto the first die and engaged with the second cutting die at a second compression pressure greater than the first compression pressure to engage the first cutting die disposed on a back side of the forming die such that the cutting die contacts the film to define the opening through the first and third sheets, and to engage the second cutting die to cut define the moveable lid portion in the second sheet, including for example, defining the hinge feature. The extent to which the cutting die extends to contact the film and/or second compression pressure can be configured such that the cutting die cuts through the first sheet and optional third sheet, but preferably does not cut through the second sheet. In some embodiments, the cutting die can contact the second sheet, partially scoring the second sheet, so long as the second sheet is not weakened by the scoring.

FIGS. 75A to 75K further illustrates an embodiment of a forming station that includes a secondary forming plate that provides a secondary forming operation to further force the film further into the inner forming cavity, which can improve formation of undercuts and other features on the formed lid assembly.

Any suitable packaging machinery may be used to form the re-closable packaging assembly 10. For example, as illustrated in FIGS. 19A to 19F, a vertical form, fill, and seal (VFFS) packaging machine 135 may be used. The packaging machine 135 is capable of intermittently forming a series of re-closable packaging assemblies 10 from a web of film, such as a roll 136 of the first sheet 14 that may be fed into the packaging machine 135. The roll 136 can be adapted to have a larger diameter than conventional film rolls to accommodate a locally thickened portion of the film, for example, by including a third sheet on the films and/or locally thickening portions of the first sheet. For example, the roll can have an increased diameter of ¾ inch to 1 inch. On such a web of film, the opening 20 (and/or cuts 107*a*, 107*b* of the hinge portion 28 of the embodiment of FIGS. 20A and 20B) may be pre-cut (or pre-scored or pre-perforated) on the first sheet 14 and the second sheets 24 may be secured to desired portions of the first sheet 14. One having ordinary skill in the art would recognize that the second sheets 24 could be applied while the web of film is directed through the packaging machine 135 at any point prior to heating and thermoforming. In some applications, the web of film may be pre-printed with graphics relating to the product to be disposed within the re-closable packaging assembly 10, such as product information, manufacturer information, nutritional information, bar coding and the like. The roll 136 may be rotatably mounted on a shaft at the inlet end of the packaging machine 135. The web of film is typically fed into the packaging machine 135 over a series of dancer rolls and guide rolls 137, one or more of which may be driven to direct the first sheet 14 in the direction of the transport path of the packaging machine 135.

Before being formed into the shape of the container 12 of the re-closable packaging assembly 10, the web of film may be directed through one or more heating stations 138 that heat the web of film for a subsequent thermoforming step. The web of film is then directed through a first forming station 140 that may thermoform the desired features of the container 12 and/or the closure assembly 22 as described above. For example, at this first forming station 140, the first engagement feature 36, the first securement feature 104*a*, the second engagement portion 38, the convex portion 98, the second securement feature 104*b*, the hinge portion 28 of the closure assembly 22, the one or more ribs 51, and/or the optional locking mechanism 126 may all be formed simultaneously using a single mold. Pressure forming or pressure and vacuum forming may be used. An inert gas may be used for pressure forming and/or for reverse air-eject. Following the first forming station 140, the web of film may then be directed through one or more subsequent forming stations (not shown) that may perform further manufacturing operations, such as scoring or further thermoforming of desired features, as described above. However, it is preferable if all of the forming is done at a single forming station, such as the first forming station 140. After passing through the first forming station 140 (and any subsequent forming station(s)), the web of film is directed to a package forming station 142 having a forming shoulder 144, or other device such as a forming box or sequential folding system, configured to wrap the film around a forming tube 146 in a manner known in the art. In the present example, the forming tube 146 is a product fill tube 148 having a funnel 150 for receiving the product to be disposed in the re-closable packaging assembly 10 and filling the re-closable packaging assembly 10 with the product as the film proceeds along the forming tube 146. It is contemplated that filling of the package can occur on or off the forming tube. For example, the package can be removed from the forming tube having an open, unsealed end and filled in a separate operation. The forming tube 146 is configured to form the film into the desired shape based on the characteristics of the final package design, such as square, rectangular, oval, trapezoidal, round, irregular and the like. Of course, where other types of non-VFFS packaging machines are used, a forming tube may not necessarily be used, and instead the film may be wrapped directly around the product to be stored in the re-closable packaging assembly 10. As previously described, the first forming station 140 (or any subsequent forming station) may be disposed at and integrally formed with a downstream end of the forming tube 146.

After the film is formed around the forming tube 146, the web of film moves along the transport path to a combination edge seal/corner seal station 152 to form corner seals at the corners between the sides 16*a-f* of the container 12, and to create combination edge seal and corner seals, if desired, at the lateral edges of the web of film. In various embodiments, corner seals can border and surround one side of the package or opposed sides of the package. The web of film may pass a series of forming plates and shaping bars, and the web of film may then be directed past welding devices of the station 152 that weld overlapping portions of the film to complete the corner seals of the container 12. Of course, the corner seals and the edge seals of the container 12 may be formed by different work stations depending on the particular configuration of the packaging machine.

The one or more heating stations 138, first forming station 140, and any subsequent forming stations have been described as being located upstream of the package forming station 142 or the combination edge seal/corner seal station 152. However, in alternative embodiments of the packaging machine 135, the web of film may be directed into the one or more heating stations 138, the first forming station 140, and any subsequent forming stations following the seal/corner seal station 152. Alternatively, the web of film may be directed into the one or more heating stations 138, the first forming station 140, and any subsequent forming stations at a point between the package forming station 142 and the seal/corner seal station 152.

In order to further control the movement of the web of film along the forming tube 146 and the transport path, pull belts 154 may be provided after the stations 152 (or after the one or more heating stations 138, first forming station 140, and any subsequent forming stations) to engage the film and pull the film through the previous stations 142, 152.

Following the seal/corner seal station 152, the edges of the container 12 may be sealed to close the container 12, and folded and tacked down to conform to the shape of the container 12 at a closing station 156. At the closing station 156, seal bars 158 may simultaneously close upon the film and may seal a trailing edge (such as the first and/or second edge 48, 50, for example) of a preceding container 12 and a leading edge of a current container 12 in a manner known in the art.

As discussed above, the forming tube 146 of the illustrated embodiment of the packaging machine 135 is a product fill tube 148. Once the leading edge of the container 12 is closed during the sealing process at the closing station 156, the product may be added to the package 12. At that point, a specified amount of the product may be poured through the funnel 150 into the fill tube 148 and dropped into the container 12. After or as the container 12 receives the product, the container 12 advances to align a trailing edge of the container 12 at the closing station 156 and the trailing edge may be tucked and is sealed in the manner described above, thereby sealing the container 12 with the product disposed therein.

At the same time the seals of the adjacent containers 12 are formed, a gas flushing operation may be performed if necessary to place a desired atmosphere in the container 12. Once the container 12 of the re-closable packaging assembly 10 is sealed, it may be detached from the web of film in preparation for any final processing steps and containerization. Consequently, the closing station 156 may further include a knife or other separation device (not shown) proximate the seal bars 158 to cut the common seal and separate the adjacent container 12. Alternatively, the separation may occur at a downstream station.

After separation, the re-closable packaging assembly 10 may drop or otherwise be transported to a conveyor 160 for delivery to the remaining processing stations. Referring to FIGS. 76A-76F, the conveyor can be provided in some embodiments as a continuous, race-track type design. The race-track type conveyor can be provided with various stations, for example, to provide for folding and sealing of an end seal (flap). In some embodiments, as discussed in detail below, the conveyor can include package receiving member. The conveyor can be further equipped with a tilting portion or open portion, for example, to tip or allow the packages drop from the package receiving member into a box or take away conveyor. Alternatively, an arm can remove the package from the conveyor. For example, the re-closable packaging assembly 10 may drop through a package chute 162. The re-closable packaging assembly 10 may fall loosely at a first conveyor location 164, but mostly aligned onto the conveyor 160. At a second conveyor location 166, package side guides 167*a*, 167*b* may hold snug against the re-closable packaging assembly 10 and may positively locate it through a third conveyor location 168. At a fourth conveyor location 170, package side guides 167*a*, 167*b* may start to taper down towards the re-closable packaging assembly 10. At a fifth conveyor location 172, the package top guide 173 may hold snug against the re-closable packaging assembly 10 and positively locating it in a vertical direction. One or more glue applicators 175 may deposit glue onto one or more open flaps (e.g., the portions of the first sheet 14 fourth side wall 16*e* illustrated in FIG. 1) that are to be disposed through a gap between the top of the re-closable packaging assembly 10. At a sixth conveyor location 174, the package side guides 167*a*, 167*b* transition from a low profile to a high profile and fold the flaps of the re-closable packaging assembly 10 into the position illustrated in FIG. 1. So disposed, the glue begins to "cure" or harden" and may be fully cured or hardened in this position. At a seventh conveyor location 176, the package side guides 167*a*, 167*b* are high profile and continue to hold the one or more flaps in a desired position. If the glue is not fully cured or hardened, it may continue to cure or harden in this position and/or subsequent positions. Alternatively, the one or more flaps could be heat sealed to a corresponding side wall 16*d*, 16*e*. If necessary, a post-processing station(s) (not shown) may be included along the conveyor 160 for any additional operations to be performed prior to shipment, such as code dating, weight checking, quality control, labeling or marking, RFID installation, and the like. At the conclusion of the sealing and post-processing activities, the finished re-closable packaging assembly 10 may be removed from the conveyor 160 by a case packer (not shown) and placed into a carton (not shown) for storage and/or shipment to customers.

Figure 66:
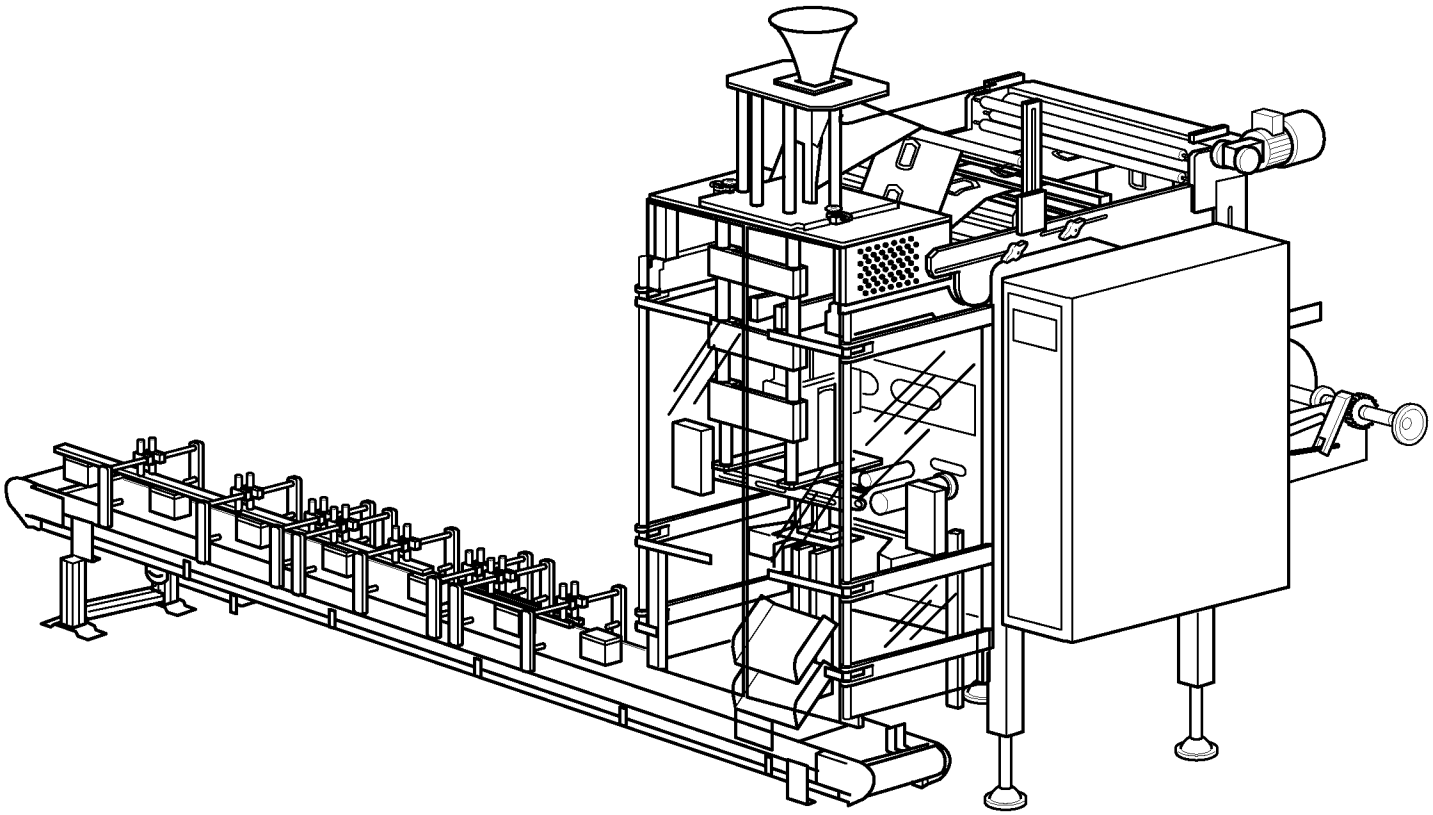
FIG. 66 is a schematic illustration of a packaging machine for forming a re-closable packaging assembly in accordance with an embodiment of the disclosure.
Figure 67E:
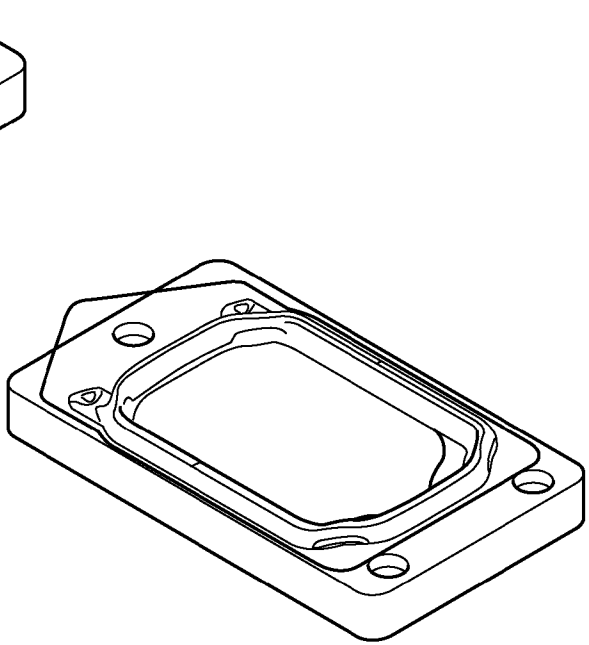
FIGS. 67A to 67E are schematic illustrations of a forming die for forming an embodiment of the reclosable packaging assembly.
Figure 67C:
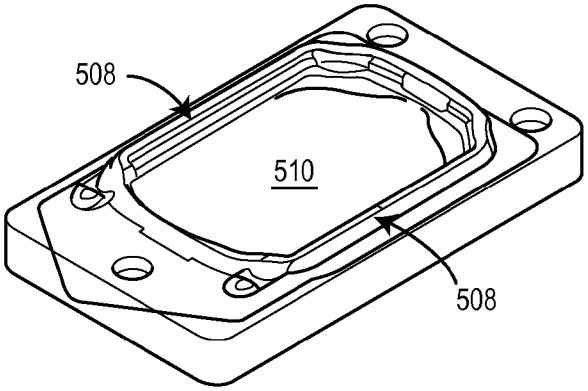
Figure 67D:
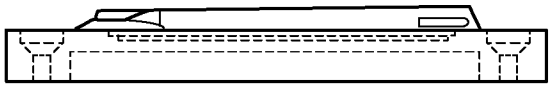
Figure 67A:
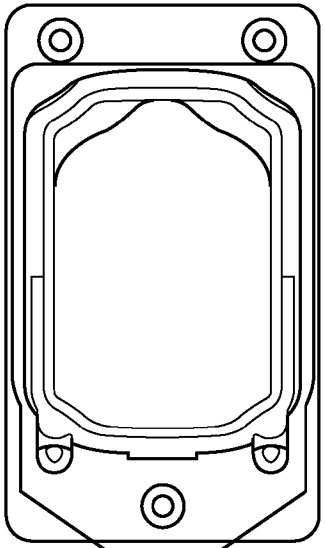
Figure 67B:
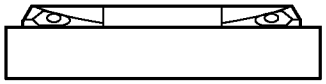
Figures 68A, 68B, 68C, 68D, 68E, 68F:
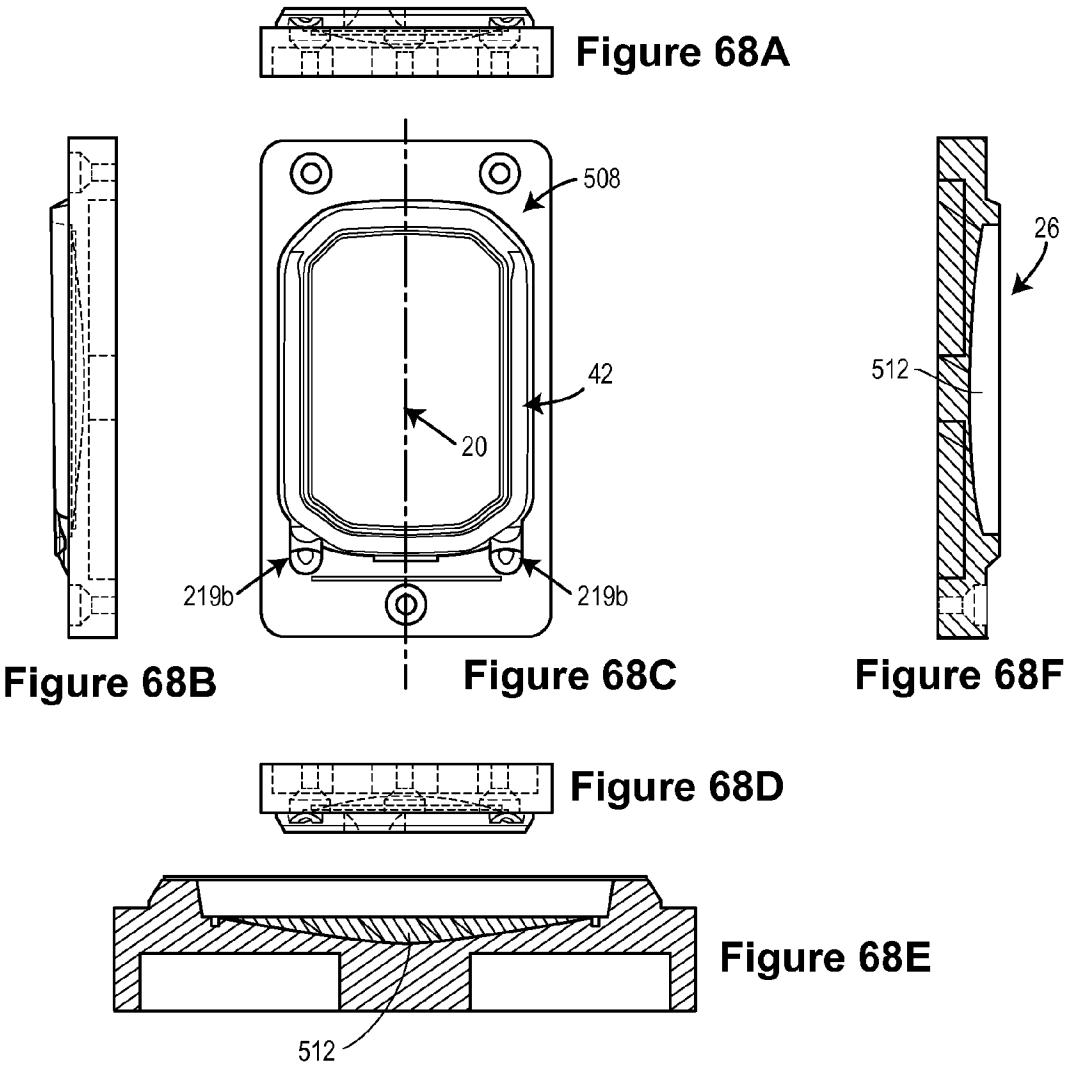
FIGS. 68A to 68F are various views of a lid member in accordance with an embodiment of the disclosure.
Figure 74A:
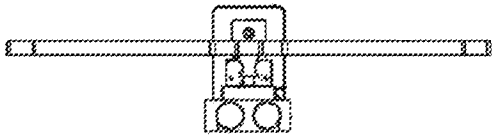
FIGS. 74A to 74F are schematic illustrations of a heat plate for heat sealing a seal flap to a side of the package.
Figure 74B:
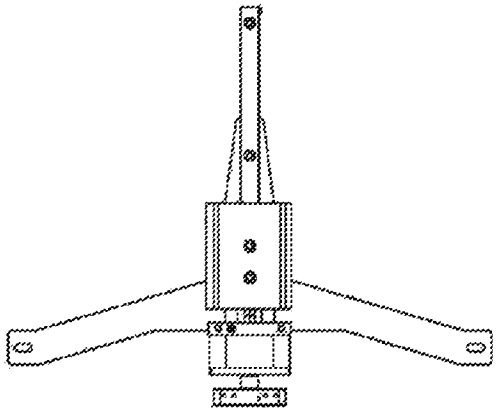
Figure 74C:
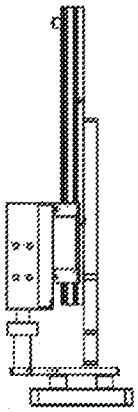
Figure 74D:
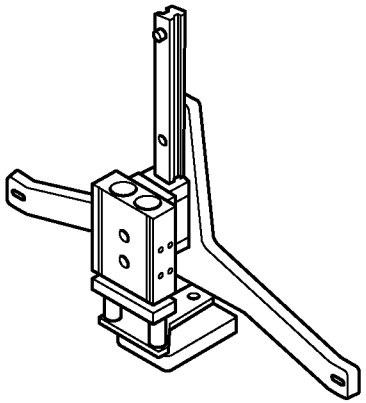
Figure 74E:
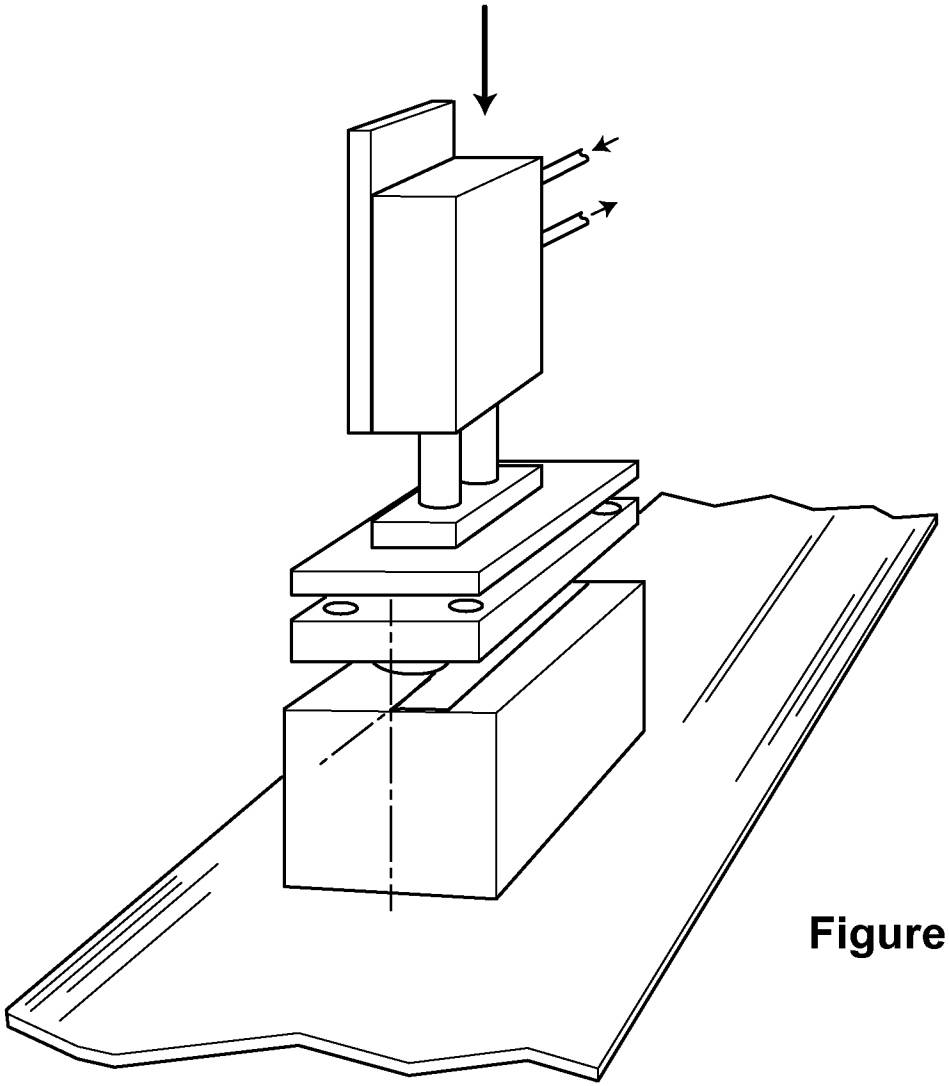
Figure 74F:
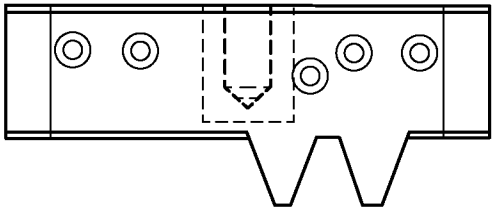
Figure 75A:
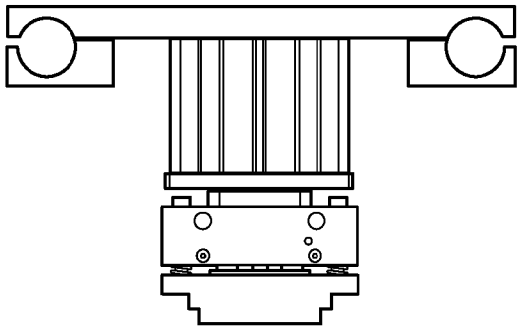
FIGS. 75A to 75K are a schematic illustration of a forming die having an integrated cutting die and outer forming station in accordance with an embodiment of the disclosure.
Figure 75C:
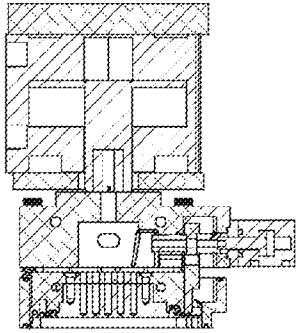
Figure 75B:
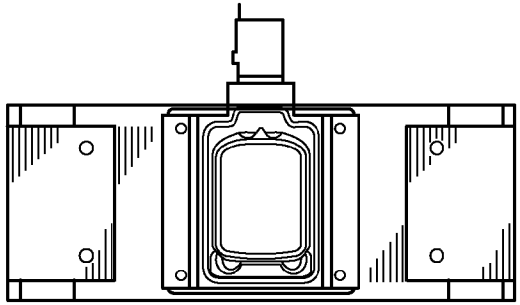
Figure 75D:
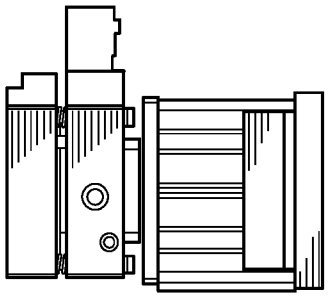
Figure 75E:
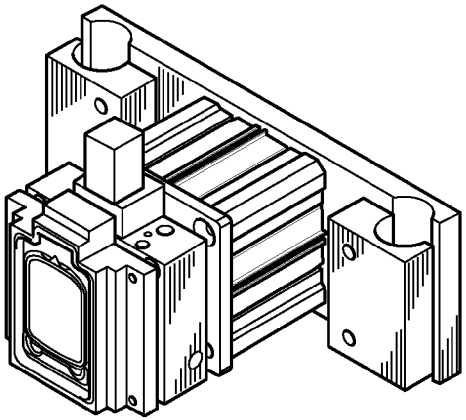
Figure 75F:
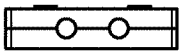
Figure 75G:
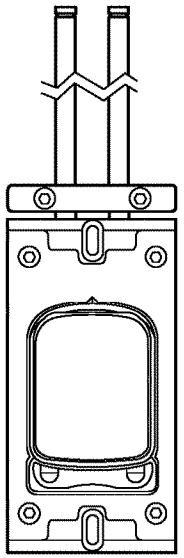
Figure 75I:
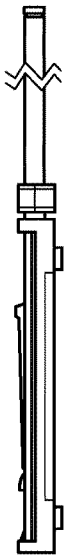
Figure 75J:
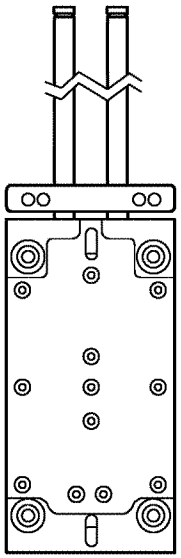
Figure 75K:
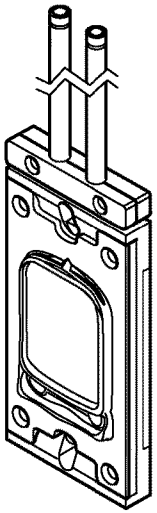
Figure 75H:
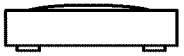

FIG. 66, illustrates an embodiment in which the conveyor includes a package receiving member that guides the package along the conveyor locations. For example, the package assembly drop from the packaging machine into a package receiving member disposed on the conveyor. The package receiving member can aid in retaining the package assembly shape while and remaining assembly steps, such as forming and/or folding of the trailing seal (also referred to as end seals), are performed on the conveyor. The package receiving member can have, for example, a size and shape that corresponds to the size and shape of the package assembly. For example, the package receiving member can have the same cross-sectional shape as the package assembly, and be sized so that the package assembly resides within the package receiving member. The package receiving member can be, for example, open on the top and bottom, such that side walls are provided corresponding to the side walls of the package. For example, the package can reside tightly within the package receiving member so as to provide a compressive force to maintain the intended folded shape of the package. The package receiving member can have any suitable height. For example, the package receiving member can have a height such that it extends to cover at least 20%, at least 30%, at least 40%, at least 50%, at least 60%, at least 70%, at least 80%, at least 90%, at least 95%, or 100% of the height of the package assembly (as measured from the bottom wall). In embodiments in which the package receiving member has approximately the same height as the package assembly, it should be understood that a trailing seal, which may be formed or unformed when the package assembly is placed onto the package receiving member, can extend above the top of the package receiving member such that it can be formed and/or further processed for folding and/or adhering to the package wall. For example, the trailing seal (also referred to as an end seal or flap) can be folded over and heat sealed to the outside of the package and/or glues using an adhesive. FIGS. 74A-74F illustrate embodiments of a heating plate that can be incorporated into the conveyor to heat a flap formed by the trailing seal sufficiently to attached the flap to the side of the package using a heat seal. As illustrated in FIG. 74F, the heat plate can include two downward extensions and a recessed region to receive the flap, while the sides of the flap are heated by the downward extensions. In an alternative embodiment, illustrated in FIGS. 74A to 74E the heat plate can include a flat plate or a plate with single projection, respectively, for contacting and heating the flap before and/or after the flap is folded over to contact the side of the container to thereby seal the flap by the container. The conveyor can include one or more heating plates for sealing the flap to the side of the package. For example, a first heating station can be provided with low heat than a second heating station. For example, the first heating station can include a heat plate in accordance with the embodiment shown in FIG. 74F having the two projections and a second heating station can include a heating plate with no projection or a single projection, for example, as illustrated in FIGS. 74A to 74E, respectively. For example, the conveyor can include the heating plate having first and second projections for a first heating step when the flap is in the upright position and a heating plate having no projection or a single projection for further heating after the flap has been folded over to contact a side of the package.

The conveyor can include any suitable number of package receiving members spaced at suitable intervals along the conveyor. The number and spacing of the package receiving members can be determined for example, by one or more of the speed of the package forming process, the length of the conveyor, and the number and duration of processes to be performed on the package while on the conveyor. For example, the conveyor can include about 1 to about 30, about 5 to about 10, about 12 to about 24, about 6 to about 18, about 7 to about 20, or about 10 to about 25 package receiving members. Other suitable numbers of package receiving members include about 1, 2, 3, 4, 5, 6, 7, 8, 9, 10, 11, 12, 13, 14, 15, 16, 17, 18, 19, 20, 21, 22, 23, 24, 25, 26, 27, 28, 29, and 30. The spacing can be determined, for example, by the various processes performed on the package assembly while on the conveyor and the timing of the processes to be performed. For example, in an embodiment in which the trailing seal is folded over and attached to a side of the package, the package receiving members can be spaced about 2 in to about 24 in.

Figure 36:
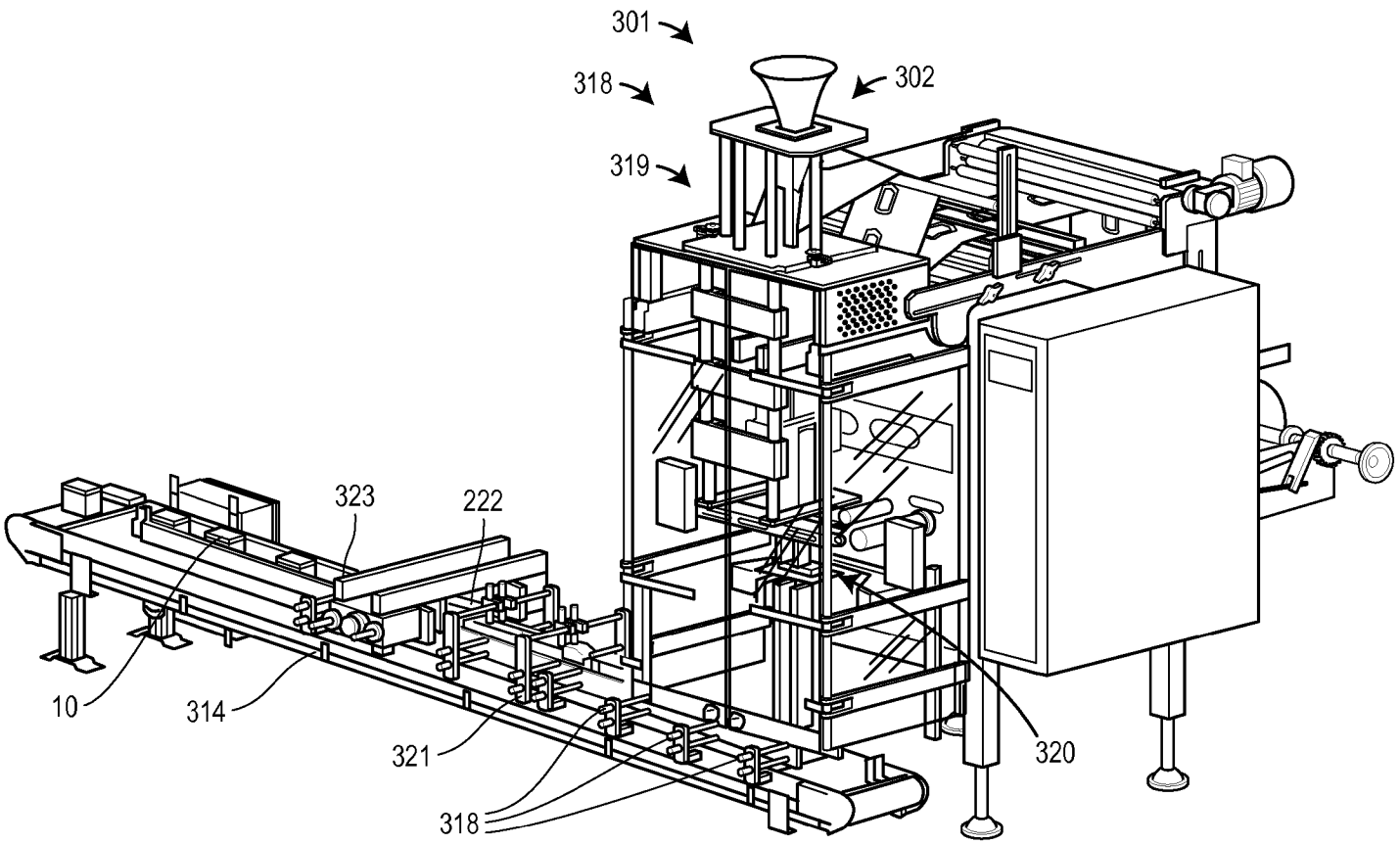
FIG. 36 is a perspective view of an embodiment of a packaging machine used to manufacture an embodiment of a re-closable packaging assembly 10.
Figure 37:
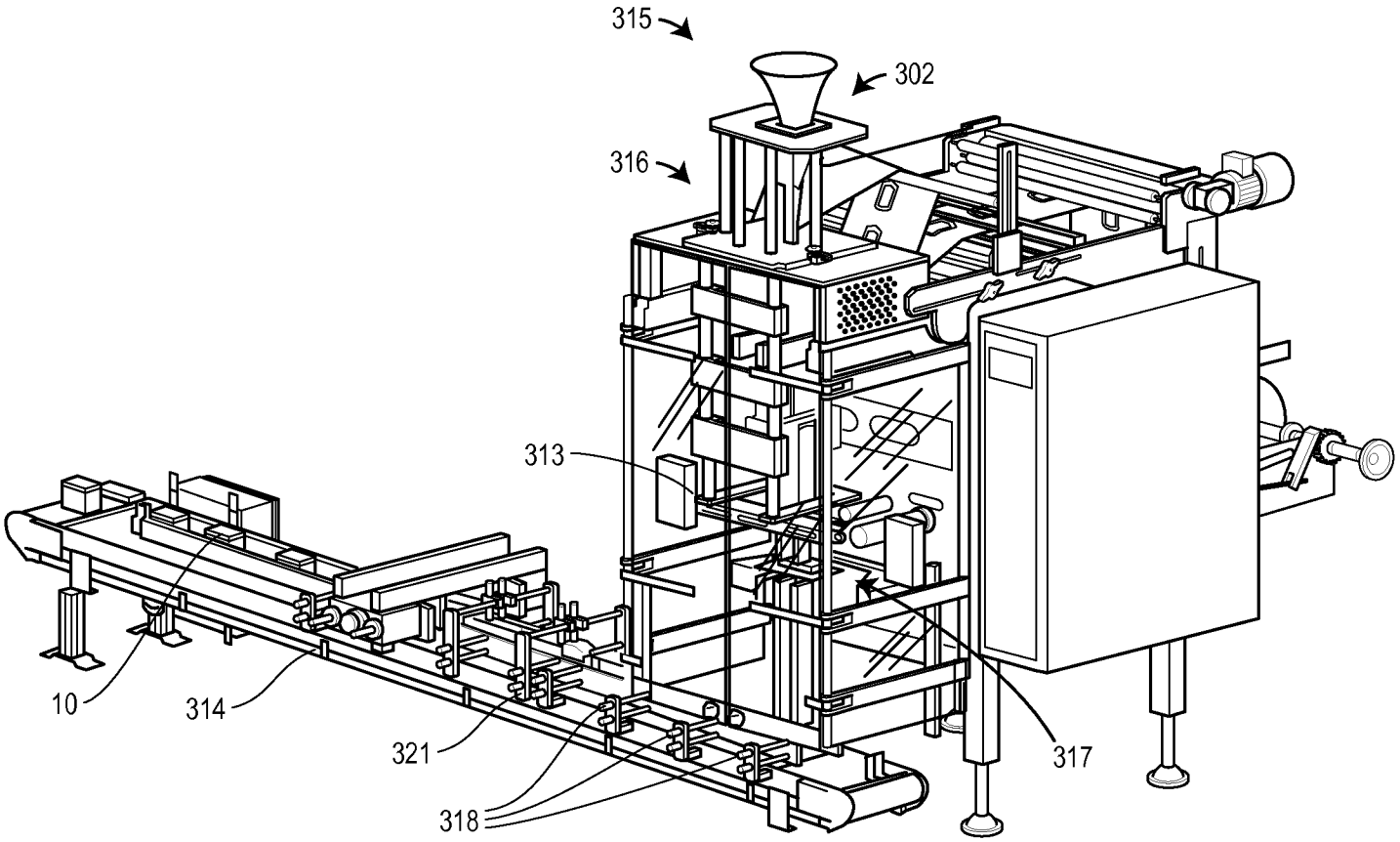
FIG. 37 is a perspective view of an embodiment of a packaging machine used to manufacture an embodiment of a re-closable packaging assembly 10.
Figure 38:
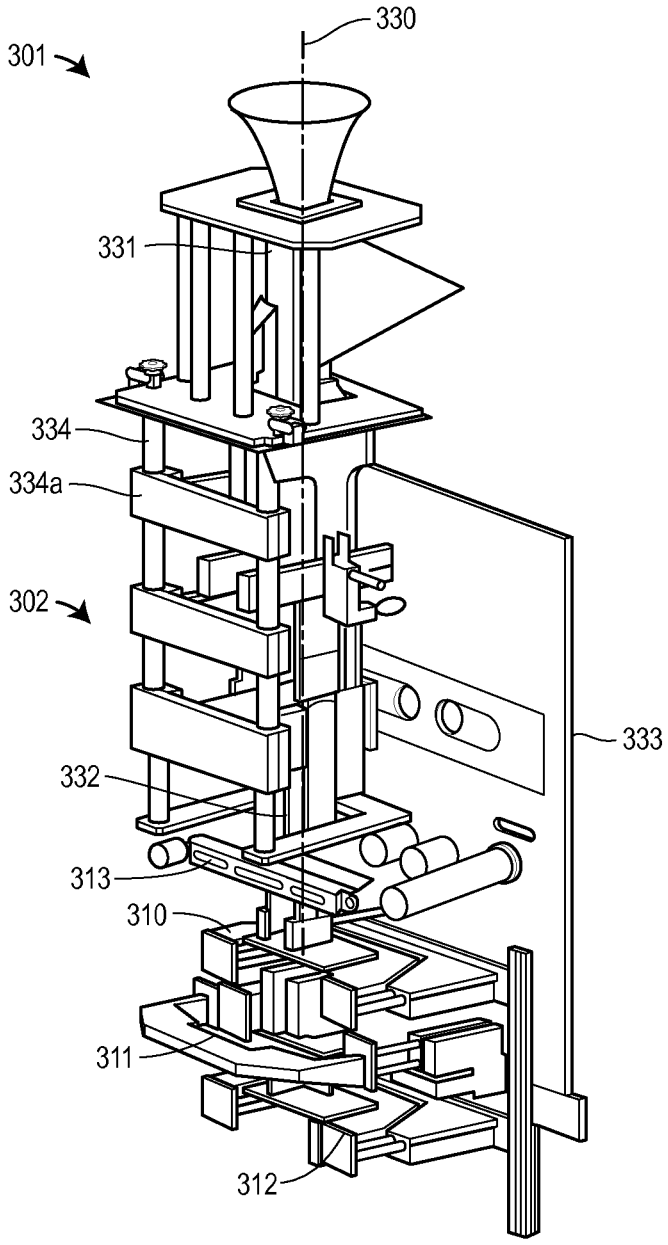
FIG. 38 is a perspective view of an embodiment of a forming station of a packaging machine used to manufacture an embodiment of a re-closable packaging assembly 10.
Figure 39D:
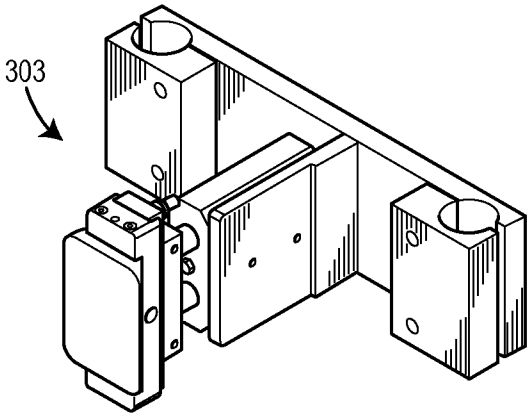
FIGS. 39A to 45F illustrate various components of the embodiment of the forming station of FIG. 38.
Figure 39C:
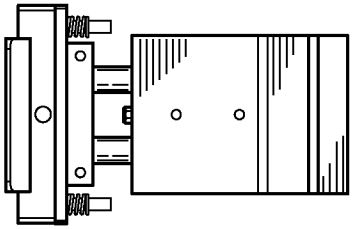
Figure 39A:
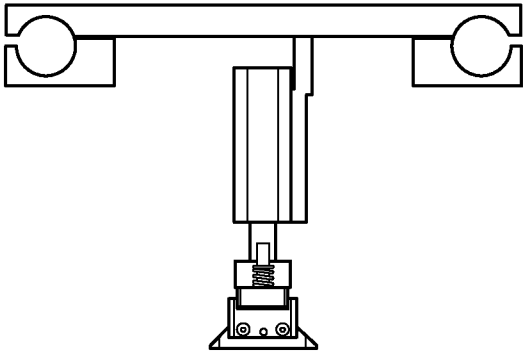
Figure 39B:
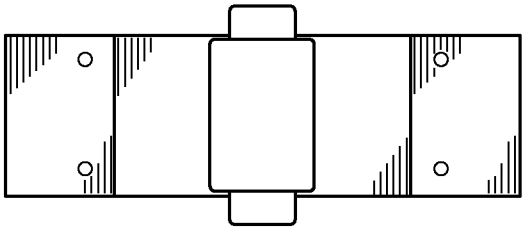
Figure 40A:
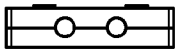
Figure 40B:
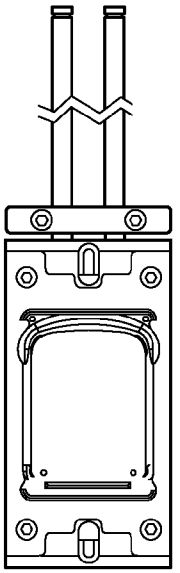
Figure 40D:
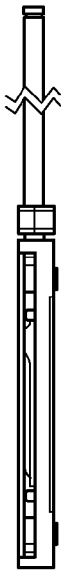
Figure 40E:
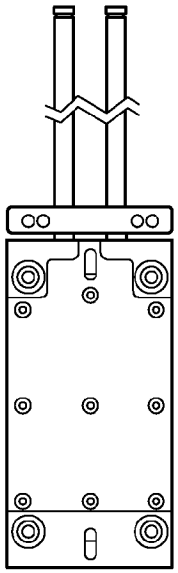
Figure 40C:
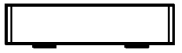
Figure 40F:
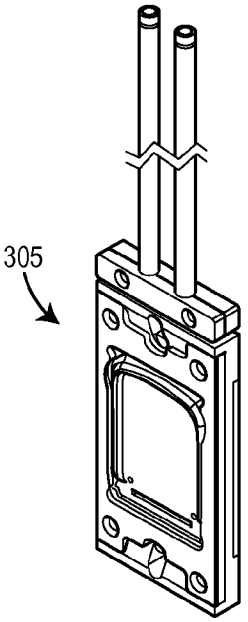
Figure 41D:
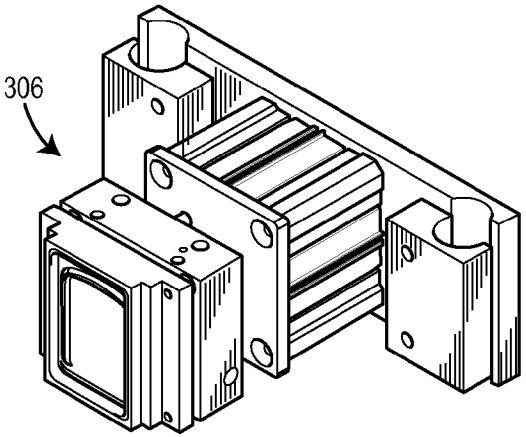
Figure 41C:
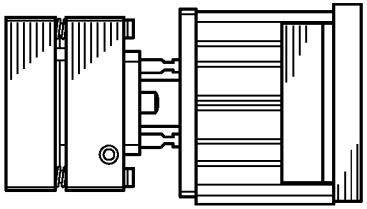
Figure 41A:
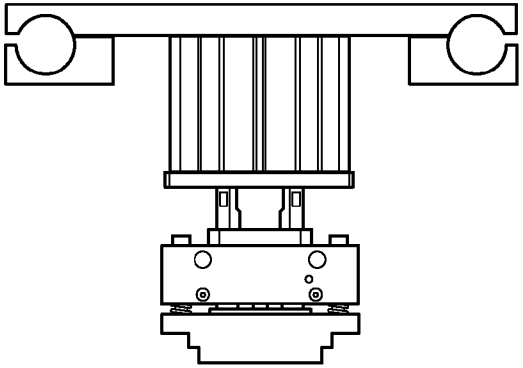
Figure 41B:
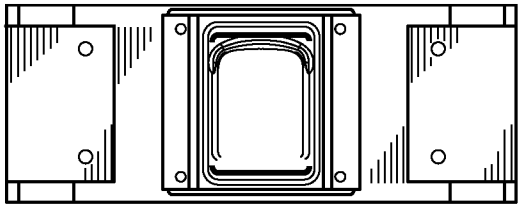
Figure 42A:
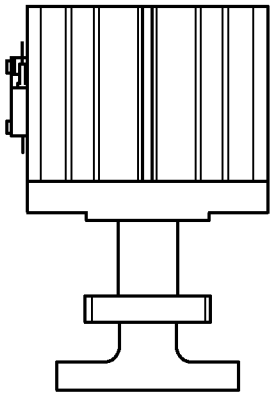
Figure 42B:
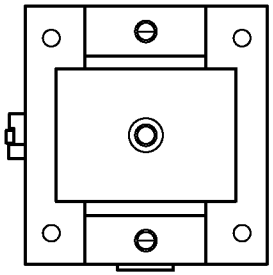
Figure 42C:
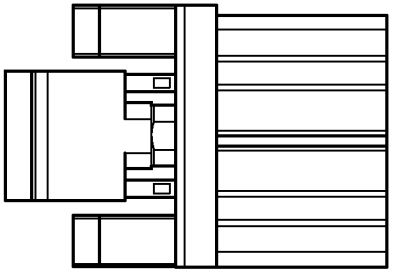
Figure 42D:
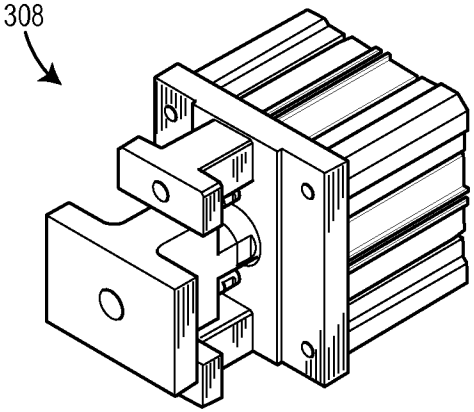
Figure 43A:
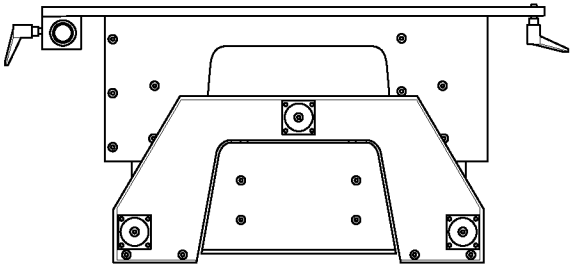
Figure 43B:
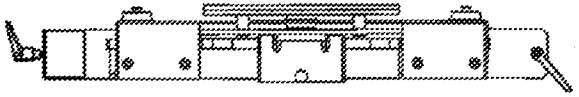
Figure 43C:
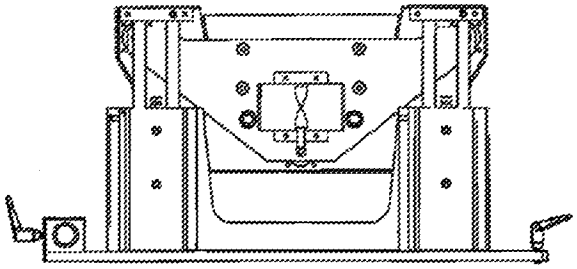
Figure 43D:
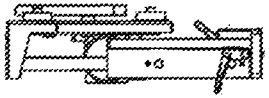
Figure 43E:
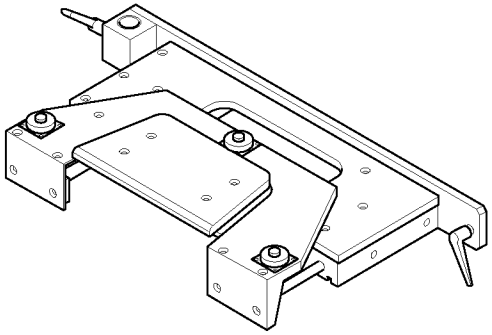
Figure 43F:
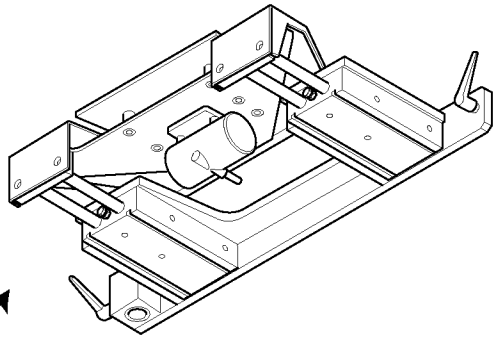
Figure 44A:
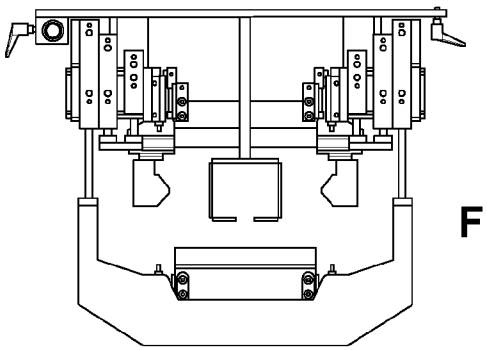
Figure 44B:
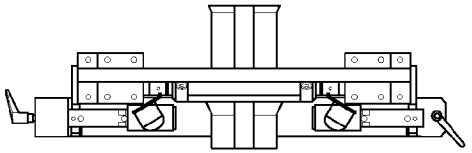
Figure 44D:
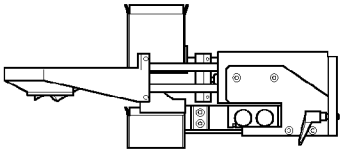
Figure 44C:
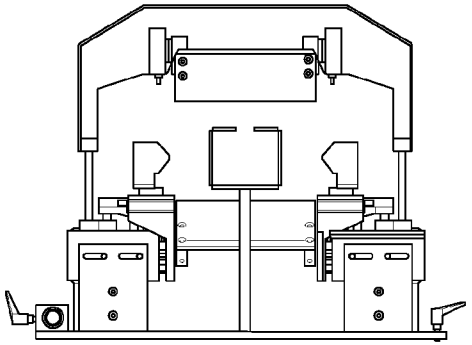
Figure 44E:
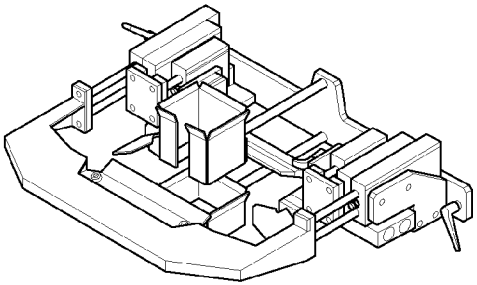
Figure 44F:
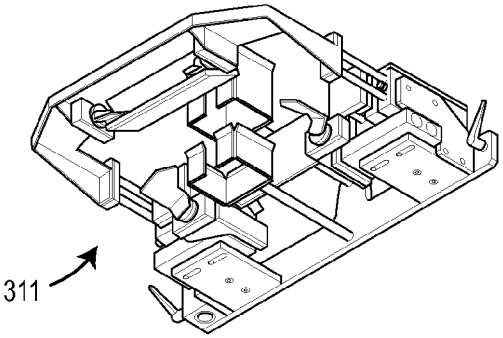
Figure 45E:
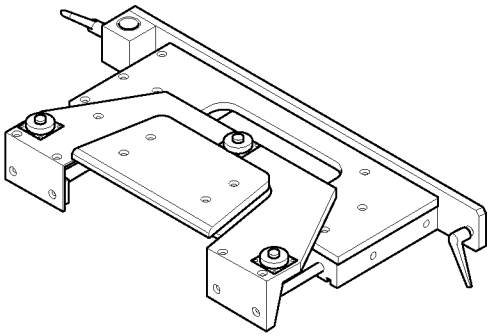
Figure 45F:
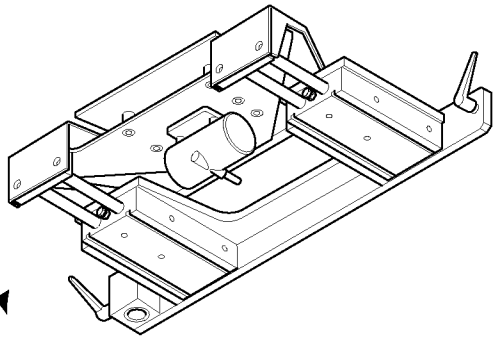
Figure 45D:
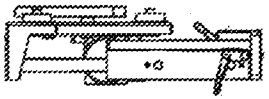
Figure 45A:
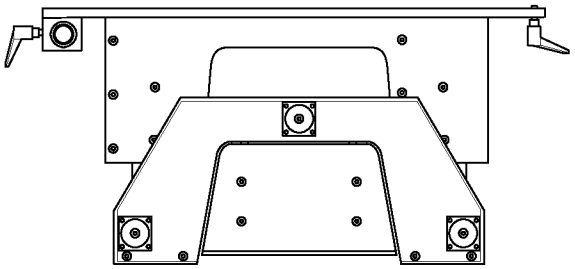
Figure 45B:
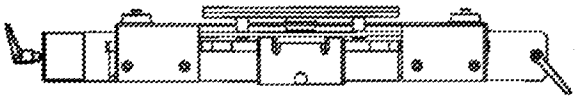
Figure 45C:
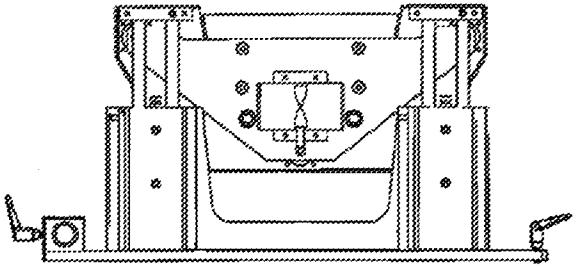
Figure 46:
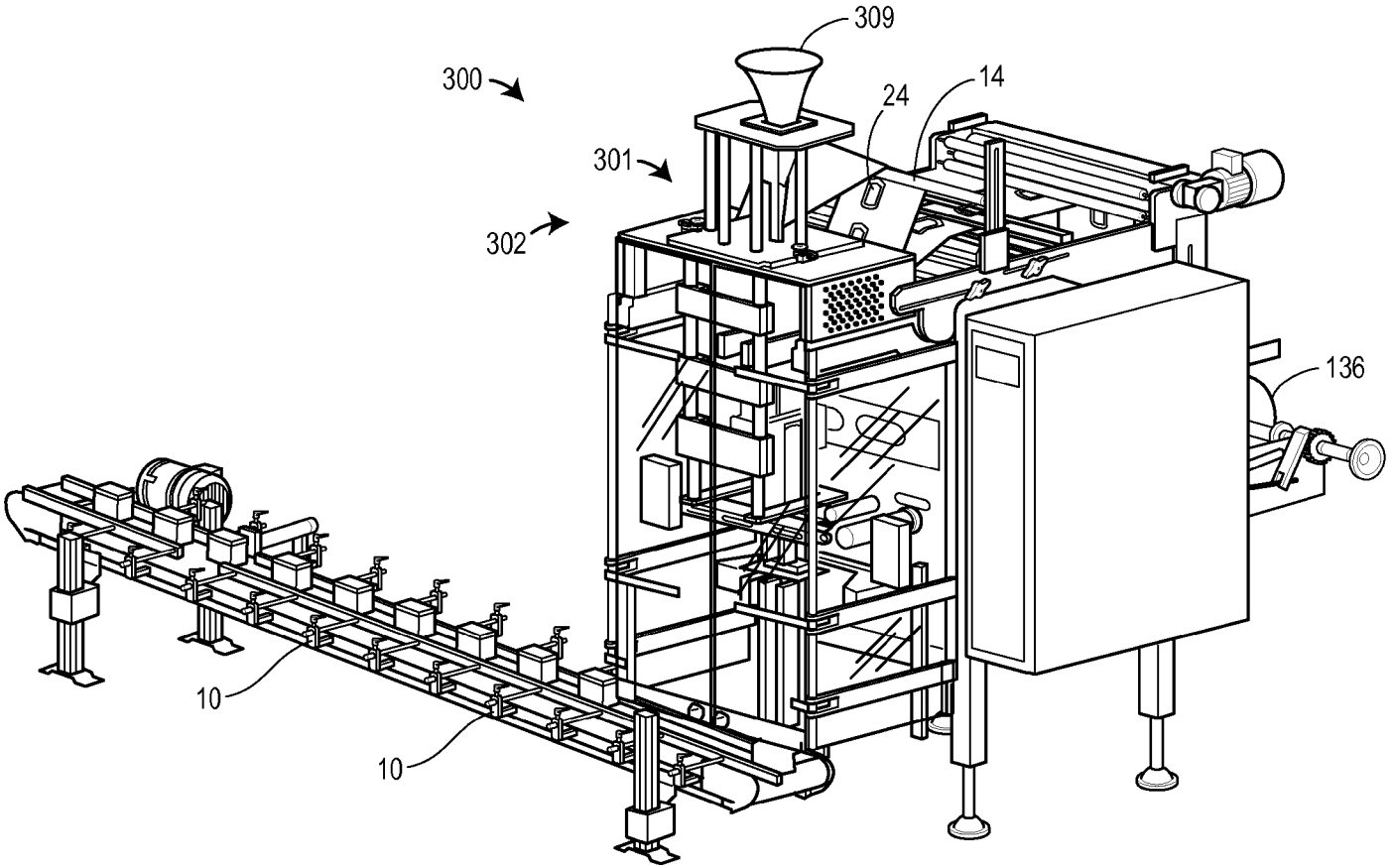
FIG. 46 is a perspective view of an embodiment of a packaging machine used to manufacture an embodiment of a re-closable packaging assembly 10.

FIGS. 36, 37, and 46 illustrate various embodiments of VFFS machines. FIG. 46 illustrates a VFFS machine 300 (Vertical Folding Station Mode) having an embodiment of the vertical forming station 301 illustrated in FIG. 38. The vertical forming station 301 includes the forming tube assembly 302 illustrated in FIGS. 33A to 33D, and the forming tube assembly 302 may include a forming tube 307 extending along a first longitudinal axis 330 from a first end 331 to a longitudinally-opposite second end 332. The first longitudinal axis 330 may be vertical or substantially vertical. As used herein, the term vertical includes a direction parallel or substantially parallel to the Z-axis of the reference coordinate system provided in FIGS. 33 and 52A. Alternatively, the first longitudinal axis 330 may be horizontal or substantially horizontal. As used herein, the term horizontal includes a direction normal to or substantially normal to the Z-axis of the reference coordinate system provided in FIGS. 33A to 33D and 52A, such as a direction within or substantially within the X-Y plane of the reference coordinate system provided in FIGS. 33A to 33D and 52A. The forming tube assembly 302 may be modular and may be releasably secured to a primary frame assembly or a portion of the primary frame assembly. The forming tube assembly 302 of FIGS. 33A to 33D may include one or more (e.g., two) heating stations 303, and the heating stations 303 may each be identical to the embodiment of FIGS. 39A to 39D. In some embodiments, the heat station 303 can be designed to selectively heat zones of the portion of film disposed within the heating station. The forming tube assembly 302 of FIGS. 33A to 33D may also include a forming station 304, such as a thermoforming station, that may include an inside forming cavity or a first mold element 305 (illustrated in FIGS. 40A to 40F) and an outside forming cavity or a second mold element 306 (illustrated in FIGS. 41A to 41D) to form any or all of the first engagement feature 36, the first securement feature 104*a*, the second engagement portion 38, the convex portion 98, the second securement feature 104*b*, the hinge portion 28 of the closure assembly 22, the one or more ribs 51, and/or the optional locking mechanism 126. The forming tube assembly 302 of FIGS. 33A to 33D may further include a forming tube 307 (illustrated in FIGS. 34A to 34E) that extends longitudinally (i.e., along the first longitudinal axis 330) relative to the forming tube assembly 302, and the forming tube 307 may function identically to the forming tube 146 described above. That is, the forming tube 307 may be adapted to shape the film as the film displaces in a direction parallel to the first longitudinal axis 330. The first mold element 305 (which may be identical to the die 193 of FIG. 35), or any portion of the forming station 304, may be secured directly to a portion of the forming tube 307, and the portion of the forming tube may be at or adjacent to the second end of the forming tube 332.

The forming tube assembly 302 of FIGS. 33A to 33D may further include a pressure offset assembly 308 (illustrated in FIGS. 42A to 42D) that applies pressure to the forming tube 307 opposite to the inside forming cavity 305 and the outside forming cavity 306. The pressure applied to the forming tube assembly 302 by the pressure offset assembly 308 may be equal or approximately equal to the pressure applied by the inside forming cavity 305 and the outside forming cavity 306, and this offset pressure improves stability and reduces deflection in the forming tube assembly 302. The forming tube assembly 302 of FIGS. 33A to 33D may additionally include a product funnel 309 for receiving the product to be disposed in the re-closable packaging assembly 10.

A primary frame assembly 333 may extend along or substantially along the first longitudinal axis 330, with at least a portion of the forming tube 307 directly or indirectly coupled to a portion of the primary frame assembly 333 to support the forming tube 307 or any portion of the forming tube assembly 302. A first end of the primary frame assembly 333 may be disposed adjacent to (or vertically extend above) the first end 331 of the forming tube 307 and a second end of the frame assembly may extend beyond (or vertically extend below) the second end 332 of the forming tube 332. The primary frame assembly 333 may include a frame or other support assembly, such as a plate, (or multiple frames and/or support assemblies) that is adapted to be a permanent or semi-permanent base for the components that comprise the VFFS machine 300. In contemplated embodiments, one or more modular frame assemblies 334, such as a first modular frame assembly 334*a*, may be removably secured to the primary frame assembly 333, One or more components, such as the first heating station 303, may be secured to a first portion of the first modular frame assembly 334 and at least a portion of the first thermoforming station 304 (such as the second mold element of the first thermoforming station 304) may be secured to a second portion of the first modular frame assembly 334. One skilled in the art would recognize that such modular frame assemblies 334 allow a user or technician to quickly and efficiently switch out components secured to the modular frame assemblies 334. The second modular frame assembly 334*b* may have one or more different heating stations 303 and/or one or more different thermoforming stations 304 (or a portion of a thermoforming station) than the first modular assembly 334. However, such modular frame assemblies 334 are optional, and the first heating station 303 and at least a portion of the thermoforming station 304 may be secured directly (or indirectly) to the primary frame assembly 333.

Figure 52A:
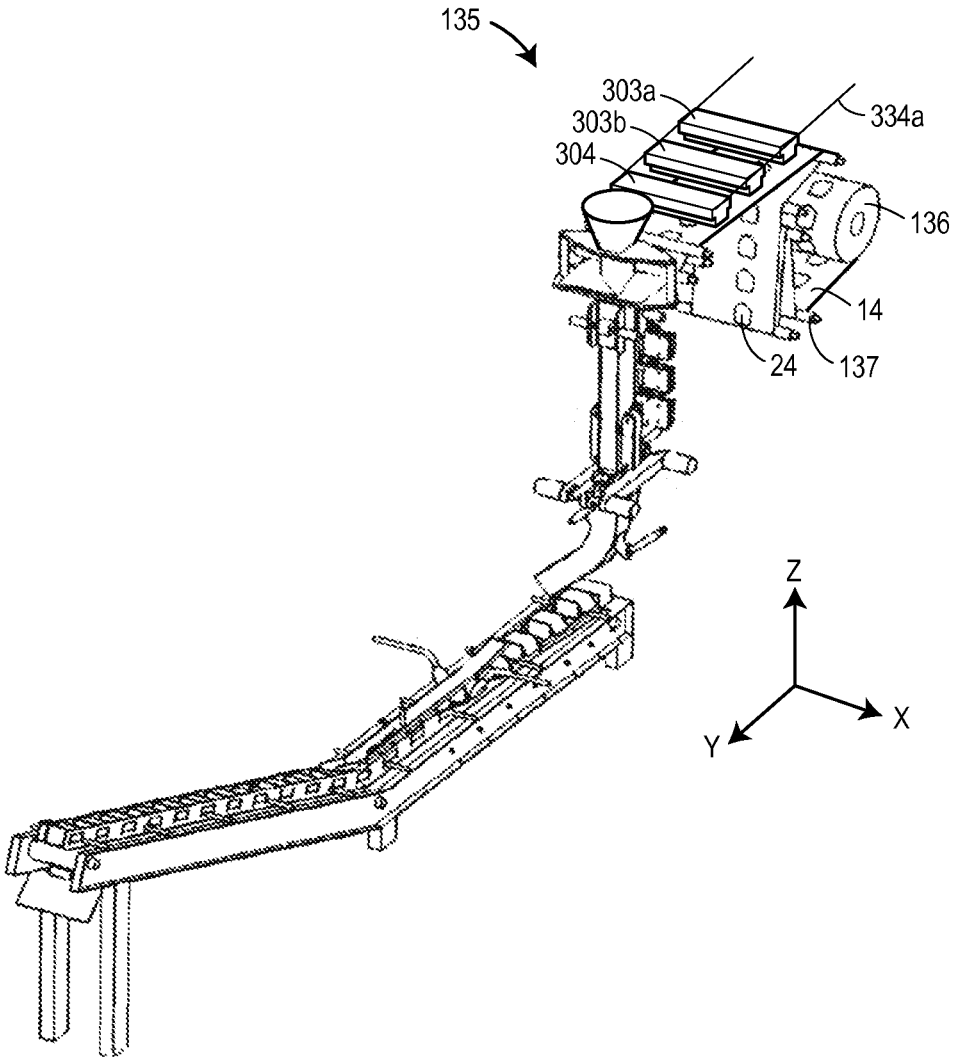
FIG. 52A is a perspective view of an embodiment of a packaging machine used to manufacture an embodiment of a re-closable packaging assembly 10.
Figure 52B:
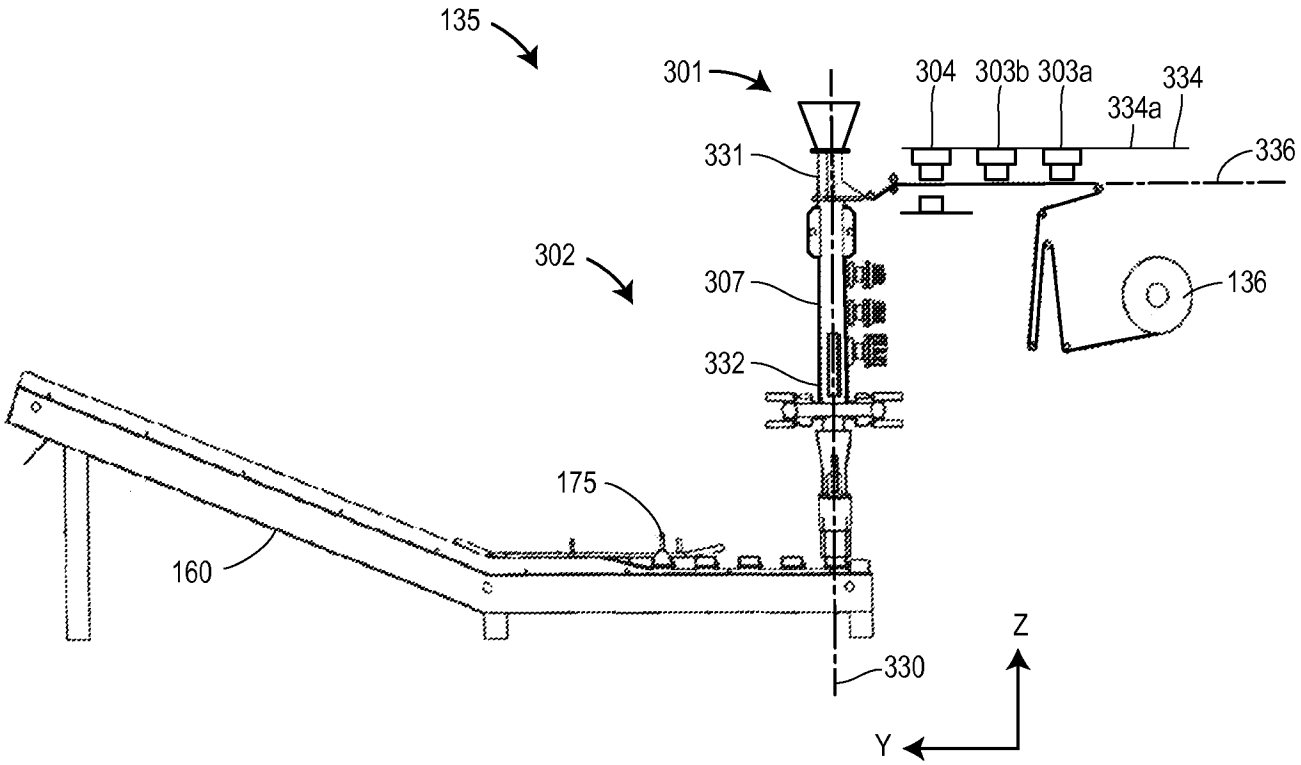
FIG. 52B is a side view of the embodiment of FIG. 52A.
Figure 53A:
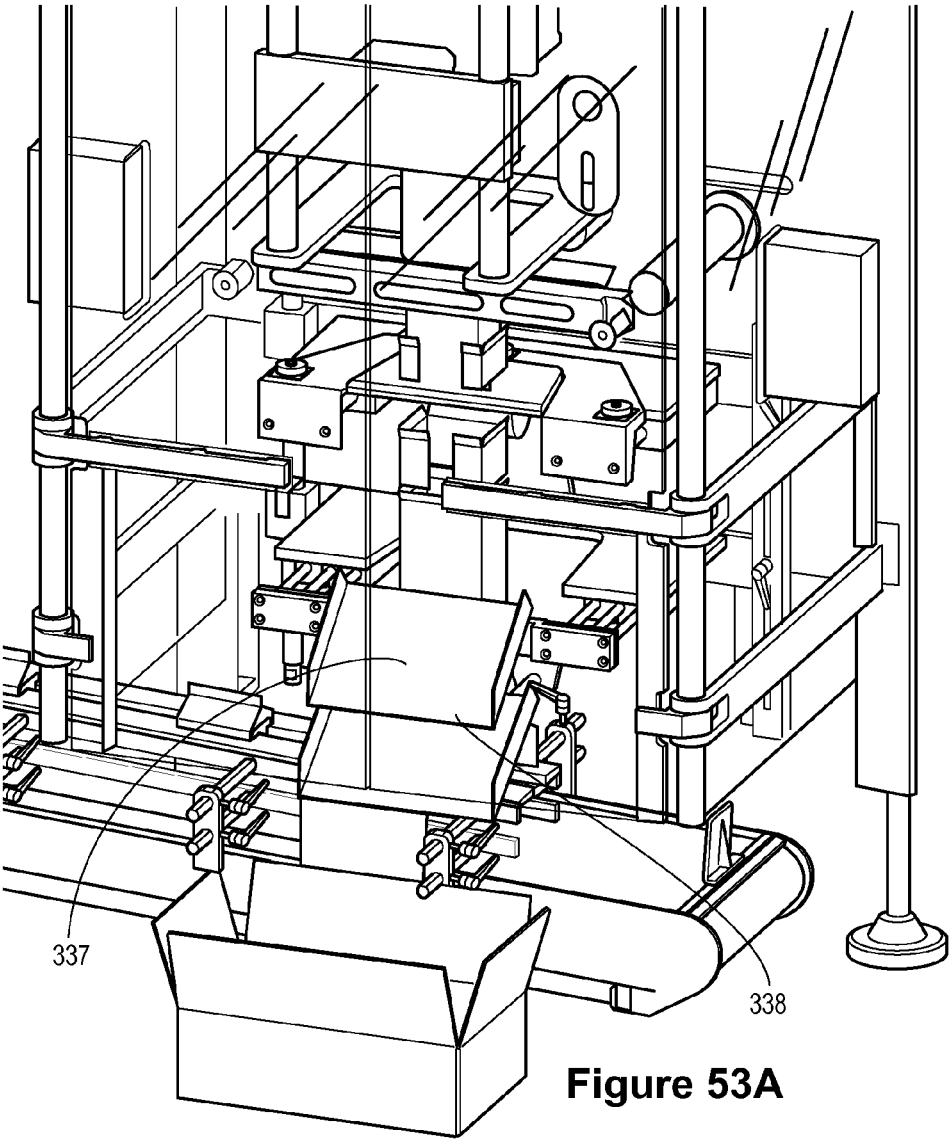
FIGS. 53A to 53F are various views of a reject station.
Figure 53B:
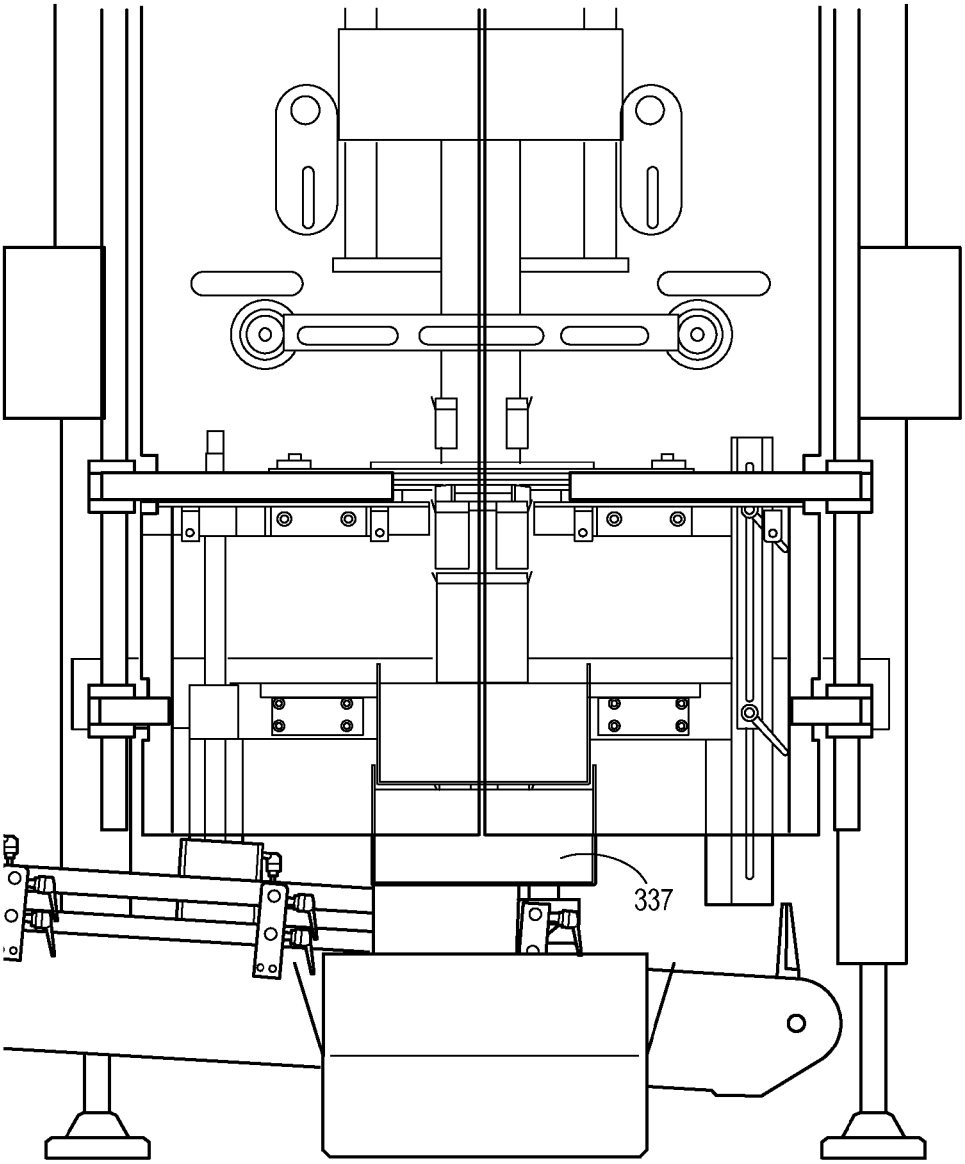
Figure 53C:
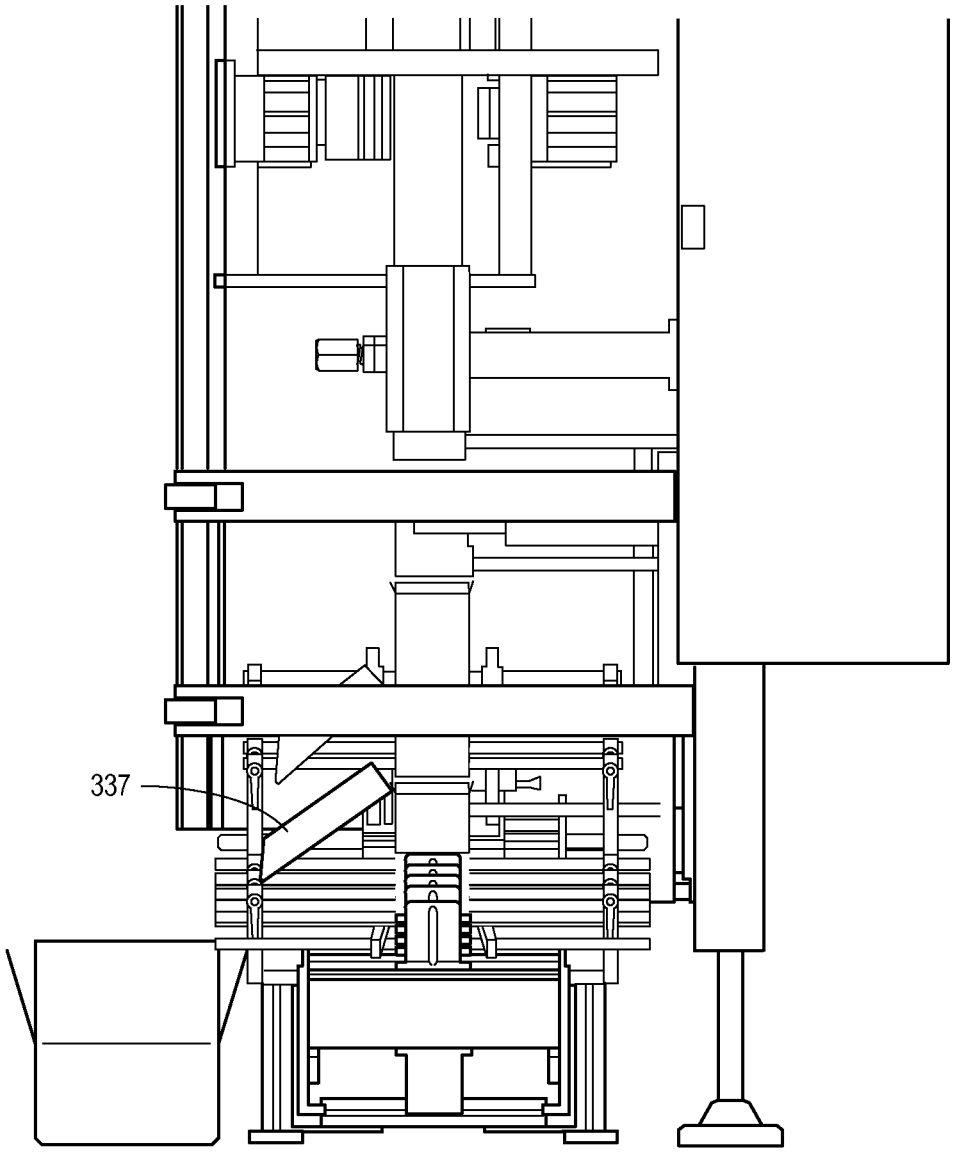
Figure 53D:
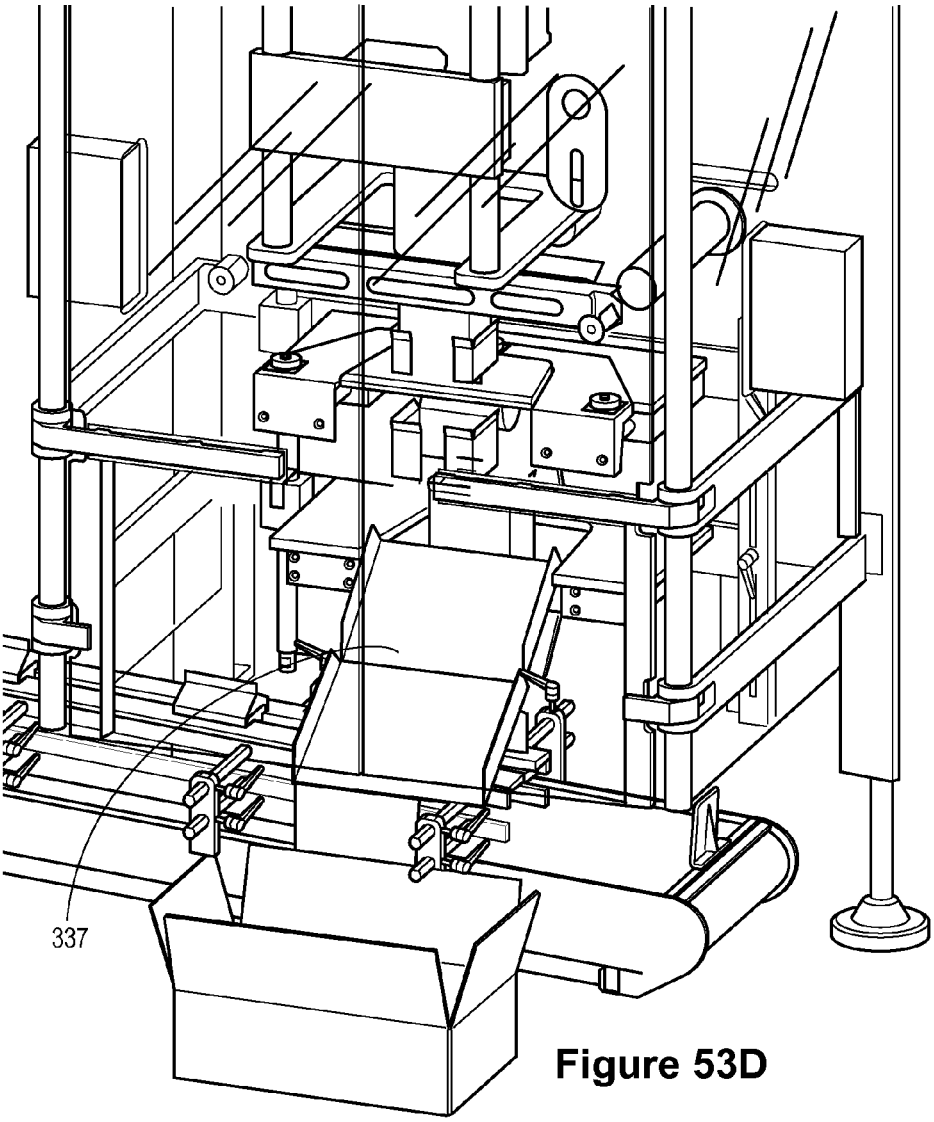
Figure 53E:
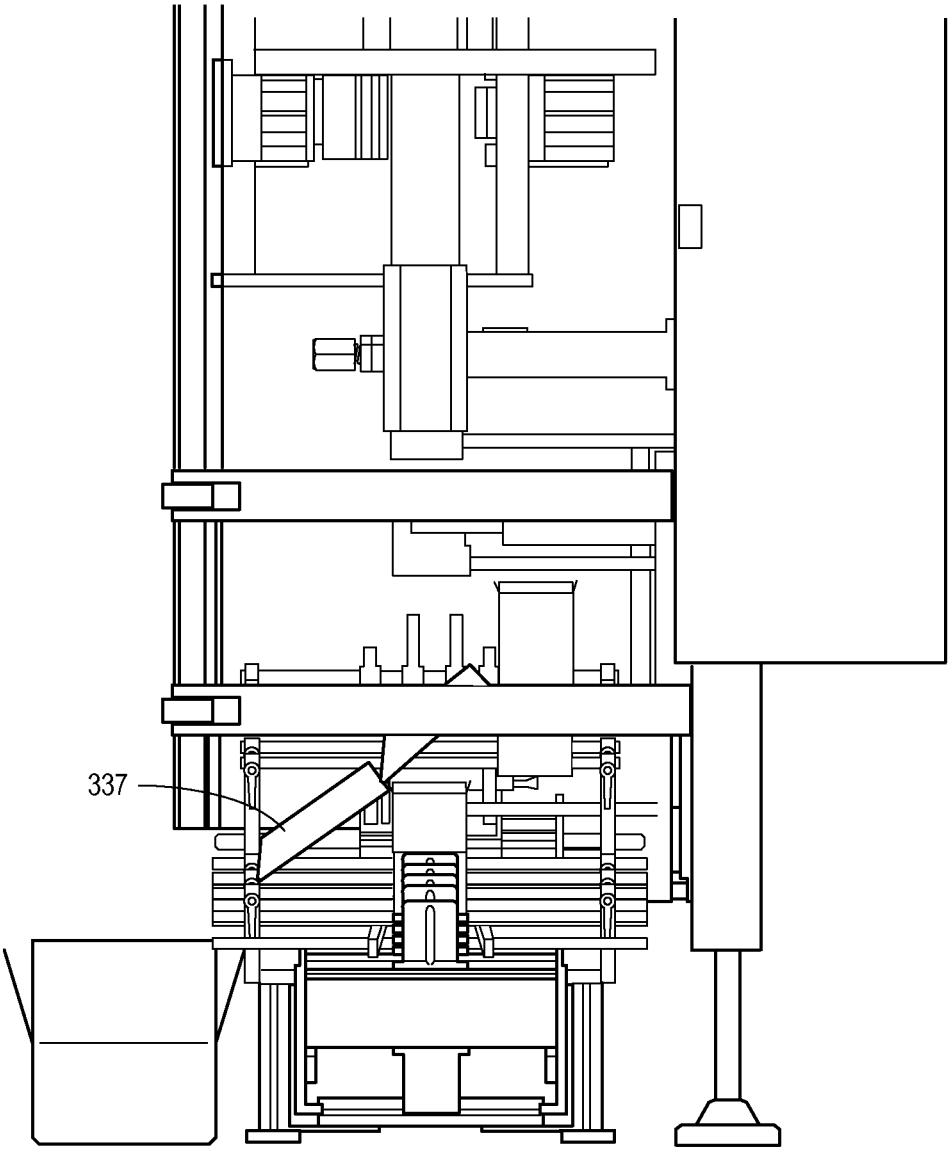
Figure 53F:
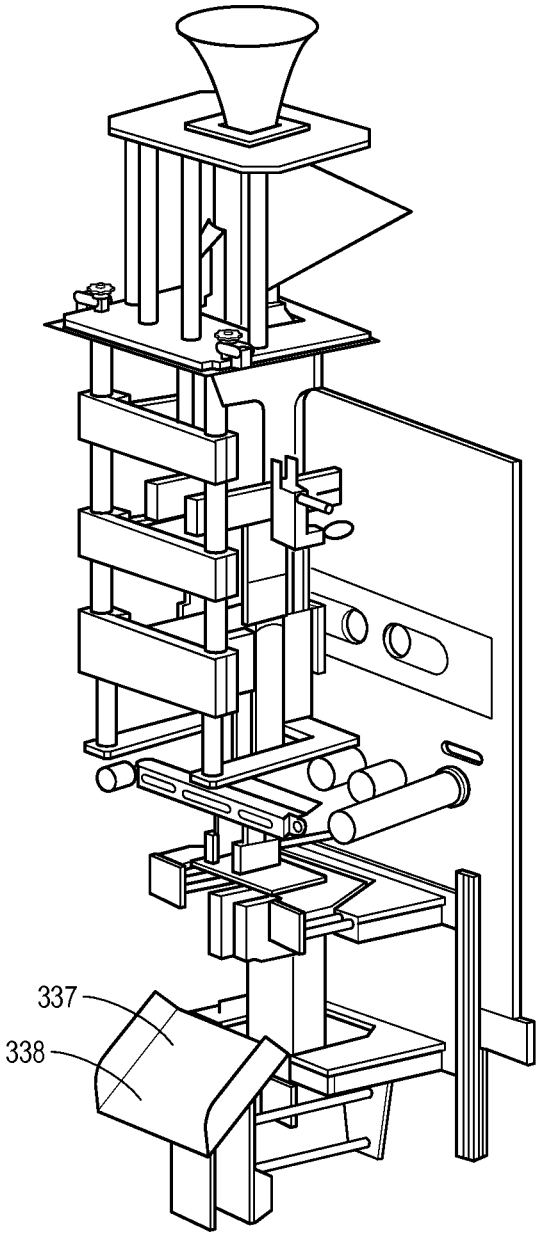

In other embodiments, such as the vertical forming station 335 of FIGS. 52A and 52B, the film roll station 136 may be coupled to the primary frame assembly 333 in any suitable manner, and the film roll station 136 may be adapted to support a roll of the film 14. The film roll station 136 may be positioned such that the film 14 extends from the film roll station 136 to a point at or adjacent to the first end 331 of the forming tube 307. More specifically, the film 14 may extend from the film roll station 136 to a portion of the forming tube 307 between the first end 331 and at least one of the heating stations 303 (such as the first heating station). The film may engage one or more dancer rolls 137 to guide the film along the film path. Each of the dancer rolls 137 and the support rod of the film roll 136 may have a diameter of 2" to prevent the label 24 from separating from the film 14 as the film 14 translates over the rolls 136, 137. In this embodiment, a first segment of the film 14 may extend between the film roll station 136 and the first end 331 of the forming tube 307 along a second longitudinal axis 336. The second longitudinal axis 336 may have any suitable orientation, and the second longitudinal axis 336 may be non-parallel and non-coaxial with the first longitudinal axis 330. For example, the second longitudinal axis 336 may be normal to (extend oblique to) the first longitudinal axis 330.

In this embodiment, one or more heating stations 303 may include a first heating element 303*a* for heating a first portion of the film 14 as the film displaces toward the first end 331 of the forming tube 307, the first heating station 303*a* being disposed between the film roll station 136 and the first end 331 of the forming tube 307. A second heating station 303*b* may be disposed between the first heating station 303*a* and the first end 331 of the forming tube 307. The first thermoforming station 304 may be disposed between the first heating station 303*a* (or the second heating station 303*b*) and the first end 331 of the forming tube 307. So configured, the one or more heating stations 303 and the first thermoforming station 304 may be disposed upstream (relative to the direction of travel of the film 14 through the vertical forming station 335) of the forming tube 307 or the first end 331 of the forming tube 307.

In contemplated embodiments, as illustrated in FIGS. 52A and 52B, one or more modular frame assemblies 334, such as a first modular frame assembly 334*a*, may be removably secured to the primary frame assembly 333 at one or more locations between the film roll 136 and the first end 331 of the forming tube 307. One or more components, such as the first heating station 303, may be secured to a first portion of the first modular frame assembly 334 and at least a portion of the first thermoforming station 304 (such as the second mold element of the first thermoforming station 304) may be secured to a second portion of the first modular frame assembly 334. One skilled in the art would recognize that such modular frame assemblies 334 allow a user or technician to quickly and efficiently switch out components secured to the modular frame assemblies 334. For example, a first modular frame assembly 334 may removed from the primary frame assembly 333 and a second modular frame assembly 334*b* may be secured to the primary frame assembly 333. The second modular frame assembly 334*b* may have one or more different heating stations 303 and/or one or more different thermoforming stations 304 (or a portion of a thermoforming station) than the first modular assembly 334. However, such modular frame assemblies 334 are optional, and the first heating station 303 and at least a portion of the thermoforming station 304 may be secured directly (or indirectly) to the primary frame assembly 333.

Referring again to FIG. 38, the vertical forming station 301 of FIG. 38 may include an upper bottom flap folding assembly 310 (or a first folding assembly or a first folding station illustrated in FIGS. 43A to 43D) downstream of a seal bar assembly 313 and the forming tube assembly 302. The first folding station 310 may be coupled to the primary frame assembly 333 or the modular frame assembly 334 and may be disposed between the second end 332 of the forming tube and the second end of the primary frame assembly.

The upper bottom flap folding assembly 310 may also include a product settling vibrator and/or a heater. The vertical forming station 301 may also include a top flap folding assembly 311 (illustrated in FIGS. 44A to 44F) and a lower bottom flap folding assembly 312 (illustrated in FIGS. 45A to 45F), and the lower bottom flap folding assembly 312 may also include a product settling vibrator and/or a heater. The upper bottom flap folding assembly 310, the top flap folding assembly 311, and/or the lower bottom flap folding assembly 312 may cooperate to form flaps, corners, and/or folds in the film to form portions of the re-closable packaging assembly 10. The vertical forming station 301 may also include seal bars 313 to seal edges of the film to form portions of the re-closable packaging assembly 10. The seal bars 313 may also form the end seals and cut the packages apart.

In the VFFS machine 300 illustrated in FIG. 46, the re-closable packaging assembly 10 is formed or substantially formed in the vertical forming station 301, and each completed or substantially completed the re-closable packaging assembly 10 is placed on a takeaway conveyor 314 that transports the re-closable packaging assembly 10 for subsequent inspection or further packaging.

Referring now to FIG. 37, an embodiment of a VFFS machine 315 (Horizontal Top End Seal Folding and Gluing Mode) includes an embodiment of a vertical forming station 316 that includes the forming tube assembly 302 illustrated in FIGS. 33A to 33D. The vertical forming station 316 may be similar to the vertical forming station 301 of FIG. 38. However, the vertical forming station 316 may only include a package bottom folding assembly 317. In this embodiment, partially-formed re-closable packaging assemblies 10 are placed on the conveyor 314 and the partially-formed re-closable packaging assemblies 10 are routed through side guides that hold snug against the re-closable packaging assembly 10 and positively locate it in a desired fixed position, such a vertical orientation. On the conveyor, the partially-formed re-closable packaging assemblies 10 may pass through a product settling/vibration station 318, and, subsequently, additional folding and glue stations to complete the re-closable packaging assemblies 10. The glue stations can include equipment for applying glue to a flap and folding the flap over to seal to the side of the package. Alternatively, heated bars can be provided at the glue station to heat the film material and then folding devices can be provided to fold the heated flap over and apply pressure to secure the flap to the side of the package by a heat seal. In various embodiments, the packaging machine can include power driven belts, which can for example, facilitate moving the film/packages through the machine.

Referring to FIG. 36, an embodiment of a VFFS machine 318 (Horizontal Top End Seal Folding and Sealing Mode) includes an embodiment of a vertical forming station 319 that includes the forming tube assembly 302 illustrated in FIGS. 33A to 33D. The vertical forming station 319 may be similar to the vertical forming station 301 of FIG. 38. However, the vertical forming station 316 may only include a package bottom folding assembly 317 and may include seal jaws 320 adapted to form seals having vent channels to vent the re-closable packaging assembly 10 in a manner that will be subsequently described in more detail. In such seal jaws 320, each of the seal bars has a channel extending therethrough, and the channel of each of the seal bars is aligned such that when the seal bars engage to seal a portion of the film of the packaging assembly 10, the channels cooperate to create an elongated unsealed vent in the film. The vent may be disposed in any orientation, including the vertical direction. In this embodiment, partially-formed re-closable packaging assemblies 10 are placed on the conveyor 314 and the partially-formed re-closable packaging assemblies 10 are routed through side rails as described above. On the conveyor, the partially-formed re-closable packaging assemblies 10 may pass through a product settling/vibration station 318. In addition, the partially-formed re-closable packaging assemblies 10 may pass through an end seal control and deflation station 321 and then an end seal station 322, 323 to seal the vent and/or to make the package tighter.

Figure 76A:
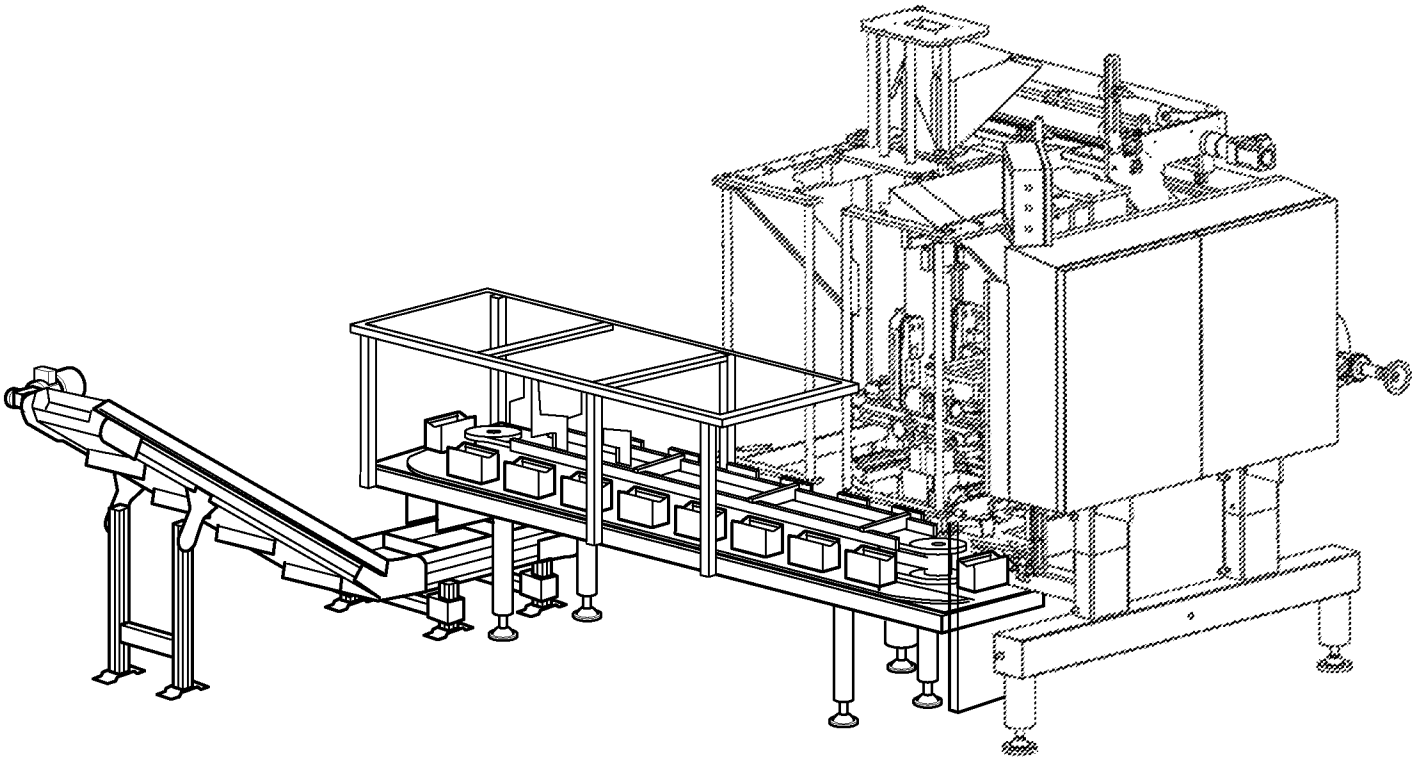
FIG. 76A to 76E are various view of a schematic illustration of packaging machine having a race-track type conveyor in accordance with an embodiment of the disclosure.

As illustrated in FIGS. 53A to 53F, a VFFS machine may include a reject station 337 disposed between the second end of the primary frame assembly 333 and the second end 332 of the forming tube 307. The rejection station 337 may include at least one ramp (e.g., a first ramp 338 alone ore more than one ramps), and the at least one ramp 338 may be disposed in any position below the second end of the forming tube to allow containers downwardly displaced from the second end of the forming tube to contact a surface of the first ramp 338. For example, the at least one ramp 338 may be disposed at an angle relative to a reference plane normal to the first longitudinal axis 330. So configured, the first ramp has a first end that is disposed adjacent to and below the second end of the forming tube such that the film that forms a partially-formed re-closable container contacts the first end of the first ramp when the partially-formed re-closable container is released from the forming tube 307. The partially-formed re-closable container travels under the influence of gravity to the second end of the ramp and into a waste receptacle, for example. The reject station 337 may be secured directly or indirectly to any portion of the assembly, such as the primary frame assembly 333 or the vertical forming station 301, for example. The reject station 337 may be deployed at start-up when partially-formed containers are released from the forming tube 307 that would become stuck in downstream folding stations. The reject station may also be deployed if under or overweight product fills are detected or if metal is detected in the package, for example. A reject station can alternatively be provided on the conveyor. For example, a portion of the conveyor can drop out or a robotic arm can be provided to remove a package from the conveyor at a reject location. FIG. 76A illustrates an embodiment in which a reject station is provided on the conveyor.

The components of the packaging machine 135 and the steps for forming the re-closable packaging assembly 10 therein may be rearranged as necessary to properly form the re-closable packaging assembly 10, and to do so in an efficient and cost-effective manner. For example, as explained above, the web of film may be directed into the one or more heating stations 138, the first forming station 140, and any subsequent forming stations following the seal/corner seal station 152.

In various embodiments, the package can be formed using a process for venting the internal atmosphere of the package. In the packaging of various materials, it can be necessary to provide a particular head space in the package during the filling and package sealing process to protect the product. Methods in accordance with the disclosure can include venting this headspace, which can advantageously reduce the package size. The package can be vented for example by forming a vent hole when sealing the leading or trailing seal of the package. For example, the seal jaw can form the seal in the package leaving a small gap in the seal through which air can vent. Once vented, the seal can be resealed to seal the vent hole. In quad seal type packages, for example, an initial seal can be provided to include the vent and then upon venting of the air in the package, the seal can be reformed to close the vent and then the seal can be folded over and adhered to the outer side of the package.

In some embodiments, the process can include settling the product in the package before forming the seal to close the package. For example, a leading seal can be formed in the package and the product can be filled in the package. Prior to sealing the trailing seal, the product can be subject to a settling process, for example by vibration or other methods known in the art, to settle the product to the portion of the package adjacent the formed leading seal. The trailing seal can then be formed. In some embodiments, the package can be dropped or placed onto a conveyor from the forming tube before forming the trailing seal. The conveyor can include a settling station in which the product is settled to the portion of the package adjacent the trailing seal. The leading seal can then be formed and optionally may include a vent as described above.

In various embodiments of the package, the trailing and leading seals can be folded over and adhered to the outer portion of the package. Such folding and sealing operations of the leading seal can be completed either when forming the leading seal with the film disposed about the forming tube or when the package is disposed on the conveyor. Such folding and sealing operations of the trailing seal can be completed either when the film is provided about the forming tube or on the conveyor. When the trailing seal is formed on the conveyor, the folding and sealing operations to adhere the seal to the outside of the package will be performed on the conveyor. In some embodiments, the trailing seal can be formed while the film is about the forming tube such that a sealed package is provided to the conveyor for the folding and sealing of the leading and/or trailing seals to the outside of the package. In some embodiments, the leading and trailing seals can be both formed and folded and sealed to the outer portion of the package when the package is disposed in line with the forming tube, and prior to placing the package on a conveyor.

One skilled in the art will understand that the containers 10 may be formed by other types of machines or combinations of machines, such as horizontal form, fill and seal (HFFS) machines, Stand-Up Pouch type machines, sequential assembly machines and the like, and the use of such machines or combinations of machines performing the various tasks in forming containers in accordance with the present disclosure is contemplated by the inventors. One skilled in the art would also recognize that any suitable product may be disposed within the container 12 of the re-closable packaging assembly 10. For example, food products, such as peanuts, may be disposed within the container 12. Alternatively, baby wipes may also be disposed within the container 12.

As previously explained, and unlike conventional re-closable packaging assemblies, the lid member 26, the first engagement feature 36, and the second engagement feature 38 may be formed in the container 12 and the closure assembly 22 in one manufacturing operation, thereby eliminating the need to attach a separately-fabricated lid assembly that is secured to a container. Because the features are formed in a single process step, and because the separately-fabricated lid assembly is not necessary, one having ordinary skill in the art would recognize that manufacturing time and cost are reduced. Moreover, one having ordinary skill in the art would recognize such features allows for reliable resealing of the lid member 26 to the container 12 despite the presence of surface contaminants in the sealing area.

Figure 76B:
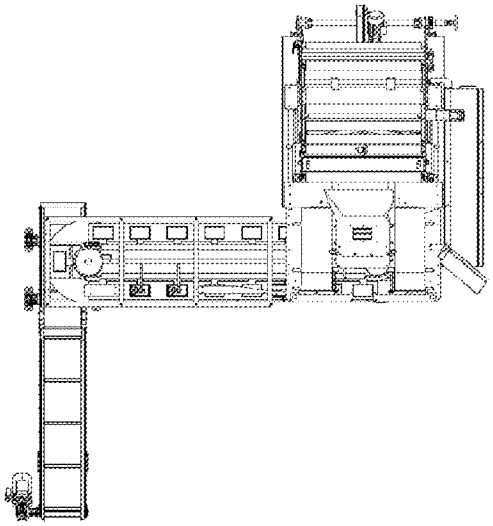
Figure 76D:
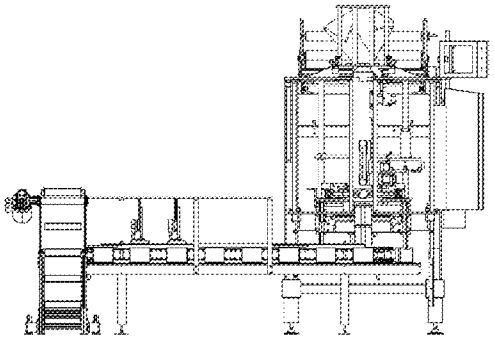
Figure 76E:
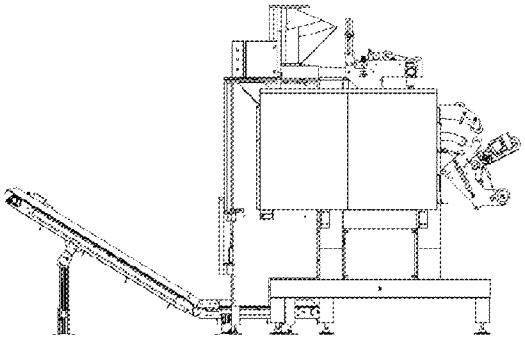
Figure 76C:
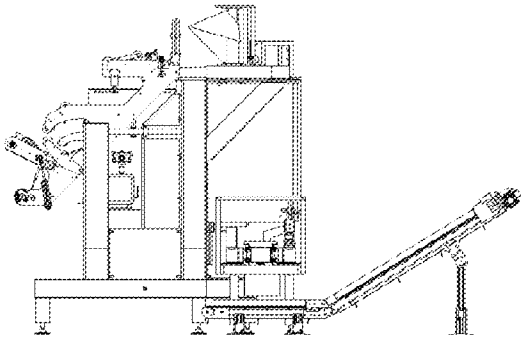
Figure 76F:
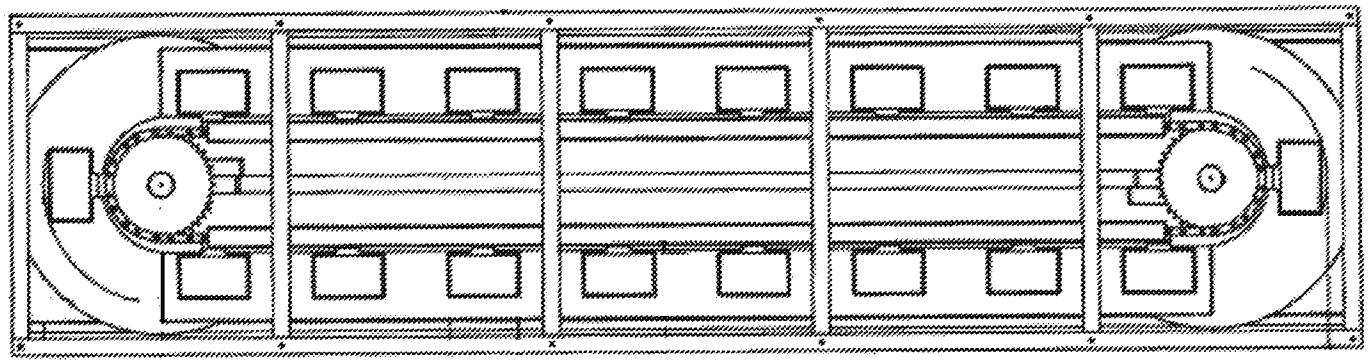
FIG. 76F is a schematic illustration of the race-track type conveyor illustrated in FIGS. 76A to 76E.
Figure 78:
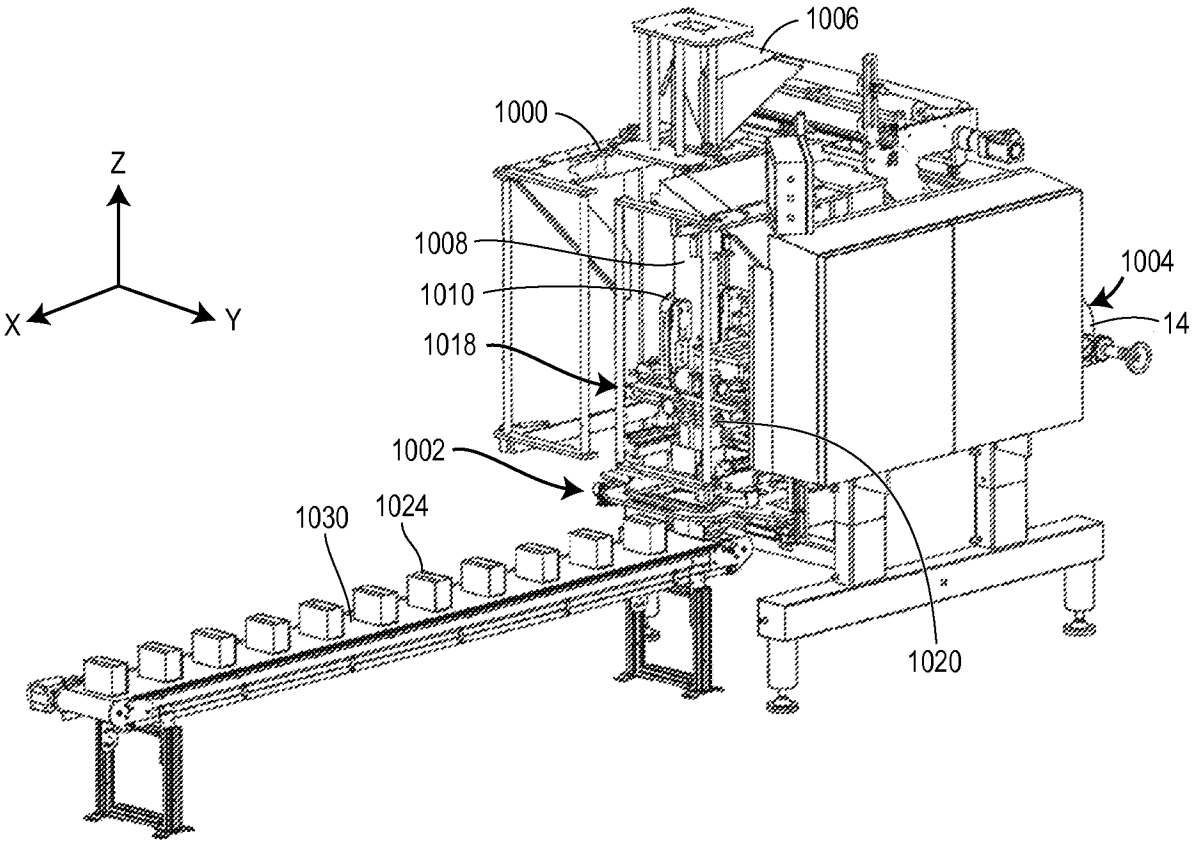
FIG. 78 is a perspective view of an embodiment of a VFFS machine.
Figure 79C:
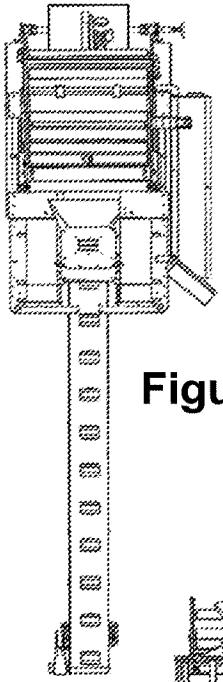
FIGS. 79A to 79F are various views of the embodiment of the VFFS machine of FIG. 78.
Figure 79A:
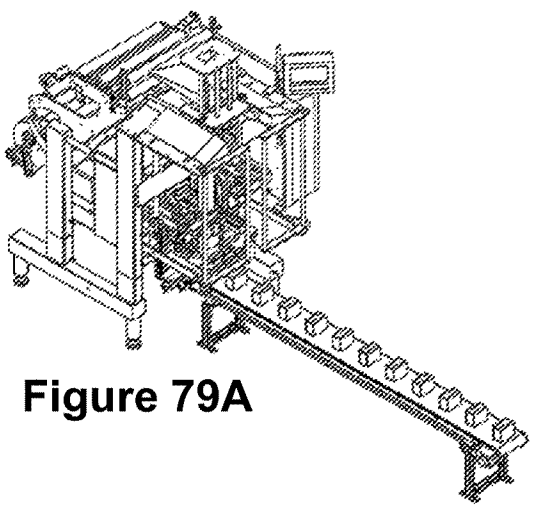
Figure 79E:
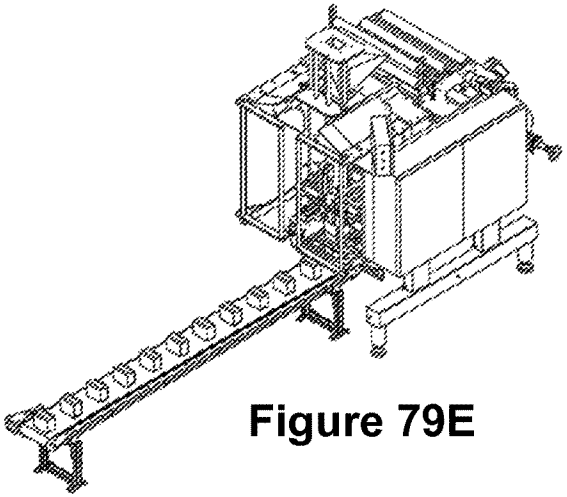
Figure 79D:
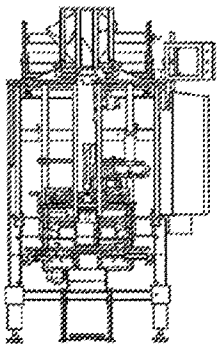
Figure 79B:
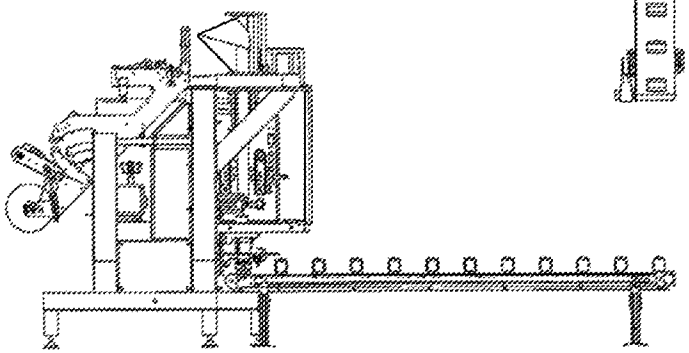
Figure 79F:
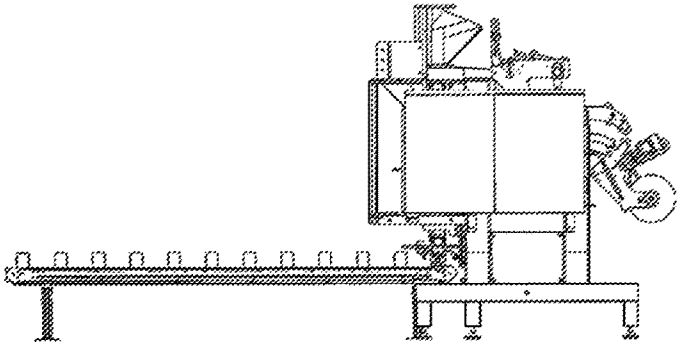

Referring now to FIG. 78, an embodiment of a VFFS machine 1000 includes an embodiment of a flap folding station assembly 1002 adapted to replace the race-track type conveyor that includes various stations, for example, to provide for folding and sealing of an end seal flap (see e.g., FIGS. 76A to 76C). In this embodiment, a film roll 1004 similar or identical to any of those previously described (e.g., a first sheet 14 and a second sheet 24) may be guided over a forming shoulder 1006 and around a forming tube 1008 that extends along (or substantially along) a vertical (along or parallel to the Z-axis of the reference coordinate system of FIG. 78) axis in a the manner previously described or in any conventional manner. However, to reduce or eliminate creasing in the first sheet 14 and/or the second sheet 24, the forming shoulder 1006 may have one or more radius pieces 1007 (as illustrated in FIGS. 84*a* to 84*d*) that allows for a bending radius of the first sheet 14 and the second sheet 24 that is greater than corresponding radii of conventional forming shoulders. The forming shoulder 1006 may have one or more radius pieces 1007 that may be disposed at any suitable location on the forming shoulder 1006, and the radius pieces 1007 may have any suitable geometry to increase the bending radius of the first sheet 14 and the second sheet 16. For example, each radius piece 1007 may be a ramp-like projection on an edge of the forming shoulder 1006 that provides a bending radius of 0.063" to 2.000", depending on the thickness of the first sheet 14. For example, the bending radius may be 0.375". As the first sheet 14 and the second sheet 24 are folded around the forming tube 1006 in a conventional manner, one or more vertical sealing stations 1010 may apply a vertical seal—such as a heat seal—to one or more vertically-aligned edges of the first sheet 14 such that the first sheet 14 is sealed around the perimeter of the forming tube 1008.

Figure 80A:
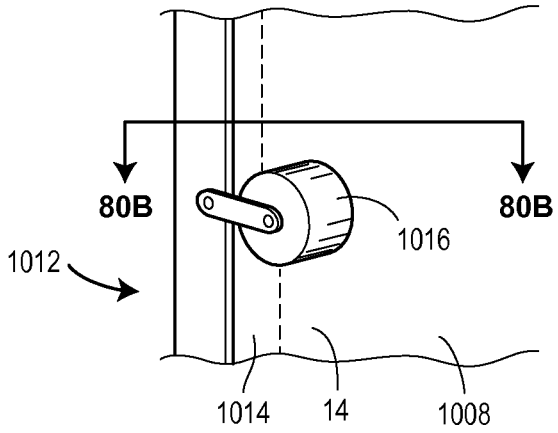
FIGS. 80A to 80B are various views of an embodiment of an edge folding station.
Figure 80B:
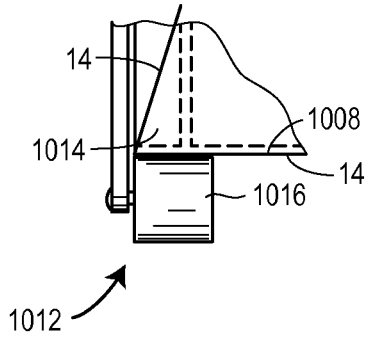

As previously described, one or more edges of the second sheet 16 may be perforated or scored to assist in edge folding, additionally or alternatively one or more edge folding stations 1012 may be disposed along the forming tube. 1008 to further assist in edge folding and/or mechanically define a crease in the first and second sheets at the edge when no line of reduced strength is provided. As illustrated in FIGS. 80A and 80B, the edge folding stations 1012 may include a projection tab 1014 that may be vertically disposed along an edge of the forming tube 1006 and may transversely (i.e., normal to the Z-axis of the reference coordinate system of FIG. 78, such as, for example, along or parallel to the X or Y-axis of the reference coordinate system of FIG. 78) extend beyond the perimeter of the outer surface of the forming tube 1008. The projection tab 1014 may be aligned with a score and/or a perforation on the first sheet 14 (and the second sheet 24) such that one or more rollers 1016—such as a cylindrically-shaped roller—may engage one or both sides of a portion of the perforated/scored edge to fold that edge about the projection tab 1014. One skilled in the art would understand that as described, the projection tab 1014 cooperating with the roller(s) 1016 allows for a bend that exceeds 90 degrees to form a more sharp crease in the first sheet 14 along a score or perforation than that possible on the forming tube 1008 alone, as illustrated in FIG. 80*b*. FIGS. 85*a* to 85*g* illustrate an embodiment of the edge folding station 1012 having two rollers 1017 (the axles of the rollers 1017 are not shown) disposed adjacent to projection tabs 1014 formed on edges of the forming tube 1008. The projection tab 1014 or the forming tube 1008 may have portions that are contoured to correspond with contoured shapes of scored or perforated portions of the first sheet and/or the second sheet 24 to facilitate bending to the contoured shapes.

After the vertical perimeter edge of the first sheet 14 is sealed, the first and second sheets 14, 24 are vertically advanced to a first horizontal sealing station 1018 that may include one or more tuckers (not shown) that may displace in a horizontal direction (or a substantially horizontal direction) to displace a portion of a first end of a segment of the first sheet 14 in a known manner. In some embodiments, a first and second tucker may converge towards the vertical axis of the forming tube 1008 to symmetrically displace opposing portions of the first end of a segment of the first sheet 14 in a known manner. A pair of horizontally disposed seal bars may then seal (e.g., heat seal) the first end of a segment of the first sheet 14 in a known manner. A horizontal cut may be made adjacent to the seal of the first end of a segment of the first sheet 14 to create a partially-formed container with an open second end.

The partially-formed container with an open second end (e.g., a top end) may then be vertically advanced to a second horizontal sealing station 1020. While advancing between the first horizontal sealing station 1018 and the second horizontal sealing station 1020 (or while at either of the first horizontal sealing station 1018 or the second horizontal sealing station 1020), the partially-formed container with the open second end may be filled with product from the fill tube in a conventional manner. For example, the first and second horizontal sealing stations 1018, 1020 may function cooperatively and substantially simultaneously to define the lower seal of a first container and the upper seal of a second container, disposed downstream of the first container, the first and second containers being attached until the seal disposed between them (formed cooperatively by the first and second horizontal sealing stations) is cut. The container may be filled with product after the lower seal of the container is filled and just prior to or alternatively, while web is transition the container such that the upper seal region is disposed in the second horizontal sealer.

Figure 81:
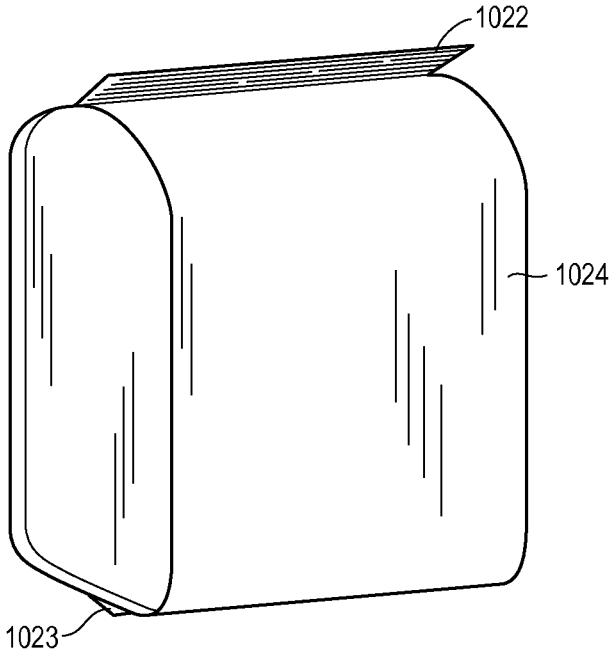
FIG. 81 is a perspective view of an embodiment of a sealed container.
Figure 82A:
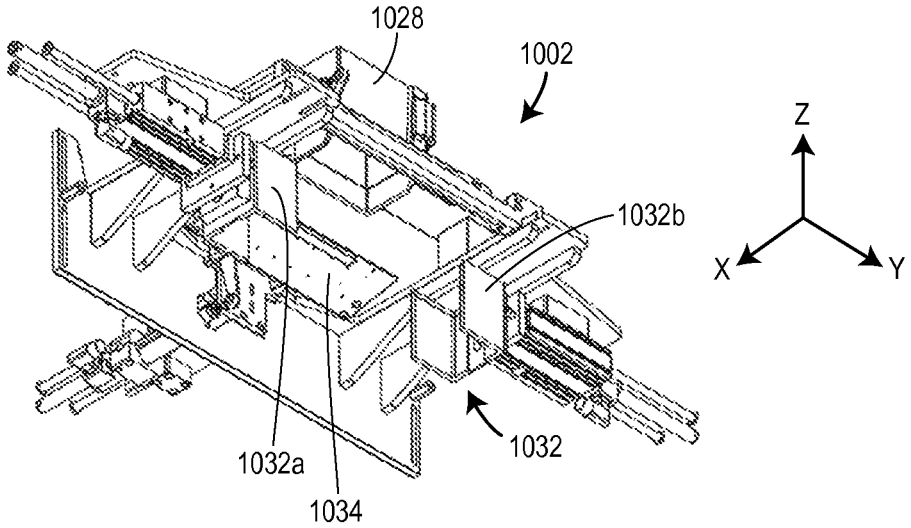
FIGS. 82A to 82B are various views of an embodiment of a flap sealing station assembly.
Figure 82B:
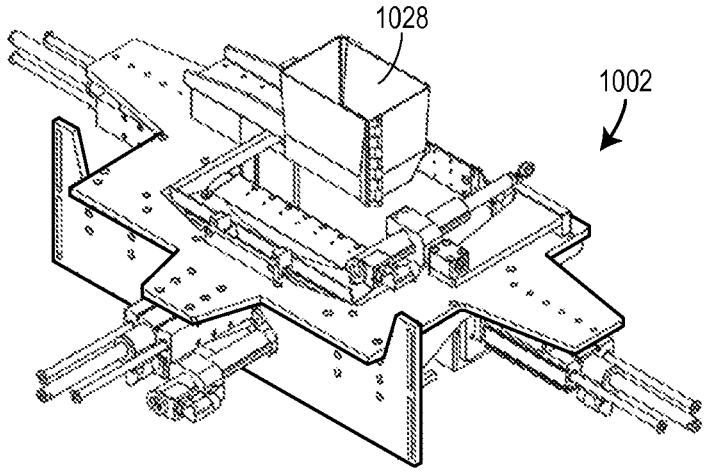
Figure 83A:
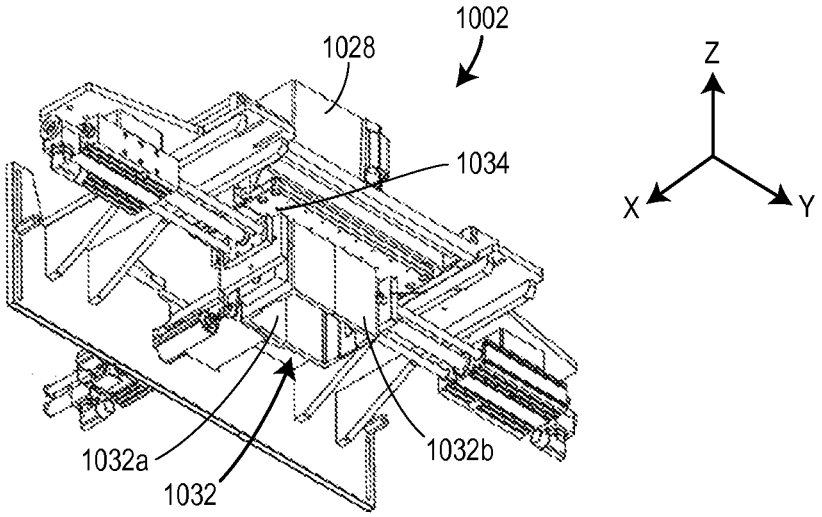
FIGS. 83A to 83B are various views of an embodiment of a flap sealing station assembly.
Figure 83B:
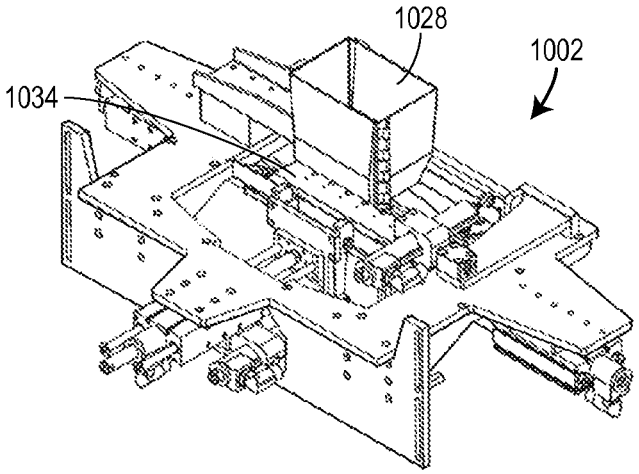
Figure 84B:
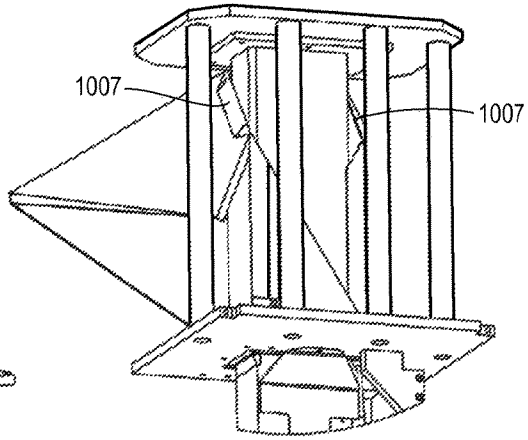
FIGS. 84A to 84D are various views of an embodiment of a forming shoulder.
Figure 84A:
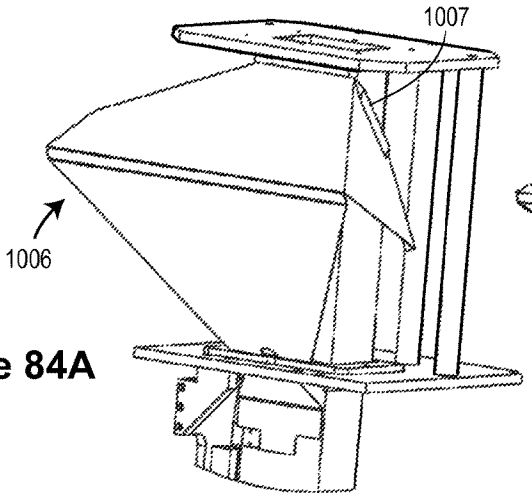
Figure 84D:
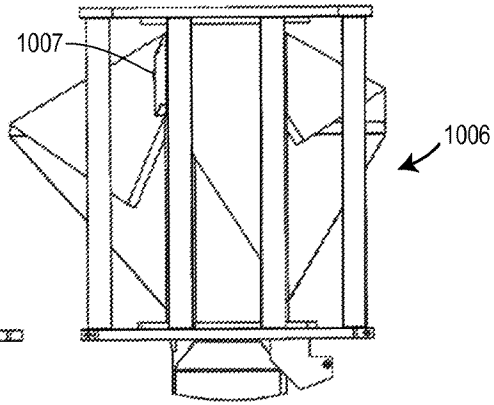
Figure 84C:
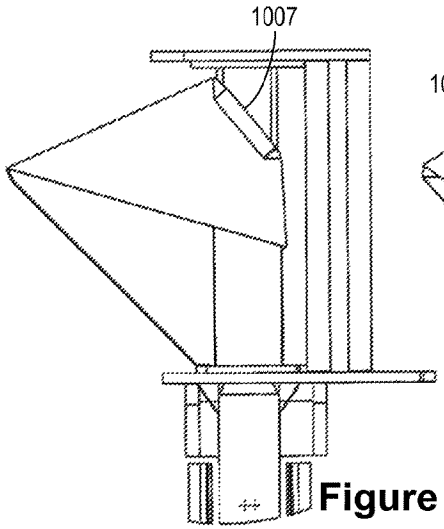
Figures 85A, 85B, 85C, 85D, 85E, 85F, 85G:
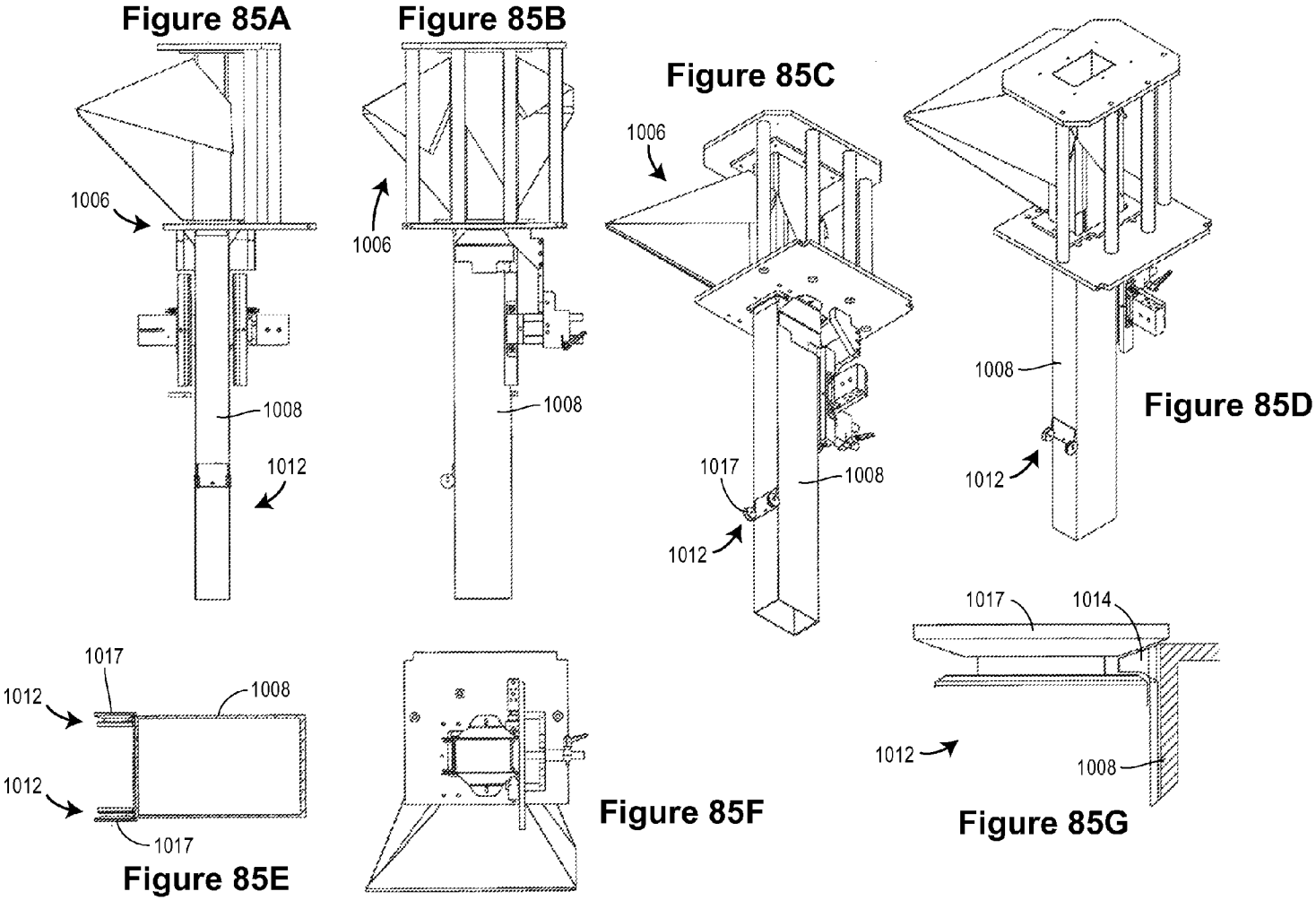
FIGS. 85A to 85G are various views of an embodiment of an edge folding station.
Figure 86F:
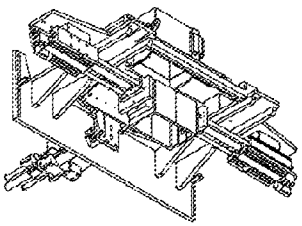
FIGS. 86A to 86G are various views of an embodiment of a flap sealing station assembly.
Figure 86G:
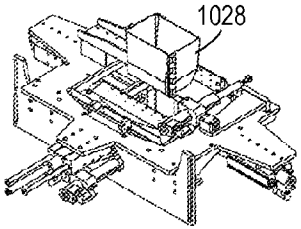
Figure 86D:
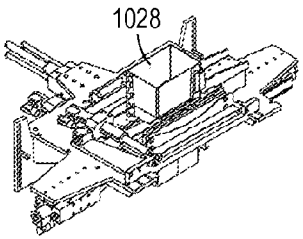
Figure 86E:
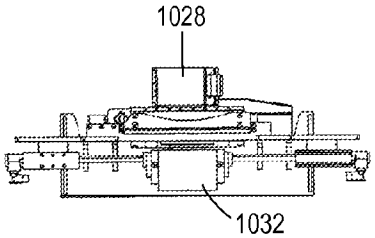
Figure 86A:
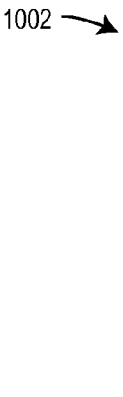
Figure 86B:
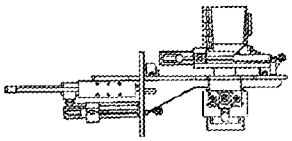
Figure 86C:
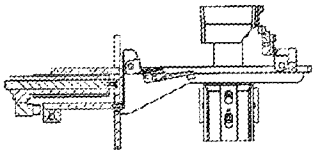
Figure 87F:
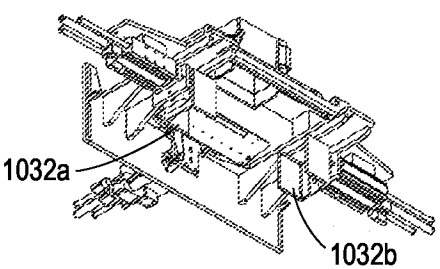
FIGS. 87A to 87G are various views of an embodiment of a flap sealing station assembly.
Figure 87G:
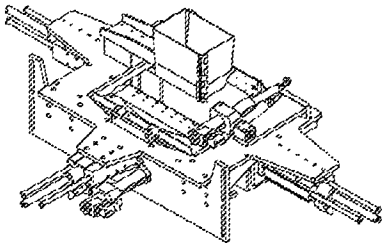
Figure 87D:
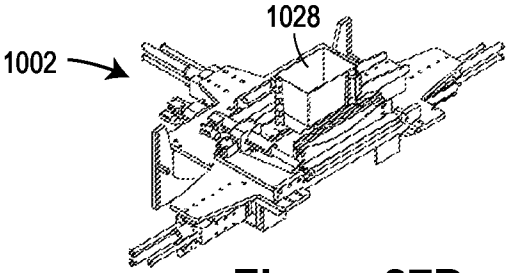
Figure 87E:
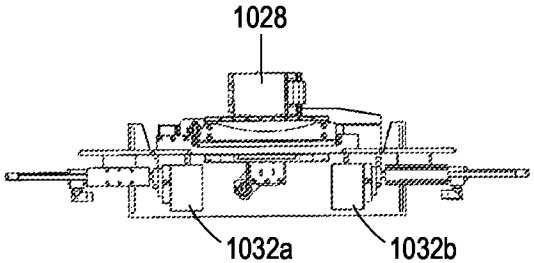
Figure 87A:
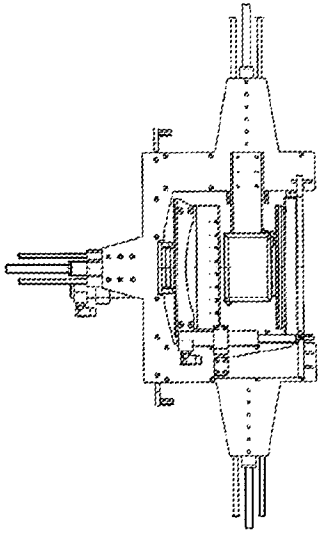
Figure 87B:
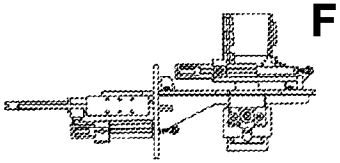
Figure 87C:
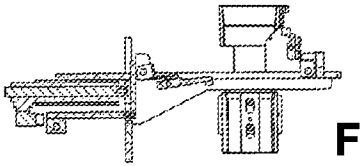
Figure 88A:
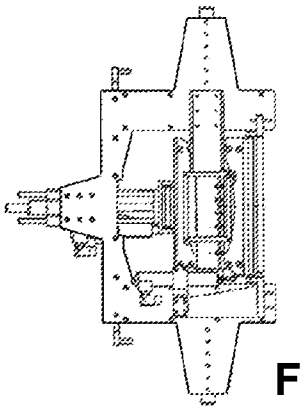
FIGS. 88A to 88G are various views of an embodiment of a flap sealing station assembly.
Figure 88B:
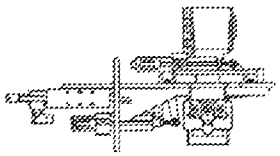
Figure 88C:
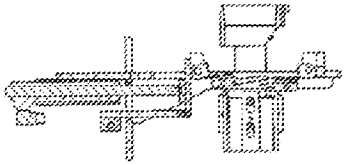
Figure 88D:
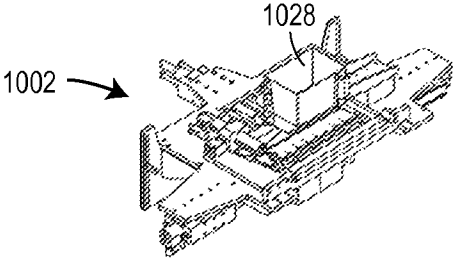
Figure 88E:
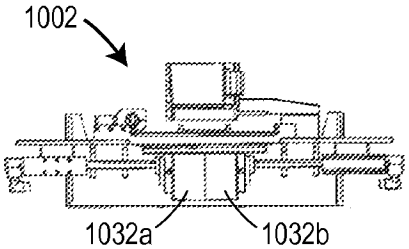
Figure 88F:
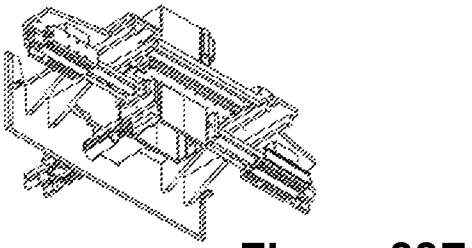
Figure 88G:
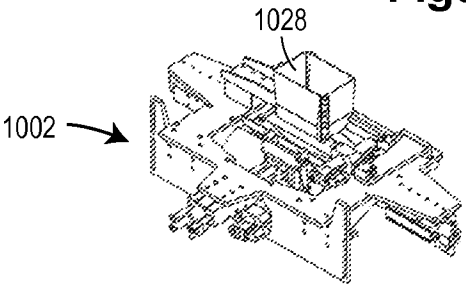
Figure 89F:
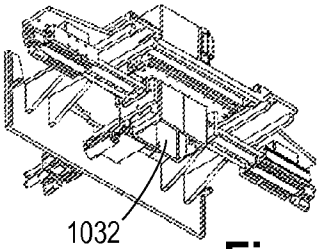
FIGS. 89A to 89G are various views of an embodiment of a flap sealing station assembly.
Figure 89G:
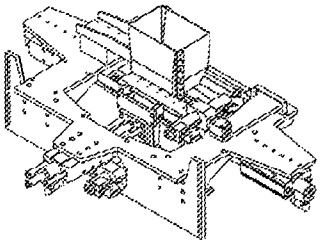
Figure 89D:
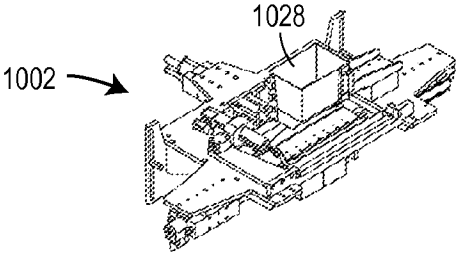
Figure 89E:
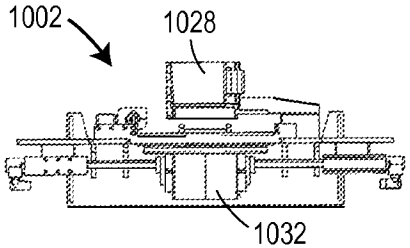
Figure 89A:
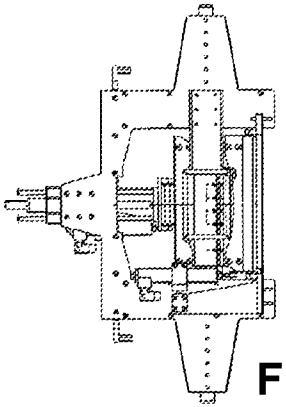
Figure 89B:
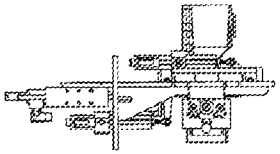
Figure 89C:
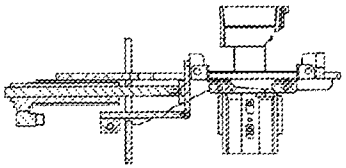

The second horizontal sealing station 1020 may be similar or identical in function to the first horizontal sealing station 1018. That is, the second horizontal sealing station 1020 may include one or more tuckers (not shown) that may displace in a horizontal direction (or a substantially horizontal direction) to displace a portion of the second end of the partially-formed container in a known manner. In some embodiments, a first and second tucker may converge towards the vertical axis of the forming tube 1008 to symmetrically displace opposing portions of the partially-formed container in a known manner. The horizontally disposed seal bar may then seal (e.g., heat seal) the second end of the partially-formed container in a known manner (e.g., while sealing the first end of the partially-formed container at the first horizontal sealing station 1018), thereby creating a sealed container 1024 having a transverse sealed flap 1022 at the second end (e.g., the top end). The transverse sealed flap 1022 (see FIG. 81) is the transverse flap created when the second end of the partially-formed container is sealed to close the partially-formed container into the sealed container 1024.

A support structure (e.g., a retractable platform) may be disposed normal to the vertical axis of the forming tube 1008 to support the first end of the partially-formed container at the second horizontal sealing station 1020. In addition, instead of cutting the sealed first end of a segment of the first sheet 14 (to create a partially-formed container with an open second end) at the first horizontal sealing station 1018, such a cut could be made at the second horizontal sealing station 1020 to create the partially-formed container (or to create the sealed container 1024). The first and second sheet 14, 24 may pause at the first horizontal sealing station 1018 and the second horizontal sealing station 1020 to form the seals and/or perform the horizontal cutting operation. However, the first and second sheet 14, 24 may continuously move at and between the first horizontal sealing station 1018 and the second horizontal sealing station 1020. In such an embodiment, the first horizontal sealing station 1018 and/or the second horizontal sealing station 1020 may vertically displace downwards at the same rate as the first sheet 14 for the duration of the sealing/cutting process, as is known in the art. The first horizontal sealing station 1018 and/or the second horizontal sealing station 1020 may then vertically displace upwards to begin the next sealing process, as is known in the art.

A flap sealing station assembly 1002 may be disposed downstream of (e.g., vertically offset from or below) the first horizontal sealing station 1018 and/or the second horizontal sealing station 1020. As illustrated in FIGS. 82A, 82B, 83A, 83B, and 86A to 89G, the flap sealing station assembly 1002 may include a vertically-disposed guide structure 1028 that is adapted to ensure proper positioning of the sealed container 1024 after the sealed container 1024 exits the second horizontal sealing station 1020 (e.g., is dropped from the support structure). For example, the guide structure 1028 may include a plurality of vertical walls disposed at right angles to form a rectangular perimeter that is slightly offset from the vertically-aligned perimeter side walls of the sealed container 1024. The guide structure 1028 may be hinged about a vertical edge to allow one or more walls of the guide structure 1028 to be opened by a technician. In some embodiments, the flap sealing station 1024 may also include a displaceable support (not shown) that may support the bottom (e.g., the first end) of the sealed container 1024. The displaceable support may retract or pivot from a first position at or adjacent to a bottom portion of (e.g., under) the guide structure 1028 to a second position remote from the bottom portion of the guide structure 1028 to temporarily support the sealed container 1024. In the first position, the sealed container 1024 may rest on the displaceable support such that all or a portion of the sealed container 1024 is surrounded by the guide structure 1028. In such a position, a transverse sealed flap 1023 (see FIG. 81) is maintained against the bottom portion of the sealed container 1024. Because the transverse sealed flap 1023 is still heated from the sealing operation, the transverse sealed flap 1023 is secured (e.g., heat sealed) to the bottom portion of the sealed container 1024, thereby allowing for a more esthetically streamlined package. In the second position, the sealed container 1024 may drop (under the influence of gravity alone) to a position directly beneath and aligned with the guide structure 1028. In alternative embodiments, no displaceable support may be used and the sealed container 1024 may drop (under the influence of gravity alone) to a position directly beneath and aligned with the guide structure 1028. After dropping, the bottom (e.g., the first end) of the sealed container 1024 may be disposed on a support structure, such as a horizontal surface of a conveyor 1030, as illustrated in FIG. 78.

On the support structure, the sealed container 1024 may be engaged (e.g., immediately engaged or surrounded) by a retaining structure 1032 of the flap sealing station assembly 1002, and the retaining structure 1032 may have a cross-sectional shape that corresponds to the sealed container 1024. For example, the retaining structure 1032 may include a plurality of vertical walls disposed at right angles to form a rectangular perimeter that is slightly offset from the vertically-aligned perimeter side walls of the sealed container 1024. The retaining structure 1032 may include a first portion 1032*a* and a second portion 1032*b* that may horizontally displace from a first closed position to a second open position, and vice versa. In the first closed position, shown in FIG. 83A, an end portion of the first portion 1032*a* may be adjacent to or in contact with an end portion of the second portion 1032*b* such that the first portion 1032*a* and second portion 1032*b* cooperate to form an enclosure that surrounds the sealed container 1024 when the sealed container 1024 is disposed on the support structure. That is, each of the plurality of vertical walls that form the retaining structure 1032 (e.g., the first portion 1032*a* and second portion 1032*b*) may be directly adjacent to or in contact with a corresponding vertical wall of the sealed container 1024. In the second open position, shown in FIG. 82A, the end portion of the first portion 1032*a* may be displaced from the end portion of the second portion 1032*b* such that the sealed container 1024 is not enclosed by the first portion 1032*a* and second portion 1032*b* when the sealed container 1024 is disposed on the support structure. For example, each of the first portion 1032*a* and the second portion 1032*b* may be horizontally disposed a predetermined distance away from the vertical axis of the forming tube 1008.

In the first closed position, one or more pressure plates 1034 of the flap sealing station assembly 1002 may engage the top (e.g., the second end) of the sealed container 1024. The one or more pressure plates 1034 may retract or pivot from a first position at or adjacent to a top portion of (e.g., over) the retaining structure 1032 to a second position remote from the top portion of the retaining structure 1032. In some embodiments, the sealed container 1024 may be disposed within the retaining structure 1032—and the retaining structure 1032 may be in the first closed position—prior to the one or more pressure plates 1034 displacing to the first position. With the sealed container 1024 engaged by the retaining structure 1032 in the first closed position, pressure provided against the vertical sides and bottom of the sealed container 1024 by the retaining structure 1032 and the support structure cooperate to compress the residual fluid (e.g., air) in the sealed container 1024, thereby providing an increased pressure within the sealed container 1024. As the one or more pressure plates 1034 are pivoted or otherwise displaced into the first position to engage (i.e., contact) the top (e.g., the second end) of the sealed container 1024, the increased pressure allows the one or more pressure plates 1034 to compress the transverse sealed flap 1022 against the top portion of the sealed container 1024. Because the transverse sealed flap 1022 is still heated from the sealing operation, the transverse sealed flap 1022 is secured (e.g., heat sealed) to the top portion of the sealed container 1024, thereby allowing for a more esthetically streamlined package. When the transverse sealed flap 1022 has been so secured, the one or more pressure plates 1034 is retracted, the retaining structure 1032 moves to the second open position, and the conveyor transports the finished sealed container 1024 to a remote station for further packaging or processing. The process is then repeated for the next sealed container 1024.

EXAMPLES

Example 1

Blue Printed Film

The film had a first sheet with a laminate structure as follows:

150 ga Cast Polypropylene

INK

Adhesive 120 ga PLA

Adhesive 2.875 mil EVOH Coex (12321.302W)

The first sheet had a nominal thickness of 5.575 mils. The film further included a second sheet disposed on the first sheet in a region to be formed into the top wall. The second sheet had a 10 mil nominal thickness and was formed of PET. The film also includes a third sheet disposed on the first sheet opposite the second sheet. The third sheet had a nominal thickness of 7 mil and was formed of PLA/EVOH/PE. The ink provided the film with a blue color over the entire surface of the film. The film was capable of being thermoformed to include a closure assembly having a lid formed into the film.

Example 2

Blue Printed Film with Clear Window

The film had a first sheet with a laminate structure as follows:

150 ga Cast Polypropylene

INK

Adhesive 76 ga Formable PET

Adhesive 3.5 mil High Clarity Polyethylene

The first sheet had a nominal thickness of 5.76 mils. The high clarity polyethylene was disposed in a portion of the film such that when the package was formed a clear window was provided on a portion of the sidewalls of the package. The film further included a second sheet disposed on the first sheet in a region to be formed into the top wall. The second sheet had a 10 mil nominal thickness and was formed of PET. The film also includes a third sheet disposed on the first sheet opposite the second sheet. The third sheet had a nominal thickness of 7 mil and was formed of PLA/EVOH/PE. The ink provided the film with a blue color over the entire surface of the film. The film was capable of being thermoformed to include a closure assembly having a lid formed into the film.

Example 3

Clear Film

The film had a first sheet with a laminate structure as follows:

140 ga BOPP
ADH
92 ga PET
ADH
3.5 mil High Clarity Polyethylene

The first sheet had a nominal thickness of 5.82 mils. The package produced from the film was clear. The film further included a two sheets of PLA, each having a nominal thickness of 4.75 mils, disposed one on top of the other on the first sheet and in a region of the film corresponding to the top wall of the package.

Example 4

Elastic Modulus

Films were evaluated for their stiffness. It has been observed that films need to have sufficient stiffness such that package retains its shape when the product is filled into the package, but must remain sufficient flexibility to traverse the filling and forming material. Table 1 provides a listing of materials and measured secant modulus. Table 2 provides the secant modulus of different laminate. The stiffness of the laminate is an averaged value between the stiffest web in the laminate and the softest web. The stiffness (as measured by the 1% secant modulus) was measured using ASTM D882 at 23° C.

TABLE 1

Secant Modulus (psi)

| | MD | TD |
|---|---|---|
| Cello | 362,500 | 182,500 |
| BOPP | 305,850 | 376,900 |
| NYLON | 505,706 | 425,415 |
| PLA | 256,269 | 218,460 |
| CAST PP | 70,000 | 65,000 |

Figure 49:
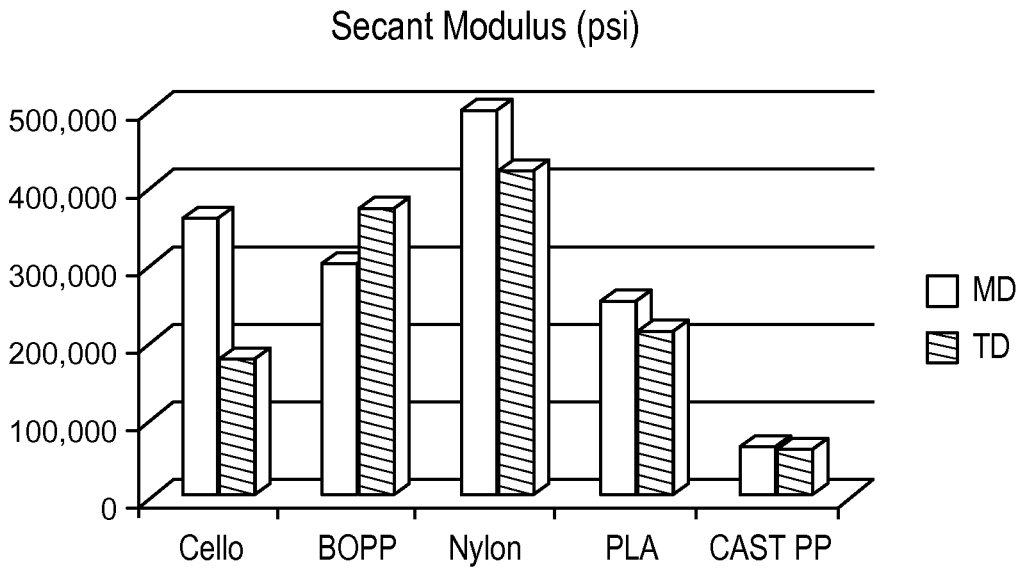
FIG. 49 is a graph of the secant modulus of various polymer films.

The values of Table 1 are represented graphically in FIG. 49. Table 2 below provides the Secant Modulus of various laminates that can be used in various aspects of the disclosure.

TABLE 2

Secant Modulus of Different Laminates

| ACTUAL MATERIAL | CLASS CODES | Tensile modulus PSI -MD | Tensile modulus PSI -TD |
|---|---|---|---|
| 1.5 mil LLDPE/60 BON/ 1.5 LLDPE | LLDPE/NYB/LLDPE | 60165 | 69852 |
| 120 OPP/120 OPP | PPCX2/PPCX2 | 146843 | 244738 |
| 2.0 mil LLDPE/60 BON/ 2.0 12321.0 | LLDPE/NYB/PEMB | 42000 | 50000 |
| 48 PET/0015 LLDPE | PETTC/LLDLD | 97635 | 115209 |
| 60ga HEAT SEALABLE PET | PETUS | 290627 | 296745 |
| 70- OPP/48 MET PET/ 0025 LLDPE | PP/PETM/LLDPE | 85524 | 122638 |

TABLE 2-continued

Secant Modulus of Different Laminates

| ACTUAL MATERIAL | CLASS CODES | Tensile modulus PSI -MD | Tensile modulus PSI -TD |
|---|---|---|---|
| 1.5 mil .202/60 OEB/ 2.0 mil .202 | PEMT/NYE/PEMT | 42610 | 47201 |
| 120 SUPERECO/ 002 .801 | BIODEG BOPP/ EVOH SEALANT | 80305 | 103249 |
| 120 SUPERECO/ 004 .801 | BIODEG BOPP/ EVOH SEALANT | 63538 | |
| 250HB Cello/002 LLDPE | CELLULOSE/LLDPE | 120994 | 84558 |
| 50 PVDC PET/002 LLDPE | PETC/LLDPE | 91006 | 91777 |
| 48 PET/00225 CX5-12321.302 | PET/5 LAYER EVOH SEALANT | 99273 | 106232 |
| 48 MET PET/00225 LLDPE | PETM/LLDLD | 75206 | 76481 |
| 60 BON/00175 3% EVA | NYB/EVA SEALANT | 90605 | 82013 |
| 70 OPP/0015 LLDPE (8 SERIES) | PP/LLDPE | 48391 | 91777 |
| 48PET/4.0 K191 | PET/PE | 42611 | 46298 |
| 48 PET/35 FOIL/48 PET/2 SURLYN | PET/FOIL/PET/ SURLYN | 168582 | 143072 |
| 48PET/0025.0 | PET/5 LAYER EVOH SEALANT | 91777 | 94326 |
| 48 PET/HDPE/EVA | PET/PEELABLE | 113099 | 135348 |
| XP360(60BON/2.875.0) | NY/5 LAYER EVOH SEALANT | 92832 | 91777 |

Aspects of the Disclosure

Aspect 1. An apparatus for forming a film into a reclosable container, the apparatus comprising:

an elongated forming tube extending along a first longitudinal axis from a first end to a longitudinally-opposite second end, the forming tube adapted to shape the film as the film displaces in a direction parallel to the first longitudinal axis, the forming tube having a hollow interior adapted to receive a product that is to be disposed within the container;

a first heating station including a first heating element for heating a first portion of the film as the film displaces in a direction parallel to the first longitudinal axis, the first heating element being disposed offset from the forming tube between the first and second end of the forming tube; and a first thermoforming station for thermoforming the first portion of the film, the first thermoforming station including a first mold element disposed between the first heating element assembly and the second end of the forming tube.

Aspect 2. The apparatus of aspect 1, further comprising a primary frame assembly extending along the first longitudinal axis, with at least a portion of the forming tube coupled to a portion of the primary frame assembly to support the forming tube.

Aspect 3. The apparatus of any of the preceding aspects, wherein a first end of the primary frame assembly is disposed adjacent to the first end of the forming tube and wherein a second end of the frame assembly extends beyond the second end of the forming tube.

Aspect 4. The apparatus of any of the preceding aspects, further comprising a first modular frame assembly removably secured to the primary frame assembly, wherein the first heating station is secured to a first portion of the first modular frame assembly and at least a portion of the first thermoforming station is secured to a second portion of the first modular frame assembly.

Aspect 5. The apparatus of any of the preceding aspects, wherein the first mold element is secured to a portion of the forming tube.

Aspect 6. The apparatus of any of the preceding aspects, wherein the portion of the forming tube is adjacent to the second end of the forming tube.

Aspect 7. The apparatus of any of the preceding aspects, wherein the first thermoforming station includes a second mold element that cooperates with the first mold element for thermoforming the first portion of the film, the second mold element being displaceable relative to the first mold element.

Aspect 8. The apparatus of any of the preceding aspects, wherein the second mold element displaces in a direction normal to the first longitudinal axis relative to the first mold element.

Aspect 9. The apparatus of any of the preceding aspects, wherein the first mold element is not directly secured to the forming tube.

Aspect 10. The apparatus of any of the preceding aspects, wherein the longitudinal axis extends in a horizontal direction or a vertical direction.

Aspect 11. The apparatus of any of the preceding aspects, further comprising a first folding assembly adapted to fold a first folded feature on the film, the first folding station coupled to the primary frame assembly and disposed between the second end of the forming tube and the second end of the primary frame assembly.

Aspect 12. The apparatus of any of the preceding aspects, further comprising a second folding assembly adapted to fold a second folded feature on the film, the second folding assembly disposed between the first folding assembly and the second end of the primary frame assembly.

Aspect 13. The apparatus of any of the preceding aspects, further comprising a first seal jaw assembly disposed between the thermoforming station and the first folding assembly, the first seal jaw assembly having a pair of seal bars that extends in a direction normal to the longitudinal axis.

Aspect 14. The apparatus of any of the preceding aspects, wherein each of the seal bars has a channel extending therethrough, the channel of each of the seal bars being aligned such that when the seal bars engage to seal a portion of the film, the channels cooperate to create an elongated unsealed vent in the film.

Aspect 16. The apparatus of any of the preceding aspects, further comprising a second seal jaw assembly disposed downstream of the first seal jaw assembly to seal the vent in the film.

Aspect 17. The apparatus of any of the preceding aspects, further comprising a product settling station upstream of the second seal jaw assembly.

Aspect 18. The apparatus of any of the preceding aspects, wherein the primary frame assembly includes at least one support plate disposed normal to the first longitudinal axis, wherein a portion of the forming tube is disposed through a cut-out formed in the at least one support plate.

Aspect 19. The apparatus of any of the preceding aspects, further comprising a second modular frame assembly adapted to be removably secured to the primary frame assembly, wherein a second heating station is secured to a first portion of the second modular frame assembly and at least a portion of a second thermoforming station is secured to a second portion of the first modular frame assembly, wherein the second thermoforming station is different than the first thermoforming station.

Aspect 20. The apparatus of any of the preceding aspects, further comprising a film roll station coupled to the primary frame assembly, the film roll station adapted to support a roll of the film, the film roll station positioned such that the film extends from the film roll station to the first end of the forming tube.

Aspect 21. The apparatus of any of the preceding aspects, further comprising a product funnel for receiving a product that is to be disposed within the container, the product funnel being coupled to the primary frame assembly and the product funnel having an open first end and an open second end longitudinally-opposite the first end, the second end of the product funnel being disposed adjacent to the first end of the forming tube such that product entering the first end of the product funnel is directed into the hollow interior of the forming tube.

Aspect 22. The apparatus of any of the preceding aspects, further comprising a rejection station disposed between the second end of the frame assembly and the second end of the forming tube.

Aspect 23. The apparatus of any of the preceding aspects, wherein the rejection station includes a first ramp disposed at an angle relative to a reference plane normal to the first longitudinal axis, the first ramp having a first end that is disposed adjacent to and below the second end of the forming tube such that the film that forms a partially-formed re-closable container contacts the first end of the first ramp when the partially-formed re-closable container is released from the forming tube.

Aspect 24. An apparatus for forming a film into a re-closable container, the apparatus comprising:

an elongated forming tube extending along a first longitudinal axis from a first end to a longitudinally-opposite second end, the forming tube adapted to shape the film as the film displaces from the first end of the forming tube to the second end of the forming tube in a direction parallel to the first longitudinal axis, the forming tube having a hollow interior adapted to receive a product that is to be disposed within the container;

a primary frame assembly extending along the first longitudinal axis, with at least a portion of the forming tube coupled to a portion of the primary frame assembly to support the forming tube;

a film roll station coupled to the primary frame assembly, the film roll station adapted to support a roll of the film, the film roll station positioned such that the film extends from the film roll station to the first end of the forming tube;

a first heating station including a first heating element for heating a first portion of the film as the film displaces toward the first end of the forming tube, the first heating station being disposed between the film roll station and the first end of the forming tube; and a first thermoforming station for thermoforming the first portion of the film, the first thermoforming station including a first mold element disposed between the first heating element and the first end of the forming tube.

Aspect 25. The apparatus of any of the preceding aspects, wherein the first thermoforming station includes a second mold element that cooperates with the first mold element for thermoforming the first portion of the film, the second mold element being displaceable relative to the first mold element.

Aspect 26. The apparatus of any of the preceding aspects, wherein a first end of the primary frame assembly is disposed adjacent to the first end of the forming tube and wherein a second end of the frame assembly extends beyond the second end of the forming tube.

Aspect 27. The apparatus of any of the preceding aspects, wherein the first longitudinal axis extends in a vertical direction or a horizontal direction.

Aspect 28. The apparatus of any of the preceding aspects, further comprising a first modular frame assembly removably secured to the primary frame assembly, wherein the first heating station is secured to a first portion of the first modular frame assembly and at least a portion of the first thermoforming station is secured to a second portion of the first modular frame assembly.

Aspect 29. The apparatus of any of the preceding aspects, further comprising a first folding assembly adapted to fold a first folded feature on the film, the first folding station coupled to the primary frame assembly and disposed between the second end of the forming tube and the second end of the primary frame assembly.

Aspect 30. The apparatus of any of the preceding aspects, further comprising a second folding assembly adapted to fold a second folded feature on the film, the second folding assembly disposed between the first folding assembly and the second end of the primary frame assembly.

Aspect 31. The apparatus of any of the preceding aspects, further comprising a first seal jaw assembly disposed between the second end of the forming tube and the first folding assembly, the first seal jaw assembly having a pair of seal bars that extends in a direction normal to the longitudinal axis.

Aspect 32. The apparatus of any of the preceding aspects, wherein each of the seal bars has a channel extending therethrough, the channel of each of the seal bars being aligned such that when the seal bars engage to seal a portion of the film, the channels cooperate to create an elongated unsealed vent in the film.

Aspect 33. The apparatus of any of the preceding aspects, further comprising a second seal jaw assembly disposed downstream of the first seal jaw assembly to seal the vent in the film.

Aspect 34. The apparatus of any of the preceding aspects, further comprising a product settling station upstream of the second seal jaw assembly.

Aspect 35. The apparatus of any of the preceding aspects, further comprising a second modular frame assembly adapted to be removably secured to the primary frame assembly, wherein a second heating station is secured to a first portion of the second modular frame assembly and at least a portion of a second thermoforming station is secured to a second portion of the first modular frame assembly, wherein the second thermoforming station is different than the first thermoforming station.

Aspect 36. The apparatus of any of the preceding aspects, further comprising a product funnel for receiving a product that is to be disposed within the container, the product funnel being coupled to the primary frame assembly and the product funnel having an open first end and an open second end longitudinally-opposite the first end, the second end of the product funnel being disposed adjacent to the first end of the forming tube such that product entering the first end of the product funnel is directed into the hollow interior of the forming tube.

Aspect 37. The apparatus of any of the preceding aspects, further comprising a rejection station disposed between the second end of the frame assembly and the second end of the forming tube, the rejection station including a first ramp disposed at an angle relative to a reference plane normal to the first longitudinal axis, the first ramp having a first end that is disposed adjacent to and below the second end of the forming tube such that the film that forms a partially-formed re-closable container contacts the first end of the first ramp when the partially-formed re-closable container is released from the forming tube.

Aspect 38. The apparatus of any of the preceding aspects, wherein a first segment of the film extends between the film roll station and the first end of the forming tube along a second longitudinal axis.

Aspect 39. The apparatus of any of the preceding aspects, wherein the second longitudinal axis is not parallel to or coaxial with the first longitudinal axis.

Aspect 40. A method of forming a film into a re-closable container using a forming apparatus, the forming apparatus including an elongated forming tube extending along a first longitudinal axis from a first end to a longitudinally-opposite second end, the forming tube having a hollow interior adapted to receive a product that is to be disposed within the container, the method comprising:

advancing a first portion of the film from the first end of the forming tube towards the second end of the forming tube in a direction parallel to the first longitudinal axis;

heating the first portion of the film at a first heating station downstream of the first end of the forming tube; and forming a first feature on the first portion of the film at a thermoforming station downstream of the first heating station.

Aspect 41. The method of any of the preceding aspects, further comprising:

advancing the first portion of the film from a film roll station to the first end of the forming tube prior to advancing the first portion of the film from the first end of the forming tube towards the second end of the forming tube.

Aspect 42. The method of any of the preceding aspects, wherein forming a first feature on the first portion of the film at the thermoforming station includes forming the first feature on the first portion of the film by a first mold element secured to a portion of the forming tube.

Aspect 43. The method of any of the preceding aspects, wherein a second mold element cooperates with the first mold element to form the first feature, the second mold element being displaceable relative to the first mold element.

Aspect 44. The method of any of the preceding aspects, wherein forming the first feature on the first portion of the film at the thermoforming station includes forming a re-closable lid on the first portion of the film, the lid being adapted to allow a user to access an interior volume of the re-closable container.

Aspect 45. The method of any of the preceding aspects, wherein forming the re-closable lid on the first portion of the film includes forming a hinge portion and a flap portion, the hinge portion pivotably coupling the flap portion to the a body panel of the re-closable container.

Aspect 46. The method of any of the preceding aspects, wherein forming the first feature on the first portion of the film at the thermoforming station includes forming a removable lid on the first portion of the film, the removable lid being adapted to allow a user to access an interior volume of the re-closable container.

Aspect 47. The method of any of the preceding aspects, further comprising:

folding a second portion of the film by a first folding assembly disposed downstream of the second end of the forming tube.

Aspect 48. The method of any of the preceding aspects, further comprising:

folding a third portion of the film by a second folding assembly disposed downstream of the first folding assembly.

Aspect 49. The method of any of the preceding aspects, further comprising:

sealing a fourth portion of the film by a seal jaw assembly prior to the folding of the second portion of the film by a first folding assembly.

Aspect 50. The method of aspect 43, wherein sealing the fourth portion of the film includes partially sealing the fourth portion of the film to create a vent channel in the fourth portion of the film.

Aspect 51. The method of aspect 34, further comprising:

inserting a product that is to be disposed within the container into an open first end of a product funnel, the product funnel having an open second end longitudinally-opposite the first end, the second end of the product funnel being disposed adjacent to the first end of the forming tube such that product entering the first end of the product funnel is directed into the hollow interior of the forming tube.

Aspect 52. The method of aspect 34, further comprising:

securing a first modular frame assembly to a primary frame assembly, wherein the forming tube is coupled to the primary frame assembly to support the forming tube, and wherein the first heating station is secured to a first portion of the first modular frame assembly and at least a portion of the first thermoforming station is secured to a second portion of the first modular frame assembly.

Aspect 53. The method of aspect 34, further comprising:

securing a first modular frame assembly to a primary frame assembly, wherein the forming tube is coupled to the first modular frame assembly, and wherein the first heating station is secured to a first portion of the first modular frame assembly and at least a portion of the first thermoforming station is secured to a second portion of the first modular frame assembly.

Aspect 54. The method of aspect 46, further comprising:

removing the first modular frame assembly from the primary frame assembly; and securing a second modular frame assembly to the primary frame assembly, wherein a second heating station is secured to a first portion of the second modular frame assembly and at least a portion of a second thermoforming station is secured to a second portion of the first modular frame assembly, wherein the second thermoforming station is different than the first thermoforming station.

Aspect 55. A method of forming a film into a re-closable container using a forming apparatus, the forming apparatus including an elongated forming tube extending along a first longitudinal axis from a first end to a longitudinally-opposite second end, the forming tube having a hollow interior adapted to receive a product that is to be disposed within the container, the method comprising:

advancing a first portion of the film from a film roll station to a first end of the forming tube;

heating the first portion of the film at a first heating station upstream of the first end of the forming tube; and forming a first feature on the first portion of the film at a thermoforming station downstream of the first heating station and upstream of the first end of the forming tube.

Aspect 56. The method of aspect 48, wherein forming a first feature on the first portion of the film at the thermoforming station includes forming the first feature on the first portion of the film by a first mold element and a second mold element that cooperates with the first mold element to form the first feature, the second mold element being displaceable relative to the first mold element.

Aspect 57. The method of aspect 48, wherein forming a first feature on the first portion of the film at the thermoforming station includes forming a re-closable lid on the first portion of the film, the lid being adapted to allow a user to access an interior volume of the re-closable container.

Aspect 58. The method of aspect 50, wherein forming the re-closable lid on the first portion of the film includes forming a hinge portion and a flap portion, the hinge portion pivotably coupling the flap portion to a body panel of the re-closable container.

Aspect 59. The method of aspect 48, wherein forming the first feature on the first portion of the film at the thermoforming station includes forming a removable lid on the first portion of the film, the removable lid being adapted to allow a user to access an interior volume of the re-closable container.

Aspect 60. The method of aspect 48, further comprising:

advancing the first portion of the film from the first end of the forming tube towards the second end of the forming tube in direction parallel to the first longitudinal axis.

Aspect 61. The method of aspect 48, further comprising:

folding a second portion of the film by a first folding assembly disposed downstream of the second end of the forming tube.

Aspect 62. The method of aspect 48, further comprising:

folding a third portion of the film by a second folding assembly disposed downstream of the first folding assembly.

Aspect 63. The method of aspect 54, further comprising:

sealing a fourth portion of the film by a seal jaw assembly prior to the folding of the second portion of the film by a first folding assembly.

Aspect 64. The method of aspect 56, wherein sealing the fourth portion of the film includes partially sealing the fourth portion of the film to create a vent channel in the fourth portion of the film.

Aspect 65. The method of aspect 48, further comprising inserting a product that is to be disposed within the container into the an open first end of a product funnel, the product funnel having an open second end longitudinally-opposite the first end, the second end of the product funnel being disposed adjacent to the first end of the forming tube such that product entering the first end of the product funnel is directed into the hollow interior of the forming tube.

Aspect 66. The method of aspect 48, further comprising:

securing a first modular frame assembly to a primary frame assembly, wherein the forming tube is coupled to the primary frame assembly to support the forming tube, and wherein the first heating station is secured to a first portion of the first modular frame assembly and at least a portion of the first thermoforming station is secured to a second portion of the first modular frame assembly.

Aspect 67. The method of aspect 59, further comprising:

removing the first modular frame assembly from the primary frame assembly; and securing a second modular frame assembly to the primary frame assembly, wherein a second heating station is secured to a first portion of the second modular frame assembly and at least a portion of a second thermoforming station is secured to a second portion of the first modular frame assembly, wherein the second thermoforming station is different than the first thermoforming station.

Aspect 68. A re-closable packaging assembly comprising:

a container formed at least partially by a first sheet, the container having a plurality of walls that cooperate to define an interior volume, the container having an opening through at least one of the plurality of walls;

a closure assembly secured to the container adjacent to the opening, at least a portion of the closure assembly comprising a second sheet and a portion of the first sheet, the closure assembly including a lid member and a hinge portion, wherein the lid member is pivotable about the hinge portion between a first position in which the lid member releasably engages a first portion of the container surrounding the opening and a second position in which the lid member is pivoted away from a portion of the opening about the hinge portion, thereby allowing for a user to access the interior volume through the opening, wherein a first engagement feature is disposed on the container adjacent to the opening and a second engagement feature is disposed on the lid member of the closure assembly such that the first engagement feature engages the second engagement feature to removably secure the lid member to the container when the lid member is in the first position.

Aspect 69. A re-closable packaging assembly comprising:

a container formed at least partially by a first sheet, the container having a plurality of walls that cooperate to define an interior volume, the container having an opening through at least one of the plurality of walls;

a closure assembly secured to the container adjacent to the opening, at least a portion of the closure assembly comprising a second sheet and a portion of the first sheet, the closure assembly including a removable lid member, the lid member being movable between a first position in which the lid member releasably engages a first portion of the container surrounding the opening and a second position in which the lid member is not in contact with the container, thereby allowing for a user to access the interior volume through the opening, wherein a first engagement feature is disposed on the container adjacent to the opening and a second engagement feature is disposed on the lid member of the closure assembly such that the first engagement feature engages the second engagement feature to removably secure the lid member to the container when the lid member is in the first position.

Aspect 70. The re-closable packaging assembly of any of the preceding aspects, wherein the first engagement feature extends at least one of upwardly or downwardly from the container.

Aspect 71. The re-closable packaging assembly of any of the preceding aspects, wherein the second engagement feature extends at least one or upwardly or downwardly from the lid member of the closure assembly.

Aspect 72. The re-closable packaging assembly of any of the preceding aspects, wherein the second sheet is secured to the first sheet by an adhesive, and the adhesive is applied to one or both of a second side of the second sheet and a first side of the first sheet.

Aspect 73. The re-closable packaging assembly of any of the preceding aspects, wherein the second engagement feature is integrally formed on the lid member of the closure assembly.

Aspect 74. The re-closable packaging assembly of any of the preceding aspects, wherein the first engagement feature is integrally formed with the container.

Aspect 75. The re-closable packaging assembly of any of the preceding aspects, wherein the first engagement feature is a ridge and the second engagement feature is a channel adapted to releasably receive the ridge.

Aspect 76. The re-closable packaging assembly of any of the preceding aspects, wherein the first engagement feature is a channel and the second engagement feature is a ridge adapted to be releasably received into the ridge.

Aspect 77. The re-closable packaging assembly of any of the preceding aspects, wherein the lid member has a first lateral edge and a second lateral edge parallel to the first lateral edge.

Aspect 78. The re-closable packaging assembly of any of the preceding aspects, wherein a first portion of each of the first engagement feature and second engagement feature is elongated and has a longitudinal axis parallel to the first lateral edge and a second portion of each of the first engagement feature and second engagement feature is elongated and has a longitudinal axis parallel to the second lateral edge.

Aspect 79. The re-closable packaging assembly of any of the preceding aspects, wherein a pour spout is disposed adjacent to or in contact with the opening.

Aspect 80. The re-closable packaging assembly of any of the preceding aspects, wherein the pour spout is integrally formed on the container.

Aspect 81. The re-closable packaging assembly of any of the preceding aspects, wherein the pour spout extends at least one or upwardly of downwardly from the container.

Aspect 82. The re-closable packaging assembly of any of the preceding aspects, wherein the lid member has a first end edge that extends between a first end of the first lateral edge and a first end of the second lateral edge.

Aspect 83. The re-closable packaging assembly of any of the preceding aspects, wherein the first end edge is disposed normal to the first lateral edge and the second lateral edge.

Aspect 84. The re-closable packaging assembly of any of the preceding aspects, wherein at least a portion of the first end edge is non-linear.

Aspect 85. The re-closable packaging assembly of any of the preceding aspects, wherein at least a portion of the first end edge is at least partially curved.

Aspect 86. The re-closable packaging assembly of any of the preceding aspects, wherein a third portion of each of the first engagement feature and second engagement feature is elongated and has a longitudinal axis parallel to the first end edge.

Aspect 87. The re-closable packaging assembly of any of the preceding aspects, wherein a third portion of each of the first engagement feature and the second engagement feature is elongated and has a non-linear axis that is offset from the first end edge.

Aspect 88. The re-closable packaging assembly of any of the preceding aspects, wherein the lid member has a second end edge that extends between a second end of the first lateral edge and a second end of the second lateral edge.

Aspect 89. The re-closable packaging assembly of any of the preceding aspects, wherein the second end edge is disposed normal to the first lateral edge and the second lateral edge.

Aspect 90. The re-closable packaging assembly of any of the preceding aspects, wherein any of the first end edge, the second end edge, the first lateral edge, and the second lateral edge cooperates to define a pour spout.

Aspect 91. The re-closable packaging assembly of any of the preceding aspects, wherein at least a portion of the second end edge is non-linear.

Aspect 92. The re-closable packaging assembly of any of the preceding aspects, wherein the lid member has a second end edge that extends between a second end of the first lateral edge and a second end of the second lateral edge.

Aspect 93. The re-closable packaging assembly of any of the preceding aspects, wherein a fourth portion of each of the first engagement feature and second engagement feature is elongated and has a longitudinal axis parallel to the second end edge.

Aspect 94. The re-closable packaging assembly of any of the preceding aspects, wherein a fourth portion of each of the first engagement feature and the second engagement feature is elongated and has a non-linear axis that is offset from the second end edge.

Aspect 95. The re-closable packaging assembly of any of the preceding aspects, wherein the first portion of the first engagement feature, the second portion of the first engagement feature, and the third portion of the first engagement feature form a continuous, single feature.

Aspect 96. The re-closable packaging assembly of any of the preceding aspects, wherein the first portion of the first engagement feature, the second portion of the first engagement feature, the third portion of the first engagement feature form, and the fourth portion of the first engagement feature a continuous, single feature that surrounds the opening.

Aspect 97. The re-closable packaging assembly of any of the preceding aspects, wherein the opening has any of a rectangular, oval, oblong, round, and/or polygonal shape.

Aspect 98. The re-closable packaging assembly of any of the preceding aspects, wherein a third sheet is secured to a second portion of the container adjacent to the opening to stiffen the second portion of the container.

Aspect 99. The re-closable packaging assembly of any of the preceding aspects, wherein a second side of the second sheet is adjacent to a first side of the first sheet and a first side of the third sheet is adjacent to a second side of the first sheet.

Aspect 100. The re-closable packaging assembly of any of the preceding aspects, wherein the third sheet is bonded to the first sheet.

Aspect 101. The re-closable packaging assembly of any of the preceding aspects, wherein the third sheet is bonded to the first sheet by an adhesive, heat sealing, glue, and/or ultrasonic welding.

Aspect 102. The re-closable packaging assembly of any of the preceding aspects, wherein the third sheet is integrally formed with the first sheet.

Aspect 103. The re-closable packaging assembly of any of the preceding aspects, wherein the lid member of the closure assembly has a convex portion that abuts the hinge portion, the convex portion adapted to cooperate with the hinge to maintain the lid member in the second position.

Aspect 104. The re-closable packaging assembly of any of the preceding aspects, wherein the hinge portion comprises a pair of oppositely-disposed cuts that may inwardly extend from a lid edge defining an outer perimeter edge of the lid member, and wherein the lid member pivots from the first position to the second position about a portion of the closure member extending between a terminal end of each of the cuts.

Aspect 105. The re-closable packaging assembly of any of the preceding aspects, wherein when the lid member is pivoted into the second position, a first lid projection and a second lid projection deform into a position in which an edge formed by one of more segments comprising the cut engages a portion of the closure assembly to support the lid member in the second position.

Aspect 106. The re-closable packaging assembly of any of the preceding aspects, wherein the closure assembly includes a locking mechanism that includes a locking feature that is received into a receiving feature when the lid member is in the second position.

Aspect 107. The re-closable packaging assembly of any of the preceding aspects, wherein the locking feature is a protrusion that upwardly extends from the lid member, and the receiving feature is a receiving slot that releasably retains the protrusion.

Aspect 108. The re-closable packaging assembly of any of the preceding aspects, wherein the lid comprises first and second projections disposed in a vicinity of the hinge portion, the first and second projections being movable between a first position in which the projections are generally parallel the wall having the opening and a second position in which the projections are generally perpendicular to the wall having the opening to thereby retain the lid in the second position in which the lid member is pivoted away from a portion of the opening about the hinge portion.

Aspect 109. The re-closable packaging assembly of any of the preceding aspects, wherein the projections have a semi-circular shape.

Aspect 110. The re-closable packaging assembly of any of the preceding aspects, wherein the projections are disposed equidistant from a cut in the lid defining the hinge portion.

Aspect 111. The re-closable packaging assembly of any of the preceding aspects, wherein the projections are disposed non-equidistant from a cut in the lid defining the hinge portion.

Aspect 112. A method of manufacturing a re-closable packaging assembly comprising a container defining an interior volume, the method comprising:

providing a first sheet;

providing a second sheet secured to a first portion of the first sheet;

forming a lid member of a closure assembly from a portion of the second sheet such that at least a portion of the lid member is secured to the first portion of the first sheet;

forming a hinge portion of the closure assembly from the second sheet, the hinge portion being disposed adjacent to the lid member; and wherein the lid member is pivotable about the hinge portion between a first position in which the lid member releasably engages a first portion of the container surrounding an opening formed in the first sheet and a second position in which the lid member is pivoted away from a portion of the opening.

Aspect 113. A method of manufacturing a re-closable packaging assembly comprising a container defining an interior volume and having an opening adapted to access the interior volume, the method comprising:

providing a first sheet;

providing a second sheet secured to a first portion of the first sheet; and forming a lid member of a closure assembly from a portion of the second sheet such that at least a portion of the lid member is secured to the first portion of the first sheet, wherein the lid member is movable between a first position in which the lid member releasably engages a first portion of the container surrounding the opening and a second position in which the lid member is not in contact with the container, thereby allowing for a user to access the interior volume through the opening.

Aspect 114. The method of any of the preceding aspects, wherein securing the portion of the first sheet to the first portion of the second sheet occurs prior to forming the lid member from the second sheet.

Aspect 115. The method of any of the preceding aspects, wherein securing the portion of the first sheet to the first portion of the second sheet occurs simultaneously with forming the lid member from the second sheet.

Aspect 116. The method of any of the preceding aspects, further comprising forming the container from the first sheet, the container having a plurality of walls that cooperate to define the interior volume.

Aspect 117. The method of any of the preceding aspects, wherein forming the container from the first sheet occurs after forming the lid member and hinge portion of the closure assembly.

Aspect 118. The method of any of the preceding aspects, wherein forming a container from the first sheet includes forming a portion of the container simultaneously with forming the lid member and hinge portion of the closure assembly.

Aspect 119. The method of any of the preceding aspects, further comprising forming a first engagement feature disposed on the container adjacent to the opening and a second engagement feature disposed on the lid member of the closure assembly such that the first engagement feature engages the second engagement feature to removably secure the lid member to the container when the lid member is in the first position.

Aspect 120. The method of any of the preceding aspects, wherein forming the first engagement feature and the second engagement feature occurs simultaneously with forming the lid member.

Aspect 121. The method of any of the preceding aspects, wherein forming the first engagement feature includes forming the first engagement feature as a ridge and forming the second engagement feature includes forming the second engagement feature as a channel adapted to releasably receive the ridge.

Aspect 122. The method of any of the preceding aspects, wherein forming the first engagement feature includes forming the first engagement feature as a channel and forming the second engagement feature includes forming the second engagement feature as a ridge adapted to be releasably received into the ridge.

Aspect 123. The method of any of the preceding aspects, further comprising:

providing a third sheet secured to a second side of the first sheet adjacent to the first portion of the first sheet, wherein the second sheet is secured to a first side of the first sheet, the third sheet stiffening the first sheet.

Aspect 124. The method of any of the preceding aspects, further comprising:

wherein securing the third sheet to the second side of the first sheet occurs prior to forming the lid member of the closure assembly.

Aspect 125. The method of any of the preceding aspects, wherein securing the third sheet to the second side of the first sheet includes applying an adhesive or glue to one or both of the third sheet and the first sheet.

Aspect 126. The method of any of the preceding aspects, wherein securing the third sheet to the second side of the first sheet includes ultrasonically welding or heat sealing one or both of the third sheet and the first sheet.

Aspect 127. The method of any of the preceding aspects, wherein securing the third sheet to the second side of the first sheet includes integrally forming the third sheet with the second side of the first sheet.

Aspect 128. The method of any of the preceding aspects, wherein forming the opening occurs simultaneously with forming the lid member and the hinge portion.

Aspect 129. The method of any of the preceding aspects, wherein forming the opening occurs prior to forming the lid member and the hinge portion.

Aspect 130. The method of any of the preceding aspects, wherein forming the lid member of the closure assembly includes thermoforming the lid member of a closure assembly.

Aspect 131. The method of any of the preceding aspects, wherein forming the first engagement feature and the second engagement feature includes thermoforming the first engagement feature and the second engagement feature.

Aspect 132. The method of any of the preceding aspects, wherein thermoforming the first engagement feature and the second engagement feature occurs simultaneously with forming the lid member.

Aspect 133. A flexible material for a flexible package, comprising:

an opening panel region comprising a first sheet; and a second sheet secured to at least a portion of the first sheet in the opening panel region, wherein:

the opening panel region is configured to define a panel of the package having an opening for accessing an interior volume of the package, the opening panel region comprises an opening boundary configured to define the opening panel region comprises a first zone and a second zone adjacent the first zone, a first portion of the second sheet is secured to a first portion of the first sheet in the first zone, a second portion of the second sheet is secured to a second portion of the first sheet in the second zone, a first peel strength between the first and second sheets in the first zone is greater than a second peel strength between the first and second sheets in the second zone, and at least portion of the second portion is configured to be thermoformed.

Aspect 134. The flexible material of aspect 133, wherein the second peel strength that is about 10% to about 60% of the first peel strength.

Aspect 135. The flexible material of aspect 133 or 134, wherein the first peel strength is at least 500 gms/in.

Aspect 136. The flexible material of any one of aspects 133 to 135, wherein the second peel strength is about 0 gms/in to about 200 gms/in.

Aspect 137. The flexible material of any one of the preceding aspects, wherein the first peel strength is about 500 gms/in to about 2000 gms/in Aspect 138. The flexible material of any one of the preceding aspects, further comprising an adhesive disposed in the opening panel region on one or both of the first and second sheets, and a deadening agent disposed in the second zone on one or both of the first and second sheets, wherein the deadening agent in the second zone is applied having a coverage of about 50% to about 100%.

Aspect 139. The flexible material of any one of preceding aspects, further comprising a score in the first sheet in the opening panel region, wherein the score defines the opening of the package, and the first zone is disposed on opposed sides of the score.

Aspect 140. The flexible material of any one of the preceding aspects, wherein the second zone surrounds the first zone on at least three sides.

Aspect 141. The flexible material of any one of the preceding aspects, further comprising a score in the first sheet in the opening panel region, wherein the score defines an outer boundary of the first zone and the opening of the package.

Aspect 142. The flexible material of aspect 141, wherein the opening panel region further comprises a third zone between the first and second zones, the score defines a third portion of the second sheet is secured to a third portion of the first sheet, and the third zone has a third peel strength that is less than the first peel strength.

Aspect 143. The flexible material of aspect 142, wherein the third peel strength is substantially equal to or less than the peel strength of the second zone.

Aspect 144. The flexible material of aspect 142, wherein the third peel strength of about 0 gms/in to about 200 gms/in.

Aspect 145. The flexible material of any one of aspects 142 to 144, further comprising an adhesive disposed in the opening panel region on one or both of the first and second sheets, and a deadening agent disposed in the second and third zones on one or both of the first and second sheets, wherein the deadening agent in the second zone is applied having a coverage of about 50% to about 100%, and the deadening agent in the third zone is applied having a coverage of about 50% to about 100%.

Aspect 146. The flexible material of any one of the preceding aspects, wherein the opening panel region further comprises a fourth zone adjacent to the second zone opposite the first zone, wherein a fourth portion of the second sheet is secured to a fourth portion of the first sheet in the fourth zone, and the fourth zone has a fourth peel strength that is less than the first zone.

Aspect 147. The flexible material of any one of the preceding aspects, wherein a second portion of the second sheet is secured to a second portion of the first sheet in the second zone Aspect 148. The flexible material of any one of the preceding aspects, wherein the opening panel further comprises a pull tab zone, wherein a pull tab portion of second sheet is disposed on a pull tab portion of the first sheet and has a third peel strength with the pull tab portion of the first sheet, and the pull tab portion of the second sheet is configured to define a pull tab.

Aspect 149. The flexible material of aspect 148, wherein the pull tab peel strength is in a range of 0 gms/in to about 30 gms/in.

Aspect 150. The flexible material of aspect 148, wherein the pull tab zone further comprises a deadening agent disposed on the first or second sheet.

Aspect 151. The flexible material of any one of the preceding aspects, further comprising an adhesive disposed in the opening panel region on one or both of the first and second sheets, and a deadening agent disposed in the second, third, and pull tab zones on one or both of the first and second sheets, wherein the deadening agent in the second zone is applied having a coverage of about 50% to about 100%, the deadening agent in the third zone is applied having a coverage of about 50% to about 100%, and the deadening agent in the pull tab zone is applied having a coverage of about 100%.

Aspect 152. The flexible material of any one of the preceding aspects, wherein the first portion of the first sheet is sealed to the first portion of the second sheet by at least one seal.

Aspect 153. The flexible material of aspect 152, wherein the at least one seal is selected from the group consisting of a heat seal, an ultrasonic seal, a weld, a crimp, and combinations thereof.

Aspect 154. The flexible material of aspect 152 or 153, wherein the second portion of the first sheet is secured to the second portion of the second sheet with an adhesive.

Aspect 155. The flexible material of any one of the preceding aspects, further comprising a third sheet secured to a portion of the first sheet in the opening panel region.

Aspect 156. The flexible material of aspect 155, further comprising at least one wall region comprising the first sheet, wherein the at least one wall region is configured to define at least one wall of the package, and the third sheet is secured to a portion of the first sheet in the at least one wall region Aspect 157. The flexible material of aspect 156, wherein the at least one wall region comprises first and second opposed boundaries configured to define first and second boundaries of the wall, and a portion of the third sheet at least partially overlaps with one or both of the first and second boundaries.

Aspect 158. The flexible material of aspect 157, wherein the third sheet comprises a line of reduced strength in a portion of the third sheet that at least partially overlaps with the first and/or second boundary.

Aspect 159. The flexible material of aspect 155 or 156, wherein the third sheet completely overlaps with the opening panel region.

Aspect 160. A flexible material for a flexible package, comprising:

an opening panel region comprising a first sheet, a second sheet secured to at least a portion of the first sheet in the opening panel region, and a third sheet secured to at least a portion of the first sheet in the opening panel region, wherein:

the opening panel region is configured to define a panel of the package having an opening for accessing an interior volume of the package, the opening panel region further comprises first and second opposed boundaries configured to define first and second edges of the panel of the package having the opening, the third sheet comprises a reduced strength portion that at least partially overlaps with the one or both of first and second boundaries of the opening panel region, and third sheet comprises a line of reduced strength in at least a portion of the reduced strength portion.

Aspect 161. The flexible material of aspect 160, wherein a first region of the third sheet overlaps with the first boundary of the at least opening panel region and a second region of the third sheet overlaps with the second boundary of the at least opening panel region, and the first and second regions of the third sheet are not contiguous.

Aspect 162. The flexible material of aspect 160 or 161, further comprising at least one wall region comprising the first sheet, wherein the at least one wall region is configured to define at least one wall of the package, and a portion of the third sheet is secured to at least a portion of the first sheet in the at least one wall region.

Aspect 163. The flexible material of aspect 161, wherein the at least one wall region comprises first and second opposed boundaries configured to define edges of the wall, a portion of the third sheet at least partially overlaps one or both of the first and second boundaries, and third sheet comprises a line of reduced strength in the portion of the third sheet that at least partially overlaps with the first and/or second boundaries.

Aspect 164. The flexible material of aspect 163, wherein the third sheet extends between and overlaps with the first and second boundaries.

Aspect 165. The flexible material of aspect 161 to 164, wherein the third sheet completely overlaps with the first sheet in the at least one wall region.

Aspect 166. The flexible material of aspect 163, wherein a first region of the third sheet overlaps with the first boundary of the at least one wall region and a second region of the third sheet overlaps with the second boundary of the at least one wall region, and the first and second regions of the third sheet are not contiguous.

Aspect 167. The flexible material of any one of aspects 161 to 166, wherein the portion of the third sheet secured to the first sheet in the at least one wall region is separated from the portion of the third sheet secured to the first sheet in the opening panel region.

Aspect 168. The flexible material of any one of the preceding aspects, further comprising at least one wall region and at least one tucking region comprising the first sheet, wherein the at least one wall region is configured to define at least one wall of the package, the at least one tucking region is adjacent to a boundary of the opening panel region and/or a boundary of at least one wall region, and at least one fourth sheet secured to the first sheet in the at least tuck folding region, wherein, the at least one tuck folding region is configured to be tucked inward to define the edge of the package or panel of the package at the boundary.

Aspect 169. The flexible material of any one of the preceding aspects, wherein the second sheet comprises a pull tab region.

Aspect 170. The flexible material of aspect 169, wherein the first or second sheet further comprises a deadening agent in the pull tab region so that the pull tab region is not secured to the first sheet.

Aspect 171. The flexible material of any one of the preceding aspects, wherein at least a portion of the second sheet is releasable secured to at least a portion of the first sheet.

Aspect 172. The flexible material of any one of the preceding aspects, wherein the opening panel region further comprises an opening line of reduced strength defining the opening of the package.

Aspect 173. The flexible material of any one of the preceding aspects, comprising a hinge line of reduced strength configured to define a hinge about which a lid of a closure assembly pivots.

Aspect 174. The flexible material of aspect 173, wherein the hinge line of reduced strength does not overlap with the opening line of reduced strength.

Aspect 175. The flexible material of any one of aspects 155 to 174, wherein the third sheet is substantially permanently secured to the first sheet.

Aspect 176. The flexible material of aspect 175, wherein the third sheet is secured to the first flexible sheet material with a permanent adhesive.

Aspect 177. The flexible material of any one of aspects 155 to 176, wherein the first sheet is disposed between the second and third sheets.

Aspect 178. The flexible material of any one of aspects 155 to 176, wherein the third sheet is secured to the first sheet and the second sheet is secured to the first sheet.

Aspect 179. The flexible material of any one of aspects 155 to 177, wherein the third sheet comprises a material selected from the group consisting of PP, PET, PLA, OPS, PS, PETG, polyamide, PE, and blend, copolymers, laminates, and combinations thereof.

Aspect 180. The flexible material of any one of the preceding aspects, wherein the second sheet has a thickness of at least 6 mils.

Aspect 181. The flexible material of any one of the preceding aspects, wherein the second sheet comprises a material selected from the group consisting of PP, PET, PLA, OPS, PE, PS, polyamide, PETG, blends, copolymers, laminates, and combinations thereof.

Aspect 182. The flexible material of any one of the preceding aspects, wherein the first sheet comprises a material selected from the group consisting of PP, PE, NY, PET, PS, PLA, blends, copolymers, laminates, and combinations thereof.

Aspect 183. The flexible material of any one of the preceding aspects, comprises a plurality of opening panel regions discretely spaced along a longitudinal length of the flexible material, the plurality of opening panel regions comprising the first sheet, and a plurality of second sheets secured to the first sheet in each of the plurality of opening panel regions.

Aspect 184. The flexible material of aspect 183, further comprising a plurality of third sheets secured to the first sheet in each of the plurality of opening panel regions.

Aspect 185. A method of forming a flexible material comprising an opening panel region configured to define a panel of the package having an opening, the opening panel region comprising a first sheet and a second sheet secured to the first sheet in at least first and second zones, the first zone comprising a region in which an opening is configured to be formed and the second zone adjacent to the first zone, the method comprising:

applying an adhesive in the opening panel region in at least the first and second zones; and applying a deadening agent in the second zone; and securing the first sheet to the second sheet in the first and second zones, the first and second sheets having a first peel strength in the first zone and a second peel strength in the second zone, wherein the first peel strength is greater than the second peel strength wherein the second zone is configured to be thermoformed.

Aspect 186. The method of aspect 185, wherein the opening panel region further comprises a third zone disposed between the first and second portions, and the method further comprises applying a deadening agent to the third zone and securing the first sheet to the second sheet in the third zone, wherein first and second sheets have a third peel strength in the third zone, and the third peel strength is less than the first peel strength.

Aspect 187. The method of aspect 185 or 186, wherein the opening panel region further comprises a pull tab zone, and the method further comprises applying a deadening agent to the pull tab zone, wherein the deadening agent to have 100% coverage in the pull tab region.

Aspect 188. The method of any one of aspects 185 to 187, comprising applying the deadening agent to have about 50% to about 100% coverage in the second zone.

Aspect 189. The method of any one of aspects 185 to 188, further comprising forming a line of reduced strength in the first sheet in the opening panel region.

Aspect 190. The method of aspect 189, wherein the first zone is bounded by the line of reduced strength.

Aspect 191. The method of aspect 190, wherein the third zone is disposed between the line of reduced strength and the second zone.

Aspect 192. The method of aspect 189, wherein the first zone comprises the line of reduced strength.

Aspect 193. The method of any one of aspects 185 to 189, further comprising securing a third sheet to the first sheet in the opening panel region.

Aspect 194. The method of aspect 193, further comprising forming a line of reduced strength in the third sheet to define the opening.

Aspect 195. The method of aspect 194, comprising forming the line of reduced strength simultaneously in the first and third sheets.

Aspect 196. The method of any one of aspects 185 to 195, further comprising forming a line of reduced strength in the second sheet to define a hinge about which a lid of a closure assembly pivots.

Aspect 197. The method of aspect 196, wherein the line of reduced strength for forming the opening and the line of reduced strength for forming the hinge do not overlap.

Aspect 198. A re-closable packaging comprising:

a container formed at least partially by a first sheet, the container having a plurality of walls that cooperate to define an interior volume, the container having an opening through at least one of the plurality of walls;

a second sheet attached to at a portion of the first sheet in at least a portion of two walls of the package, wherein a portion of the second sheet provides a reclosable flap disposed over the opening for resealable closure of the package.

Aspect 199. The re-closable package of aspect 198, wherein the second sheet is disposed over a boundary of two adjacent, wherein the boundary defines and edge of the package, and the second sheet is scored or perforated in a region of the boundary.

Aspect 200. The method or apparatus of any one of the preceding aspects, further comprising a conveyor having a race-track type configuration.

Aspect 201. The method or apparatus of any one of the preceding aspects, further comprising a package receiving member disposed on a conveyor for receiving a package after removal from the forming tube.

Aspect 202. The method or apparatus of any one of the preceding aspects, further comprising a conveyor, wherein the conveyor comprises a heat or glue member for adhering a trailing seal of the package to a side of the package.

Aspect 203. The method or apparatus of aspect 202, further comprising a folding member for folding the trailing seal of the package into contact with the side of the package.

Aspect 204. A reclosable package assembly in accordance with any of the preceding aspects, wherein the lid assembly comprises a pull tab disposed in a corner of the lid assembly.

Aspect 205. A reclosable package assembly in accordance with any of the preceding aspects, wherein the lid assembly comprises a hinge adjacent to an end of the opening panel region.

Aspect 206: A flexible container comprising:

plurality of walls that cooperate to define an interior volume, the plurality of walls being defined by a first sheet, wherein the plurality of walls comprises:

opposed side walls each having a seal disposed along a portion of the side wall and one or more tucks, the tucks each comprising a portion of the first sheet tucked toward the interior volume and disposed at least partially under the seal, at least one wall defining an opening panel comprising at least a portion of an opening for accessing the interior volume, a second sheet attached to at least a portion of the first sheet, the second sheet at least partially extending over at least three of the plurality of walls, wherein each of the at least three of the plurality of walls is adjacent to at least one of the other at least three plurality of walls, one of the at least three of the plurality of walls is the at least one wall defining the opening panel and a portion of the second sheet defines a resealable flap disposed over the opening for resealable closure of the container, one of the at least three of the plurality of walls is a side wall, the second sheet extends over boundaries between adjacent ones of the at least three of the plurality of walls and a portion of the second sheet extends into at least one tuck, and the second sheet includes a line of reduced strength at or adjacent to a boundary between a portion of the second sheet extending into the at least one tuck and a portion of the second sheet extending across an adjacent one of the at least three plurality of walls between the side wall.

Aspect 207. The flexible container of aspect 206, wherein the second sheet includes lines of reduced strength at each of the boundaries between adjacent ones of the at least three of the plurality of walls.

Aspect 208. The flexible container of aspect 206 or 207, wherein the second sheet has a thickness of 10 mils or less, the line of reduced strength comprises one or both of perforations having at least 10% cut openings, score lines extending at least 10% into the thickness of the second sheet.

Aspect 209. The flexible container of aspect 207 or 209, wherein the second sheet has thickness greater than 10 mils wherein at least one of the lines of reduced strength comprises one or both of perforations having at least 50% cut openings, score lines extending at least 50% into the thickness of the second sheet.

Aspect 210. The flexible container of any one of the preceding aspects, wherein the at least one wall defining the opening panel includes four corners defined by the first sheet, the second sheet includes apertures in portions of the second sheeting extending across the corners such that the corner extends through the aperture.

Aspect 211. The flexible container of aspect 206, wherein:

the at least three of the plurality of walls comprise the at least one wall defining an opening panel, one of the side walls, and a third wall adjacent to the at least one wall defining the opening panel, the second sheet extends across the at least one wall defining the opening panel and over a first boundary disposed between the at least one wall defining the opening panel and the side wall, the second sheet having a portion that extends into the tucks of the side wall, the second sheet further extends over a second boundary disposed between the at least one wall defining the opening panel and the third wall, the second sheet extends at least partially over the third wall, the second sheet includes a first line of reduced strength at or adjacent to the first boundary, and the second sheet includes a second line of reduced strength at or adjacent to the second boundary.

Aspect 212. The flexible container of aspect 211, wherein the first and second lines of reduced strength comprise perforations and the first line of reduced strength has a greater percentage of cut opening than the second line of reduced strength.

Aspect 213. The flexible container of any one of aspect 211 or 212, wherein the first line of reduced strength has about 50% to about 100% cut openings, and the second line of reduced strength has about 1% to about 50% cut openings.

Aspect 214. The flexible container of aspect 213, wherein the first and second line of reduced strength comprise score lines and the first line of reduced strength has score lines that extend more deeply into the thickness of the second sheet than the second line of reduced strength.

Aspect 215. The flexible container of aspect 213, wherein the first line of reduced strength comprises a score line extending about 50% to about 100% into the thickness of the second sheet and the second line of reduced strength extends about 1% to about 50% into the thickness of the second sheet.

Aspect 216. The flexible container of any one of aspects 211 to 215, wherein the third wall is adjacent to the side wall, the second sheet extends over a third boundary disposed between the third wall and the side wall, and the second sheet includes a third line of reduced strength at or adjacent to the second boundary.

Aspect 217. The flexible container of aspect 216, wherein the second sheet has a thickness of less than 10 mils, and the third line of reduced strength comprises perforations having about 1% to about 60% cut openings and/or score lines that extend about 1% to about 60% into the thickness of the second sheet.

Aspect 218. The flexible container of aspect 216, wherein the second sheet has a thickness of greater than 10 mils, and the third line of reduced strength comprises perforations having about 50% to about 100% cut openings and/or score lines that extend about 50% to about 100% into the thickness of the second sheet.

Aspect 219. The flexible container of any one of aspect 216 to 218, wherein the third line of reduced strength is substantially linear and an edge of the container defined at the third boundary is substantially linear.

Aspect 220. The flexible container of any one of aspect 216 to 218, wherein the third line of reduced strength is curved, thereby defining an edge of the container disposed at the third boundary to have a curvature corresponding to the curve of the third line of reduced strength.

Aspect 221. The flexible container of any one of aspect 220, wherein a portion of the second sheet extending into the sidewall from the third boundary comprises a contouring line of reduced strength that is a mirror image of the third line of reduced strength.

Aspect 222. The flexible container of aspect 221, wherein the contouring line of reduced strength comprises perforations having substantially the same cut opening percentage as the third line of reduced strength and/or the contouring line of reduced strength comprises score lines having substantially same percentage of penetration as score lines of the third line of reduced strength.

Aspect 223. The flexible container of any one of aspect 216 to 222, wherein the third line of reduced strength has substantially same cut opening percentage as the first line of reduced strength, and or the penetration of one or more score lines of the third line of reduced strength is substantially equal to the penetration of one or more score lines of the first line of reduced strength.

Aspect 224. The flexible container of any one of aspect 221 to 223, wherein the first boundary extends between first and second corners, and the second sheet includes apertures at each of the first and second corners.

Aspect 225. The flexible container of any one of the preceding aspects, wherein the second sheet further comprises a hinge defined by a line of reduced strength, the hinge is disposed at an end of the resealable flap, and the resealable flap is pivotable about the hinge from a closed position in which the resealable flap is in contact with the opening panel to resealable close the opening, and an open position in which the resealable flap is pivoted away from the opening panel.

Aspect 226. The flexible container of any one of the preceding aspects, wherein the second sheet further comprises first and second projections disposed at an end of the resealable flap, the first and second projections being pivotable from a first position in which the first and second projections are in the same plane as at least one wall defining the opening panel and the resealable flap is in a closed position, and a second position in which the first and second projections are oblique to the at least one wall defining the opening panel and the resealable flap is in an open position.

Aspect 227. The flexible container of aspect 226, wherein the second sheet further comprises a hinge about which the resealable flap pivots from the closed position to the open position and the first and second projections are disposed on opposed sides of the hinge.

Aspect 228. The flexible container of aspect 226 or 227, wherein the first and second projections are disposed equidistant from the hinge.

Aspect 229. The flexible container of any one of aspects 226 to 228, wherein the first and second projections have a semi-circular shape.

Aspect 230. The flexible container of any one of the preceding aspects, wherein the resealable flap comprises a pull tab for gripping the resealable flap.

Aspect 231. The flexible container of aspect 230, wherein the pull tab is disposed adjacent a boundary between adjacent walls and the pull tab is spaced about 0.03 inches to about 0.1 inches from a line of reduced strength at or adjacent the boundary adjacent to the pull tab.

Aspect 232. The flexible container of aspect 230, wherein the pull tab extend up to or past the line of reduced strength at or adjacent the boundary adjacent the pull tab.

Aspect 233. The flexible container of any one of the preceding aspects, wherein at least one of the first and second seals is attached to the sidewall.

Aspect 234. The flexible container of any one of the preceding aspects, wherein at least one of the first and second seals extends substantially perpendicularly to the sidewall and comprises a gripping aperture in a portion of the seal to define a handle.

Aspect 235. The flexible container of any one of the preceding aspects, wherein the second sheet has a thickness of about 2 mils to about 30 mils.

Aspect 236. The flexible container of any one of the preceding aspects, wherein at least one of the plurality of walls defines a bottom wall of the container upon which the flexible container stands, and the bottom wall comprises a corner seal.

Aspect 237. The flexible container of aspect 236 Error! Reference source not found, wherein the at least one of the plurality of walls defining the opening panel is adjacent to the bottom wall, the opening comprises a pull tab at an end, and the pull tab is disposed adjacent to the corner seal.

Aspect 238. The flexible container of aspect 236, wherein the at least one of the plurality of walls defining the opening panel is opposite the bottom wall.

Aspect 239. The flexible container of any one of the preceding aspects, wherein at least one of the plurality of walls defines a bottom wall of the container upon which the flexible container stands, and a third sheet is attached to the first sheet at the bottom wall.

Aspect 240. The flexible container of any one of the preceding aspects, wherein the opening extends across at least two adjacent ones of the plurality of walls.

Aspect 241. A flexible container, comprising:

opposed top and bottom walls, opposed side walls, each side wall comprising a seal and tucks disposed adjacent to the top and bottom walls, the tucks comprising part of the first sheet tuck inward and disposed under the seal;

opposed front and back walls, wherein the top, bottom, opposed side, front, and back walls cooperate to define an interior volume of the container and are defined by a first sheet;

an opening for accessing the interior volume defined in one or more of the top wall, the front wall, and the back wall, a second sheet attached to at least a portion of the first sheet, the second sheet comprising:

a top wall portion extending across at least a portion of the top wall, tuck portions extending into the tucks of the opposed side wall disposed adjacent to the top wall, wherein the top wall portion and the tuck portions are connected such that the second sheet extends across opposed first and second boundaries disposed at an interface between the top wall and the opposed side walls, respectively, a first and second face portions extending across at least a portion of the front and back walls, respectively, wherein the top wall portion and the first and second face portions are connected such that the second sheet extends across opposed third and fourth boundaries disposed at an interface between the top wall portion and the first and second face portions, respectively; and side wall portions extending across at least a portion of each of the side walls, outboard of the seal, the side wall portions being connected to adjacent face portions such that the second sheet extends across a fifth, sixth, seventh, and eighth boundaries disposed at respective interfaces between adjacent side wall portions and face portions, first, second, third, fourth, fifth, sixth, seventh, and eighth lines of reduced strength disposed in the second sheet at or adjacent to the first, second, third, fourth, fifth, sixth, seventh, and eighth boundaries, and a resealable flap defined in one or more of the top wall portion and face portions and disposed to resealably cover the opening.

Aspect 242. The flexible container of aspect 241, wherein the opening is defined in the top wall.

Aspect 243. The flexible container of aspect 242, wherein the resealable flap comprises a pull tab, and the pull tab has a terminal edge extending up to or past the first line of reduced strength.

Aspect 244. The flexible container of aspect 242, wherein the resealable flap comprises a pull tab, and a terminal edge of the pull tab is spaced at least 0.03 inches from the first line of reduced strength.

Aspect 245. The flexible container of aspect 241, wherein the opening is defined in the front panel.

Aspect 246. The flexible container of aspect 245, wherein the resealable flap comprises a pull tab, the bottom wall comprises a corner seal, and a terminal end of the pull tab extends to the corner seal.

Aspect 247. The flexible container of aspect 241, wherein the opening is defined in the top wall and the front panel.

Aspect 248. The flexible container of any one of aspects 241 to 247, wherein the top wall comprises four corners, and the top wall portion comprises a corner relief aperture at the corners such that the second sheet is disposed around the corners.

Aspect 249. The flexible container of any one of aspects 241 to 248, wherein the first, second, fifth, sixth, seventh, and eighths lines of reduced strength comprise perforations having about 1% to about 50% cut openings.

Aspect 250. The flexible container of any one of aspects 241 to 249, wherein the third and fourth lines of reduced strength comprise perforations having about 60% to about 99% cut openings.

Aspect 251. The flexible container of any one of aspects 241 to 250, further comprising a third sheet attached to the bottom wall.

Aspect 252. The flexible container of any one of aspects 241 to 251, wherein each seal is folded over and attached to the respective side wall.

Aspect 253. The flexible container of aspect 252, wherein each seal is heat sealed to the portion of the first sheet defining the side wall.

Aspect 254. The flexible container of aspect 252, wherein the side wall portions comprise first and second side wall portions, the first and second side wall portions extending across the side wall up to the seal disposed in the respective side wall, each seal is folded over and sealed to the respective first or second side wall portion.

Aspect 255. A contoured flexible container, comprising:

opposed top and bottom walls, opposed side walls, each side wall comprising a seal and tucks disposed adjacent to the top and bottom walls, the tucks comprising part of the first sheet tuck inward and disposed under the seal;

opposed front and back walls, wherein the top, bottom, opposed side, front, and back walls cooperate to define an interior volume of the container and are defined by a first sheet;

an opening for accessing the interior volume defined in one or more of the top wall, the front wall, and the back wall, a second sheet attached to at least a portion of the first sheet, the second sheet comprising:

a top wall portion extending across at least a portion of the top wall, tuck portions extending into the tucks of the opposed side wall disposed adjacent to the top wall, wherein the top wall portion and the tuck portions are connected such that the second sheet extends across opposed first and second boundaries disposed at an interface between the top wall and the opposed side walls, respectively, face portions extending across at least a portion of the front and back walls, respectively, wherein the top wall portion and the face portions are connected such that the second sheet extends across opposed third and fourth boundaries disposed at an interface between the top wall portion and the face portions, respectively; and side wall portions extending across at least a portion of each of the side walls, outboard of the seal, the side wall portions being connected to adjacent face portions such that the second sheet extends across a fifth, sixth, seventh, and eighth boundaries disposed at respective interfaces between adjacent side wall portions and face portions, first, second, third, fourth, fifth, sixth, seventh, and eighth lines of reduced strength disposed in the second sheet at or adjacent to the first, second, third, fourth, fifth, sixth, seventh, and eighth boundaries, the fifth, sixth, seventh, and eighth lines of reduced strength have a curved shape such that edges of the package defined between the side walls and adjacent front and/or back panel have a curved shape, and a resealable flap defined in one or more of the top wall portion and face portions and disposed to resealable cover the opening.

Aspect 256. The contoured flexible container of aspect 255, wherein the fifth, sixth, seventh, and eighth lines of reduced strength curve away from the fifth, sixth, seventh, and eighth boundaries and into the face portions.

Aspect 257. The contoured flexible container of aspect 255 or 256, wherein the side wall portion comprises a contouring line of reduced strength in the second sheet, the contouring line of reduced strength being a mirror image Aspect 258. The contoured flexible container of any of aspects 255 to 257, wherein the opening is defined in the top wall.

Aspect 259. The contoured flexible container of aspect 258, wherein the resealable flap comprises a pull tab, and the pull tab has a terminal edge extending up to or past the first line of reduced strength.

Aspect 260. The contoured flexible container of aspect 258, wherein the resalable flap comprises a pull tab, and a terminal edge of the pull tab is spaced at least 0.03 inches from the first line of reduced strength.

Aspect 261. The contoured flexible container of any one of aspects 255 to 257 wherein the opening is defined in the front panel.

Aspect 262. The contoured flexible container of aspect 261, wherein the resealable flap comprises a pull tab, the bottom wall comprises a corner seal, and a terminal end of the pull tab extends to the corner seal.

Aspect 263. The contoured flexible container of any one of aspects 255 to 257, wherein the opening is defined in the top wall and the front panel.

Aspect 264. The flexible container of any one of the preceding aspects, further comprising a third sheet attached to the first sheet in at least the opening panel region.

Aspect 265. A method of forming a sealable package, comprising:

providing a web comprising a first sheet having a second sheet attached to a portion of the first sheet, the first sheet comprising an opening defined therein; and folding the web to define a plurality of walls that cooperate to define an interior volume of the container, the interior volume being accessible through the opening;

sealing edges of the web to define first and second seals thereby defining the first and second side walls, wherein:

the plurality of walls comprises:

opposed first and second side walls having first and second seals, respectively, disposed along a portion of the side wall and a tuck portion, the tuck portion comprising a portion of the first sheet tucked toward the interior volume and disposed at least partially under the seal, at least one wall defining an opening panel comprising at least a portion of the opening, the second sheet at least partially extends over at least three of the plurality of walls, wherein each of the at least three of the plurality of walls is adjacent to at least one of the other at least three plurality of walls, one of the at least three of the plurality of walls is the at least one wall defining the opening panel and a portion of the second sheet defines a resealable flap disposed over the opening for resealable closure of the container, one of the at least three of the plurality of walls is a side wall, the second sheet extends over boundaries between adjacent ones of the at least three of the plurality of walls and a portion of the second sheet extends into at least one tuck, and the second sheet includes a line of reduced strength at or adjacent to a boundary between portion of the second sheet extending into the at least one tuck and a portion of the second sheet extending across an adjacent one of the at least three plurality of walls.

Aspect 266. The method of aspect 265, wherein the web is folded about a forming tube, the forming tube comprises an outward extension on at least one side and a plate for creasing the web about the outward extension.

Aspect 267. The method of aspect 265 or 266, the method further comprising folding over at least one of the first and second seals and attaching the seal to the respective sidewall.

Aspect 268. The method of aspect 267, wherein folding over the at least one of the first and second seals comprises disposing the package in a holder having a size and shape corresponding to the flexible container, actuating a first plate against a portion of the side wall, not including the seal, and actuating a second plate against a remaining portion of the side wall including the seal, the second plate disposing the seal against the side wall to attach the seal to the side wall.

Aspect 269. A method of forming a contoured flexible container, the method comprising:

providing a web comprising a first sheet having a second sheet attached to a portion of the first sheet, folding the first sheet to define a plurality of walls that cooperate to define an interior volume of the container, the plurality of walls comprising opposed top and bottom walls, opposed front and back walls, and opposed first and second side walls, wherein:

the container comprises a first edge between the first side wall and the front wall, a second edge between the first side wall and the back wall, a third edge between the second side wall and the front wall, and a fourth edge between the second side wall and the back wall, at least one of the top wall, front wall, and bottom wall have at least part of an opening defined therein, the second sheet extends at least partially over the front and back walls and the first and second side walls, the second sheet comprises first, second, third, and fourth lines of reduced strength at or adjacent to the first, second, third, and fourth edges of the container, respectively, the first, second, third, and fourth lines of reduced strength each have a curved shape, and upon folding the first sheet, the first sheet defines curved first, second, third, and fourth edges resulting from the first, second, third, and fourth lines of reduced strength being curved.

While various embodiments have been described above, this disclosure is not intended to be limited thereto. Variations can be made to the disclosed embodiments that are still within the scope of the appended aspects.

What is claimed is:

1. A flexible container comprising:

a plurality of walls that cooperate to define an interior volume, the plurality of walls being defined by a first sheet, wherein the plurality of walls comprises:

opposed side walls each having a seal disposed along a portion of the side wall and one or more tucks, the tucks each comprising a portion of the first sheet tucked toward the interior volume and disposed at least partially under the seal, at least one wall defining an opening panel comprising at least a portion of an opening for accessing the interior volume, a second sheet attached to at least a portion of the first sheet, the second sheet at least partially extending over at least three of the plurality of walls, wherein each of the at least three of the plurality of walls is adjacent to at least one of the other at least three plurality of walls, one of the at least three of the plurality of walls is the at least one wall defining the opening panel and a portion of the second sheet defines a resealable flap disposed over the opening for resealable closure of the container, one of the at least three of the plurality of walls is a side wall, the second sheet extends over boundaries between adjacent ones of the at least three of the plurality of walls and a portion of the second sheet extends into at least one tuck, and the second sheet includes a line of reduced strength at or adjacent to the boundary between the side wall and the adjacent one of the at least three plurality of walls, wherein the at least one wall defining the opening panel includes four corners defined by the first sheet, the second sheet includes apertures in portions of the second sheeting extending across the corners such that the corner extends through the aperture.

2. The flexible container of claim 1, wherein the second sheet includes lines of reduced strength at each of the boundaries between adjacent ones of the at least three of the plurality of walls.

3. The flexible container of claim 1, wherein the second sheet has a thickness of 10 mils or less, the line of reduced strength comprises one or both of perforations having at least 10% cut openings, score lines extending at least 10% into the thickness of the second sheet.

4. The flexible container of claim 1, wherein the second sheet has thickness greater than 10 mils wherein at least one of the lines of reduced strength comprises one or both of perforations having at least 50% cut openings, score lines extending at least 50% into the thickness of the second sheet.

5. The flexible container of claim 1, wherein:

the at least three of the plurality of walls comprise the at least one wall defining an opening panel, one of the side walls, and a third wall adjacent to the at least one wall defining the opening panel, the second sheet extends across the at least one wall defining the opening panel and over a first boundary disposed between the at least one wall defining the opening panel and the side wall, the second sheet having a portion that extends into the tucks of the side wall, the second sheet further extends over a second boundary disposed between the at least one wall defining the opening panel and the third wall, the second sheet extends at least partially over the third wall, the second sheet includes a first line of reduced strength at or adjacent to the first boundary, and the second sheet includes a second line of reduced strength at or adjacent to the second boundary.

6. The flexible container of claim 5, wherein the first and second lines of reduced strength comprise perforations and the first line of reduced strength has a greater percentage of cut opening than the second line of reduced strength.

7. The flexible container of claim 5, wherein the first line of reduced strength has about 50% to about 100% cut openings, and the second line of reduced strength has about 1% to about 50% cut openings.

8. The flexible container of claim 7, wherein the first and second line of reduced strength comprise score lines and the first line of reduced strength has score lines that extend more deeply into the thickness of the second sheet than the second line of reduced strength.

9. The flexible container of claim 8, wherein the first line of reduced strength comprises a score line extending about 50% to about 100% into the thickness of the second sheet and the second line of reduced strength extends about 1% to about 50% into the thickness of the second sheet.

10. The flexible container of claim 5, wherein the third wall is adjacent to the side wall, the second sheet extends over a third boundary disposed between the third wall and the side wall, and the second sheet includes a third line of reduced strength at or adjacent to the third boundary.

11. The flexible container of claim 10, wherein the second sheet has a thickness of less than 10 mils, and the third line of reduced strength comprises perforations having about 1% to about 60% cut openings and/or score lines that extend about 1% to about 60% into the thickness of the second sheet.

12. The flexible container of claim 10, wherein the second sheet has a thickness of greater than 10 mils, and the third line of reduced strength comprises perforations having about 50% to about 100% cut openings and/or score lines that extend about 50% to about 100% into the thickness of the second sheet.

13. The flexible container of claim 10, wherein the third line of reduced strength is substantially linear and an edge of the container defined at the third boundary is substantially linear.

14. The flexible container of claim 10, wherein the third line of reduced strength is curved, thereby defining an edge of the container disposed at the third boundary to have a curvature corresponding to the curve of the third line of reduced strength.

15. A flexible container comprising:

a plurality of walls that cooperate to define an interior volume, the plurality of walls being defined by a first sheet, wherein the plurality of walls comprises:

a first side wall and an opposed second side wall, each of the first and second side walls having a seal disposed along a portion of the side wall and one or more tucks, the tucks each comprising a portion of the first sheet tucked toward the interior volume and disposed at least partially under the seal, at least one wall defining an opening panel comprising at least a portion of an opening for accessing the interior volume, a second sheet attached to at least a portion of the first sheet, the second sheet at least partially extending over at least three of the plurality of walls, wherein:

each of the at least three of the plurality of walls is adjacent to at least one of the other at least three plurality of walls, and the at least three of the plurality of walls comprises the at least one wall defining an opening panel, the first side wall, and a third wall adjacent to the at least one wall defining the opening panel, a portion of the second sheet defines a resealable flap disposed over the opening for resealable closure of the container, the second sheet extends across the at least one wall defining the opening panel and over a first boundary disposed between the at least one wall defining the opening panel and the first side wall, a portion of the second sheet extends into at least one tuck, the second sheet includes a first line of reduced strength at or adjacent to the first boundary, the second sheet further extends over a second boundary disposed between the at least one wall defining the opening panel and the third wall, the second sheet extends at least partially over the third wall, the second sheet includes a second line of reduced strength at or adjacent to the second boundary, the third wall is adjacent to the first side wall, the second sheet extends over a third boundary disposed between the third wall and the first side wall, the second sheet includes a third line of reduced strength at or adjacent to the third boundary, the third line of reduced strength is curved, thereby defining an edge of the container disposed at the third boundary to have a curvature corresponding to the curve of the third line of reduced strength, and a portion of the second sheet extending into the first side wall from the third boundary comprises a contouring line of reduced strength that is a mirror image of the third line of reduced strength.

16. The flexible container of claim 15, wherein the contouring line of reduced strength comprises perforations having substantially the same cut opening percentage as the third line of reduced strength and/or the contouring line of reduced strength comprises score lines having substantially same percentage of penetration as score lines of the third line of reduced strength.

17. The flexible container of claim 10, wherein the third line of reduced strength has substantially same cut opening percentage as the first line of reduced strength, and or the penetration of one or more score lines of the third line of reduced strength is substantially equal to the penetration of one or more score lines of the first line of reduced strength.

18. The flexible container of claim 5, wherein the first boundary extends between first and second corners, and the second sheet includes apertures at each of the first and second corners.

19. The flexible container of claim 1, wherein the second sheet further comprises a hinge defined by a line of reduced strength, the hinge is disposed at an end of the resealable flap, and the resealable flap is pivotable about the hinge from a closed position in which the resealable flap is in contact with the opening panel to resealable close the opening, and an open position in which the resealable flap is pivoted away from the opening panel.

20. The flexible container of claim 1, wherein the second sheet further comprises first and second projections disposed at an end of the resealable flap, the first and second projections being pivotable from a first position in which the first and second projections are in the same plane as at least one wall defining the opening panel and the resealable flap is in a closed position, and a second position in which the first and second projections are oblique to the at least one wall defining the opening panel and the resealable flap is in an open position.

21. The flexible container of claim 20, wherein the second sheet further comprises a hinge about which the resealable flap pivots from the closed position to the open position and the first and second projections are disposed on opposed sides of the hinge.

22. The flexible container of claim 20, wherein the first and second projections are disposed equidistant from the hinge.

23. The flexible container of claim 20, wherein the first and second projections have a semi-circular shape.

24. The flexible container of claim 1, wherein the resealable flap comprises a pull tab for gripping the resealable flap.

25. The flexible container of claim 24, wherein the pull tab is disposed adjacent a boundary between adjacent walls and the pull tab is spaced about 0.03 inches to about 0.1 inches from a line of reduced strength at or adjacent the boundary adjacent to the pull tab.

26. The flexible container of claim 24, wherein the pull tab extend up to or past the line of reduced strength at or adjacent the boundary adjacent the pull tab.

27. The flexible container of claim 1, wherein at least one of the first and second seals is attached to the sidewall.

28. The flexible container of claim 1, wherein at least one of the first and second seals extends substantially perpendicularly to the sidewall and comprises a gripping aperture in a portion of the seal to define a handle.

29. The flexible container of claim 1, wherein the second sheet has a thickness of about 2 mils to about 30 mils.

30. The flexible container of claim 1, wherein at least one of the plurality of walls defines a bottom wall of the container upon which the flexible container stands, and the bottom wall comprises a corner seal.

31. The flexible container of claim 30, wherein the at least one of the plurality of walls defining the opening panel is adjacent to the bottom wall, the opening comprises a pull tab at an end, and the pull tab is disposed adjacent to the corner seal.

32. The flexible container of claim 30, wherein the at least one of the plurality of walls defining the opening panel is opposite the bottom wall.

33. The flexible container of claim 1, wherein at least one of the plurality of walls defines a bottom wall of the container upon which the flexible container stands, and a third sheet is attached to the first sheet at the bottom wall.

34. The flexible container of claim 1, wherein the opening extends across at least two adjacent ones of the plurality of walls.

35. A method of forming a sealable package, comprising:

providing a web comprising a first sheet having a second sheet attached to a portion of the first sheet, the first sheet comprising an opening defined therein; and folding the web to define a plurality of walls that cooperate to define an interior volume of the container, the interior volume being accessible through the opening;

sealing edges of the web to define first and second seals thereby defining the first and second side walls, wherein:

the plurality of walls comprises:

opposed first and second side walls having first and second seals, respectively, disposed along a portion of the side wall and a tuck portion, the tuck portion comprising a portion of the first sheet tucked toward the interior volume and disposed at least partially under the seal, at least one wall defining an opening panel comprising at least a portion of the opening, the second sheet at least partially extends over at least three of the plurality of walls, wherein each of the at least three of the plurality of walls is adjacent to at least one of the other at least three plurality of walls, one of the at least three of the plurality of walls is the at least one wall defining the opening panel and a portion of the second sheet defines a resealable flap disposed over the opening for resealable closure of the container, one of the at least three of the plurality of walls is a side wall, the second sheet extends over boundaries between adjacent ones of the at least three of the plurality of walls and a portion of the second sheet extends into at least one tuck, and the second sheet includes a line of reduced strength at or adjacent to a boundary between the side wall and the adjacent one of the at least three plurality of walls, wherein the at least one wall defining the opening panel includes four corners defined by the first sheet, the second sheet includes apertures in portions of the second sheeting extending across the corners such that the corner extends through the aperture.

36. The method of claim 35, wherein the web is folded about a forming tube, the forming tube comprises an outward extension on at least one side and a plate for creasing the web about the outward extension.

37. The method of claim 35, the method further comprising folding over at least one of the first and second seals and attaching the seal to the respective sidewall.

38. The method of claim 37, wherein folding over the at least one of the first and second seals comprises disposing the package in a holder having a size and shape corresponding to the flexible container, actuating a first plate against a portion of the side wall, not including the seal, and actuating a second plate against a remaining portion of the side wall including the seal, the second plate disposing the seal against the side wall to attach the seal to the side wall.

* * * * *